US009926702B2

(12) United States Patent
Rockwell et al.

(10) Patent No.: US 9,926,702 B2
(45) Date of Patent: Mar. 27, 2018

(54) ROOF INSULATION SYSTEMS

(71) Applicant: Owens Corning Intellectual Capital, LLC, Toledo, OH (US)

(72) Inventors: Anthony L. Rockwell, Pickerington, OH (US); James William Rinne, Granville, OH (US); Glenn Eric Haley, Granville, OH (US); Liang Gwee, New Albany, OH (US); Harry Alter, Granville, OH (US); Andrew Broderick, Newark, OH (US); David Herman Wolf, Newark, OH (US); Mikael Salonvaara, Jefferson, GA (US); Robert J. O'Leary, Newark, OH (US); Zachary Phillip Homoelle, Columbus, OH (US); Elaina Carpino, Hebron, OH (US)

(73) Assignee: OWENS CORNING INTELLECTUAL PROPERTY, LLC, Toledo, OH (US)

( * ) Notice: Subject to any disclaimer, the term of this patent is extended or adjusted under 35 U.S.C. 154(b) by 0 days.

(21) Appl. No.: 14/532,302

(22) Filed: Nov. 4, 2014

(65) Prior Publication Data

US 2015/0218803 A1 Aug. 6, 2015

Related U.S. Application Data

(63) Continuation-in-part of application No. 14/452,696, filed on Aug. 6, 2014, now Pat. No. 9,476,204.
(Continued)

(51) Int. Cl.
*E04D 13/00* (2006.01)
*E04D 13/16* (2006.01)
(Continued)

(52) U.S. Cl.
CPC ..... *E04B 7/022* (2013.01); *E04D 13/1625* (2013.01); *E04D 13/1637* (2013.01);
(Continued)

(58) Field of Classification Search
CPC ..... E04D 13/1612; E04D 13/1625; E04D 3/3601; E04D 3/3602; E04D 3/3603;
(Continued)

(56) References Cited

U.S. PATENT DOCUMENTS 1,172,379 A * 2/1916 Mazer ..... E04B 1/7612 181/291
1,848,272 A * 3/1932 Powell ..... E04B 1/7666 29/432
(Continued)

FOREIGN PATENT DOCUMENTS

GB 2449985 12/2008
WO 08/127936 10/2008
(Continued)

OTHER PUBLICATIONS

The Sealed Attic System with DuPont Tyvek AttickWrap, Building Science Bulletin, 4 pgs. copyright 2005.
(Continued)

*Primary Examiner* — Phi Dieu Tran A
(74) *Attorney, Agent, or Firm* — Calfee, Halter & Griswold LLP

(57) ABSTRACT

An insulation system includes roof sheathing panels, spaced apart structural members, a first insulation material, and a second insulation material. The first insulation material is disposed between pairs of the spaced apart structural members. The second insulation material is disposed across the spaced apart structural members and the first insulation
(Continued)

material, such that both the spaced apart structural members and the first insulation material are covered by the second insulation material.

36 Claims, 124 Drawing Sheets

Related U.S. Application Data

(60) Provisional application No. 61/935,111, filed on Feb. 3, 2014, provisional application No. 62/058,034, filed on Sep. 30, 2014.

(51) Int. Cl.
*E04B 1/74* (2006.01)
*E04B 7/02* (2006.01)
*E04D 13/17* (2006.01)
*E04B 1/76* (2006.01)

(52) U.S. Cl.
CPC ..... *E04D 13/1668* (2013.01); *E04D 13/172* (2013.01); *E04B 1/7658* (2013.01); *E04B 2103/04* (2013.01); *E04D 13/00* (2013.01)

(58) Field of Classification Search
CPC .... E04B 1/74; E04B 2001/742; E04B 1/7654; E04B 1/7658; E04B 1/7662; E04B 1/7666; E04B 1/767; E04B 1/7675; E04B 1/78
USPC ..... 52/407.1, 407.2, 407.3, 407.4, 407.5, 52/404.5
See application file for complete search history.

(56) References Cited

U.S. PATENT DOCUMENTS 1,921,518 A * 8/1933 Frobisher ..... E04C 2/16 181/285
1,929,751 A 10/1933 MacDonell
1,937,843 A * 12/1933 Clifton ..... E04F 13/0805 52/407.4
1,997,581 A * 4/1935 Heeren ..... E04B 9/26 248/228.7
1,997,605 A * 4/1935 Strom ..... E04B 9/26 52/145
2,112,631 A 3/1938 Macdonald
2,330,941 A * 10/1943 Acuff, Jr. ..... E04B 1/7612 52/407.1
2,476,499 A * 7/1949 Lowell ..... E04B 9/001 52/144
2,887,733 A * 5/1959 Kice ..... F16L 59/143 52/143
3,082,487 A 3/1963 Fowler et al.
3,267,626 A 8/1966 Daly
3,304,680 A 2/1967 Birdwell
3,708,940 A 1/1973 Harman
4,135,342 A 1/1979 Cotter
4,222,212 A 9/1980 Alderman
4,233,791 A 11/1980 Kuhl et al.
4,263,763 A 4/1981 Bouwens
4,318,260 A 3/1982 Siegel
4,319,421 A 3/1982 Diamond
4,375,741 A 3/1983 Paliwoda
4,391,075 A * 7/1983 Musgrave ..... E04D 13/1637 52/404.1
4,434,601 A * 3/1984 Zellmer ..... E04D 13/1625 52/407.1
4,437,287 A 3/1984 Halfaker
4,476,659 A 10/1984 Player
4,566,239 A * 1/1986 Smigel ..... E04B 1/7666 24/460
4,635,423 A 1/1987 Ward
4,724,651 A * 2/1988 Fligg ..... E04B 1/7604 52/407.3
4,738,072 A 4/1988 Clemensen et al.
4,769,958 A 9/1988 Limp
4,799,347 A 1/1989 Byler
5,095,673 A * 3/1992 Ward ..... E04D 13/1637 52/404.2
5,242,219 A 9/1993 Tomaka
5,421,133 A 6/1995 Berdan, II et al.
5,653,081 A 8/1997 Wenrick
5,724,780 A 3/1998 Bolich
5,770,295 A * 6/1998 Alderman ..... B32B 3/08 126/618
5,799,461 A 9/1998 Dittemore
5,901,518 A 5/1999 Harkins
6,185,895 B1 * 2/2001 Rettew ..... E04D 13/1625 428/138
6,221,464 B1 * 4/2001 Patel ..... D04H 13/002 428/192
6,330,779 B1 12/2001 Kinzler
6,397,531 B1 6/2002 Martin
6,421,980 B1 7/2002 Alderman et al.
6,444,286 B1 9/2002 MacKenzie
6,487,825 B1 12/2002 Silik
6,808,772 B2 10/2004 Kunzel et al.
6,857,238 B2 2/2005 Alderman
6,878,455 B2 4/2005 Kunzel et al.
6,890,666 B2 5/2005 Kunzel et al.
7,008,890 B1 3/2006 Kunzel et al.
7,484,335 B1 2/2009 Dunlap
8,176,699 B1 5/2012 Birchfield
8,281,548 B1 * 10/2012 Garcia ..... E04D 13/1625 248/302
8,316,605 B2 * 11/2012 Oberg ..... E04D 3/3603 52/309.15
8,322,111 B2 12/2012 Near et al.
8,347,562 B2 1/2013 Morris
8,615,946 B2 * 12/2013 Oberg ..... E04B 2/58 52/309.15
8,782,982 B2 7/2014 Lewis
9,032,678 B2 5/2015 Shaw et al.
9,347,220 B1 4/2016 Gaydos
2003/0061776 A1 4/2003 Alderman
2003/0061777 A1 * 4/2003 Alderman ..... E04B 9/045 52/407.3
2003/0215609 A1 11/2003 Burkart
2004/0250490 A1 12/2004 Hall
2005/0017142 A1 1/2005 Ogden
2005/0279050 A1 12/2005 Romes
2008/0245010 A1 10/2008 Pollack
2009/0107068 A1 4/2009 Fay et al.
2010/0024325 A1 2/2010 Robbins et al.
2011/0036034 A1 2/2011 Robinson
2012/0232213 A1 9/2012 Shoemake et al.
2013/0239502 A1 9/2013 Robbins et al.
2013/0280467 A1 10/2013 Fay
2013/0292863 A1 11/2013 Shoemake et al.
2014/0001396 A1 1/2014 Tutin et al.
2014/0094562 A1 4/2014 Hagiopol et al.
2014/0154478 A1 6/2014 Fellinger
2015/0218802 A1 8/2015 Wolf
2015/0233110 A1 8/2015 Alter et al.

FOREIGN PATENT DOCUMENTS

WO 09/098499 8/2009
WO 11/022668 2/2011
WO 11/054098 5/2011
WO 12/138718 10/2012
WO 12/138723 10/2012
WO 13/150123 10/2013
WO 13/163242 10/2013
WO 13/163245 10/2013

(56) References Cited

FOREIGN PATENT DOCUMENTS

| | | |
|---|---|---|
| WO | 14/102197 | 7/2014 |
| WO | 15/117154 | 8/2015 |

OTHER PUBLICATIONS

Speed Rod, Insulating Application Products, 2 page brochure, date is at least as early as the filing date of this application.
Lstiburek, "Understanding Attic Ventilation", Building Science Digest 102, Oct. 26, 2006.
Icynene, the Evolution of Insulation, 2 page web printout, accessed Apr. 2, 2015.
International Search Report and Written Opinion from PCT/US15/014318 dated May 8, 2015.
Office action from U.S. Appl. No. 14/452,696 dated Jun. 18, 2015.
Office action from U.S. Appl. No. 14/452,696 dated Mar. 10, 2016.
Notice of Allowance from U.S. Appl. No. 14/452,696 dated Jun. 24, 2016.
Office action from U.S. Appl. No. 14/452,696 dated Dec. 8, 2015.
Interview Summary from U.S. Appl. No. 14/452,696 dated May 23, 2016.
Office action from U.S. Appl. No. 14/613,272 dated Nov. 7, 2016.
Notice of Allowance from U.S. Appl. No. 14/613,272 dated Jun. 9, 2017.

* cited by examiner

ROOF INSULATION SYSTEMS

RELATED APPLICATIONS

The present application is a continuation-in-part of U.S. application Ser. No. 14/452,696, filed Aug. 6, 2014, titled "Boxed Netting Insulation System for Roof Deck", which claims the benefit of U.S. Provisional Patent Application Ser. No. 61/935,111, filed on Feb. 3, 2014, titled "Boxed Netting Insulation System for Roof Deck." The present application also claims priority to U.S. Provisional Application Ser. No. 62/058,034, filed Sep. 30, 2014, titled "Roof Insulation Systems." The entire disclosures of U.S. patent application Ser. No. 14/452,696 and U.S. Provisional Patent Application Ser. Nos. 61/935,111 and 62/058,034 are incorporated herein by reference in their entirety.

BACKGROUND

Buildings, such as for example residential buildings, can be covered by sloping roof decks. The interior portion of the building located directly below the sloping roof decks can form an interior space called an attic. In some instances, the attic can be vented by active or passive systems, such as to replace the air within the attic with fresh air (See FIG. 1B). One recent construction trend is to provide a sealed or unvented attic (See FIG. 1C).

The interior space defining an attic can be formed with structural members. The structural members can take a wide variety of different forms and configurations. Examples of structural member configurations that are used to form attics include, but are not limited to roof decks supported by trusses (See FIG. 1A) and roof decks supported by rafters (See FIG. 1H). Trusses include angled structural members commonly referred to as truss chords. Rafters are connected at top ends to a ridge beam and at lower ends to a roof beam and/or to wall framing. Conventional systems and methods for insulating unvented attics include filling the cavities formed between adjacent truss chords or rafters with insulation materials.

SUMMARY

An insulation system includes roof sheathing panels, spaced apart structural members, a first insulation material, and a second insulation material. The first insulation material is disposed between pairs of the spaced apart structural members. The second insulation material is disposed across the spaced apart structural members and the first insulation material, such that both the spaced apart structural members and the first insulation material are covered by the second insulation material.

BRIEF DESCRIPTION OF THE DRAWINGS

FIG. 68 illustrates an exemplary embodiment of an insulation support system having a composite insulation support material;

FIG. 69 is a view taken along lines 69-69 in FIG. 68 illustrating the composite insulation support material; and FIGS. 70 and 71 provide and illustration used to describe the term "substantially flat" in the present application.

DETAILED DESCRIPTION

Figure 1A:
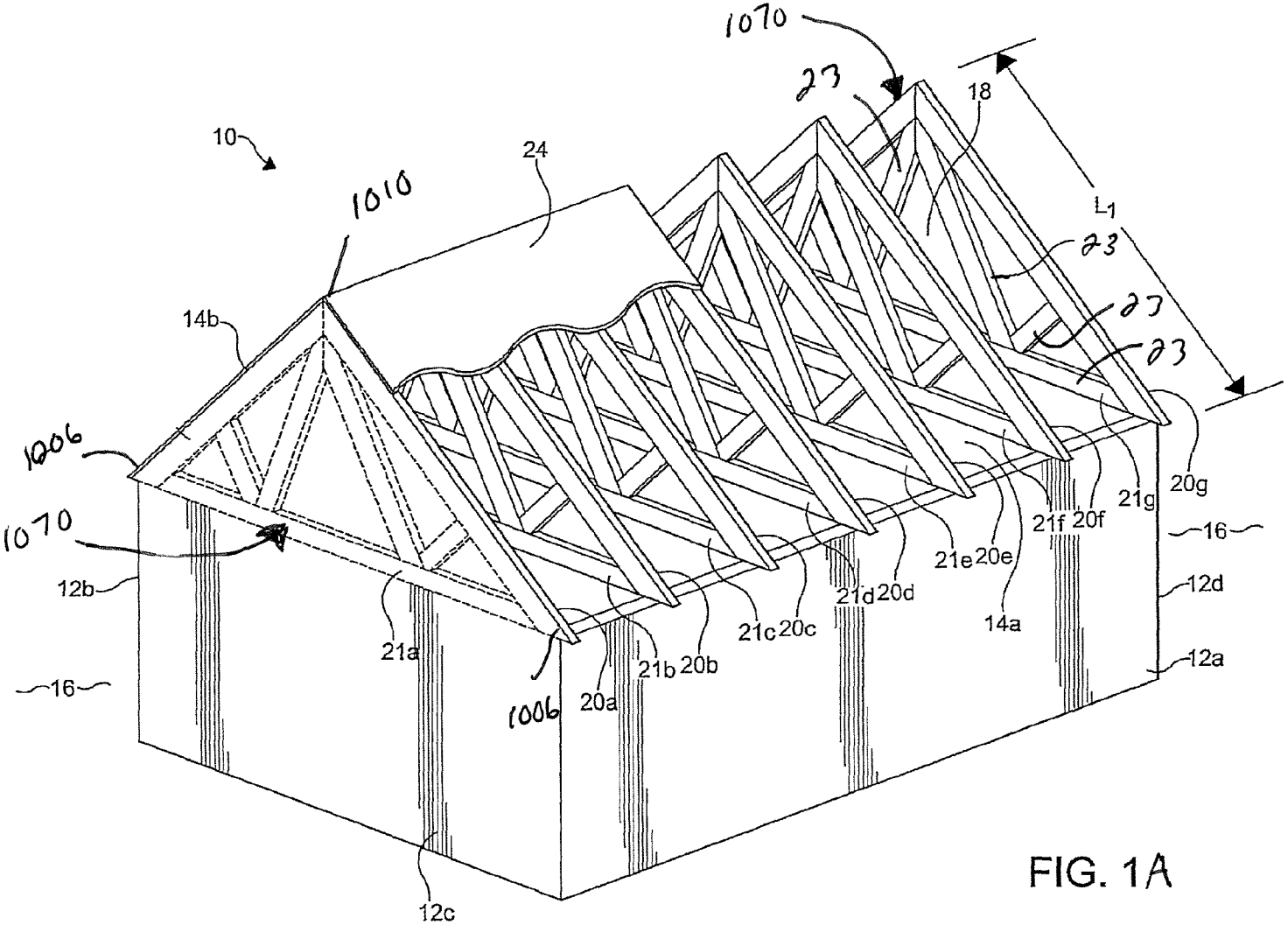
FIG. 1A is a perspective view of a building structure illustrating truss chords and insulation cavities formed between adjacent truss chords.

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

The description and figures disclose insulation systems for application to interior building spaces, such as interior building spaces located below roof decks. While the descriptions below will discuss and show insulation systems for use with sloped roof decks, it should be appreciated that the insulation systems can be applied to roof decks constituting flat roofs. The netting insulation systems are configured to form an insulation layer or layers having a desired depth and are positioned within the attic side of the roof deck. The insulation layer or layers may have a substantially uniform thickness, may have an adjustable thickness, and/or the insulation layer may insulate the structural members forming the roof deck.

The terms "roof deck", as used herein, is defined to mean any framework and/or support panels configured to support roofing materials, such as for example, shingles. As used herein, the term "roof deck" can refer to frameworks and/or support panels forming either sloped or flat roofs. The term "attic", as used herein, is defined to mean an interior portion of a building located directly below the roof decks. The term "unvented", as used herein, is defined to mean the absence of active or passive ventilation systems. The term "boxed" as used herein, is defined to mean having the general three dimensional shape or form of a box or rectangle. The term "netting", as used herein, is defined to mean any material used to contain insulation material within an insulation cavity. The term "loosefill insulation material" or "loosefill material" or "insulation material", as used herein, is defined to mean any insulation material configured for distribution in an airstream or otherwise conveyed in a loose manner. The term "unbonded", as used herein, is defined to mean the absence of a binder. The term "conditioned", as used herein, is defined to mean the shredding of the loosefill material to a desired density prior to distribution in an airstream or distribution in another loose manner.

Referring now to the drawings, FIG. 1A illustrates a first example of a structure 10. The structure 10 can take a wide variety of different forms. In one exemplary embodiment, the structure 10 is formed with a roof having a conventional truss construction (for purposes of clarity, only a few of the trusses are illustrated), and includes exterior walls 12*a*-12*d* and roof decks 14*a*, 14*b*. However, the roof can take a wide variety of different forms. For example, FIG. 1H illustrates a roof having a conventional rafter construction. Support members 20 for the roof decks 14*a*, 14*b* are rafters that extend between a ridge beam 1060 and lower roof beams 1062. The trusses illustrated by the FIGS. 1A and 1I embodiments can take a wide variety of different forms. Interspaced webs 23 of the trusses may or may not form triangles. In the example illustrated by FIG. 11, the webs 23 of gable end trusses 1070 are vertical and do not form triangles, while the remainder of the trusses illustrated by FIGS. 1A and 1I have webs 23 that form triangles. Truss type roofs have the advantage of having trusses that can be pre-fabricated. Rafter type roofs have the advantage that webs are not included or are limited in number. With the webs not included or limited in number, the space of the attic is more open than with a truss-type roof.

The exterior walls 12*a*-12*d* are configured to separate the interior spaces (not shown) of the structure 10 from areas 16 exterior to the structure 10, as well as providing a protective and aesthetically pleasing covering to the sides of the structure 10. The exterior walls 12*a*-12*d* can be formed using any typical construction methods, such as the non-limiting example of stick and frame construction. The exterior walls 12*a*-12*d* can include any desired wall covering (not shown), such as for example brick, wood, or vinyl siding, sufficient to provide a protective and aesthetically pleasing covering to the sides of the structure 10.

Referring again to FIG. 1A, a ceiling (not shown) is formed within the structure 10, adjacent the upper portions of the exterior walls 12*a*-12*d*. The ceiling can include a ceiling covering (not shown) attached to ceiling joists 21*a*-21*g*. The ceiling covering can be made from any desired materials, including the non-limiting examples of ceiling tile or drywall. An interior space or attic 18 can be formed between the ceiling and the roof decks 14*a*, 14*b*.

In the example illustrated by FIG. 1A, the support members 20*a*-20*g* support other structures, such as for example, a plurality of sheathing panels 24 and shingles (not shown). The structural support members 20*a*-20*g* can take a wide variety of different forms. In one exemplary embodiment, the support members 20*a*-20*g* are chords of trusses. In the embodiment illustrated in FIG. 1A, the support members 20*a*-20*g* are spaced apart on 24.0 inch centers. However, in other embodiments, the support members 20*a*-20*g* can be spaced apart by other distances. Each of the support members 20*a*-20*g* has a length L1.

A first gable 1070 is formed between the roof decks 14*a*, 14*b* and the exterior wall 12*c*. Similarly, a second gable 1070 is formed between the roof decks 14*a*, 14*b* and the exterior wall 12*d*.

Figure 1C:
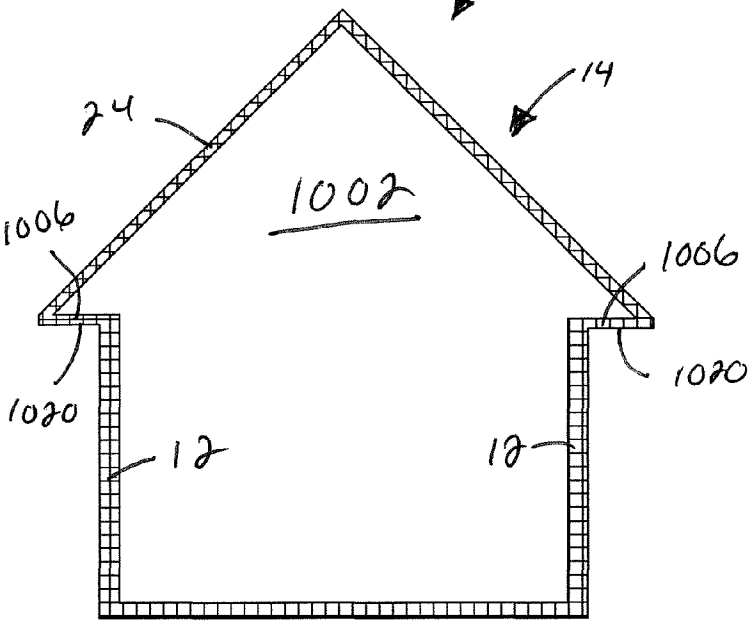
FIG. 1C is a schematic illustration of a building with an unvented attic.
Figure 1B:
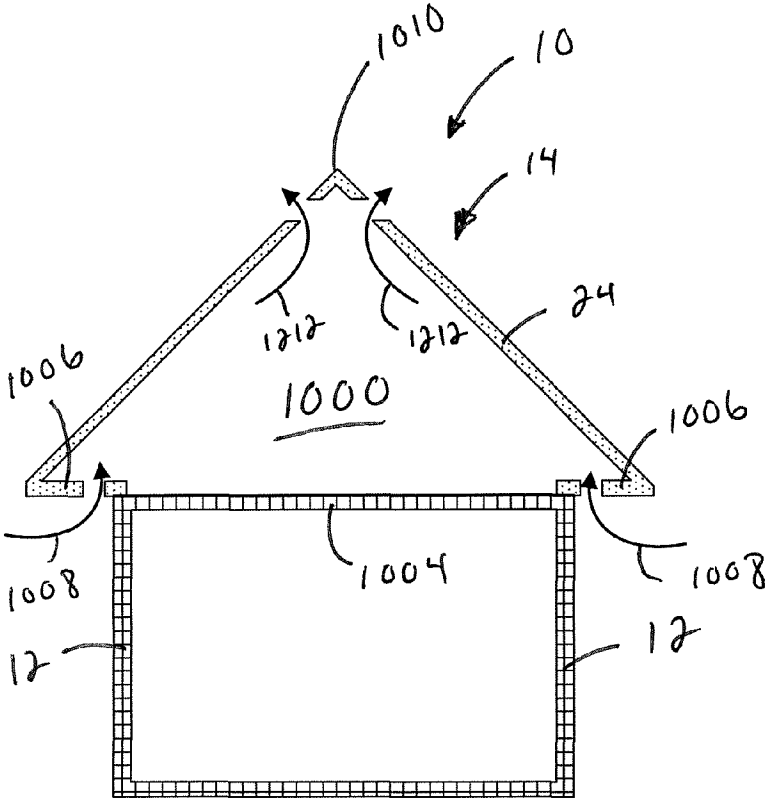
FIG. 1B is a schematic illustration of a building with a vented attic.

FIGS. 1B and 1C illustrate a vented attic 1000 and an unvented attic 1002 respectively. The inventive concepts disclosed by this patent application can be applied to vented attics 1000 and/or unvented attics 1002. The unvented attic includes a substantially air sealed envelope that comprises the walls 12 and a ceiling 1004. The air can enter the attic 1000 through eaves 1006 as indicated by arrows 1008 exit the attic 1000 through a ridge 1010 as indicated by arrows 1212. FIG. 1B illustrates just one of the many different configurations of a vented attic 1000.

Referring to FIG. 1C, the unvented attic 1002 includes a substantially air sealed envelope that comprises the walls 12 and the roof deck 14. The walls 12 may be sealed to the roof deck 14 in a wide variety of different ways. In the example illustrated by FIG. 1C, the soffits 1020 that extend between the walls 12 and the roof deck 14 are sealed. However, the walls 12 can be sealed to the roof deck 14 in a wide variety of different manners.

The roof deck 14 of the unvented attic illustrated by FIG. 1C can be sealed in a wide variety of different ways. In the example illustrated by FIG. 1E, the roof deck 14 is sealed with a sealant 1030 that is applied to joints of the sheathing panels 24. The sealant 1030 can be applied from above the sheathing panels, from below the sheathing panels, and/or to between joints of the sheathing panels 24 as the sheathing panels are being installed. In the example illustrated by FIG. 1F, an air barrier layer 1032 is applied beneath the sheathing panels 24 to air seal the roof deck. The air barrier layer 1032 may be applied between the sheathing panels 24 and the structural members 20*a*-20*g*. For example, the air barrier layer 1032 can be applied to the structural members 20*a*-20*g*, before the sheathing panels 24 are installed. In the example illustrated by FIG. 1G, an air barrier layer 1034 is applied above the sheathing panels 24 to air seal the roof deck. The air barrier layer 1034 may take a wide variety of different forms. The air barrier layer 1034 may be an underlayment disposed between the sheathing panels 24 and shingles (not shown) or shingles disposed on the sheathing panels 24 may sealed to one another to provide the air barrier layer 1034. The underlayment may include a plurality of overlapping strips as illustrated by FIG. 1G.

Figure 1D:
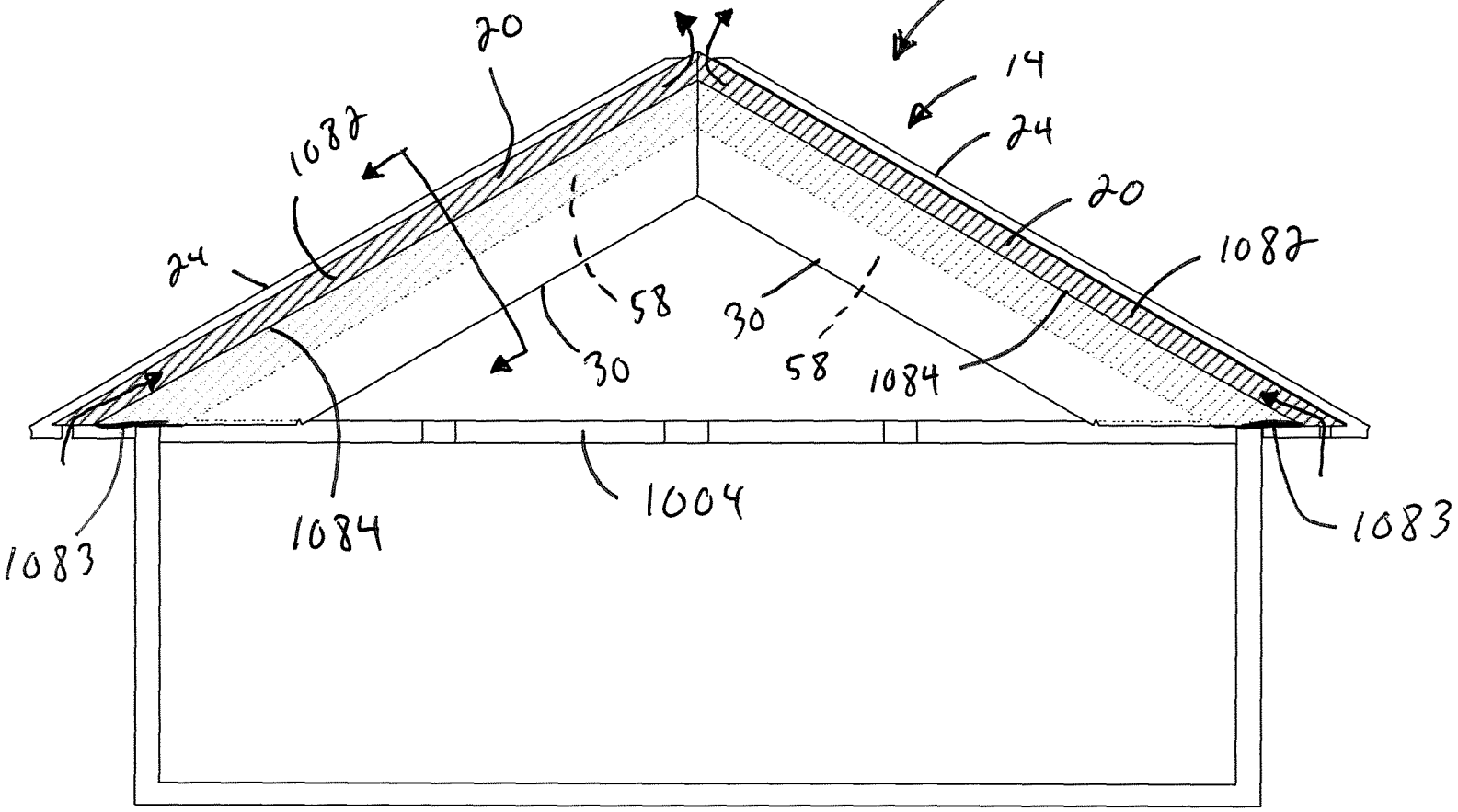
FIG. 1D is a schematic illustration of a building with a vented roof deck.
Figure 1E:
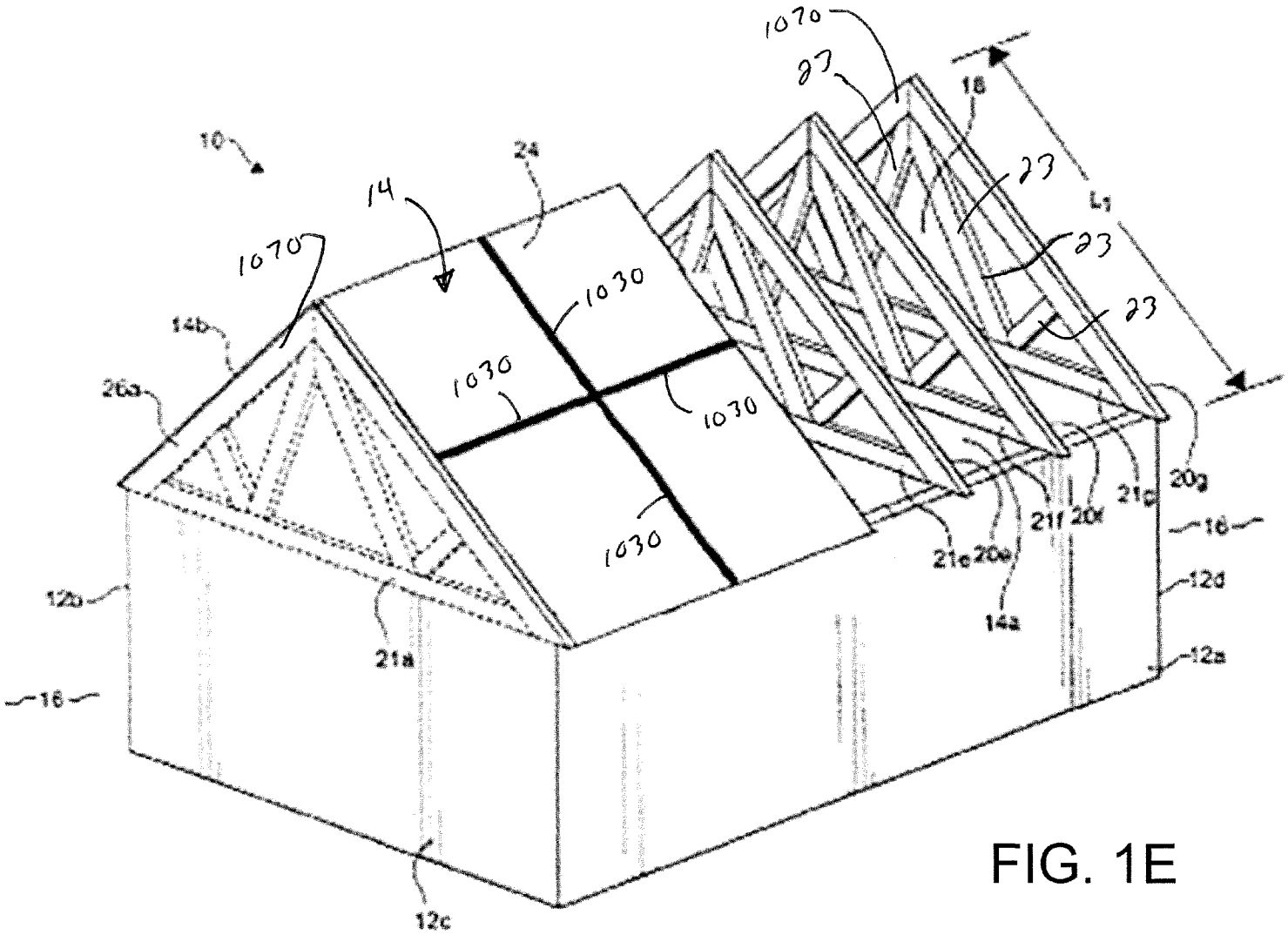
FIG. 1E illustrates an exemplary embodiment of a building having a sealed roof deck.
Figure 1F:
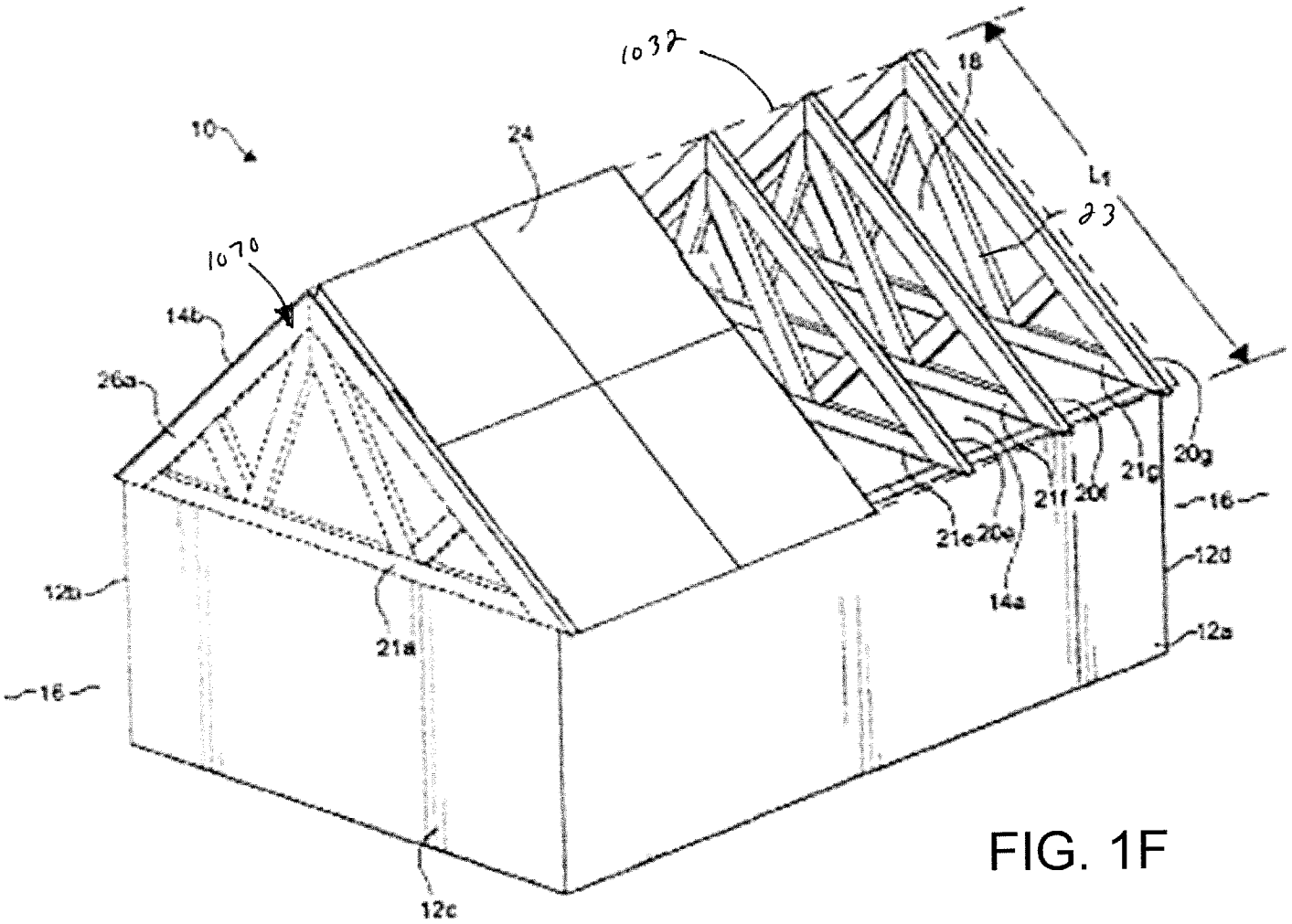
FIG. 1F illustrates an exemplary embodiment of a building having a sealed roof deck.
Figure 1G:
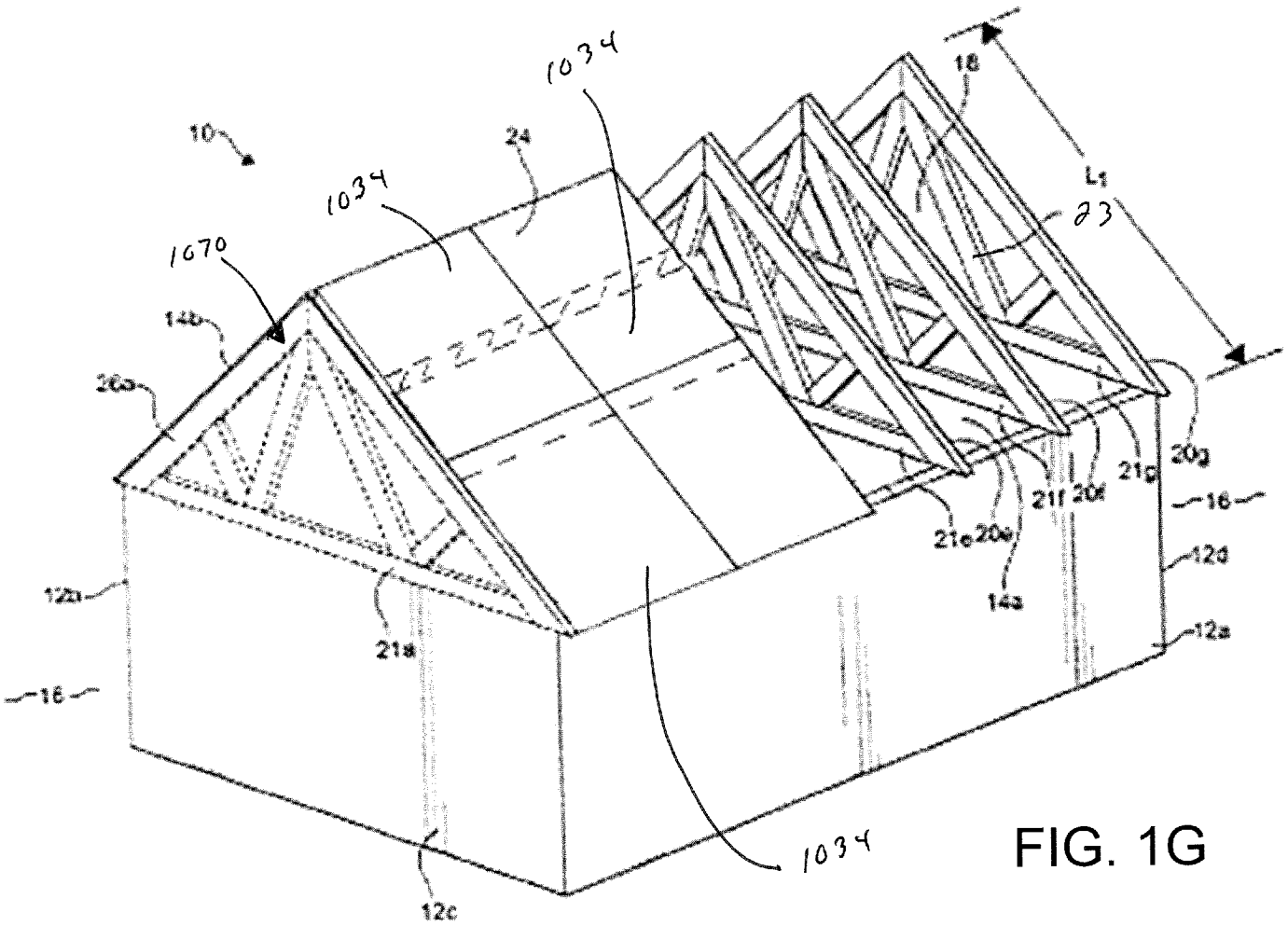
FIG. 1G illustrates an exemplary embodiment of a building having a sealed roof deck.
Figure 1H:
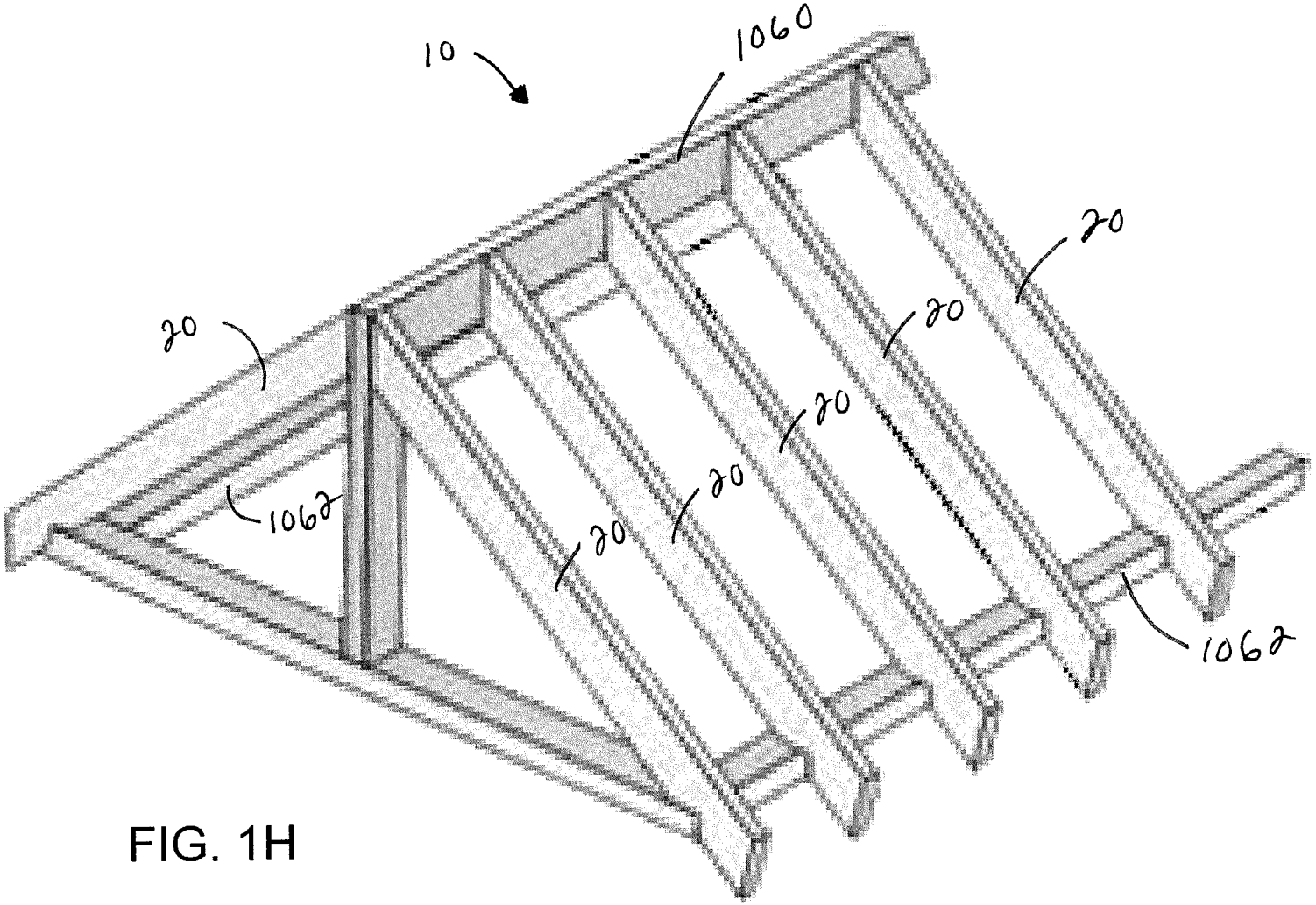
FIG. 1H is a perspective view of a building structure illustrating rafters and insulation cavities formed between adjacent rafters.
Figure 1I:
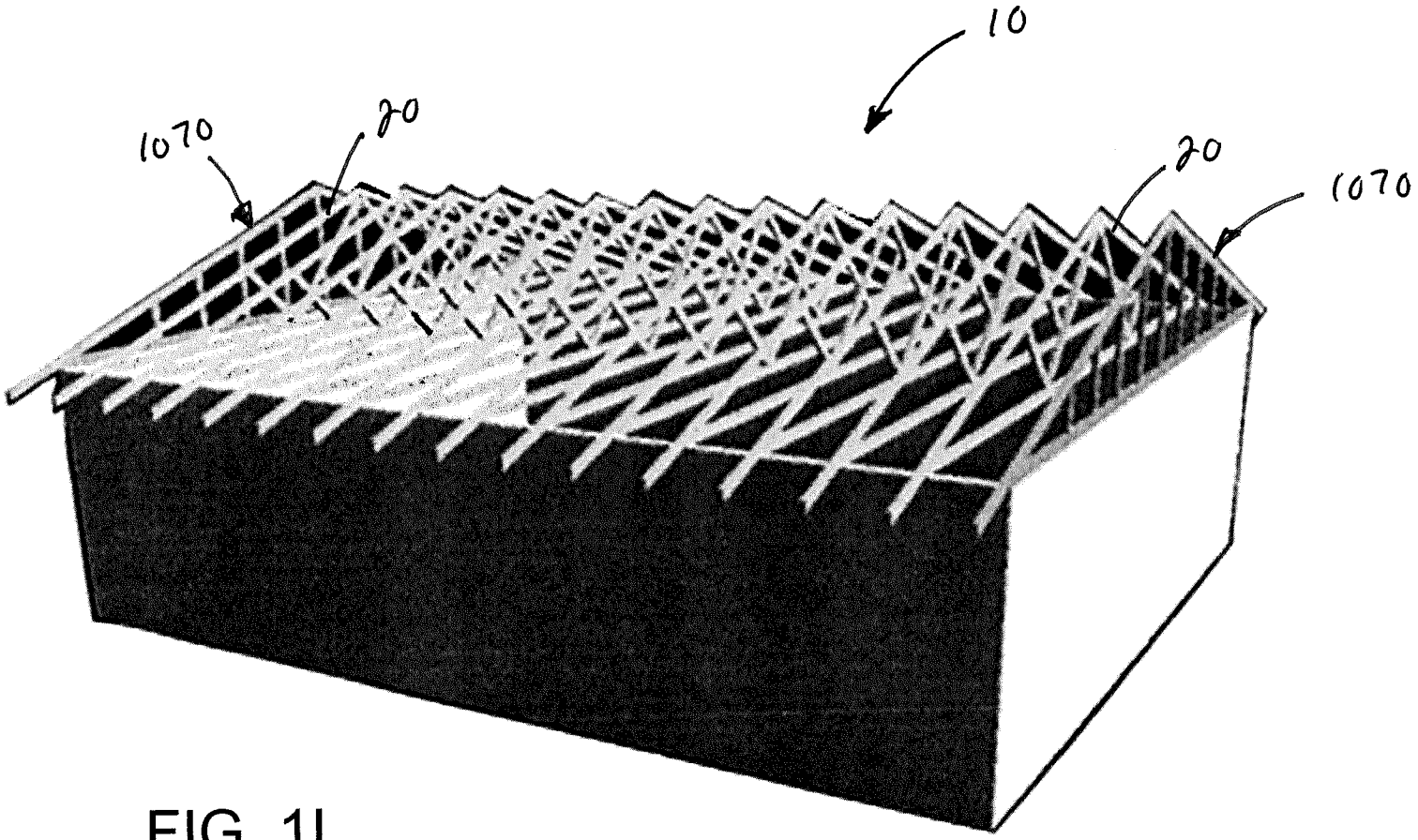
FIG. 1I is a perspective view of a building structure illustrating a gable end and vertically extending insulation cavities formed between structural members of the gable ends.
Figure 1J:
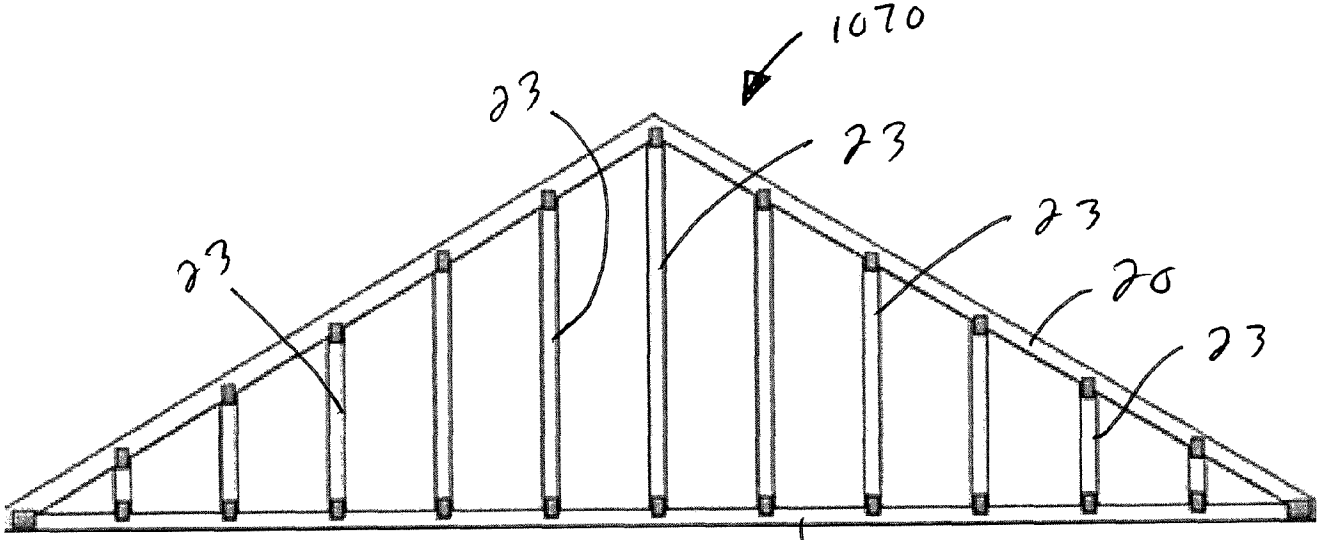
FIG. 1J is a plan view illustrating a gable end shown in FIG. 1I.
Figure 1K:
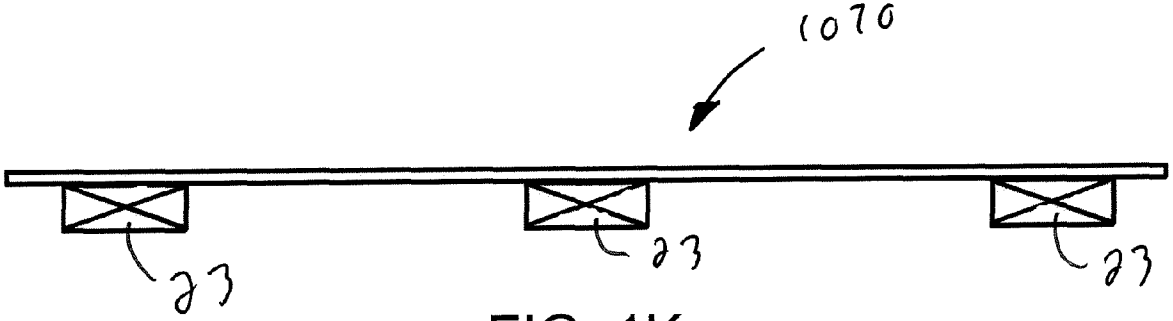
FIG. 1K is a top view of the gable end illustrated by FIG. 1J.

FIG. 1D illustrates a building structure 10 having a roof deck with a vent space 1082 between sheathing 24 and insulation 58. The building structure 10 may have a ceiling 1004 or the ceiling may be omitted. When the ceiling 1004 is omitted, the building structure is considered to have a cathedral ceiling. The illustrated building structure 10 includes a substantially air sealed envelope that comprises the walls 12 and an air-sealed bottom 1084 of the vent space. The bottom 1084 of the vent space 1082 can be sealed in a wide variety of different ways. For example, the bottom 1084 of the vent space 1082 may be made from an air barrier material (See FIGS. 14A-14E) or the bottom surface 1084 of the vent space 1082 may be a sealed decking material (See FIG. 14F). The walls 12 may be air sealed to the bottom 1084 of the vent space 1082 as indicated by lines 1083.

A wide variety of different air barrier layers can be used in the embodiments disclosed by the present application that use an air barrier. The air barrier layer may be a vapor barrier that blocks all air and water vapor or may be a water vapor retarder that blocks air, but allows permeation of water vapor. In an exemplary embodiment, the air barrier layer is permeable to water vapor and may thus be considered as breathable while remaining substantially impervious to air and water such that wind and rain does not pass through. The air barrier layer may be non-breathable in some embodiments. In some embodiments, the air barrier layer is a polymeric or cellulosic material. The air barrier layer may have a wide range of thicknesses. For example, the thickness of the air barrier layer may be from about 0.25 mils to about 1000 mils.

The water vapor permeation of the air barrier layer may be designed to be either bidirectional or unidirectional. Depending on the circumstance and in a building envelope, for most of the cases, it is very important to get any water vapor from the inside to the outside environment and not the other way around. However, in some cases, it may be desirable to have bidirectionality of water permeation. Unidirectionality may be provided by the characteristics of the air barrier layer used.

The air barrier layer may comprise a polyolefin and preferably a polyethylene, polypropylene or polybutylene. The air barrier layer may be prepared from continuous fibers of such materials using a flash spinning followed by bonding with heat and pressure. Other materials like polystyrene, expanded polystyrene, polyester, acrylic, polycarbonate, fluoropolymers, fluorinated urethane, PTFE, expanded PTFE, phenol-formaldehyde, melamine-formaldehyde, a phenolic resin, or copolymers thereof, individually or in combinations can be used to manufacture the air barrier layer One popular air barrier layer that is manufactured for building wrap is PinkWRAP® from Owens Corning. PinkWRAP® Housewrap is a woven polyolefin fabric engineered to be a weather resistant barrier. PinkWRAP® Housewrap reduces the air infiltration through residential and commercial exterior side wall construction.

PinkWRAP® Housewrap has microperforations that permit trapped moisture to escape from the wall to the exterior. PinkWRAP® Housewrap is translucent to allow installers to see the framing underneath. PinkWRAP® Housewrap has excellent tensile strength and tear resistance to withstand installation and wind driven loads. PinkWRAP® Housewrap can be left uncovered for up to 300 days before siding is installed. PinkWRAP® Housewrap meets the requirements of a weather resistant barrier as defined by ICC-ES Acceptance Criteria AC 38. See ICC Evaluation Services ESR 2801. PinkWRAP® Housewrap has the following properties.

| Property | Test Method | Actual | Required |
|---|---|---|---|
| Tensile Strength (lbs/in., MD/CD) | ASTM D 828 | 60/44 | 20/20 |
| Trapezoidal Tear Strength (lbs., MD/CD) | ASTM D 1117 | 37/49 | — |
| Water Resistance (10 min. minimum) | ASTM D 779 | >60 | 10 minute Minimum |
| Water Vapor Transmission Rate (g/m 2/24 hrs) | ASTM E 96 - Procedure A Dry Cup (75 F. 50% RH) | 52 | >35 |
| Water Vapor Permeance Rate (perms) | ASTM E 96 - Procedure A Dry Cup (75 F. 50% RH) | 7.7 | >5 |
| Fire Characteristics-Flame Spread | ASTM E 84 | 5 | <25 |
| Fire Characteristics-Smoke | ASTM E 84 | 30 | <450 |
| Application Exposure (months) | Ambient exposure | 9 | N/A |

Another material that is manufactured for housewrap that can be used as an air barrier layer is a flash spunbonded polyolefin that may be obtained from DuPont under the name Tyvek™. Another material that can be used as an air barrier layer is a microporous polyolefin film composite and may be obtained from Simplex Products under the trademark "R-Wrap™." There are a variety of other brands such as Typar® from Reemay, Amowrap® from Teneco building products, Barricade® from Simplex, and others that can be used as an air barrier layer.

In one exemplary embodiment, the air barrier is a smart vapor retarder material. Smart vapor retarder materials have a permeance (a measure of how readily water vapor can pass through) that varies based on the humidity. The goal is low permeance in the winter when humidity is low to block moisture flow and prevent condensation, and high permeance in the summer when humidity is higher and drying to both the interior and exterior is desired. U.S. Pat. Nos. 7,008,890; 6,808,772; 6,890,666; and 6,878,455 disclose examples of vapor retarder materials and are incorporated herein by reference in their entirety. Intello Plus and DB+ are two variable products made by Pro Clima in Germany and distributed by 475 High Performance Building Supply in Brooklyn, N.Y. Intello Plus is made from a polyethylene copolymer, and it varies in permeance from 0.17 in the winter to 13 in the summer, while DB+ is made mostly from recycled paper (with a fiberglass reinforcement grid) that varies in permeance from 0.8 perms with low humidity to 5.5 perms at high humidity.

As will be explained in more detail below, an insulation system (hereafter "system") can be installed in the attic 18 in a position adjacent to the roof decks 14*a*, 14*b* such as to provide an insulation layer having a substantially uniform thickness, at an adjustable insulation depth and/or that insulates the support members 20*a*-20*g* forming the roof decks 14*a*, 14*b*.

Figure 2A:
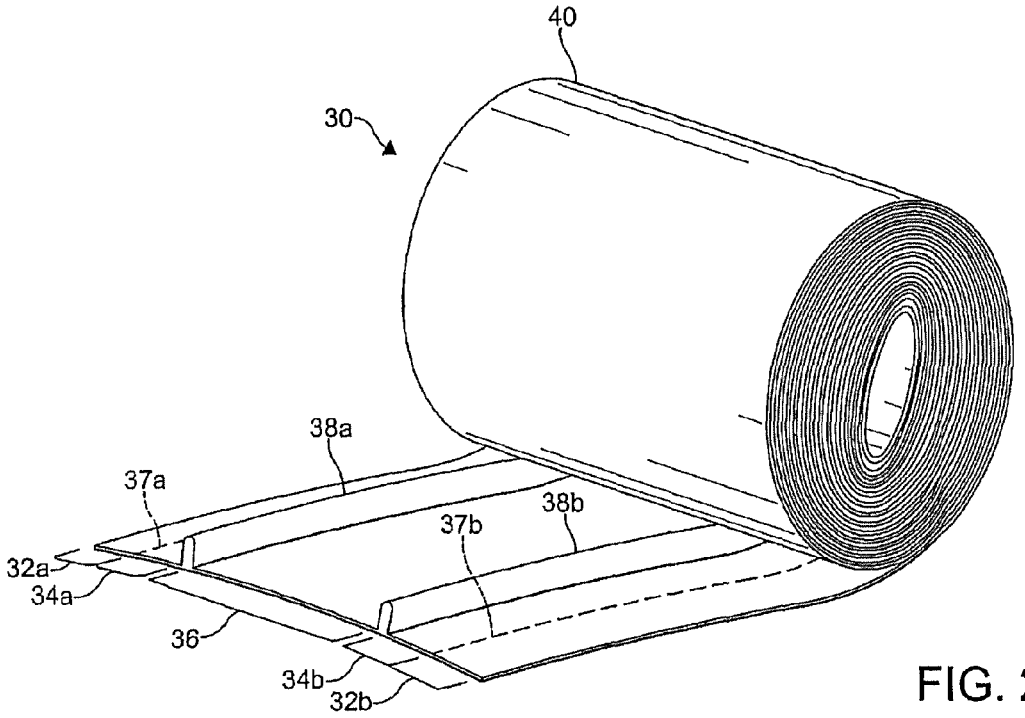
FIG. 2A is a perspective view of one embodiment of a netting for use between the adjacent truss chords of FIG. 1.
Figure 2B:
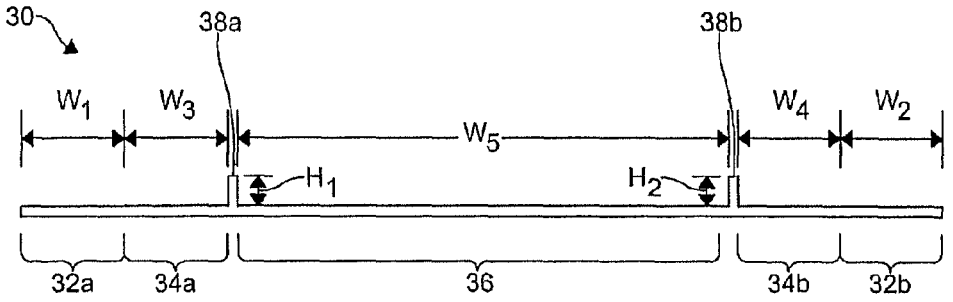
FIG. 2B is a front view, in elevation, of the netting of FIG. 2A.

Referring now to FIGS. 2A and 2B, an exemplary embodiment of a netting or insulation support material 30 is illustrated. As will be explained below in more detail, the netting 30 is configured for attachment to the support members 20*a*-20*g* or other structure and further configured to contain the loosefill insulation material 58 in a layer having a substantially uniform thickness.

The netting 30 includes end portions 32*a*, 32*b*, side panels 34*a*, 34*b* and a span segment 36. The end portions 32*a*, 32*b* are configured for attachment to a minor face of the support members 20*a*-20*g*. In the embodiment illustrated in FIG. 2A, the end portions 32*a*, 32*b* are defined by indicia 37*a*, 37*b* printed on a major face of the netting 30. However, it should be appreciated that the indicia 37*a*, 37*b* is optional and the boxed netting insulation system can be practiced without the indicia 37*a*, 37*b*.

The end portions 32*a*, 32*b* have widths W1, W2, respectively, that generally correspond to the widths of the minor faces of the support members 20*a*-20*g*. In the illustrated embodiment, the widths W1, W2 are in a range of from about 1.0 inches to about 2.0 inches. In other embodiments, the widths W1, W2 can be less than about 1.0 inches or more than about 2.0 inches. Optionally, the end portions 32*a*, 32*b* can be reinforced with any desired reinforcing material, such as for example, fiberglass tape.

Referring again to FIGS. 2A and 2B, the side panels 34*a*, 34*b* have widths W3 and W4 respectively. As will be explained in more detail below, the side panels 34*a*, 34*b* are configured to hang from support members, and when coupled with the depth of the support members, form a desired insulation depth. In the illustrated embodiment, the widths W3, W4 are in a range of from about 2.0 inches to about 14.0 inches. In other embodiments, the widths W3, W4 can be less than about 2.0 inches or more than about 14.0 inches.

Referring again to FIGS. 2A and 2B, the span segment 36 is configured to extend from one truss chord to an adjacent truss chord and has a width W5. In the illustrated embodiment, the width W5 is in a range of from about 14.0 inches to about 30.0 inches. In other embodiments, the width W5 can be less than about 14.0 inches or more than about 30.0 inches, consistent with the distance from support member to an adjacent support member.

Referring again to FIGS. 2A and 2B, the netting 30 may have two or more tabs 38*a*, 38*b* extending from a major face. As will be explained in more detail below, the tabs 38*a*, 38*b* are configured for connection to the tabs of adjacent nettings. In the illustrated embodiment, the tabs 38*a*, 38*b* are formed by folded portions of the netting. However, the tabs 38*a*, 38*b* can be formed by other desired methods, such as for example, gathering and pinching portions of the nettings. Still further, it is within the contemplation of this invention that the tabs 38*a*, 38*b* can be separate and distinct components that are fastened to the netting 30.

In the embodiment shown in FIG. 2A, the tabs 38*a*, 38*b* extend continuously along any length of the netting 30 that may cut from a roll 40. However, in other embodiments, the tabs 38*a*, 38*b* can form discontinuous lengths sufficient to allow the tabs of netting positioned adjacent to each other to be connected together.

The tabs 38*a*, 38*b* have heights H1, H2 respectively. The heights H1, H2 are configured to allow the tabs of adjacent nettings to connect to each other. In the illustrated embodiment, the heights H1, H2 are in a range of from about 0.50 inches to about 4.0 inches. In other embodiments, the heights H1, 142 can be less than about 0.50 inches or more than about 4.0 inches, sufficient to allow the tabs of adjacent nettings to be connected together. While the tabs 38*a*, 38*b* are illustrated as having substantially the same height, it is contemplated that the tabs 38*a*, 38*b* can have different heights.

The netting 30 can be made from a wide variety of different materials. In the embodiment illustrated in FIGS. 2A and 2B, the netting 30 is formed from a nonwoven polymeric-based material, such as for example spunbonded polyester. In other embodiments, the netting 30 can be formed from other desired materials, such as the non-limiting examples of knitted or woven fabrics and materials formed from natural, synthetic or blended fibers.

The netting 30 has a basis weight. The term "basis weight", as used herein, is defined to mean a weight per square area. The basis weight of the netting 30 is configured to support the weight and compression of the loosefill insulation material 58 within the insulation cavity. Accordingly, the basis weight of the netting 30 can vary as the depth of the insulation cavity varies. The basis weight of the netting can further vary as different fastening methods are used to connect the netting to the support members 20. In the illustrated embodiment, the netting 30 has a basis weight in a range from about 30 grams/square meter (gm/m$^2$) to about 70 gm/m$^2$. However, in other embodiments, the netting 30 can have a basis weight less than about 30 gm/m$^2$ or more than about 70 gm/m$^2$, such that the netting 30 can be attached to the support members 20*a*-20*g* and the netting 30 can contain the loosefill material 58 in a layer having a substantially uniform thickness.

Referring again to the embodiment shown in FIG. 2A, the netting 30 is provided on a roll 40. However, the netting 30 can be provided in other forms, such as the non-limiting example of folded sheets.

In one exemplary embodiment, all or portions of the netting is porous or very air permeable. This porosity or air permeability allows the loosefill insulation 58 to be blown into the insulation cavities, while allowing the air that blows the loosefill insulation 58 to escape from the insulation cavities. In some exemplary embodiments, portions of the netting 30 are porous or very air permeable, while other portions are air barriers. For example, in one exemplary embodiment, the side panels 34*a*, 34*b* are porous, very air permeable, and/or include spaced apart discrete sections and the tabs 38*a*, 38*b* and span segment 36 are made from a water vapor retarder material and/or an air barrier material. This allows the netting or insulation support material 30 to form a vapor retarder and/or air barrier, while still allowing the air that blows the loose-fill insulation 58 into the cavities to escape through the side panels 34*a*, 34*b*.

Figure 3:
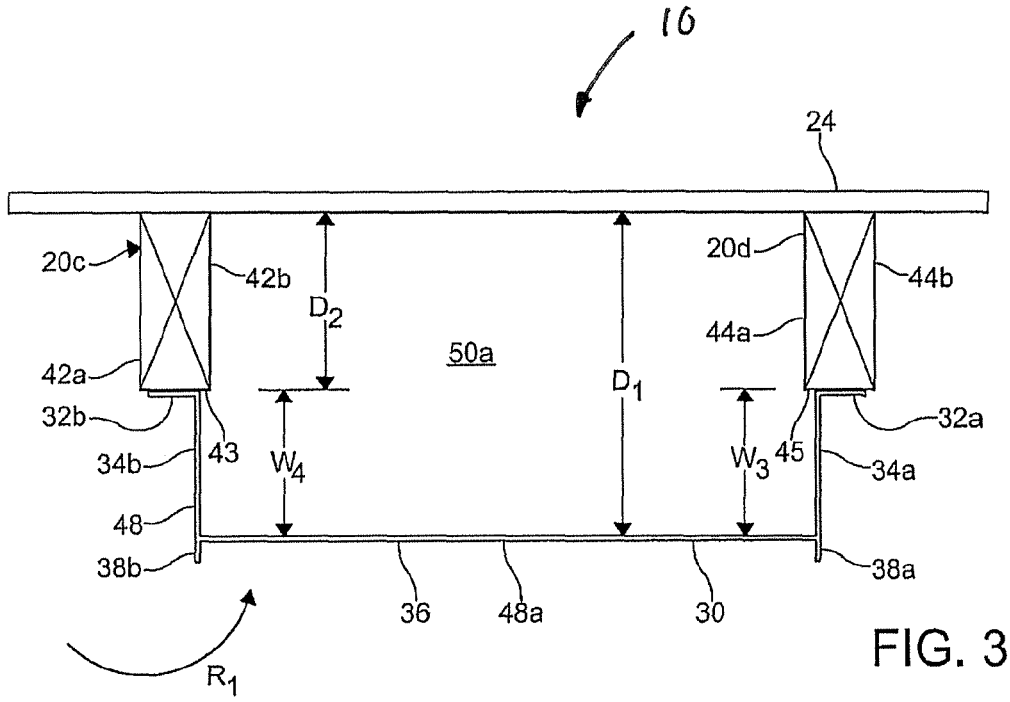
FIG. 3 is a partial front view, in elevation, of a building structure illustrating a first embodiment of a boxed netting insulation system.

Referring now to FIGS. 3-6, installation of the netting 30 illustrated by FIGS. 2A and 2B is illustrated. Referring first to FIG. 3, representative adjacent support members 20*c* and 20*d*, such as a truss chords or rafters and sheathing panel 24 are illustrated. Support member 20*c* has a first major face 42*a*, a second major face 42*b* and a first minor face 43. Similarly, support member 20*d* has a first major face 44*a*, a second major face 44*b* and a first minor face 45. In a first step, the netting 30 is unrolled from the roll 40 shown in FIG. 2A to expose a length of netting 30 that generally corresponds to the length L1 of the adjacent support members 20*c* and 20*d*. The netting 30 is cut thereby forming a formed length of netting 48*a*.

In a next step, the formed length of netting 48*a* is positioned along the length L1 of the adjacent support members 20*c*, 20*d* such that the tabs 38*a*, 38*b* extend in a direction away from the sheathing panel 24. Next, the end segment 32*b* is fastened to the first minor face 43 of support member 20*c* along the length L1 of the support member 20*c*, thereby allowing the formed length of netting 48 to hang from the first minor face 43 of support member 20*c*. While the embodiment illustrated in FIGS. 3-6 shows fastening of the end segment 32*b* to the first minor face 43 of support member 20*c*, it should be appreciated that in other embodiments, the end segment 32*b* can be fastened to other portions of the support member 20*c*, such as the non-limiting examples of a major face 42*a*, 42*b* or at the intersections of the first minor face 43 and the major faces 42*a*, 42*b*. In the illustrated embodiment, the end segment 32*b* is fastened to the first minor face 43 of the support member 20*c* with staples (not shown). In other embodiments, other desired fasteners can be used, such as the non-limiting examples of double sided tape, adhesives, clips or clamps.

Referring again to FIG. 3, in a next step, the span segment 36, side panel 34*a* and end portion 32*a* are rotated in a counter-clockwise direction, as indicated by direction arrow R1, toward the support member 20*d*. Next, the end segment 32*a* is fastened to the first minor face 45 of support member 20*d* along the length L1 of support member 20*d*, thereby allowing the side panels 34*a*, 34*b* and span segment 36 to hang from the support members 20*c*, 20*d*. In this position, the side panels 34*a*, 34*b*, span segment 36, support members 20*c*, 20*d* and the sheathing panel 24 cooperate to define a first insulation cavity 50*a*.

The first insulation cavity 50*a* extends the length L1 of the support members 20*c*, 20*d* and has a depth D1. The depth D1 of the first insulation cavity 50*a* is defined as the total of the depth D2 of the support members 20*c*, 20*d* and the widths W3, W4 of the side panels 34*a*, 34*b*. The depth D1 will be discussed in more detail below.

Figure 4:
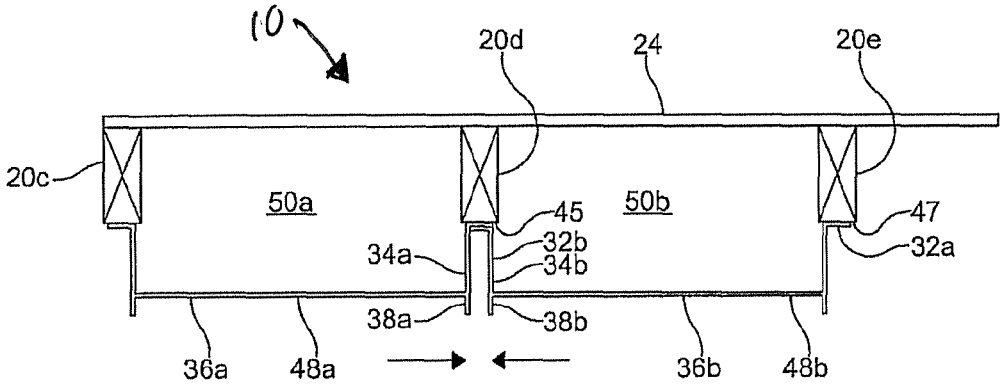
FIG. 4 is a partial front view, in elevation, of a building structure illustrating the embodiment of FIG. 3.

Referring now to FIG. 4, netting 48*a* is shown attached to support members 20*c*, 20*d*. In a manner similar, end portion 32*b* of netting 48*b* is attached to the first minor face 45 of support member 20*d* and end portion 32*a* of netting 48*b* is attached to the first minor face 47 of support member 20*e*, thereby allowing the netting 48*b* to hang from the support members 20*d*, 20*e*. In this position, the netting 48*b*, support members 20*d*, 20*e* and the sheathing panel 24 define a second insulation cavity 50*b*.

Figure 5:
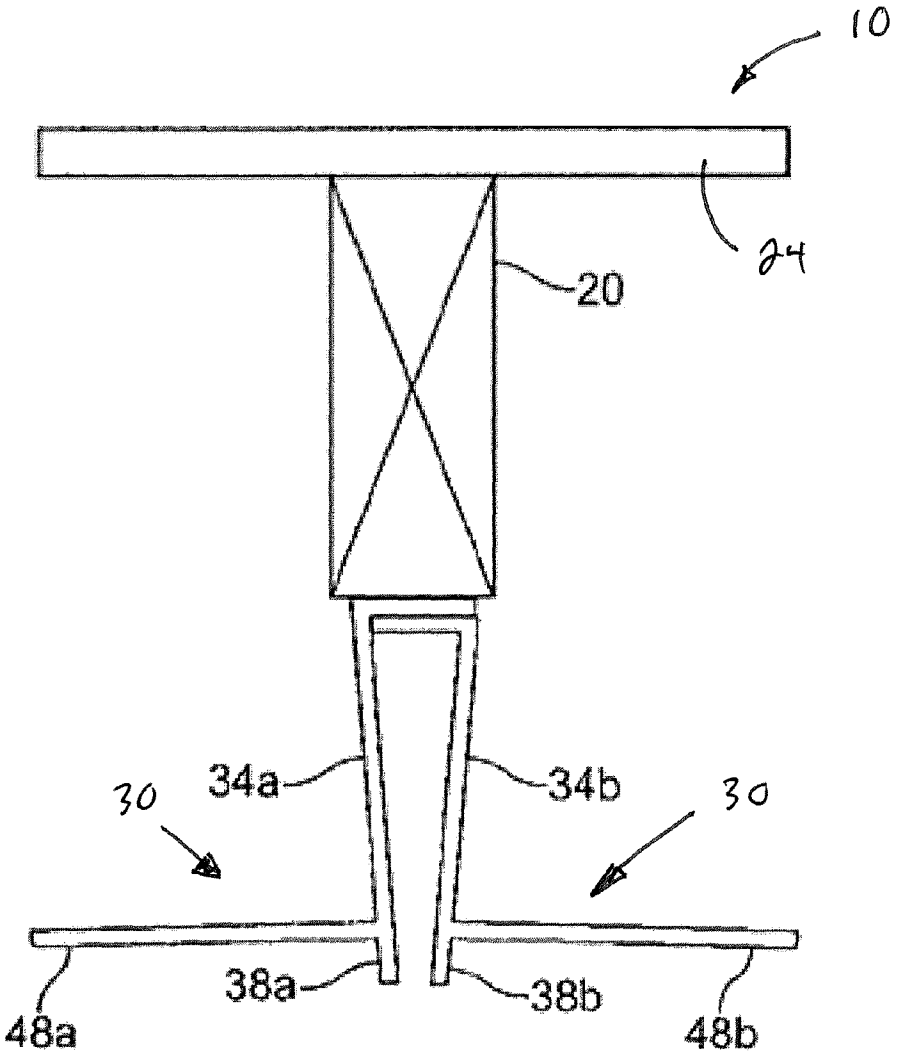
FIG. 5 in an enlarged partial front view, in elevation, of adjacent nettings of the boxed netting insulation system of FIG. 4.

Referring now to FIGS. 4 and 5, the tab 38*a* of netting 48*a* and the tab 38*b* of netting 48*b* hang such as to be substantially adjacent to each other. In a next step, the tabs 38*a*, 38*b* are fastened together along the length L1 of the support member 20*d*. Fastening of the tabs 38*a*, 38*b* brings portions of the side panel 34*a* of netting 48*a* and portions of the side panel 34*b* of netting 48*b* substantially together, and imparts a tension of the span segments 36*a*, 36*b* of the nettings 48*a*, 48*b*. The tension imparted on the span segments 36*a*, 36*b* results in the side panels 34*a*, 34*b* and the span segments 36*a*, 36*b* of the respective insulation cavities 50*a*, 50*b* forming boxlike cross-sectional shapes that are substantially retained after loosefill insulation 50 is blown into the insulation cavities 50*a*, 50*b*.

In the illustrated embodiment, the tabs 38*a*, 38*b* are fastened together at intervals in a range of about 2.0 inches to about 8.0 inches. In other embodiments, the tabs 38*a*, 38*b* can be fastened together at intervals less than about 2.0 inches or more than about 8.0 inches. Referring again to FIGS. 4 and 5, the tabs 38*a*, 38*b* have been fastened together using a plurality of fasteners (not shown). In the illustrated embodiment, the fasteners are staples. However, in other embodiments, the tabs 38*a*, 38*b* can be fastened together using other structures and devices, such as the non-limiting examples of adhesives, clips, clamps, zip-lock type fastening arrangements. These fastening devises can be used in any of the embodiments disclosed by the present application.

Figure 6:
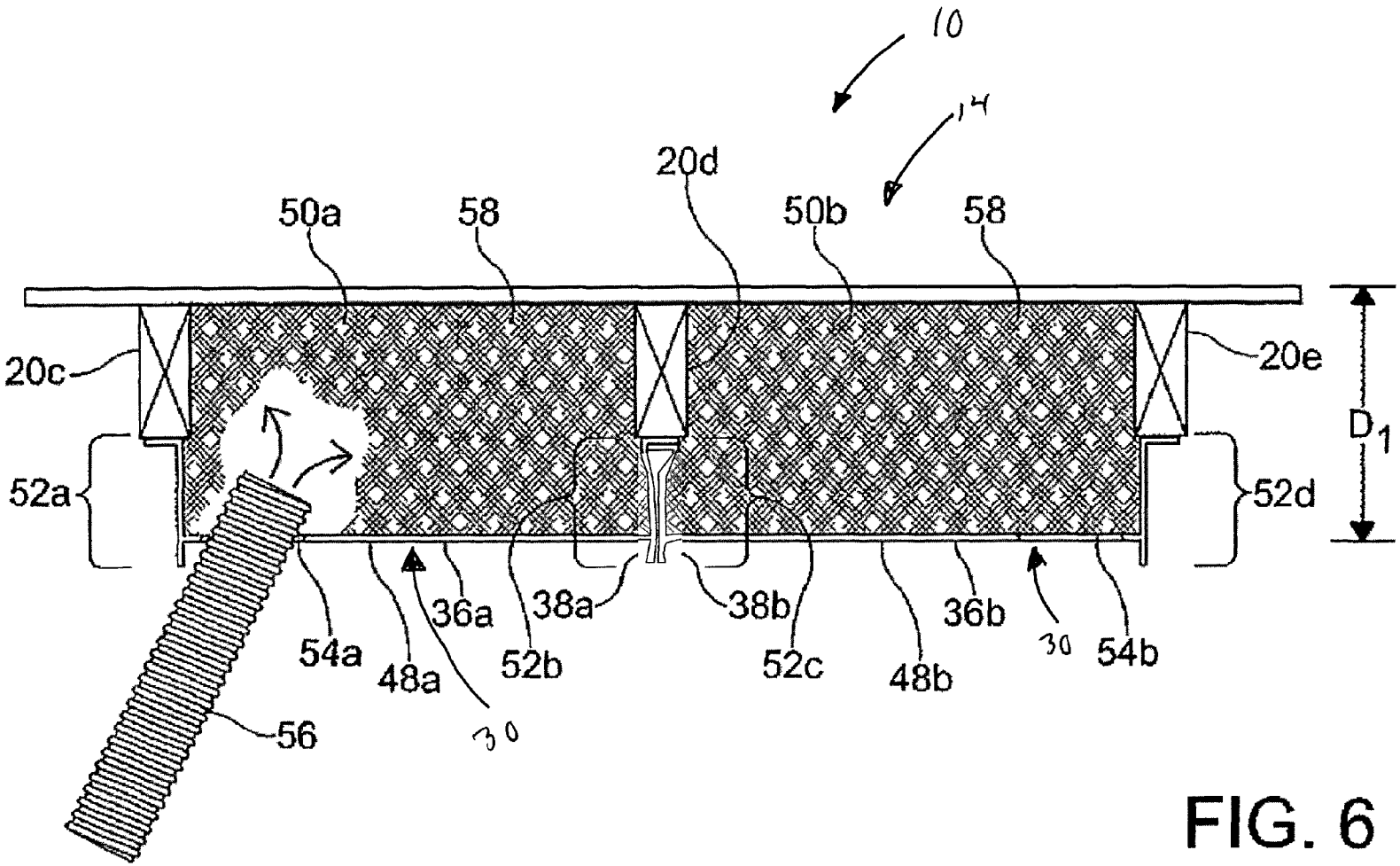
FIG. 6 is a partial front view, in elevation, of a building structure illustrating distribution of loosefill insulation material within insulation cavities formed by the boxed netting insulation system of FIG. 4.

Referring now to FIG. 6, the nettings 48*a*, 48*b* are shown after the tabs 38*a*, 38*b* have been fastened together and a tension has been established in the span segments 36*a*, 36*b*, thereby forming the box-like cross-sectional shapes of the insulation cavities 50*a*, and 50*b*. As further shown in FIG. 6, a first insulation pocket 52*a* is formed as a portion of insulation cavity 50*a* and is located under support member 20*c*. A second insulation pocket 52*b* is formed as a portion of insulation cavity 50*a* and is located under support member 20*d*. A third insulation pocket 52*c* is formed as a portion of insulation cavity 50*b* and is located under support member 20*d* and a fourth insulation pocket 52*d* is formed as a portion of insulation cavity 50*b* and is located under support member 20*e*. The insulation pockets 52*a*-52*d* will be discussed in more detail below.

Referring again to FIG. 6 in a next step, opening 54*a* is formed in the span segment 36*a* such as to allow insertion of a distribution hose 56 into the insulation cavity 50*a*. The distribution hose 56 is attached to a blowing insulation machine (not shown) and configured to convey conditioned loosefill insulation material 58 from the blowing insulation machine to the insulation cavity 50*a*. Any desired distribution hose 56 and blowing insulation machine can be used sufficient to convey conditioned loosefill insulation material 58 from the blowing insulation machine to the insulation cavity 50*a*. Distribution of the loosefill insulation material 58 into the insulation cavity 50*a* continues until the insulation cavity 50*a* is filled. An opening 54*b* is formed in the span segment 36*b* and the insulation cavity 50*b* is filled in a similar manner. In the illustrated embodiment, a single opening 54*a* is used to fill an insulation cavity. However, it should be appreciated that more than one opening can be used to fill an insulation cavity.

Referring again to FIG. 6, the loosefill insulation material 58 can be any desired loosefill insulation material, such as a multiplicity of discrete, individual tuffs, cubes, flakes, or nodules. The loosefill insulation material 58 can be made of glass fibers or other mineral fibers, and can also be polymeric fibers, organic fibers or cellulose fibers. The loosefill insulation material 58 can have a binder material applied to it, or it can be binderless.

Referring again to FIG. 6 in a final step, the openings 54*a*, 54*b* are covered with coverings (not shown) sufficient to prevent loosefill insulation material within the insulation cavities 50*a*, 50*b* from falling out of the openings 54*a*, 54*b*. In the illustrated embodiment, the coverings are formed from an adhesive tape. However, the coverings can be formed from other desired structures or materials. The steps of forming the box-shaped insulation cavities between adjacent support members and filling the insulation cavities with loosefill insulation material are repeated until all of the insulation cavities between support members forming a roof deck are completed. While the embodiment shown in FIG. 6 has been described above as covering the openings 54*a*, 54*b* with coverings in the form of adhesive tape, in other embodiments the openings 54*a*, 54*b* can be plugged with compressible or conformable materials. One non-limiting example of a compressible or conformable material is a portion of a bat of fiberglass insulation.

The boxed netting insulation system advantageously provides many benefits, although not all benefits may be realized in all circumstances. First, as shown in FIG. 6, the box-shaped insulation cavities, 50*a*, 50*b* provide a uniform thickness of the loosefill insulation material. The term "uniform thickness", as used herein, is defined to mean having a substantially consistent depth. The uniform thickness of the loosefill insulation material is substantially maintained by the tension formed in the span segments after the loosefill insulation cavities are filled with the loosefill insulation material.

Second, the depth D1 of the insulation cavities can be adjusted to provide different depths of the loosefill insulation material. Referring to FIG. 3 as discussed above, the depth of the loosefill insulation material is the sum of the depth D2 of the support members 20*c*, 20*d* and the width W3, W4 of the side panels 34*a*, 34*b*. Accordingly, differing the widths W3, W4 of the side panels 34*a*, 34*b* provides differing depths D1 of the insulation cavity. As the thermal resistance (R-Value) of the loosefill insulation material within the insulation cavities is, in part, a function of the depth of the loosefill insulation material, the thermal resistance (R-Value) of the loosefill insulation material can be adjusted by differing with widths W3, W4 of the side panels 34*a*, 34*b*.

In the illustrated embodiment, varying the widths W3, W4 of the side panels 34*a*, 34*b* results in different R-values of the resulting layer of loosefill insulation material within the insulation cavities as shown in Table 1.

TABLE 1

| Side Panel Width (Inches) | Truss Chord Depth (Inches) | Insulation Cavity Depth (Inches) | Insulation Material Density (Lbs/Ft$^3$) | Thermal Resistance (R-value) (Btu-In/(Hr · Ft$^2$ · ° F.)) |
|---|---|---|---|---|
| 2.00 | 3.50 | 5.50 | 1.30 | R-22 |
| 4.00 | 3.50 | 7.50 | 1.30 | R-30 |
| 6.00 | 3.50 | 9.50 | 1.30 | R-38 |
| 8.75 | 3.50 | 12.25 | 1.30 | R-49 |

As shown in Table 1, the thermal resistance (R-value) of the layer of a particular brand of loosefill insulation material can be varied by varying the width of the side panels. As one specific example, a thermal resistance (R-Value) of 22 can be achieved with an insulation cavity depth of 5.50 inches. While the specific example discussed above is based on a side panel width W3 of 2.00 inches and a support member depth D2 of 3.50 inches, it should be noted that Table 1 advantageously includes other values of thermal resistance (R-Value) for other side panel widths. It should also be appreciated that the results shown in Table 1 would be different for Support member depths of more or less than 3.50 inches and for Insulation Material Densities of more or less than about 1.30 lbs/ft$^3$.

Referring to again to FIG. 6 for a third advantage, distributing the loosefill insulation material 58 into the insulation cavities 50*a*, 50*b* results in loosefill insulation material filling the insulation pockets 52*a*-52*d*. As the filled insulation pockets 52*a*-52*d* are positioned below the support members 20*c*, 20*d* and 20*e*, the filled insulation pockets 52*a*-52*d* are configured to insulate the support members 20*c*, 20*d* and 20*e*.

Figure 5A:
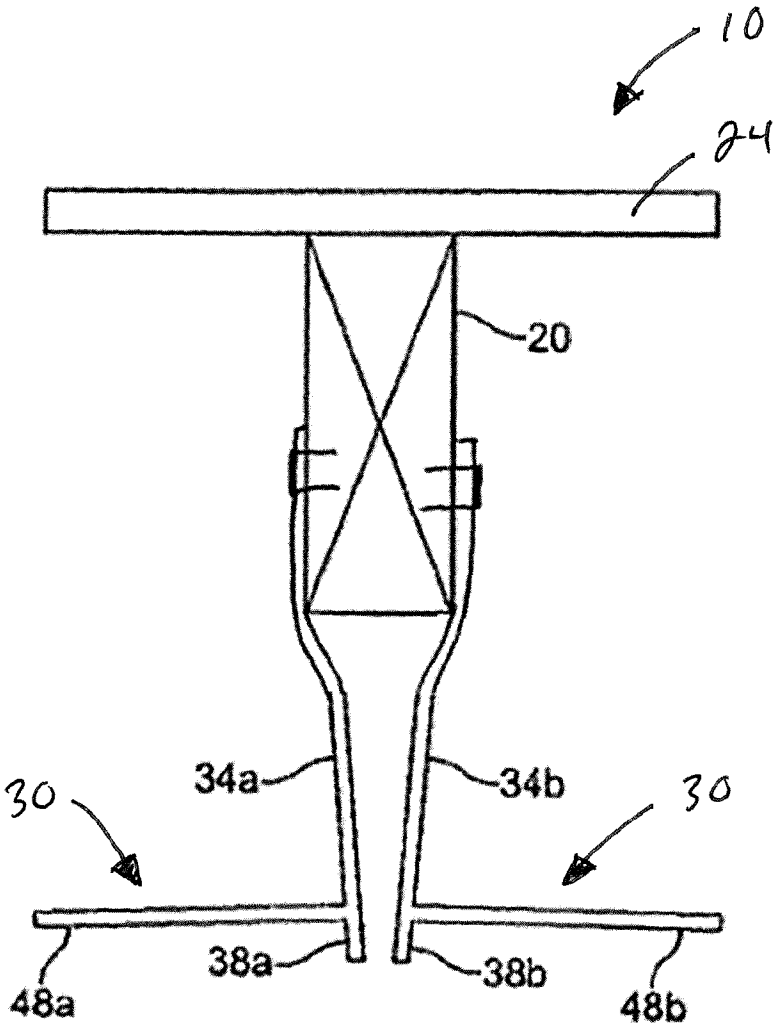
FIG. 5A is a view similar to FIG. 5 where netting is attached to opposite side faces of a roof deck supporting structural member.
Figure 5B:
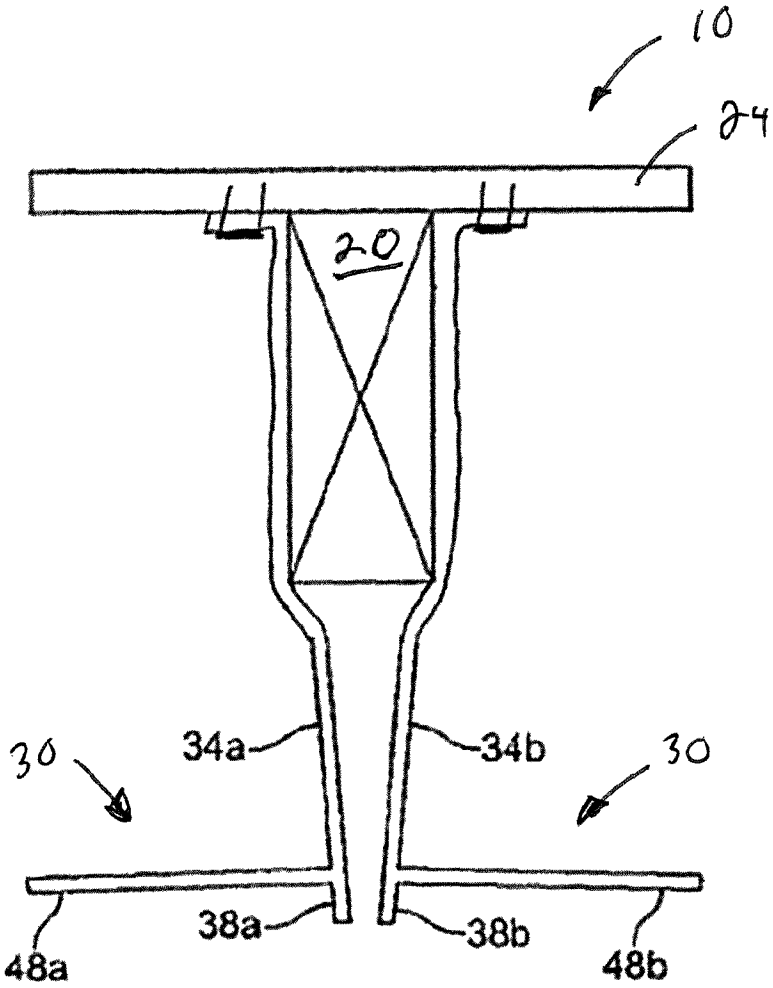
FIG. 5B is a view similar to FIG. 5 where netting is attached a roof deck on opposite sides of a roof deck supporting structural member.
Figure 5C:
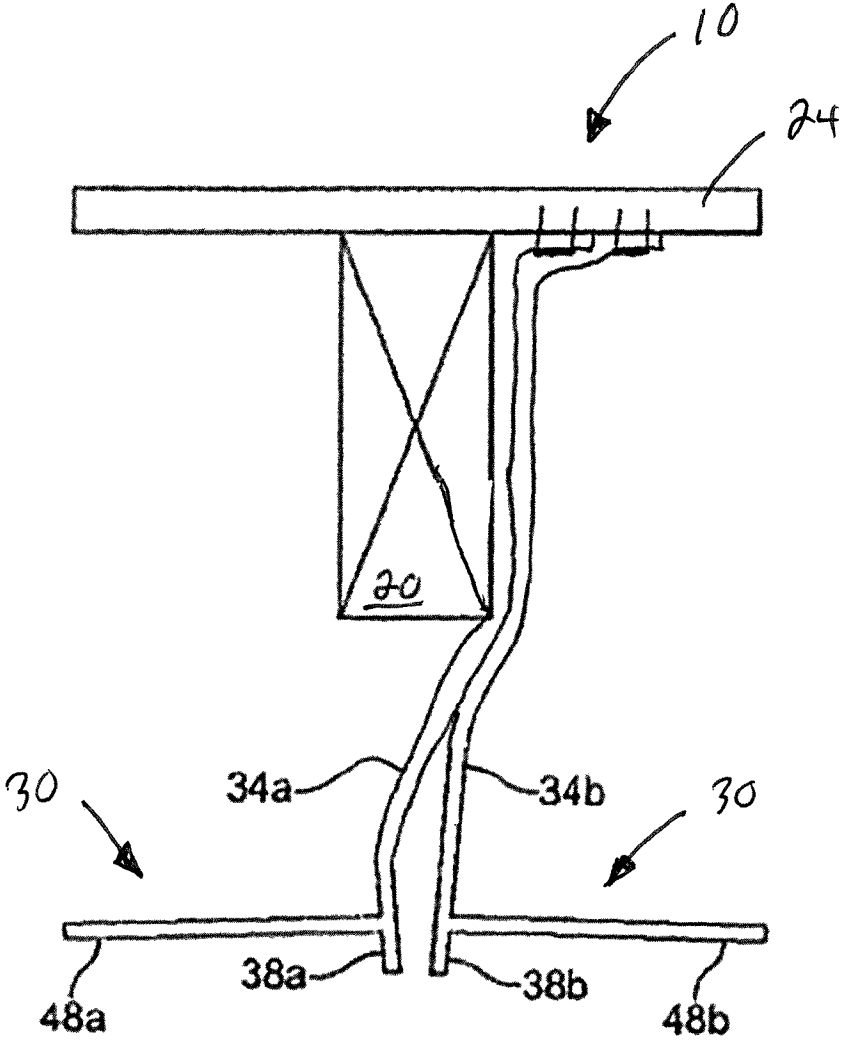
FIG. 5C is a view similar to FIG. 5 where netting is attached a roof deck on the same side of a roof deck supporting structural member.
Figure 5D:
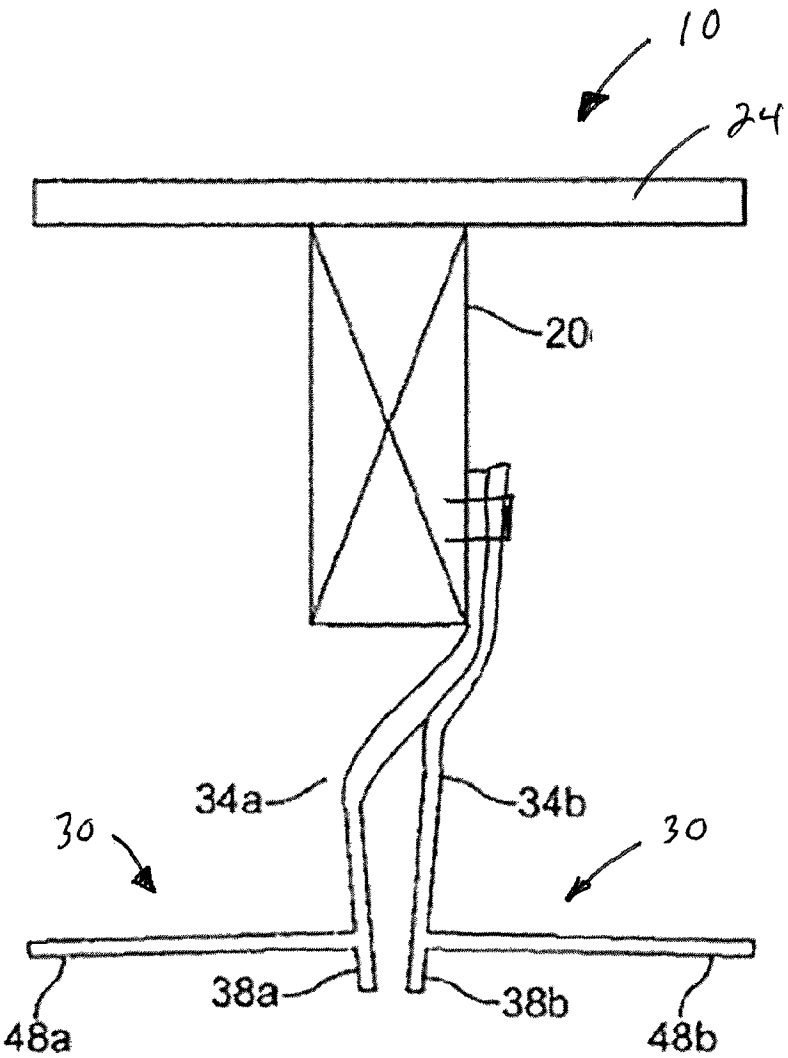
FIG. 5D is a view similar to FIG. 5 where netting is attached to one side face of a roof deck supporting structural member.
Figure 5E:
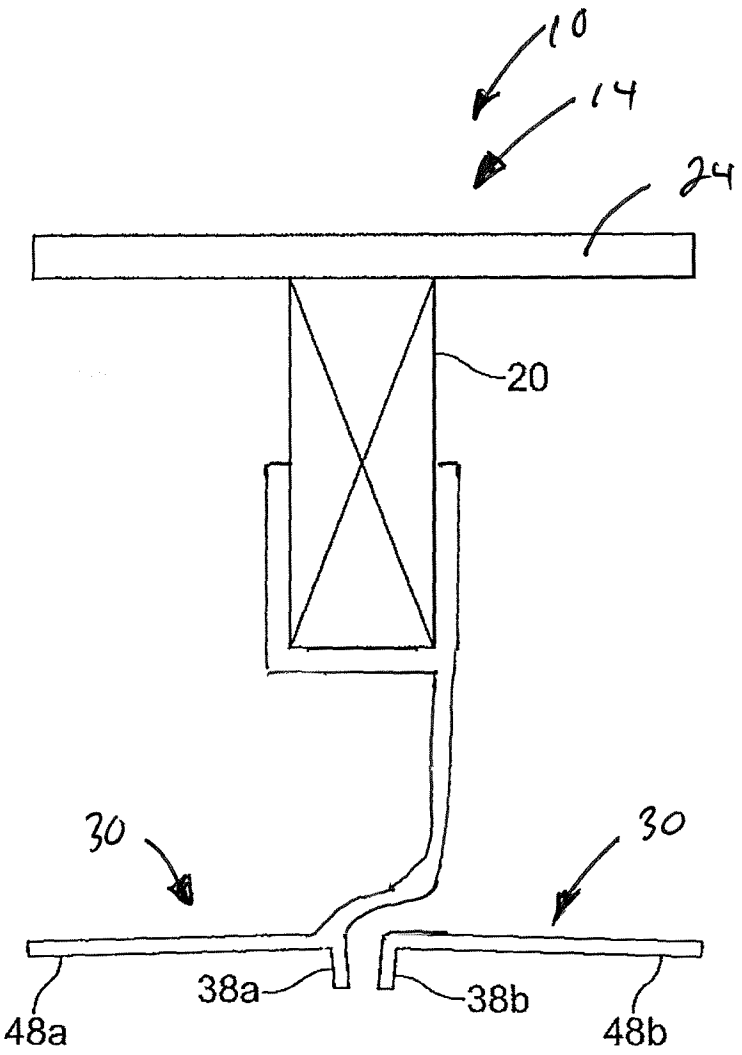
FIG. 5E is a view similar to FIG. 5 where netting is clamped to opposite side faces of a roof deck supporting structural member.

While the embodiment illustrated in FIGS. 3-6 shows fastening of the end segment 32*b* to the first minor face 43 of support member 20*c*, it should be appreciated that in other embodiments, the insulation support material 30 can be fastened to other portions of the support member 20, such as the non-limiting examples of a major face 42*a*, 42*b* or at the intersections of the first minor face 43 and the major faces 42*a*, 42*b*. In the exemplary embodiment illustrated by FIG. 5A, the insulation support materials 30 are attached to opposite side faces of a roof deck supporting structural member 20. For example, side panels 34*a*, 34*b* may be attached to opposite side faces of a roof deck supporting structural member 20. In the exemplary embodiment illustrated by FIG. 5B the insulation support material 30 is attached to a roof deck sheathing panel 24 on opposite sides of a roof deck supporting structural member 20. For example, side panels 34*a*, 34*b* may be attached to a roof deck sheathing panel 24 on opposite sides of a roof deck supporting structural member 20. In the exemplary embodiment illustrated by FIG. 5C, the insulation support material 30 is attached to a roof deck sheathing panel 24 on the same side of a roof deck supporting structural member 20. For example, side panels 34*a*, 34*b* may be attached to a roof deck sheathing panel 24 on the same side of a roof deck supporting structural member 20. In the exemplary embodiment illustrated by FIG. 5D, the insulation support materials 30 are attached to one side face of a roof deck supporting structural member 20. For example, side panels 34*a*, 34*b* may be attached to one side face of a roof deck supporting structural member 20. In the exemplary embodiment illustrated by FIG. 5E, the insulation support materials 30 are clamped to opposite side faces of a roof deck supporting structural member 20. For example, the side panel 34*a* may include a clamp 502 that clamps onto opposite faces of the roof deck supporting structural member 20. Any of the fastening arrangements illustrated by FIGS. 5, 5A-5E can be used in with any of the insulation support material embodiments disclosed by the present application.

In the exemplary embodiments illustrated by FIGS. 5, 5A-5D, the insulation support material or nettings 48*a*, 48*b* are fastened with staples (not shown). In other embodiments, other desired fasteners can be used, such as the non-limiting examples of double sided tape, adhesives, clips, velcro, and/or clamps.

Figure 3A:
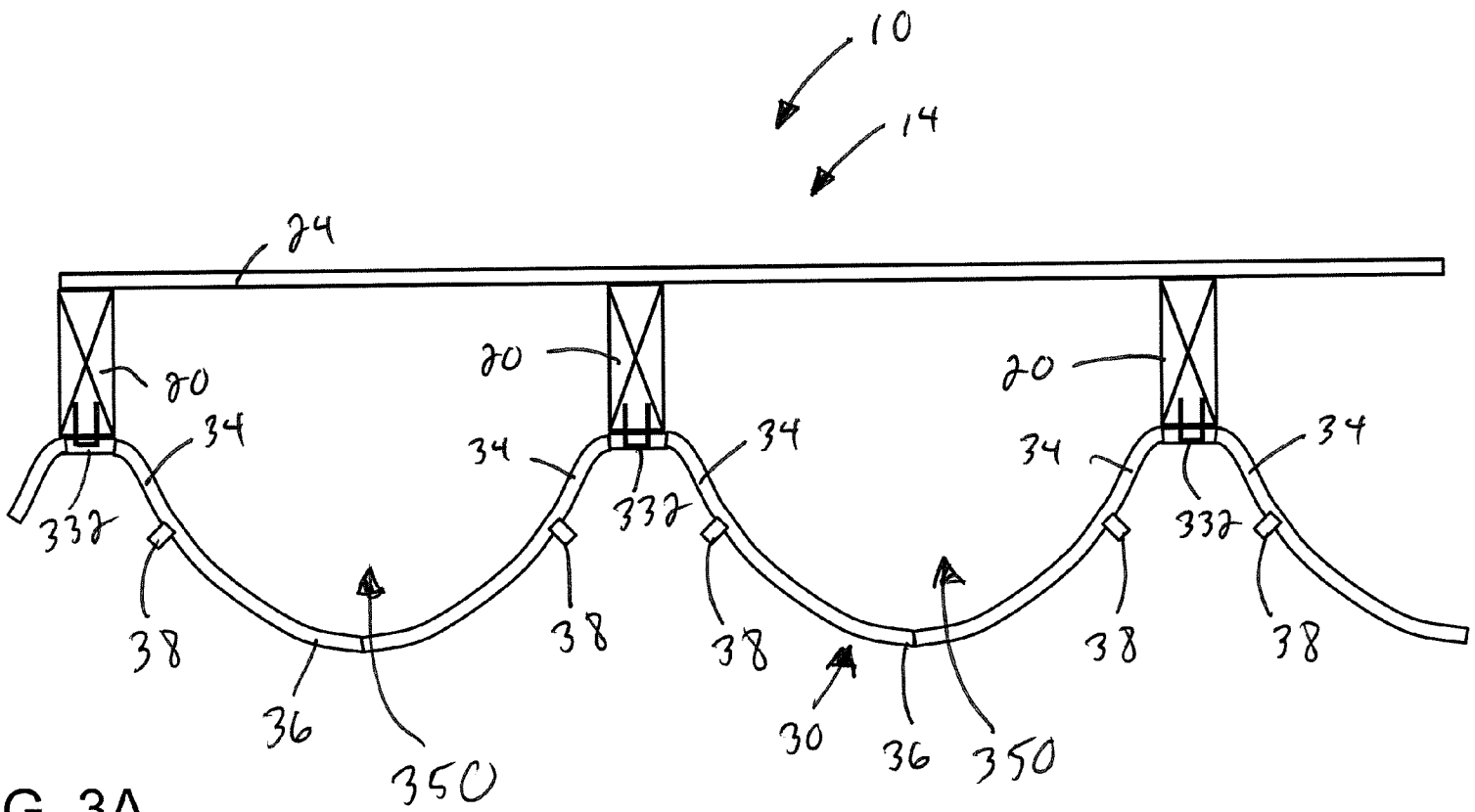
FIG. 3A is a partial front view, in elevation, of a building structure illustrating another embodiment of a boxed netting insulation system.
Figure 4A:
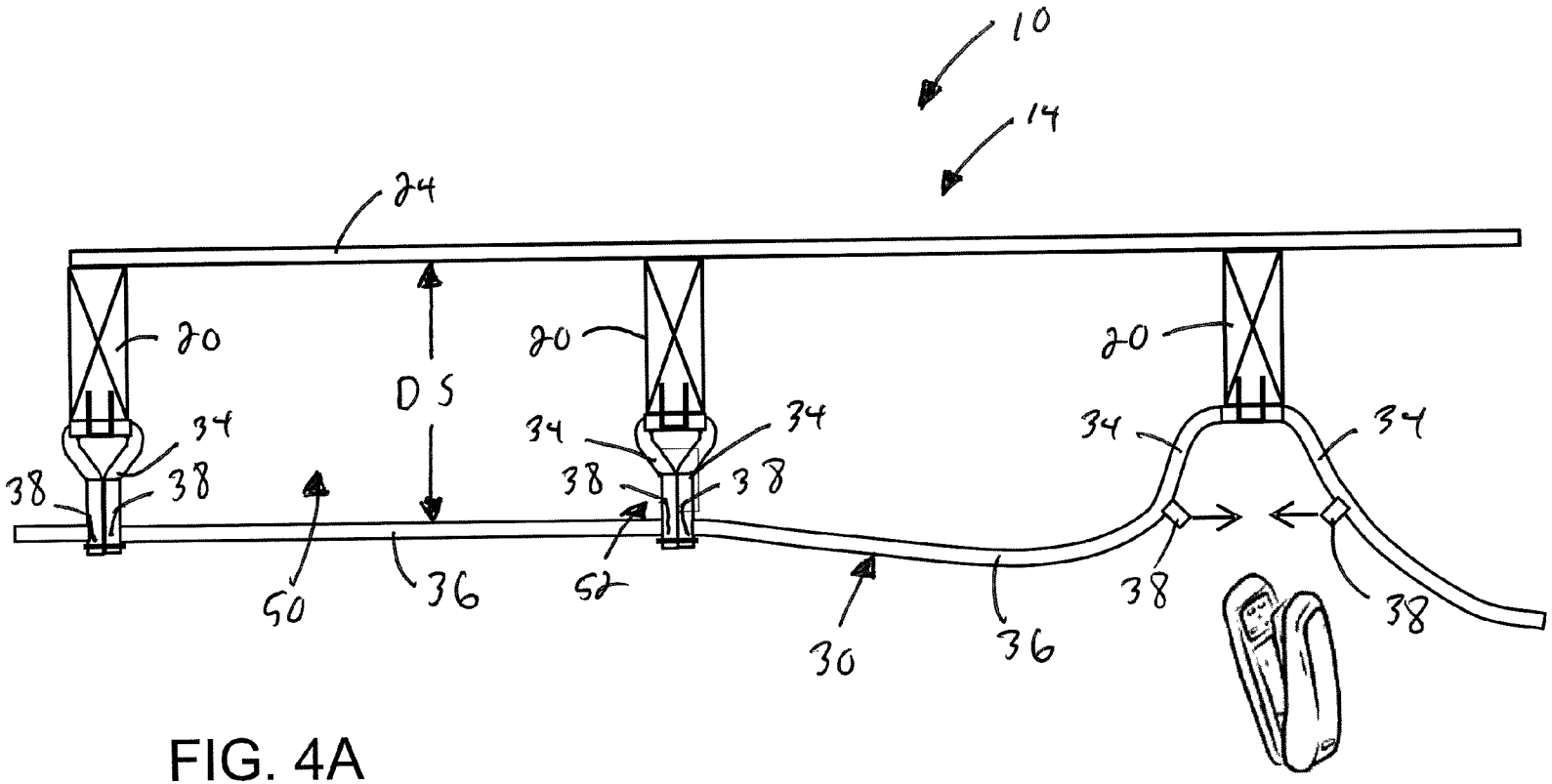
FIG. 4A is a partial front view, in elevation, of a building structure illustrating the embodiment of FIG. 3A.
Figure 6A:
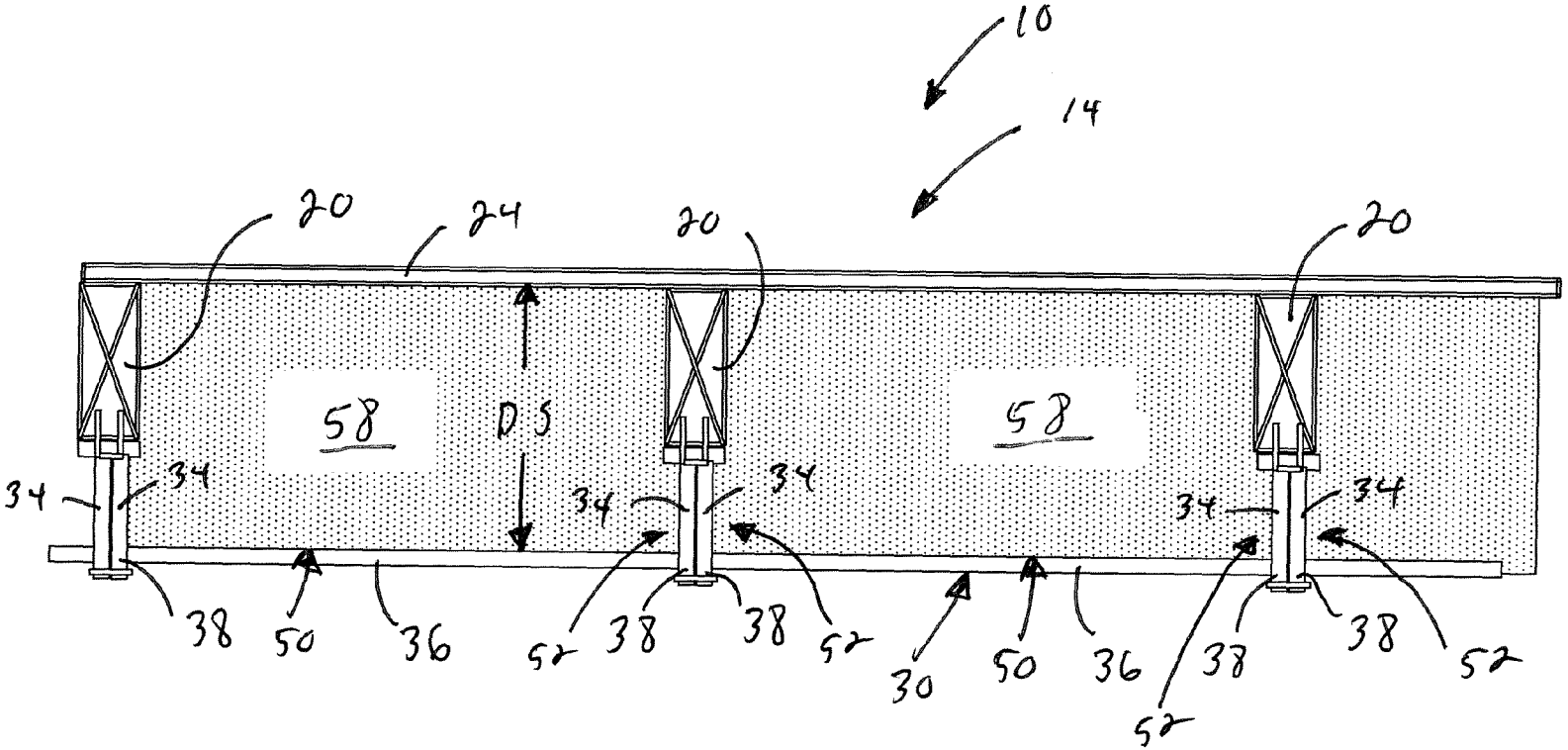
FIG. 6A is a partial front view, in elevation, of a building structure illustrating distribution of loosefill insulation material within insulation cavities formed by the boxed netting insulation system of FIG. 4A.

FIGS. 3A, 4A, and 6A illustrate an exemplary embodiment similar to the embodiment illustrated by FIGS. 3, 4, and 5, where the insulation support material 30 is wide enough to span at least three support members 20 (i.e. to form two or more insulation cavities 50 with one piece of netting 48. Like the embodiment illustrated by FIG. 3, FIG. 3A illustrates representative adjacent support members 20, such as a truss chords or rafters and a sheathing panel 24 In a first step, the netting 30 is unrolled from a roll 40 (like the roll shown in FIG. 2A, but wider and with more tab portions 38) to expose a length of netting 30 that generally corresponds to the length L1 of the adjacent support members 20. The netting is cut thereby forming a formed length of netting 30.

In a next step, the formed length of support material 30 is positioned along the length L1 of the adjacent support members 20 such that the tabs 38 extend in a direction away from the sheathing panel 24. Next, the fastening segments 332 are fastened to the minor faces of support member 20 along the length L1 of the support member 20, thereby allowing the formed length of insulation support material 30 to hang from the first minor faces to define drooping insulation cavities 350.

Referring to FIG. 4A, in a next step, the tabs 38 are fastened together as shown to form substantially taught insulation cavities 50, each having a substantially rectangular configuration. In an exemplary embodiment, a distance DS from the sheathing panel 24 to the span segments 36 is substantially uniform. Fastening of the tabs 38 brings the span segments substantially together under tension. The tension imparted on the span segments 36 results in the side panels 34 and the span segments 36 of the insulation cavities 50 forming boxlike cross-sectional shapes that are substantially retained after loosefill insulation is blown into the insulation cavities 50.

Referring now to FIG. 6A, the insulation support material 30 is shown after the tabs 38 have been fastened together and a tension has been established in the span segments 36, thereby forming the box-like cross-sectional shapes of the insulation cavities 50. As further shown in FIG. 6A, a insulation pockets 52 are formed as a portion of insulation cavity 50 and are located under support members 20.

Referring again to FIG. 6A the insulation cavities may be filled with loosefill insulation in the same manner as described with respect to FIG. 6.

While the embodiment illustrated in FIGS. 3-6 shows fastening of the netting 48 to the first minor face 43 of support member 20, it should be appreciated that in other embodiments, the nettings 48 can be fastened to other portions of the support member 20 and/or to roof decking (See, for example, FIGS. 5A-5E for examples of possible fastening locations).

Referring now to FIGS. 7A-7G, another method of forming boxed insulation cavities is illustrated. Generally, this method entails use of a clamp having a clam-shell configuration to secure the netting to adjacent support members. The clamp is further configured to shape the netting in the form of a box, thereby forming the boxed insulation cavities.

Figure 7A:
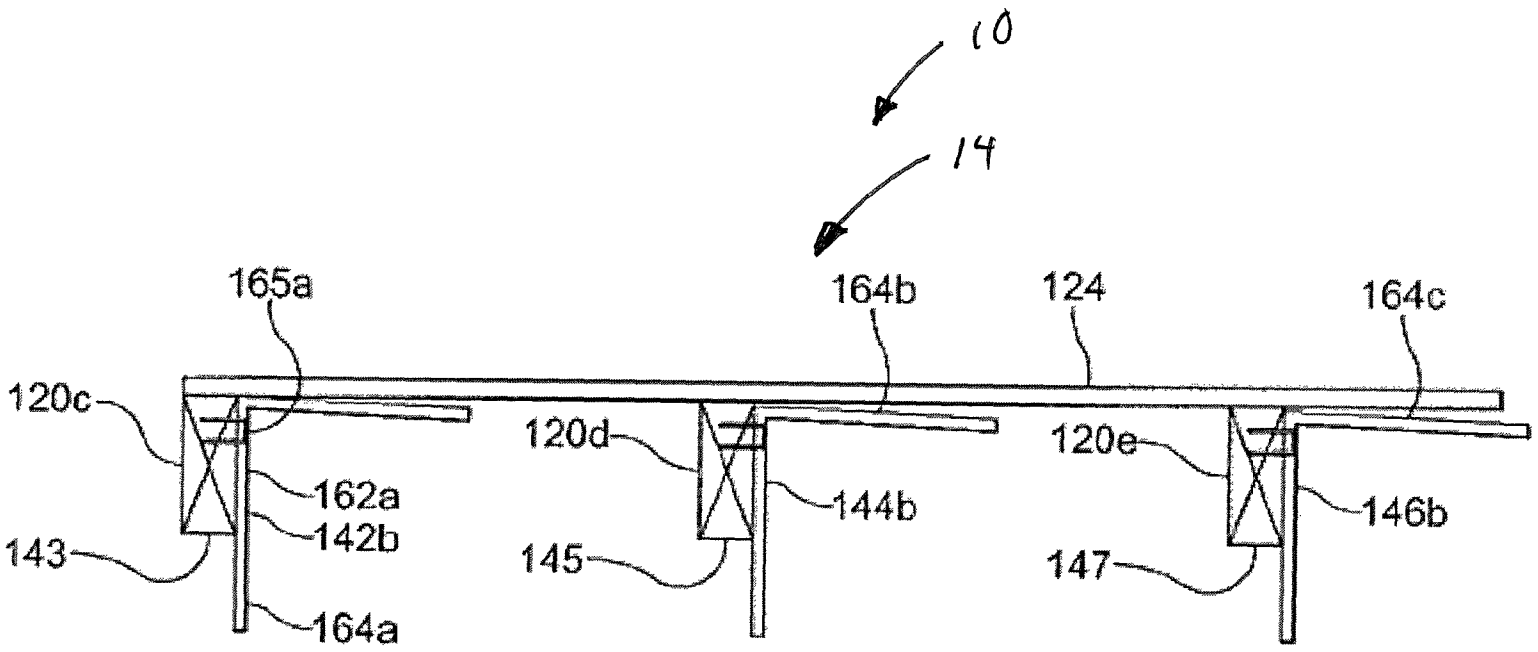
FIG. 7A is a partial front view, in elevation, of a building structure, illustrating initial installation of clamps for another embodiment of a boxed netting insulation system.

Referring first to FIG. 7A, support members 120*c*, 120*d*, and 120*e* and sheathing panel 124 are illustrated. In the illustrated embodiment, support members 120*c*, 120*d*, 120*e* and sheathing panel 124 are the same as, or similar to, support members 20*c*, 20*d*, 20*e* and sheathing panel 24 shown in FIG. 6 and described above. However, in other embodiments, support members 120*c*, 120*d*, 120*e* and sheathing panel 124 can be different from support members 20*c*, 20*d*, 20*e* and sheathing panel 24. Support member 120*c* has a major face 142*b* and a minor face 143. Similarly, support member 120*d* has a major face 144*b* and a minor face 145, and support member 120*e* has a major face 146*b* and a minor face 147.

Referring again to FIG. 7A, a first leg 162*a* of a first clamp 164*a* is fastened to the major face 142*b* of the support member 120*c* with one or more fasteners 165*a*. In the illustrated embodiment, the fastener 165*a* is a staple. However, the fastener 165*a* can be other mechanisms, devices or structures, such as for example clips, clamps or adhesives sufficient to fasten the first clamp 164*a* to the support member 120*c*. In a similar manner, second and third clamps 164*b*, 164*c* are fastened to support members 120*d*, 120*e*.

In the embodiment shown in FIG. 7A, the clamps 164*a*-164*c* are formed from structural cardboard material. In other embodiments, the clamps 164*a*-164*c* can be formed from other desired materials, such as the non-limiting example of fabric or fiberglass scrim, sufficient to form a clam-shell configuration to secure the netting to the support members.

Figure 7B:
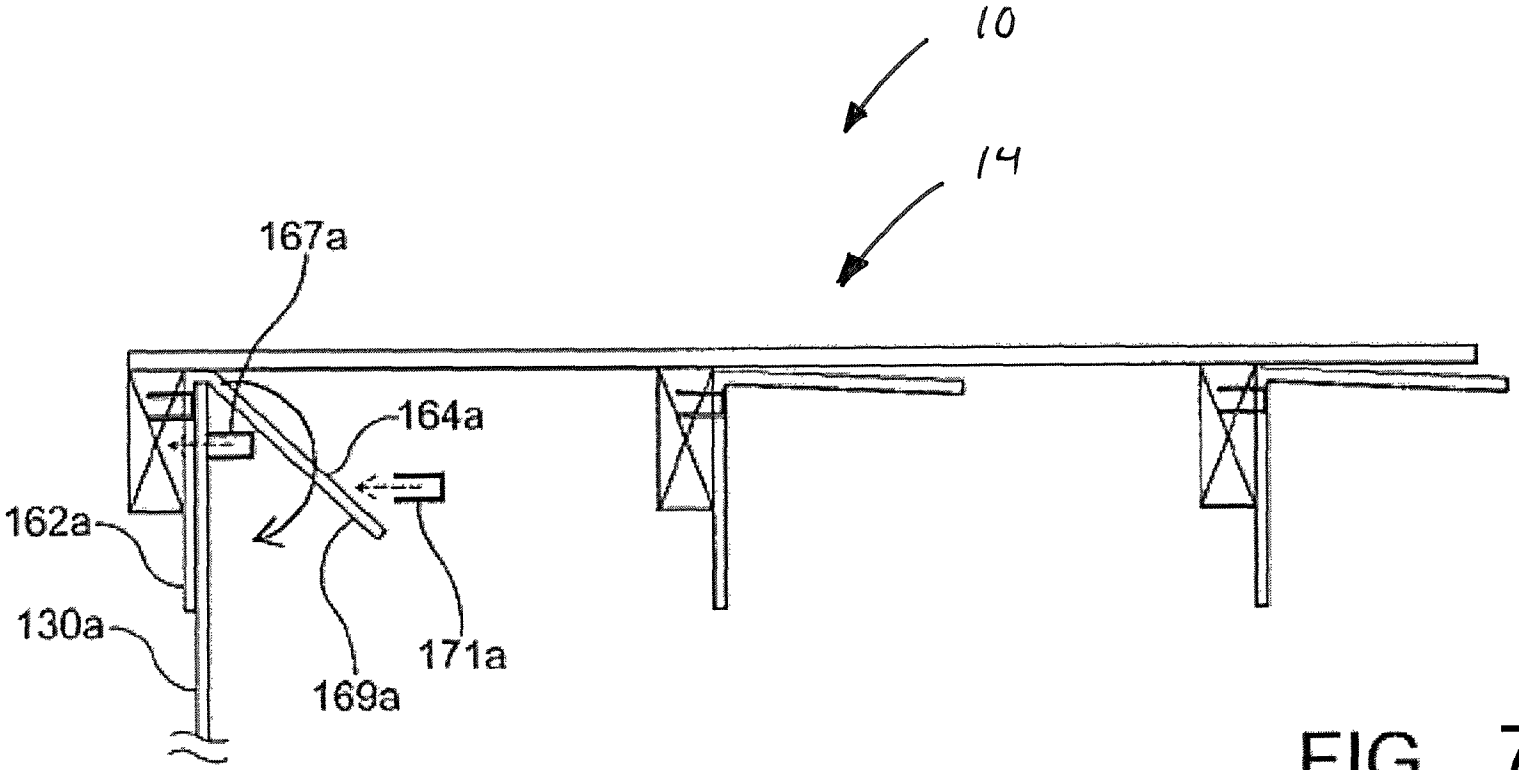
FIG. 7B is a partial front view, in elevation, of a building structure, illustrating initial installation of a first netting for the embodiment illustrated by FIG. 7A.

Referring now to FIG. 7B, a first netting 130*a* is positioned adjacent to the first leg 162*a* of the first clamp 164*a* and fastened to the support member 120*c* with one or more fasteners 167*a*. After the first netting 130*a* is fastened to the support member 120*c*, a second leg 169*a* of the first clamp 164*a* is rotated such as to be positioned adjacent to the first netting 130*a* and fastened to the support member 120*c* with one or more fasteners 171*a*. In the illustrated embodiment, the fasteners 167*a*, 171*a* are the same as, or similar to the fastener 165*a*, However, in other embodiments, the fasteners 167*a*, 171*a* can be different from the fastener 165*a*.

Figure 7C:
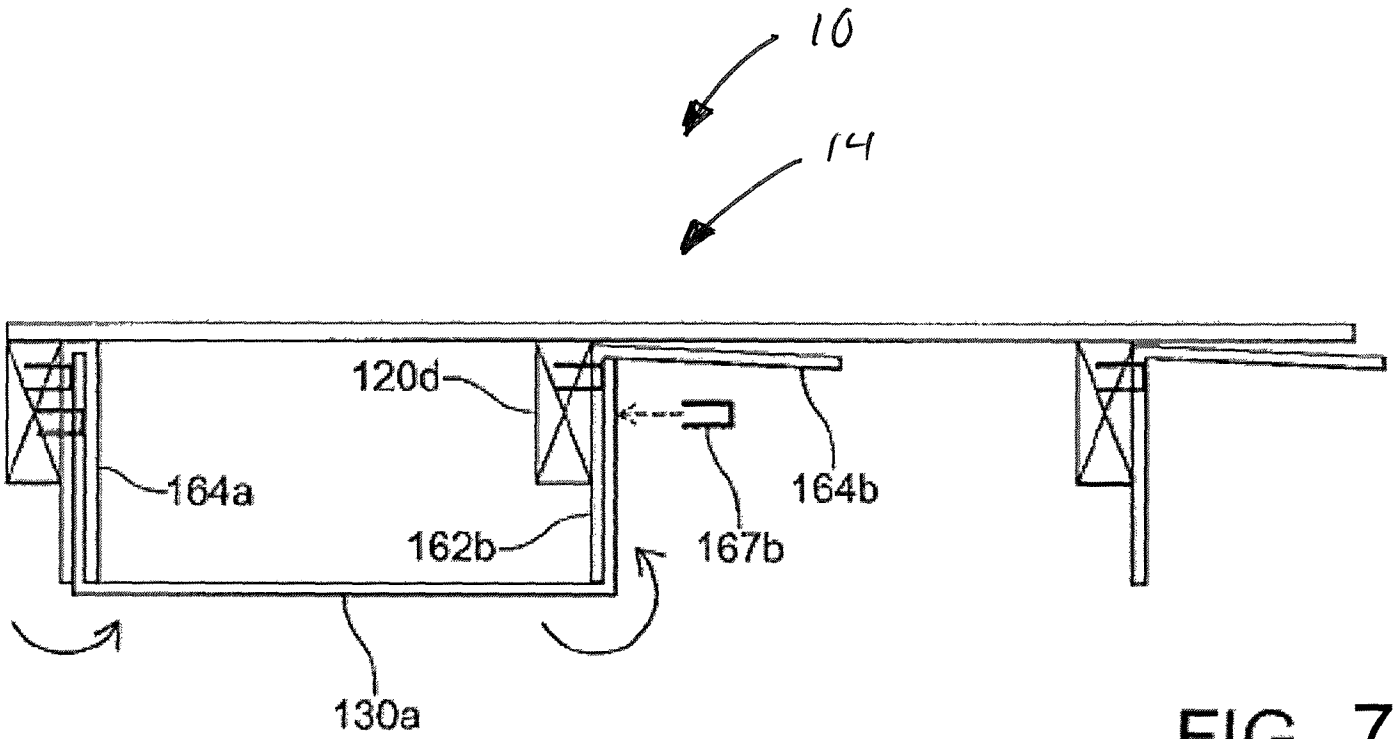
FIG. 7C is a partial front view, in elevation, of a building structure, illustrating completion of the first netting installation for the embodiment illustrated by FIG. 7A.

Referring now to FIG. 7C, the portion of the first netting 130*a* extending from the first clamp 164*a* is rotated in a counter-clockwise direction such that a portion of the first netting 130*a* is positioned adjacent to a first leg 162*b* of the second clamp 164*b*. The first netting 130*a* is fastened to the support member 120*d* by fastener 167*b* as discussed above. Fastening of the first netting 130*a* to the first leg 162*b* of the second clamp 164*b* imparts a tension on first netting 130*a*.

Figure 7D:
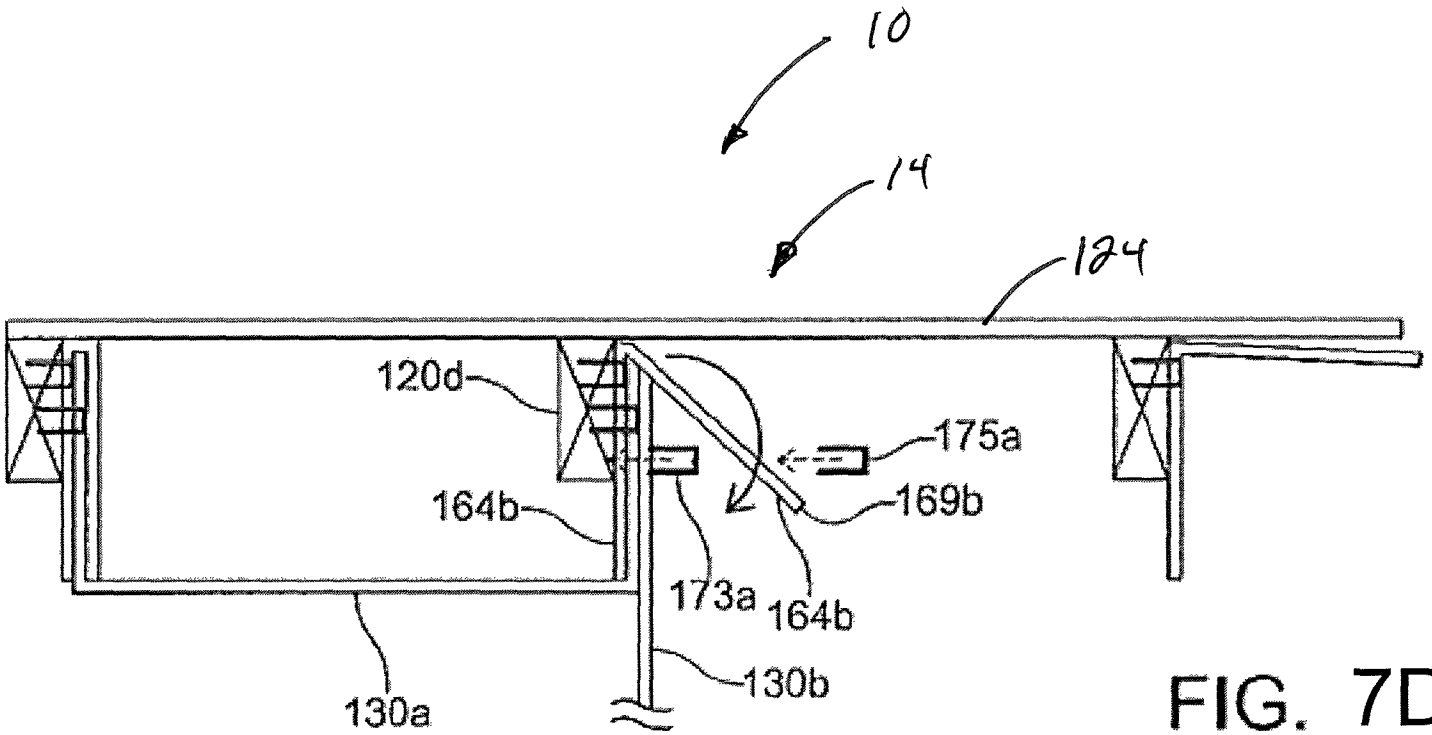
FIG. 7D is a partial front view, in elevation, of a building structure, illustrating initial installation of a second netting for the embodiment illustrated by FIG. 7A.

Referring now to FIG. 7D, once the first netting 130*a* is fastened to the support member 120*d*, a second netting 130*b* is positioned adjacent to the first netting 130*a* and fastened to the support member 120*d* with one or more fasteners 173*a*. After the second netting 130*b* is fastened to the support member 120*d*, a second leg 169*b* of the second clamp 164*b* is rotated such as to be positioned adjacent to the second netting 130*b* and the second leg 169*b* fastened to the support member 120*d* with one or more fasteners 175*a*.

Figure 7E:
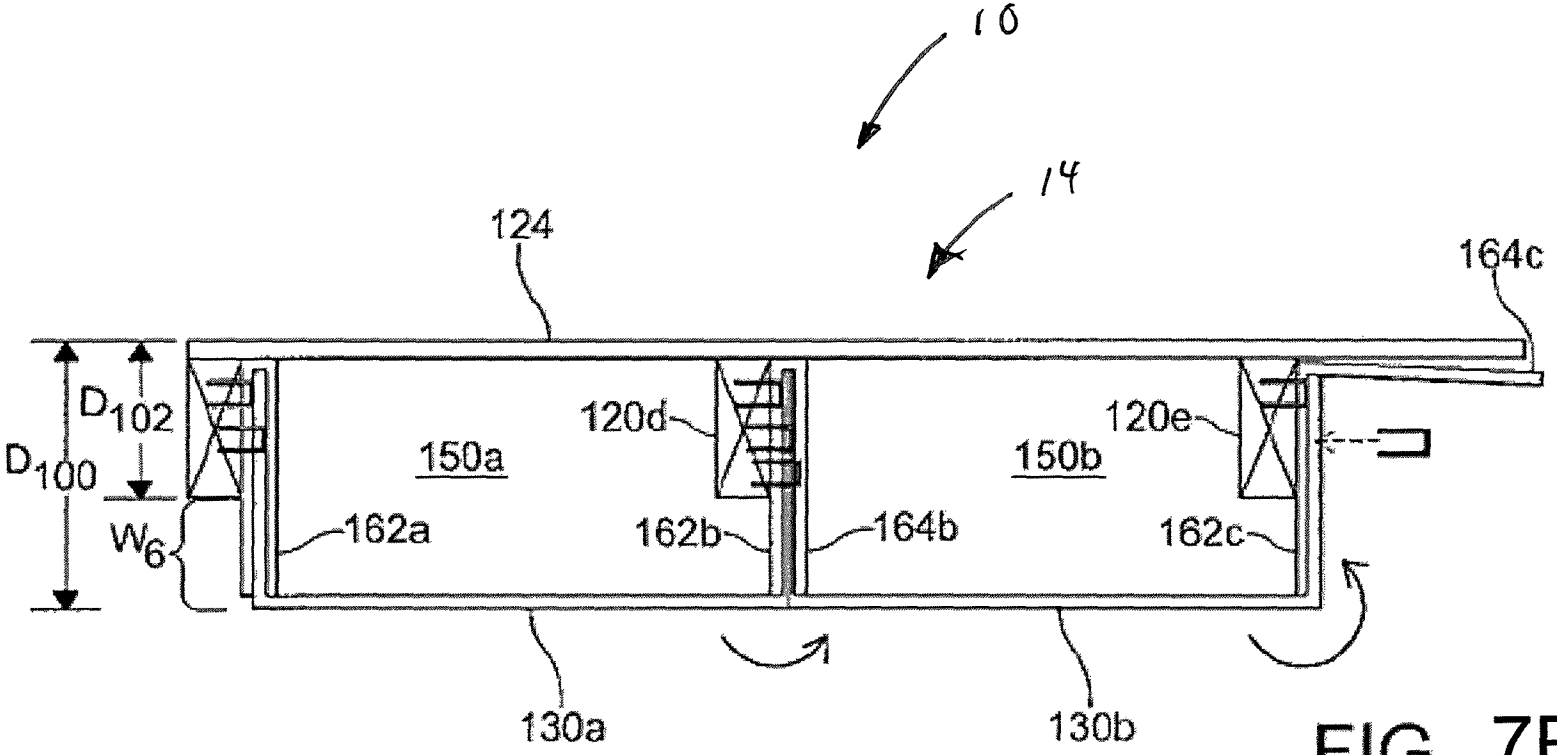
FIG. 7E is a partial front view, in elevation, of a building structure, illustrating completion of the second netting installation for the embodiment illustrated by FIG. 7A.

Referring now to FIG. 7E, the portion of the second netting 130*b* extending from the second clamp 164*b* is rotated in a counter-clockwise direction such that a portion of the second netting 130*b* is positioned adjacent to a first leg 162*c* of the third clamp 164*c*. The second netting 130*b* is fastened to the support member 120*e* as discussed above. In a repetitive manner, nettings and clamps are installed on the desired support members.

Referring again to FIG. 7*e*, the first clamp 162*a*, first netting 130*a*, support member 120*d*, second clamp 162*b* and sheathing panel 124 define a first insulation cavity 150*a*. Similarly, the second clamp 162*b*, second netting 130*b*, support member 120*e*, third clamp 162*c* and sheathing material 124 define a second insulation cavity 150*b*. As discussed above, a tension is imparted on the nettings 130*a*, 130*b*. Accordingly, the tensions result in the insulation cavities 150*a*, 150*b* having boxlike cross-sectional shapes that are substantially retained after loosefill insulation is blown into the insulation cavities 150*a*, 150*b*.

Figure 7F:
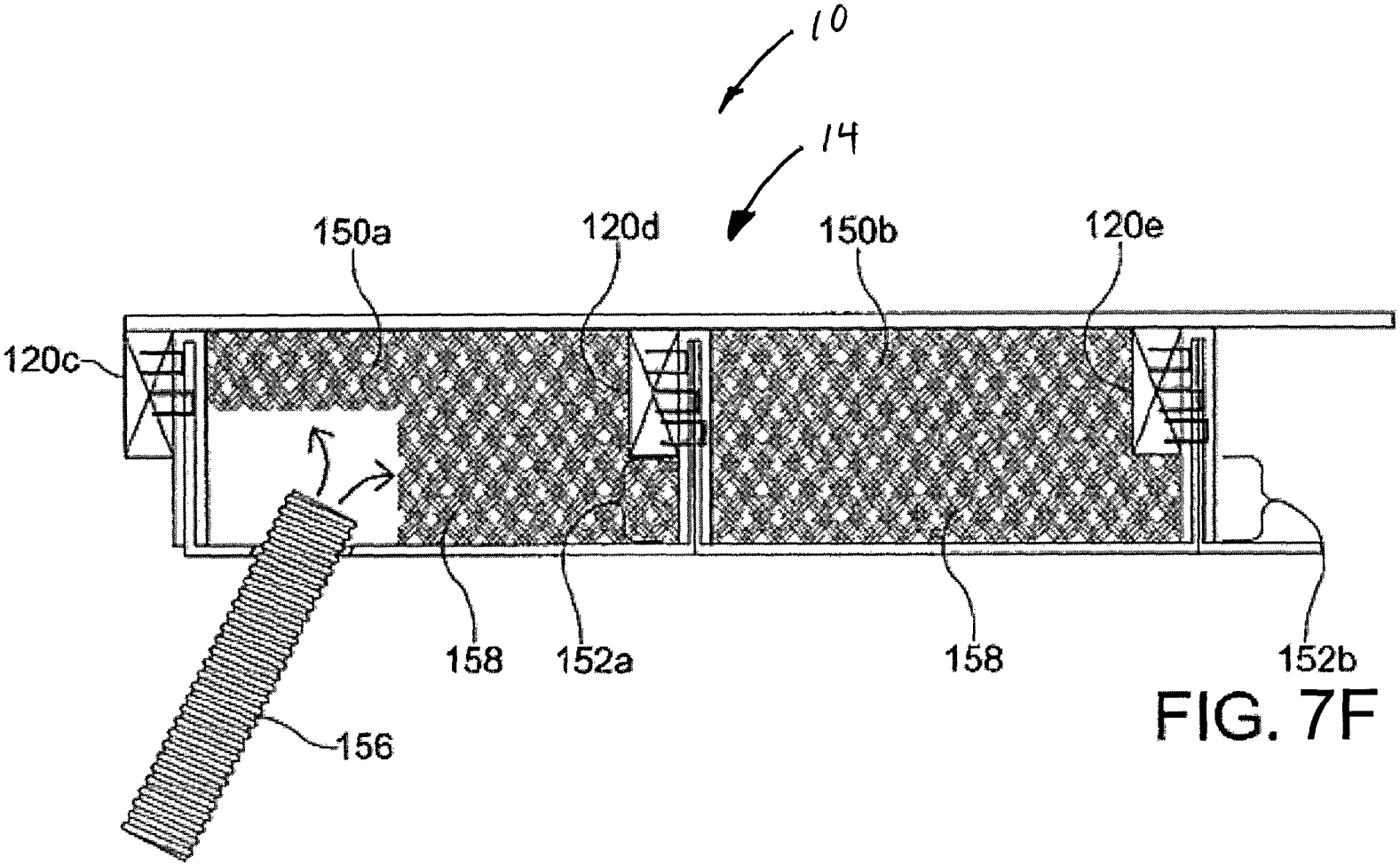
FIG. 7F is a partial front view, in elevation, of a building structure, illustrating distribution of loosefill insulation material within insulation cavities formed by the boxed netting insulation system of FIG. 7E.

Referring now to FIG. 7F, loosefill insulation 150 is distributed within the insulation cavities 150*a*, 150*b* by a distribution hose 156 and a blowing insulation machine (not shown) as discussed above. Referring again to FIG. 7E, the insulation cavities 150*a*, 150*b* has a depth D100. The depth D100 is defined as the total of the depth D102 of the support members 120*c*-120*e* and the width W6 of portions of the clamps 164*a*-164*c* that extend below the support members. The width W6 is adjustable such as to result in different depths D100 of the insulation cavity.

Referring again to FIG. 7F, a first insulation pocket 152*a* is formed as a portion of insulation cavity 150*a* and is located under support member 120*d*. A second insulation pocket 152*b* is famed as a portion of insulation cavity 150*b* and is located under support member 120*e*. Distributing loosefill insulation material 158 into the insulation cavities 150*a*, 150*b* results in loosefill insulation material filling the insulation pockets 152*a*, 152*b*. As the filled insulation pockets 152*a*, 152*b* are positioned below the support members 120*d*, 120*e*, the filled insulation pockets 152*a*, 152*b* are configured to insulate the support members 120*d*, 120*e*.

Referring again to FIGS. 7A-7F, the boxed netting insulation system provides the same advantages as previously discussed, namely, a uniform thickness of the loosefill insulation material, the depth of the insulation cavities can be adjusted to provide different depths of the loosefill insulation material and insulation pockets positioned below the support members are filled with loosefill insulation material, thereby insulating the support members.

Referring now to FIGS. 8A-8D, another method of forming insulation cavities is illustrated. Generally, this method entails use of fixture having shapes that defines a box-like perimeter over which nettings are positioned.

Figure 8A:
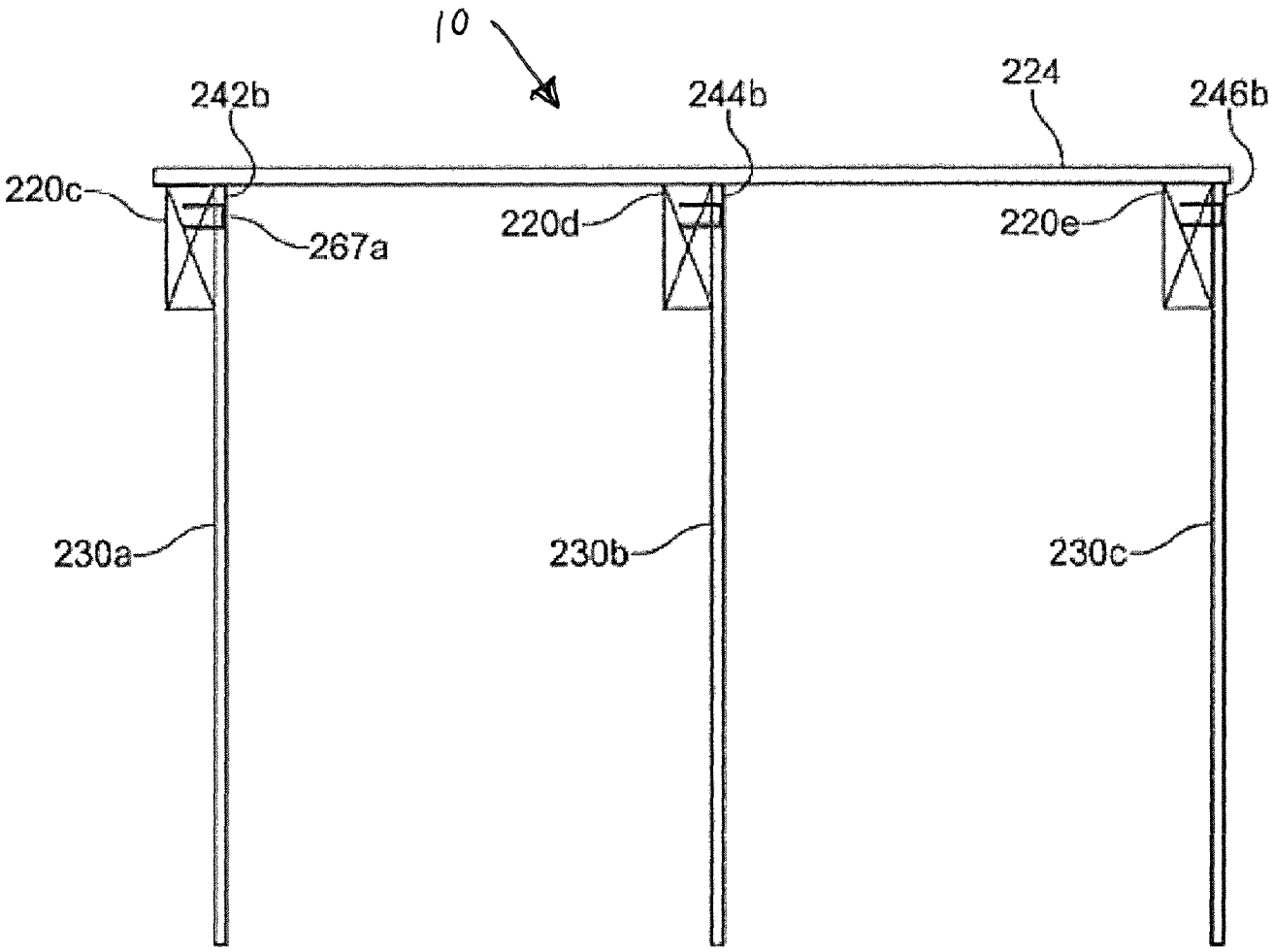
FIG. 8A is a partial front view, in elevation, of a building structure, illustrating initial installation of nettings for another embodiment of a boxed netting insulation system.

Referring first to FIG. 8A, support members 220*c*, 220*d*, and 220*e* and sheathing panel 224 are illustrated. In the illustrated embodiment, support members 220*c*, 220*d*, 220*e* and sheathing panel 224 are the same as, or similar to, support members 20*c*, 20*d*, 20*e* and sheathing panel 24 shown in FIG. 6 and described above. However, in other embodiments, support members 220*c*, 220*d*, 220*e* and sheathing panel 224 can be different from support members

20*c*, 20*d*, 20*e* and sheathing panel 24. Support member 220*c* has a major face 242*b*, support member 220*d* has a major face 244*b* and support member 220*e* has a major face 246*b*.

Referring again to FIG. 8A, a portion of a first netting 230*a* is positioned adjacent to the major face 242*b* of support member 220*c* and fastened to the support member 220*c* with one or more fasteners 267*a*. In a similar manner, portions of a second netting 230*b* and a third netting 230*c* are fastened to the support members 220*d*, 230*e* respectively.

Figure 8B:
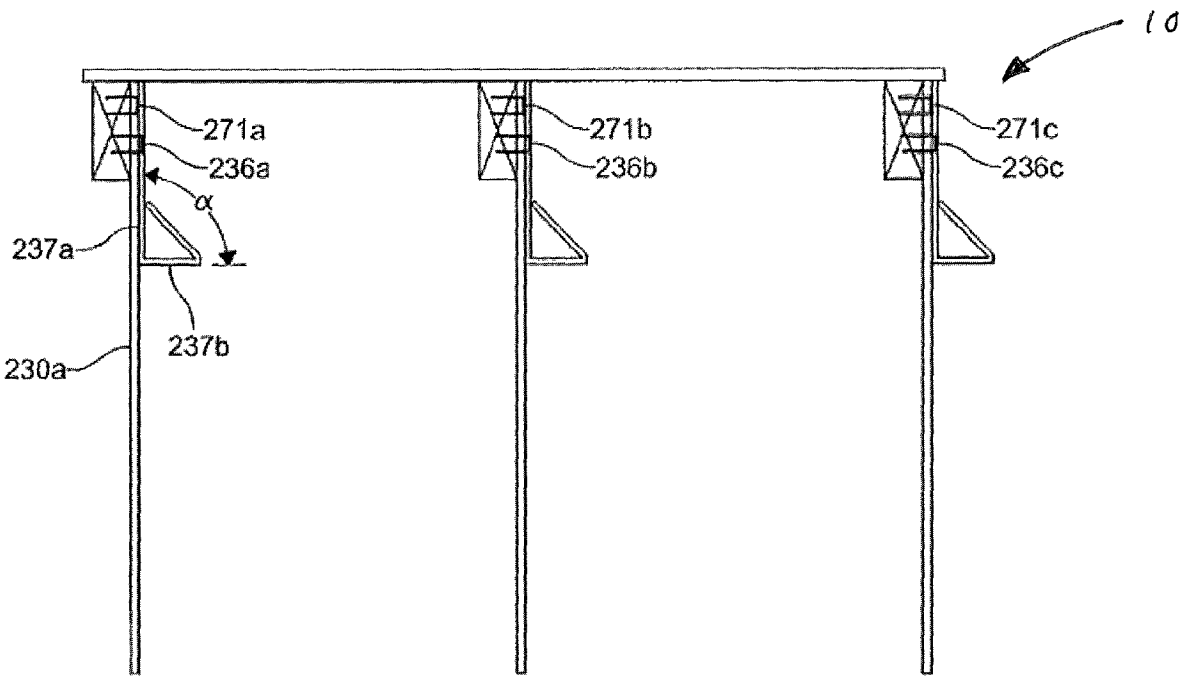
FIG. 8B is a partial front view, in elevation, of a building structure, illustrating initial installation of fixtures for the embodiment illustrated by FIG. 8A.

Referring now to FIG. 8B, after the first netting 230*a* is fastened to the support member 220*c*, a fixture 236*a* is positioned adjacent to the first netting 230*a* and fastened to the support member 220*c* with one or more fasteners 271*a*. In a similar manner, fixtures 236*b* and 236*c* are fastened to support members 220*d* and 220*e* respectively.

Figure 8E:
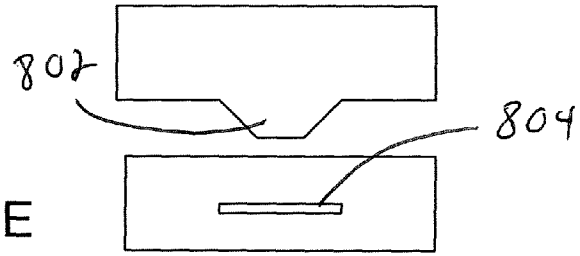
FIG. 8E illustrates a tongue and groove arrangement for forming the fixtures illustrated by FIGS. 8B-8D.

Referring again to FIG. 8B, a portion of the fixture 236*a* has the cross-sectional shape of a right triangle incorporating a base angle α and a base legs 237*a* and 237*b*. For example, the fixture may initially be a straight piece of rigid material, such as cardboard, that is bent to form the right triangle. Referring to FIGS. 8B and 8E, the triangle is held in place by inserting a tab 802 into a slot 804 in the fixture.

As will be discussed in more detail below, the base legs 237*a*, 237*b* and the base angle α a provide a perimeter around which the netting 230*a* is positioned, thereby forming a boxed insulation cavity. In the illustrated embodiment the base angle a is approximately 90°. In other embodiments, the base angle a can be more or less than about 90°, sufficient to allow the netting 230*a* to form a box shape. While the embodiment shown in FIG. 8B illustrates a portion of the fixture 236*a* as having the cross-sectional shape of a right triangle, in other embodiments, the fixture can incorporate other geometric cross-sectional shapes, such as for example a simple "L" cross-sectional shape sufficient to allow the netting 230*a* to form a box shape.

Figure 8C:
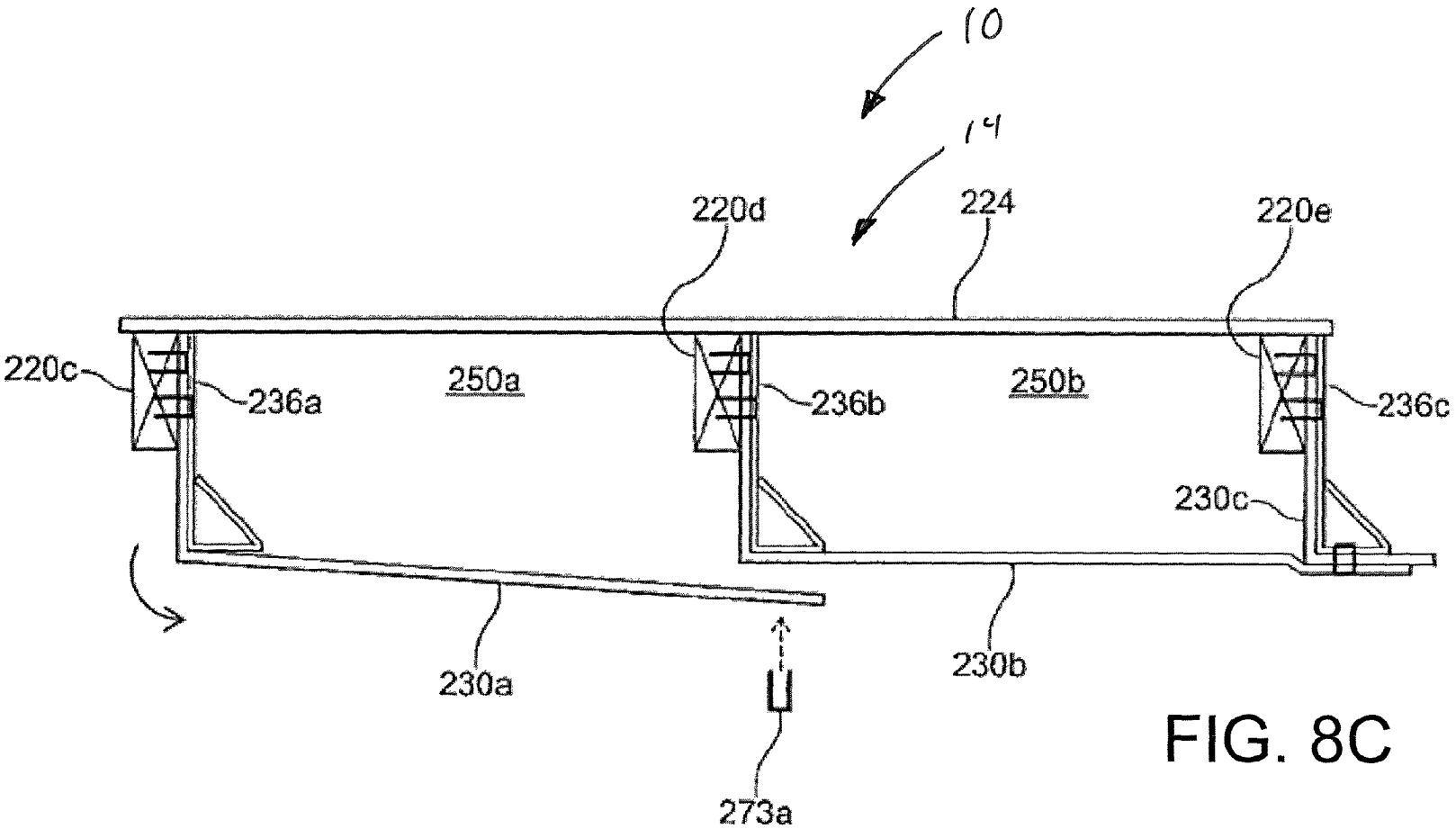
FIG. 8C is a partial front view, in elevation, of a building structure, illustrating installation of nettings over the fixtures of FIG. 8B.

Referring now to FIG. 8C, the first netting 230*a* and fixture 236*a* and a second netting 230*b* and fixtures 236*b*, 236*e* are illustrated. The second netting 230*b* is shown wrapped around the triangular portion of the fixture 236*b* and attached to the triangular portion of the fixture 236*c*. In a next assembly step, the first netting 230*a* is wrapped around the triangular portion of the fixture 236*a* and positioned over the second netting 230*b*. Finally the first netting 230*a* is attached to the triangular portion of the fixture 236*b* with a fastener 273*a* as discussed above. In a repetitive manner, nettings and fixtures are installed on the desired support members.

In the embodiment shown in FIGS. 8B and 8C, the fixtures 236*a*-236*c* are formed from structural cardboard. In other embodiments, the fixtures 236*a*-236*c* can be formed from other materials, such as the non-limiting example of reinforced fiberglass or polymeric-based materials sufficient to allow a netting to be wrapped around the fixture and form a box-shaped insulation cavity.

Referring again to FIG. 8C, the first fixture 236*a*, first netting 230*a*, support member 220*d*, second netting 230*b* and sheathing panel 224 define a first insulation cavity 250*a*. Similarly, the second fixture 236*b*, second netting 230*b*, support member 220*e*, third netting 230*c* and sheathing panel 224 define a second insulation cavity 250*b*. Fastening of the first netting 230*a* to the fixtures 236*a*, 236*b* imparts a tension on first netting 230*a* and fastening of the second netting 230*b* to the fixtures 236*b*, 236*c* imparts a tension on the second netting 230*b*. As discussed above, the tension on the nettings 230*a*, 230*b* results in the insulation cavities 250*a*, 250*b* having box-like cross-sectional shapes that are substantially retained after loosefill insulation is blown into the insulation cavities 250*a*, 250*b*.

Figure 8D:
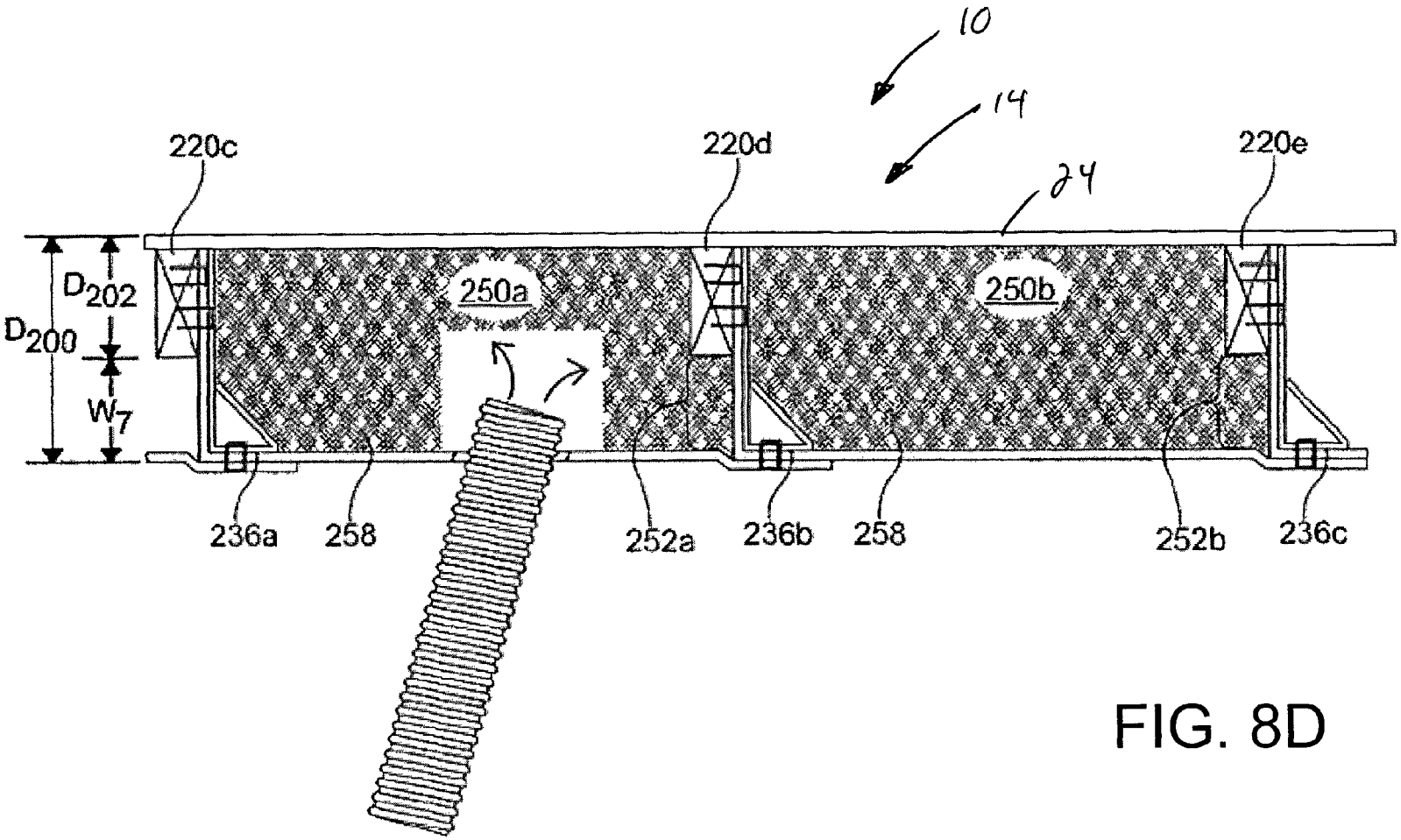
FIG. 8D is a partial front view, in elevation, of a building structure, illustrating distribution of loosefill insulation material within insulation cavities formed by the boxed netting insulation system of FIG. 8C.

Referring now to FIG. 8D, loosefill insulation 258 is distributed within the insulation cavities 250*a*, 250*b* as discussed above. The insulation cavities 250*a*, 250*b* have a depth D200. The depth D200 of is defined as the total of the depth D202 of the support members 220*e*-220*e* and the width W7 of the fixtures that extend below the support members. The width W7 is adjustable such as to result in different depths D200 of the insulation cavity.

As further shown in FIG. 8D, a first insulation pocket 252*a* is formed as a portion of insulation cavity 250*a* under support member 220*d*. A second insulation pocket 252*b* is formed as a portion of insulation cavity 250*b* under support member 220*e*. Distributing loosefill insulation material 258 into the insulation cavities 250*a*, 250*b* results in loosefill insulation material filling the insulation pockets 252*a*, 252*b*. As the filled insulation pockets 252*a*, 252*b* are located below the support members 220*d*, 220*e*, the filled insulation pockets 252*a*, 252*b* are configured to insulate the support members 220*d*, 220*e*.

Referring again to FIG. 8D, optionally the triangular portion of the fixtures 236*a*-236*c* could include openings (not shown). The openings can be configured to allow the distributed loosefill insulation material into the interior of the triangular portion of the fixtures 236*a*-236*c* such that the loosefill insulation material fills the interior of the triangular portion of the fixtures 236*a*-236*c*. In this manner, the insulation cavities 250*a*, 250*b* maintain a substantially uniform thickness of loosefill insulation material.

Referring again to FIGS. 8A-8D, the boxed netting insulation system provides the same advantages as previously discussed, namely, a uniform thickness of the loosefill insulation material, the depth of the insulation cavities can be adjusted to provide different depths of the loosefill insulation material and insulation pockets positioned below the support members are filled with loosefill insulation material, thereby insulating the support members.

Figure 9A:
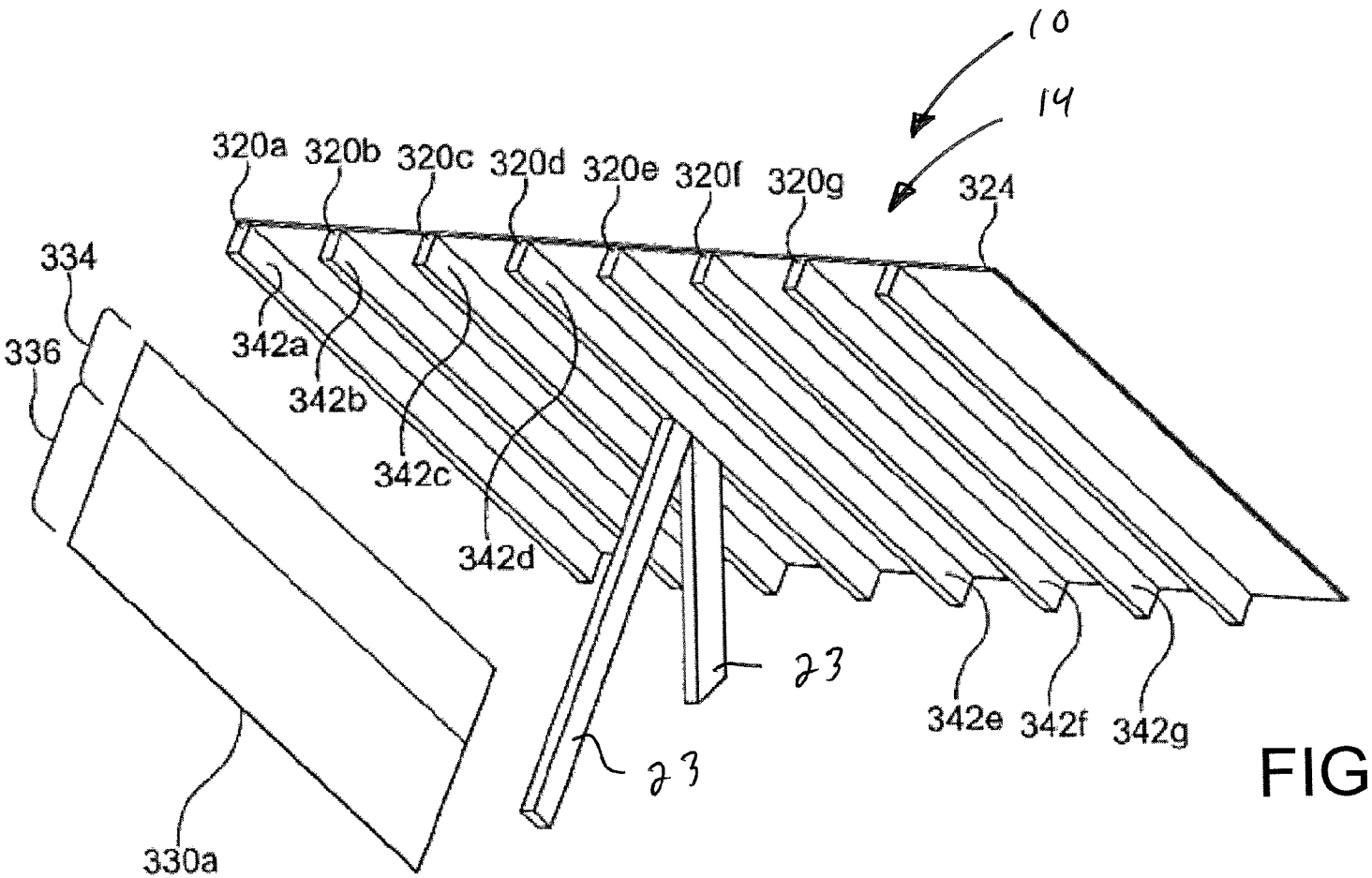
FIG. 9A is a partial perspective view, of a building structure, illustrating initial installation of a rigid membrane for another embodiment of a boxed netting insulation system.
Figure 9B:
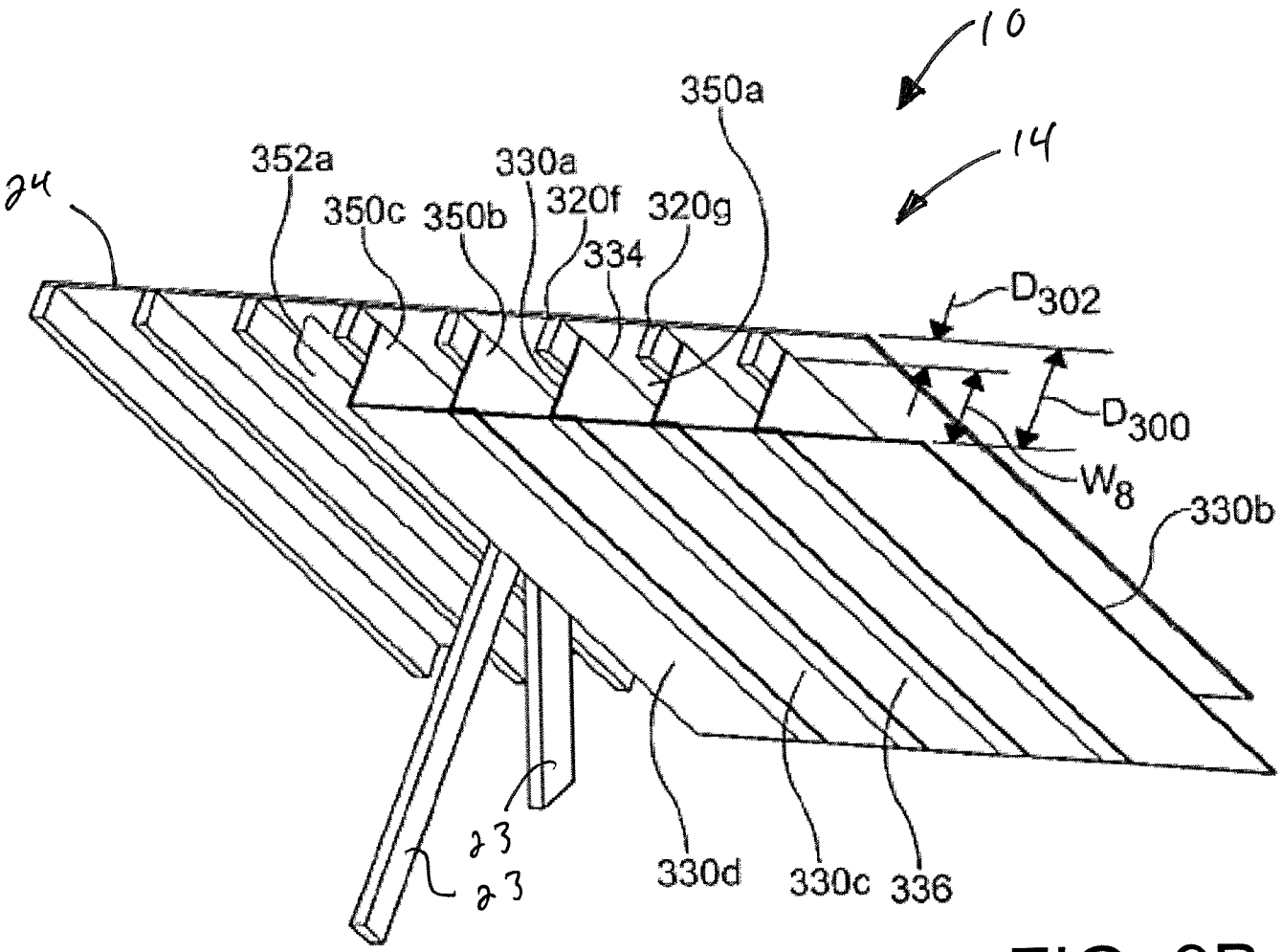
FIG. 9B is a partial perspective view, of a building structure, illustrating insulation cavities formed from the rigid membranes of FIG. 9A.

Referring now to FIGS. 9A and 9B, another method of forming boxed insulation cavities is illustrated. Generally, this method entails use of substantially rigid membranes as nettings. The rigid membranes are formed into shapes that subsequently define box-like insulation cavities in an installed position.

Referring first to FIG. 9A, support members 320*a*-320*g* and sheathing panel 324 are illustrated. In the illustrated embodiment, support members 320*a*-320*g* and sheathing panel 324 are the same as, or similar to, support members 20*c*, 20*d*, 20*e* and sheathing panel 24 shown in FIG. 6 and described above. However, in other embodiments, support members 320*a*-320*g* and sheathing panel 324 can be different from support members 20*c*, 20*d*, 20*e* and sheathing panel 24. Support members 320*a*-320*g* have major faces 342*a*-342*g* respectively.

Referring again to FIG. 9A, a membrane 330*a*, which may be a rigid membrane is illustrated. The membrane 330*a* includes a side panel segment 334 and a span segment 336. Referring now to FIG. 9B, the side panel segment 334 of rigid membrane 330*a* is positioned adjacent to the major face 342*f* of support member 320*f* and fastened to the support member 320*f* with one or more fasteners (not shown). The rigid membrane 330*a* is bent such that the side panel segment 334 and the span segment 336 form an approximate right angle with each other. The span segment 336 spans the distance between adjacent support members 320*f*, 320*g* and is subsequently fastened to a previously installed rigid membrane 330*b* with any desired fasteners (not shown). In a repetitive manner, additional rigid membranes 330*c*, 330*d* are installed on the desired support members.

As shown in FIG. 9B, the approximate right angles formed between the side panel segments and the span segments define box-shaped insulation cavities 350*a*-350*c*. The membranes may be formed from a wide variety of different materials. In one exemplary embodiment shown in FIGS. 9A and 9B, the membranes are formed from a structural cardboard material. The structural cardboard material is configured to retain the box-like cross-sectional shape of the insulation cavity after the loosefill insulation material is distributed into the formed insulation cavities. In other embodiments, the rigid membranes can be formed from other materials, such as the non-limiting example of reinforced fiberglass or polymeric-based materials sufficient to form a box-shaped insulation cavity.

Referring again to FIG. 9B, the insulation cavities 350*a*-350*c* have a depth D300. The depth D300 is defined as the total of the depth D302 of the support members 320*a*-320*g* and the width W8 of the side panel segments 334 that extend below the support members. The width W8 is adjustable such as to result in different depths D300 of the insulation cavities.

As further shown in FIG. 9B, a first insulation pocket 352*a* is formed as a portion of insulation cavity 350*a* and is located under support member 320*g*. Similarly, other insulation pockets are formed as portions of the insulation cavities and are located under the support members. Distributing loosefill insulation material (not shown) into the insulation cavities results in loosefill insulation material filling the insulation pockets. As the filled insulation pockets are located below the support members, the filled insulation pockets are configured to insulate the support members.

Referring again to FIGS. 9A and 9B, the netting insulation system provides the same advantages as previously discussed, namely, a uniform thickness of the loosefill insulation material, the depth of the insulation cavities can be adjusted to provide different depths of the loosefill insulation material and insulation pockets located below the support members are filled with loosefill insulation material, thereby insulating the support members.

Figure 10A:
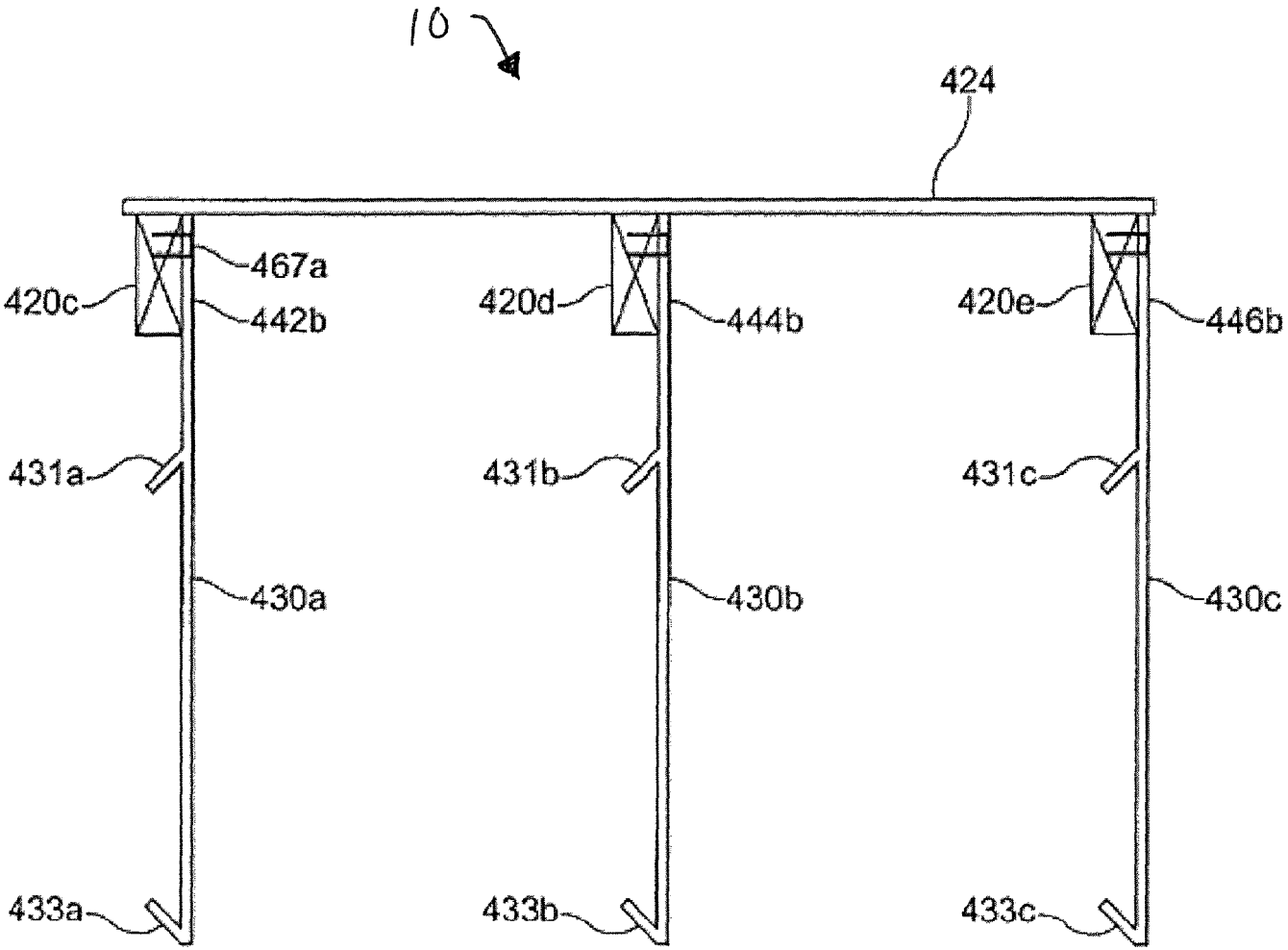
FIG. 10A is a partial front view, in elevation, of a building structure, illustrating initial installation of netting for another embodiment of a boxed netting insulation system.
Figure 10B:
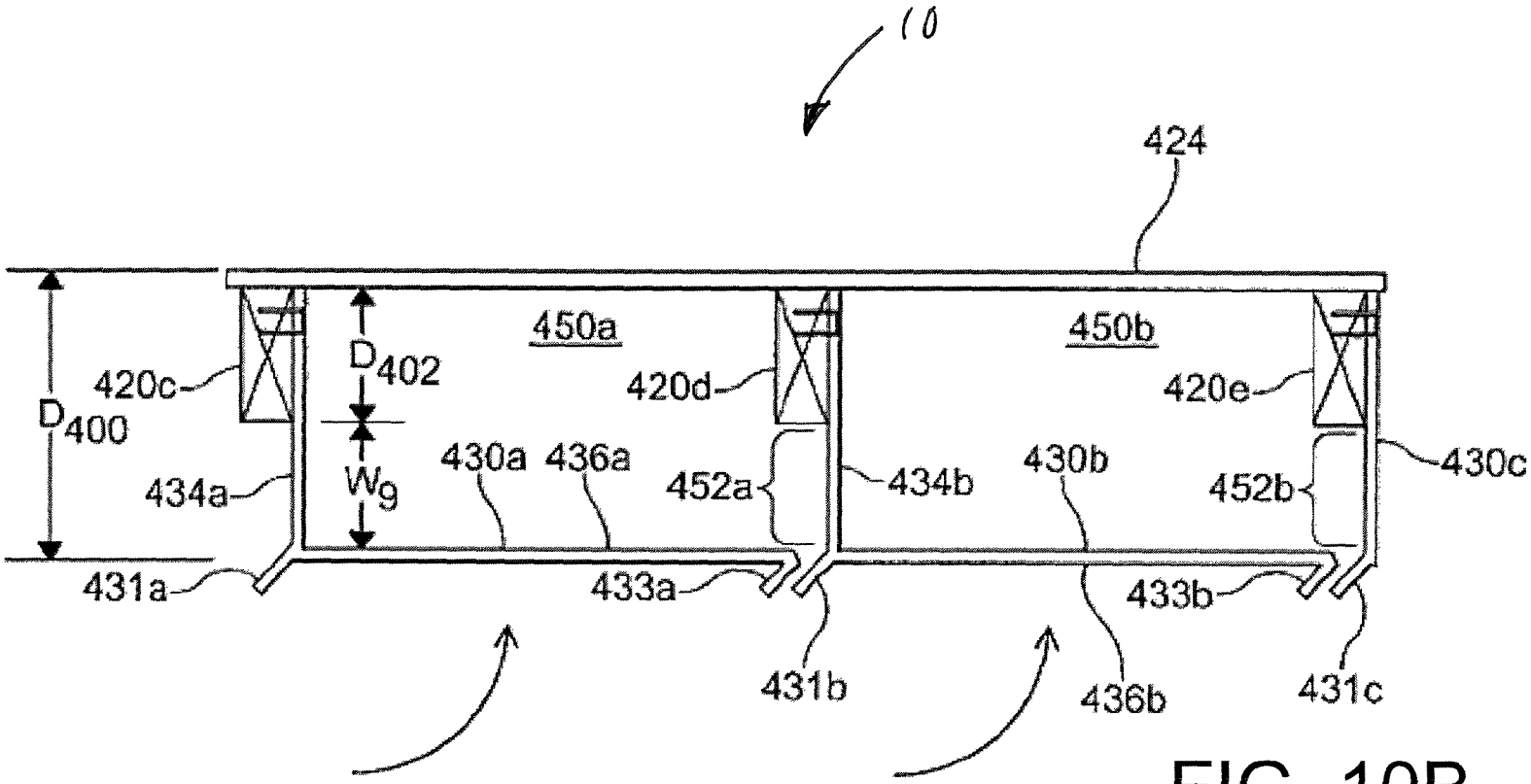
FIG. 10B is a partial front view, in elevation, of a building structure, illustrating completed installation of the netting of FIG. 10A.

Referring now to FIGS. 10A and 10B, another method of forming boxed insulation cavities is illustrated. Generally, this method entails use of interconnecting, substantially rigid members and/or flexible material such as netting, for example, the netting 30 described in the embodiments illustrated by FIGS. 2A, 2B and 3-6 to form box-shaped insulation cavities. The interconnecting material may take a wide variety of different forms and may take a wide variety of different configurations. For example, rigid interconnecting material may comprise cardboard, plastic, and the like. The netting material 30 may comprise a plastic film, a mesh, combinations of plastic film and mesh, and the like. In one exemplary embodiment, the netting material may be a breathable material, a vapor barrier, a vapor retarder, and/or an air barrier material.

Referring first to FIG. 10A, support members 420*c*, 420*d*, and 420*e* and sheathing panel 424 are illustrated. In the illustrated embodiment, support members 420*c*, 420*d*, 420*e* and sheathing panel 424 are the same as, or similar to, support members 20*c*, 20*d*, 20*e* and sheathing panel 24 shown in FIG. 6 and described above. However, in other embodiments, support members 420*c*, 420*d*, 420*e* and sheathing panel 424 can be different from support members 20*c*, 20*d*, 20*e* and sheathing panel 24. Support member 420*c* has a major face 442*b*, support member 420*d* has a major face 444*b* and support member 420*e* has a major face 446*b*.

Referring again to FIG. 10B, interconnecting portions 430*a*, 430*b* and 430*c* are illustrated. Part of interconnection portion 430*a* is positioned adjacent to the major face 442*b* of support member 420*c* and fastened to the support member 420*c* with one or more fasteners 467*a*. However, as noted above, the netting, such as the interconnecting portion 430*a* can be connected to an portion of the support member 420*c* and/or to the roof sheathing 24. In a similar manner, interconnection portions 430*b*, 430*c* are fastened to the support members 420*d*, 430*e* respectively.

Interconnecting portion 430*a* has an optional first tab 431*a* spaced apart from an optional second tab 433*a*. Similarly, interconnecting portions 430*b*, 430*c* may have optional first tabs 431*b*, 431*c* spaced apart from optional second tabs 433*b*, 433*c*. As will be discussed in more detail below, the optional first tabs 431*a*-431*c* are configured for attachment to the second tabs 433*a*-433*c*, thereby forming box-shaped insulation cavities. In one exemplary embodiment, the second tabs 433*a*-433*c* are omitted and the first tabs 431*a*-431*c* are connected to ends 1000 of the interconnecting portions 430*a*-430*c*.

Referring now to FIG. 10B, after the first interconnecting portion 430*a* has been fastened to the support member 420*c*, the first interconnecting portions 430*a* is bent or folded at a point below the first tab 431*a* and a span segment 436*a* is rotated in a counterclockwise direction such that second tab 433*a* aligns with the first tab 431*b* of the second interconnecting portion 430*b*. The second tab 433*a* and the first tab 431*b* are attached together with any desired fastener (not shown). In a similar manner, after the second interconnecting portion 430*b* is fastened to the support member 420*d*, the second interconnecting portion 430*b* is bent or folded at a point below the first tab 431*b* and a span segment 436*b* is rotated in a counterclockwise direction such that second tab 433*b* aligns with the first tab 431*c* of the third interconnecting portion 430*c*. The second tab 433*b* and the first tab 431*c* are attached together with any desired fastener (not shown). As noted above, the second tabs 433*a*-433*c* can be omitted and the first tabs 431*a*-431*c* can be connected to ends 1000 of the interconnecting portions 430*a*-430*c*.

Referring again to FIG. 10B, when made from a rigid material, interconnecting portion 430*a* is bent such that a side panel segment 434*a* and the span segment 436*a* form an approximate right angle with each other. Also, the span segment 436*a* forms an approximate right angle with the side panel segment 434*b* of the second right member 430*b*. As shown in FIG. 10B, the approximate right angles formed between the side panels segments 434*a*, 434*b* with the span segment 436*a* defines a box-shaped insulation cavity 450*a*. In a repetitive manner, the interconnecting portions 430*b*, 430*c* are bent or folded such that first tabs 431*b*, 431*c* are connected to corresponding second tabs or ends 1000.

In one exemplary embodiment the interconnecting portions shown in FIGS. 10A and 10B, are formed from a rigid material structural cardboard material. The rigid material, such as structural cardboard material is configured to retain the box-like cross-sectional shape of the insulation cavity after the loosefill insulation material is distributed into the formed insulation cavities. In other embodiments, the interconnecting portions can be formed from other materials, such as the non-limiting example of reinforced fiberglass or polymeric-based materials sufficient to form a box-shaped insulation cavity. In still other embodiments, the interconnecting portions 430*a*-430*c* can be formed from flexible materials, such as for example, the netting 30 illustrated in FIG. 2A and described above. In this embodiment, the tabs of the flexible members 430*a*-430*c* can be fastened together in the same, or similar, manner as illustrated in FIG. 5 and described above. In some exemplary embodiments, the interconnecting portions are made from more than one different material. For example, the span segments 436 may be made from a flexible material and the side panel segments 434 may be made from a rigid material. As another example, the span segments 436 may be made from an air barrier material, a vapor barrier material, and/or a vapor retarder material, while the side panel segments 434 are made from a breathable material, an open netting, or a mesh.

Referring again to FIG. 10B, insulation cavities 450*a*, 450*b* have a depth D400. The depth D400 is defined as the total of the depth D402 of the support members 420*c*-420*e* and the widths W9 of the material that extends below the support members. The widths W9 are adjustable such as to result in different depths D400 of the insulation cavities.

As further shown in FIG. 10B, a first insulation pocket 452*a* is formed as a portion of insulation cavity 450*a* and located under support member 420*b*. Similarly, other insulation pockets are formed as portions of the insulation cavities and are located under the support members. Distributing loosefill insulation material (not shown) into the insulation cavities results in loosefill insulation material filling the insulation pockets. As the filled insulation pockets are located below the support members, the filled insulation pockets are configured to insulate the support members.

Referring again to FIGS. 10A and 10B, the boxed netting insulation system provides the same advantages as previously discussed, namely, a uniform thickness of the loosefill insulation material, the depth of the insulation cavities can be adjusted to provide different depths of the loosefill insulation material and insulation pockets positioned below the support members are filled with loosefill insulation material.

Figure 11A:
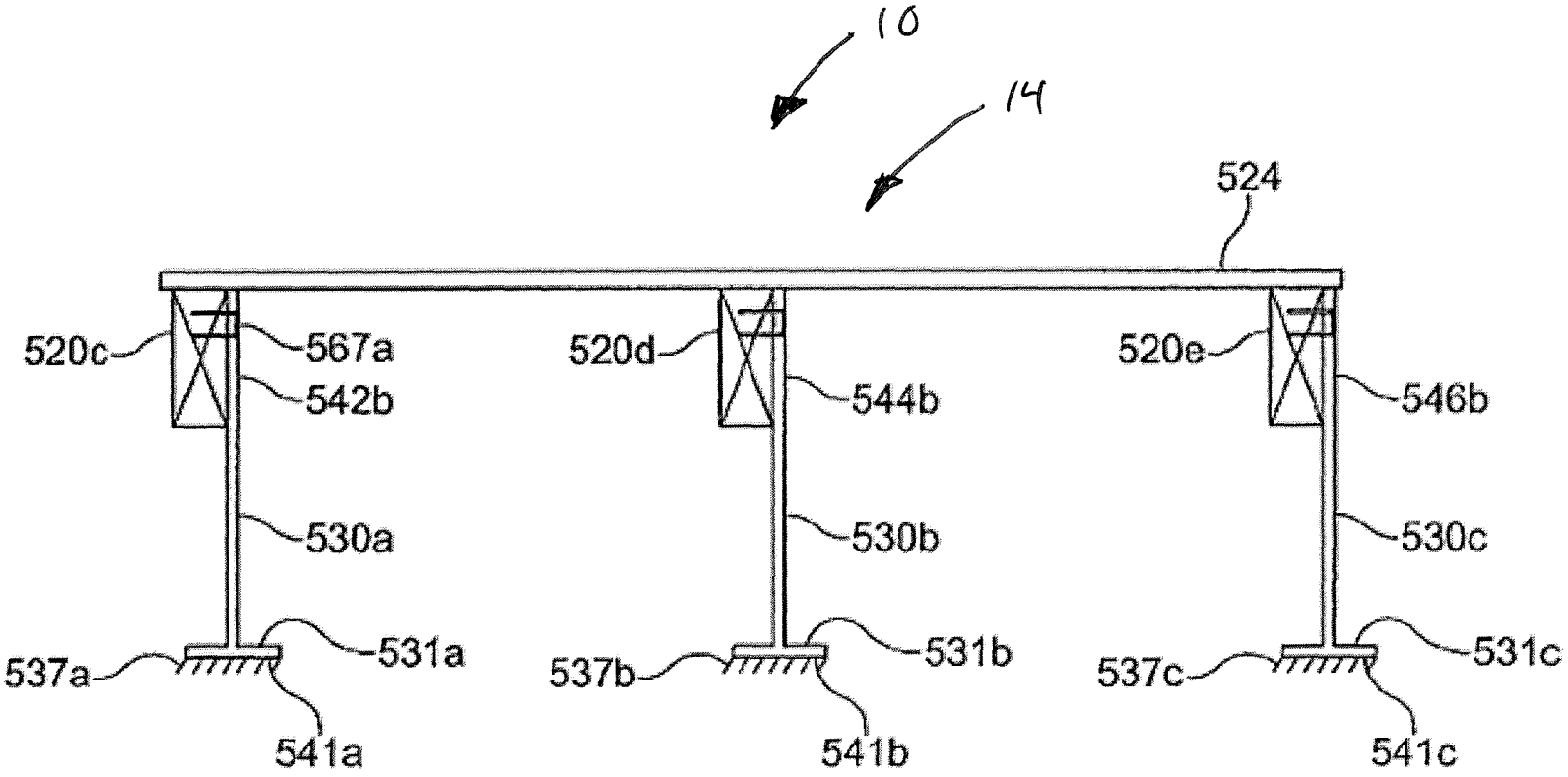
FIG. 11A is a partial front view, in elevation, of a building structure, illustrating initial installation of rigid members for another embodiment of a boxed netting insulation system.
Figure 11B:
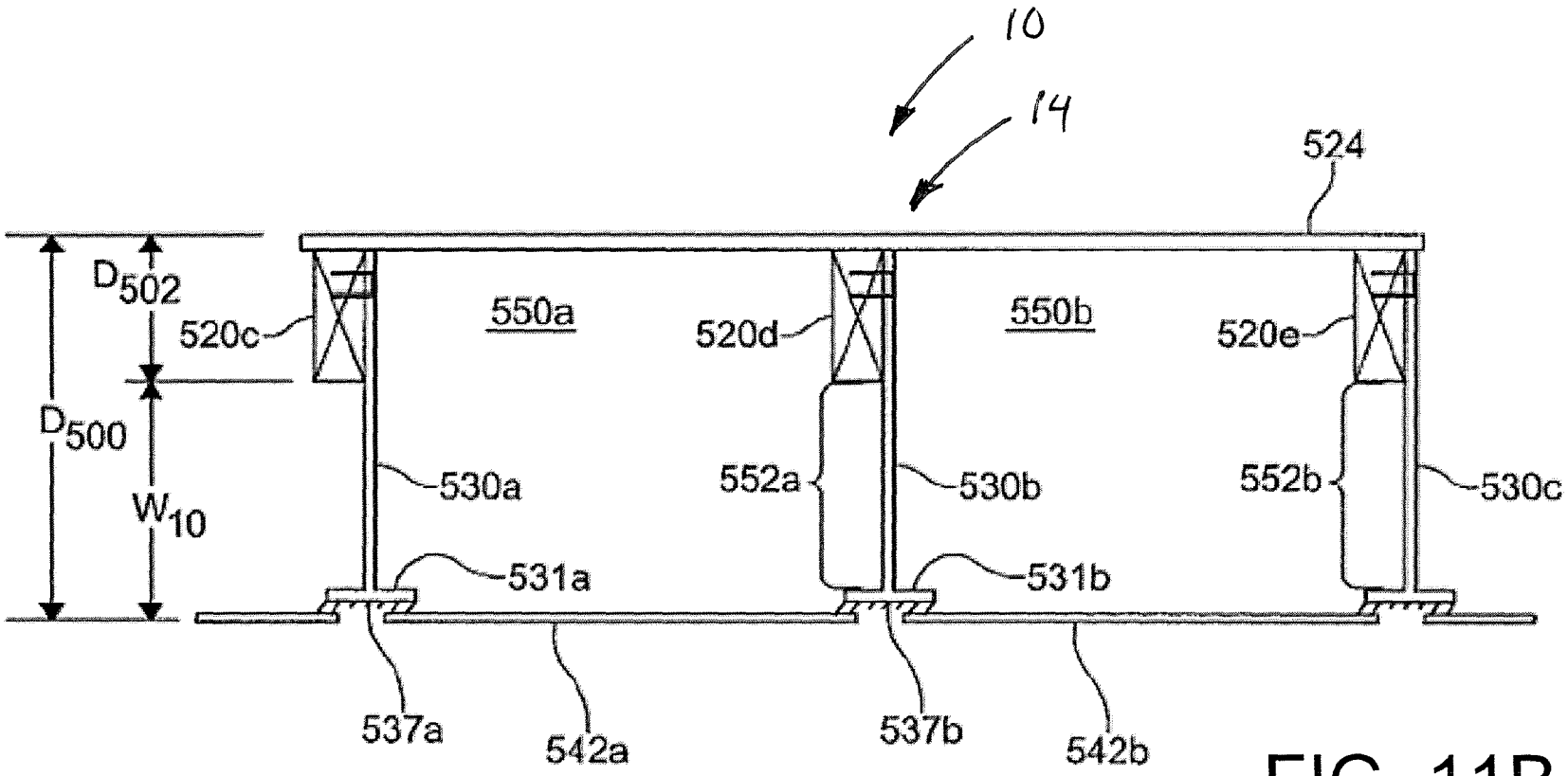
FIG. 11B is a partial front view, in elevation, of a building structure, illustrating completed installation of the rigid members of FIG. 11A.

Referring now to FIGS. 11A and 11B, another method of forming boxed insulation cavities is illustrated. Generally, this method entails use of T-shaped members and hook fasteners to form box-shaped insulation cavities. Referring first to FIG. 11A, support members 520*c*, 520*d*, and 520*e* and sheathing panel 524 are illustrated. In the illustrated embodiment, support members 520*c*, 520*d*, 520*e* and sheathing panel 524 are the same as, or similar to, support members 20*c*, 20*d*, 20*e* and sheathing panel 24 shown in FIG. 6 and described above. However, in other embodiments, support members 520*c*, 520*d*, 520*e* and sheathing panel 524 can be different from support members 20*c*, 20*d*, 20*e* and sheathing panel 24. Support member 520*c* has a major face 542*b*, support member 520*d* has a major face 544*b* and support member 520*e* has a major face 546*b*.

Referring again to FIG. 11A, rigid members 530*a*, 530*b* and 530*c* are illustrated. A portion of rigid member 530*a* is positioned adjacent to the major face 542*b* of support member 520*c* and fastened to the support member 520*c* with one or more fasteners 567*a*. In a similar manner, portions of rigid member 530*b* and rigid member 530*c* are fastened to the support members 520*d*, 530*e* respectively.

Rigid member 530*a* has a segment 531*a* positioned at an end of the rigid member 530*a*. As shown in FIG. 11A, the rigid member 530*a* and the segment 531*a* have a cross-sectional shape of an inverted "T". As shown in FIG. 11B, the inverted T cross-sectional shape of the rigid member 530*a*, coupled with the netting 542*a* combine to form a boxed insulation cavity. While the embodiment shown in FIG. 11A illustrates the inverted "T" cross-sectional shape of the rigid member 530*a*, in other embodiments, the rigid member can incorporate other geometric cross-sectional shapes, such as for example, a simple "L" cross-sectional shape sufficient to combine with the netting 542*a* to form a boxed insulation cavity.

The segment 531*a* includes a plurality of "hook" fasteners 537*a* positioned on a major face 541*a*. It should be apparent that "loop" fasteners could be on the face 541*a*, instead of the hook fasteners. The netting 542*a* may include corresponding loop fasteners, hook fasteners, or be made from a material that attaches to hook fasteners. Some hook and loop fastening systems are referred to as velcro. As will be discussed in more detail below, the hook or loop fasteners 537*a* are configured for attachment to a netting (not shown), thereby forming box-shaped insulation cavities. In a similar manner, rigid members 530*b*, 530*c* have segments 531*b*, 531*c* positioned at the ends of the rigid members 530*b*, 530*c*. The segments 531*b*, 531*c* include a plurality of "hook" or loop fasteners 537*b*, 537*c* positioned on major faces 541*b*, 541*c*.

Referring now to FIG. 11B, after the rigid members 530*a*-530*c* have been fastened to the support members 520*c*-520*e*, a first netting 542*a* is positioned to span the segments 531*a*, 531*b* and engage the hook or loop fasteners 537*a*, 537*b*, such that a tension is formed in the netting 542*a*. In a similar manner, subsequent nettings are positioned to span other segments and engage hook or loop fasteners such that a tension is formed in each of the nettings. The tension imparted on the nettings results in the rigid members and the nettings forming insulation cavities 550*a*, 550*b* having box-like cross-sectional shapes that are substantially retained after loosefill insulation is blown into insulation cavities 550*a*, 550*b*.

In the illustrated embodiment, the nettings 542*a*, 542*b* constitute the "loop" portion of the hook and loop fastening to the rigid members 530*a*-530*c*. In certain embodiments, the material forming the nettings 542*a*, 542*b* can having naturally occurring loops sufficient to provide the loop function. In other embodiments, the material forming the nettings 542*a*, 542*b* can be roughened to form loops sufficient to provide the loop function. In still other embodiments, additional materials can be added to the nettings 542*a*, 542*b* sufficient to provide the loop or hook function. One non-limiting example of an additional material is a strip of material having loops or hooks that is fastened to the nettings 542*a*, 542*b*.

In the embodiment shown in FIGS. 11A and 11B, the rigid members are formed from a structural cardboard material. The structural cardboard material is configured to retain the box-like cross-sectional shape of the insulation cavity after the loosefill insulation material is distributed into the formed insulation cavities. In other embodiments, the rigid membranes can be formed from other materials, such as the non-limiting example of reinforced fiberglass or polymeric-based materials sufficient to form a box-shaped insulation cavity.

Referring again to FIG. 11B, insulation cavities 550*a*, 550*b* each have a depth D500. The depth D500 is defined as the total of the depth D502 of the support members 520*c*-520*e* and the width W10 of the rigid members that extend below the support members. The width W10 is adjustable such as to result in different depths D500 of the insulation cavities.

Referring again to FIG. 11B, a first insulation pocket 552*a* is formed as a portion of insulation cavity 550*a* and located under support member 520*d*. Similarly, other insulation pockets are formed as portions of the insulation cavities and located under the support members. Distributing loosefill insulation material (not shown) into the insulation cavities results in loosefill insulation material filling the insulation pockets. As the filled insulation pockets are positioned below the support members, the filled insulation pockets are configured to insulate the support members.

Referring again to FIGS. 11A and 11B, the boxed netting insulation system provides the same advantages as previously discussed, namely, a uniform thickness of the loosefill insulation material, the depth of the insulation cavities can be adjusted to provide different depths of the loosefill insulation material and insulation pockets located below the support members are filled with loosefill insulation material, thereby insulating the truss cords.

Referring now to FIGS. 11C-11H, another method of forming boxed insulation cavities is illustrated. Generally, this method entails use of L-shaped members 1130 with pre-installed insulation support material 30 and optional hook fasteners to form box-shaped insulation cavities 50. Support members 20 and sheathing panel 24 may be the same as, or similar to, support members 20 and sheathing panel 24 shown and described above elsewhere in the present application. However, the support members 20 and sheathing panels 524 can take a wide variety of different forms.

Figure 11F:
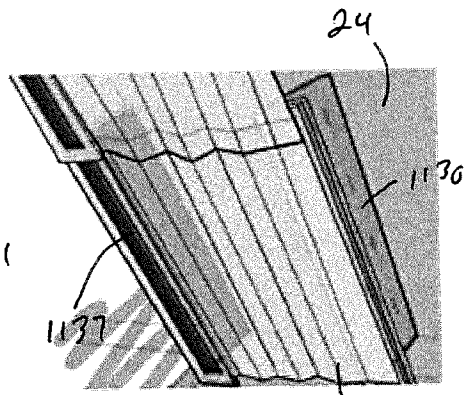
FIG. 11F is a perspective view that illustrates securing of insulation support material to the support members in the system of FIG. 11C.
Figure 11E:
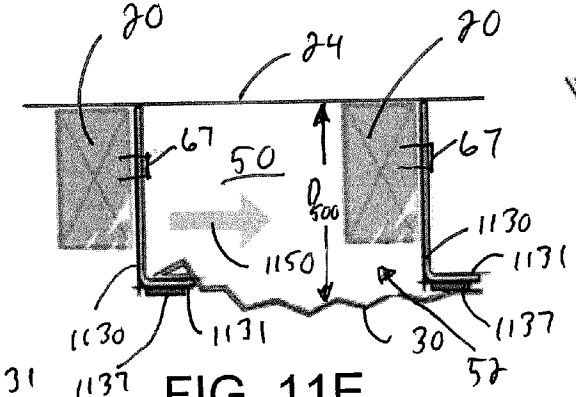
FIG. 11E is an end view that illustrates securing of insulation support material to the support members in the system of FIG. 11C.

Referring to FIG. 11E, rigid members 1130 have a portion positioned adjacent to a support member 20 and fastened to the support member 20 with one or more fasteners 67. Each rigid member 1130 has a segment 1131 positioned at an end of the rigid member 1130. As shown in FIG. 11E, the rigid member 1130 and the segment 1131 have a cross-sectional shape of an "L". As shown in FIG. 11E, the "L" cross-sectional shape of the rigid member 1130, coupled with the pre-installed insulation support material combine to form a boxed insulation cavity. While the embodiment shown in FIG. 11E illustrates the "L" cross-sectional shape of the rigid member 1130, in other embodiments, the rigid member can incorporate other geometric cross-sectional shapes, such as for example, a simple inverted "T" cross-sectional shape sufficient to combine with the pre-installed netting to form a boxed insulation cavity.

In the example illustrated by FIGS. 11C-11H, the segment 1131 optionally includes a plurality of "hook" fasteners 1137 positioned on a the segment 1131. It should be apparent that "loop" fasteners could be on the segment 1131, instead of the hook fasteners. The pre-installed insulation support material 30 may include corresponding loop fasteners, hook fasteners, or be made from a material that attaches to hook fasteners. Some hook and loop fastening systems are referred to as velcro.

Figure 11H:
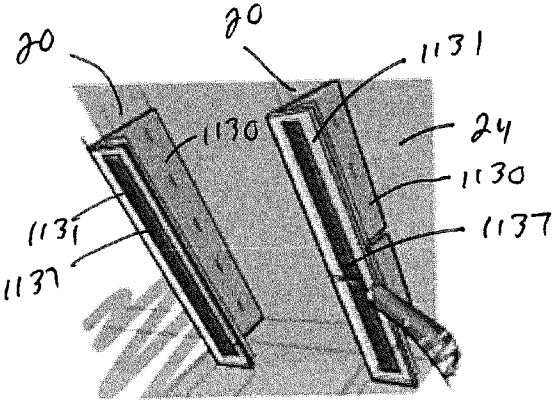
FIG. 11H is a perspective view illustrating that the support members of the FIG. 11C embodiment can be cut to fit around webs of truss support members.
Figure 11D:
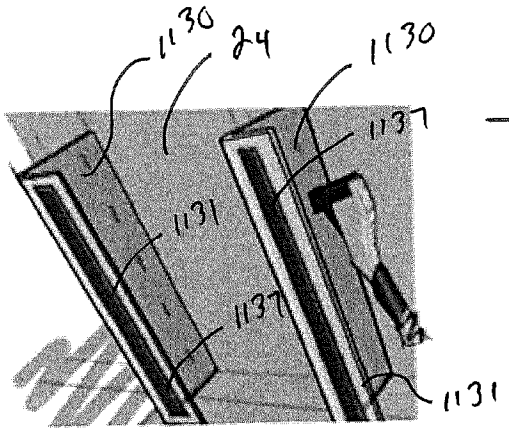
FIG. 11D is a perspective view that illustrates securing of support members to the building structure in the system of FIG. 11C.
Figure 11G:
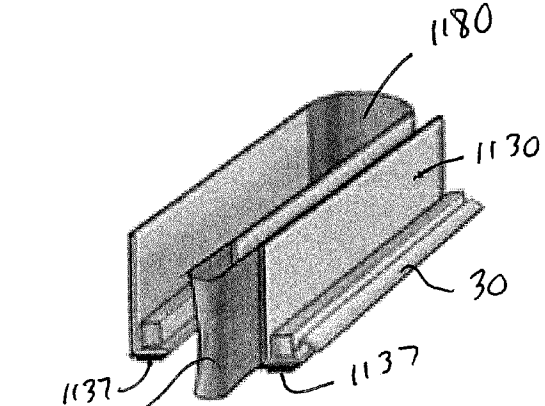
FIG. 11G is a perspective view illustrating that the support members of the FIG. 11C embodiment can be interconnected.
Figure 11C:
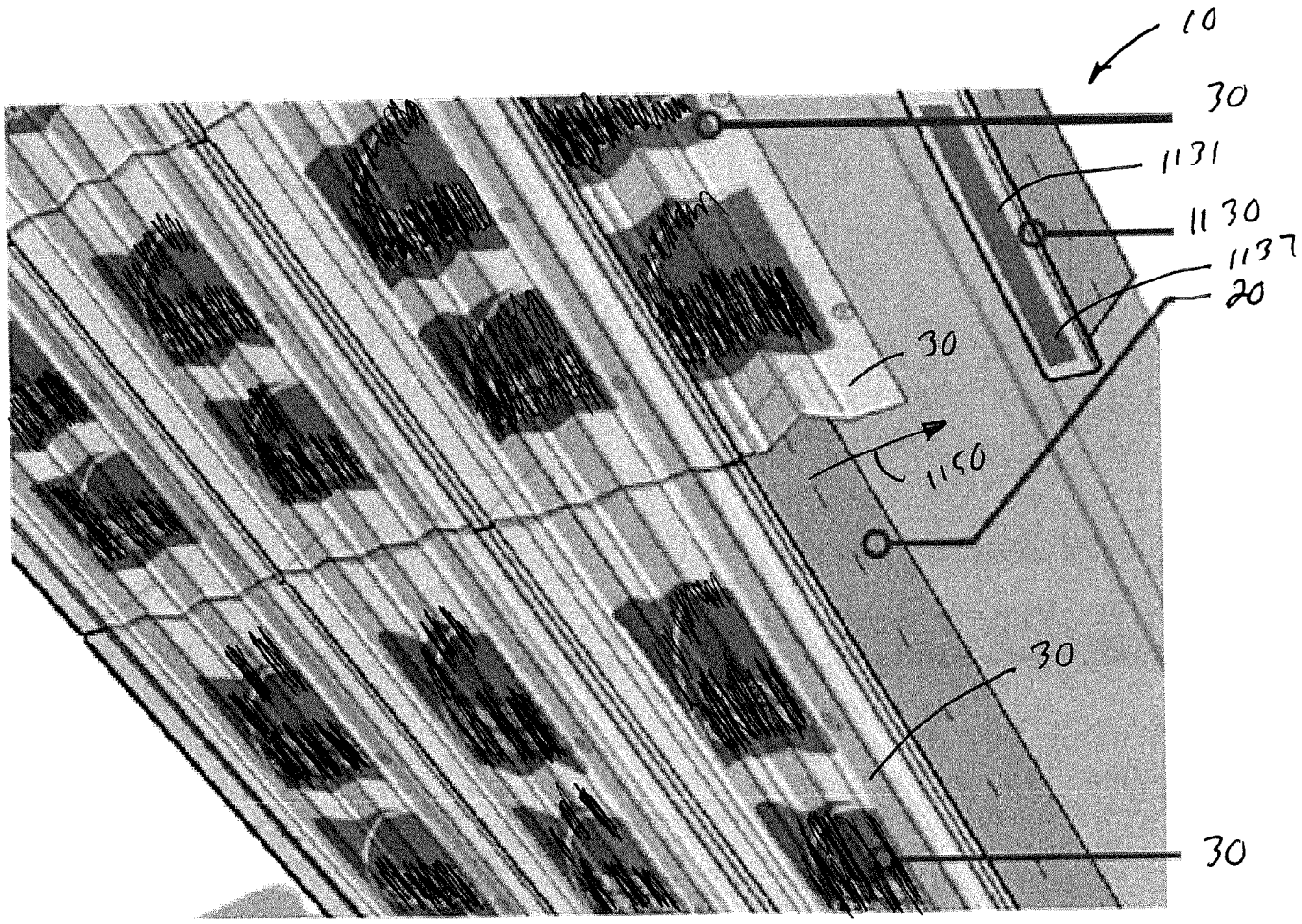
FIG. 11C is a perspective view illustrating installation of an insulation system on a building structure.

FIG. 11D illustrates fastening of rigid members 1130 to support members. Referring now to FIGS. 11E and 11F, after the rigid members 1130 have been fastened to the support members 20, the pre-installed insulation support material 30 is pulled as indicated by arrow 1150 to span the segments 1131 and optionally engage the hook or loop fasteners 1137. In another exemplary embodiment, the hook and loop material is omitted and the insulation support material 30 is attached to the segment 1131 by a fastener, such as a staple. The pre-installed insulation support material 30 may take a wide variety of different forms. In the example illustrated by FIGS. 11C-11F, the pre-installed insulation support material 30 is folded into an accordion configuration. In another exemplary embodiment, the pre-installed insulation support material 30 is in a rolled configuration prior to installation.

In a similar manner, subsequent nettings are pulled to span other segments and engage hook or loop fasteners or otherwise be attached A tension may optionally be formed in each of the insulation support materials 30 that results in the rigid members 1130 forming insulation cavities 50 having box-like cross-sectional shapes that are substantially retained after loosefill insulation is blown into insulation cavities 50.

In the illustrated embodiment, the insulation support material 30 includes a "hook" portion or a "loop" portion of the hook and loop fastening to the rigid members 1130. In certain embodiments, the material forming the insulation support material 30 can having naturally occurring loops sufficient to provide the loop function. In other embodiments, the material forming the pre-installed insulation support material can be roughened to form loops sufficient to provide the loop function. In still other embodiments, additional materials can be added to the pre-installed insulation support material sufficient to provide the loop or hook function. One non-limiting example of an additional material is a strip of material having loops or hooks that is fastened to the pre-installed insulation support material.

In the embodiment shown in FIGS. 11D and 11E, the rigid members 1130 are formed from a structural cardboard material. The structural cardboard material is configured to retain the box-like cross-sectional shape of the insulation cavity after the loosefill insulation material is distributed into the formed insulation cavities. In other embodiments, the rigid membranes can be formed from other materials, such as the non-limiting example of reinforced fiberglass or polymeric-based materials sufficient to form a box-shaped insulation cavity.

Referring to FIG. 1G, in one exemplary embodiment the rigid members 1130 are connected together by optional webs 1180. The illustrated webs 1180 extend the height of the rigid members 1130. The webs 1180 hold the rigid members 1130 together during shipping and installation, and provide an end wall to the insulation cavity 50. In one exemplary embodiment, webs 1180 are provided on both ends of the rigid members to provide walls on both ends of the insulation cavities 1150.

Referring to FIG. 11H, in one exemplary embodiment, the rigid members 1130 are formed from a material that is easily cutable, for example cutable by a utility knife. This cutability allows slots or openings to be cut in the rigid members 1130 to allow the rigid members 1130 to be installed over cross-members 23 of trusses. For example, the rigid members 1130 may be made from cardboard material that is easily cutable with a utility knife razor blade. In another exemplary embodiment, the rigid members 130 has pre-cut slots or openings that allow the rigid members 1130 to be installed over cross-members 23 of trusses.

Referring again to FIG. 11E, insulation cavities 50 each have a depth D500. The depth D500 is defined as the total of the depth of the support members 1120 and the width of the rigid members 1130 that extend below the support members. The width of the rigid members 1130 that extends below the support member is adjustable such as to result in different depths D500 of the insulation cavities.

Referring again to FIG. 11E, an insulation pocket 52 is formed as a portion of insulation cavity 50 and located under support member 20. Similarly, other insulation pockets are formed as portions of the insulation cavities and located under the support members. Distributing loosefill insulation material (not shown) into the insulation cavities results in loosefill insulation material filling the insulation pockets. As the filled insulation pockets are positioned below the support members, the filled insulation pockets are configured to insulate the support members.

Referring again to FIGS. 11C-11F, the boxed netting insulation system provides the same advantages as previously discussed, namely, a uniform thickness of the loosefill insulation material, the depth of the insulation cavities can be adjusted to provide different depths of the loosefill insulation material and insulation pockets located below the support members are filled with loosefill insulation material, thereby insulating the support members, such as truss cords.

Figure 12A:
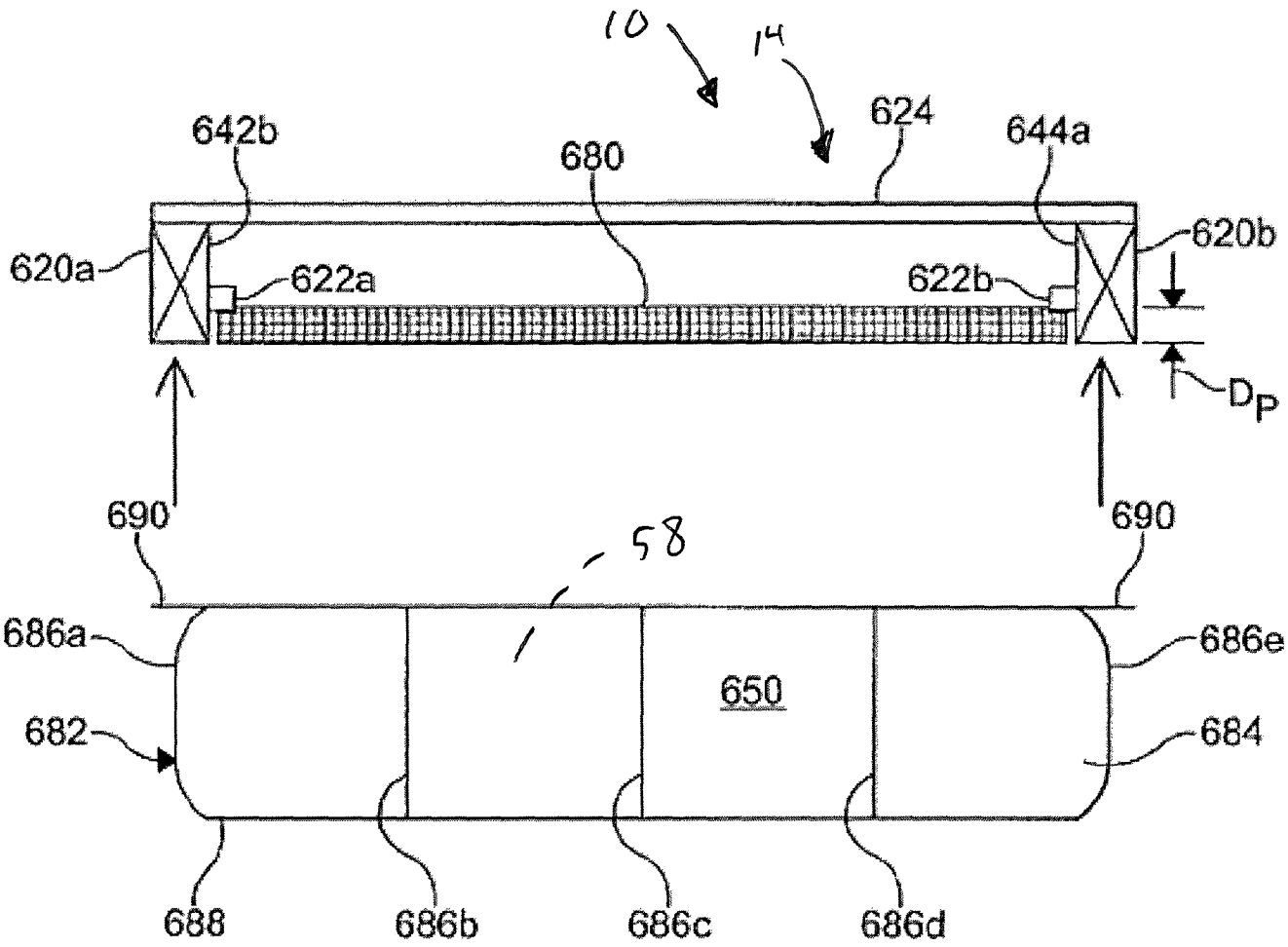
FIG. 12A is a partial front view, in elevation, of a building structure, illustrating components for another embodiment of a boxed netting insulation system.
Figure 12B:
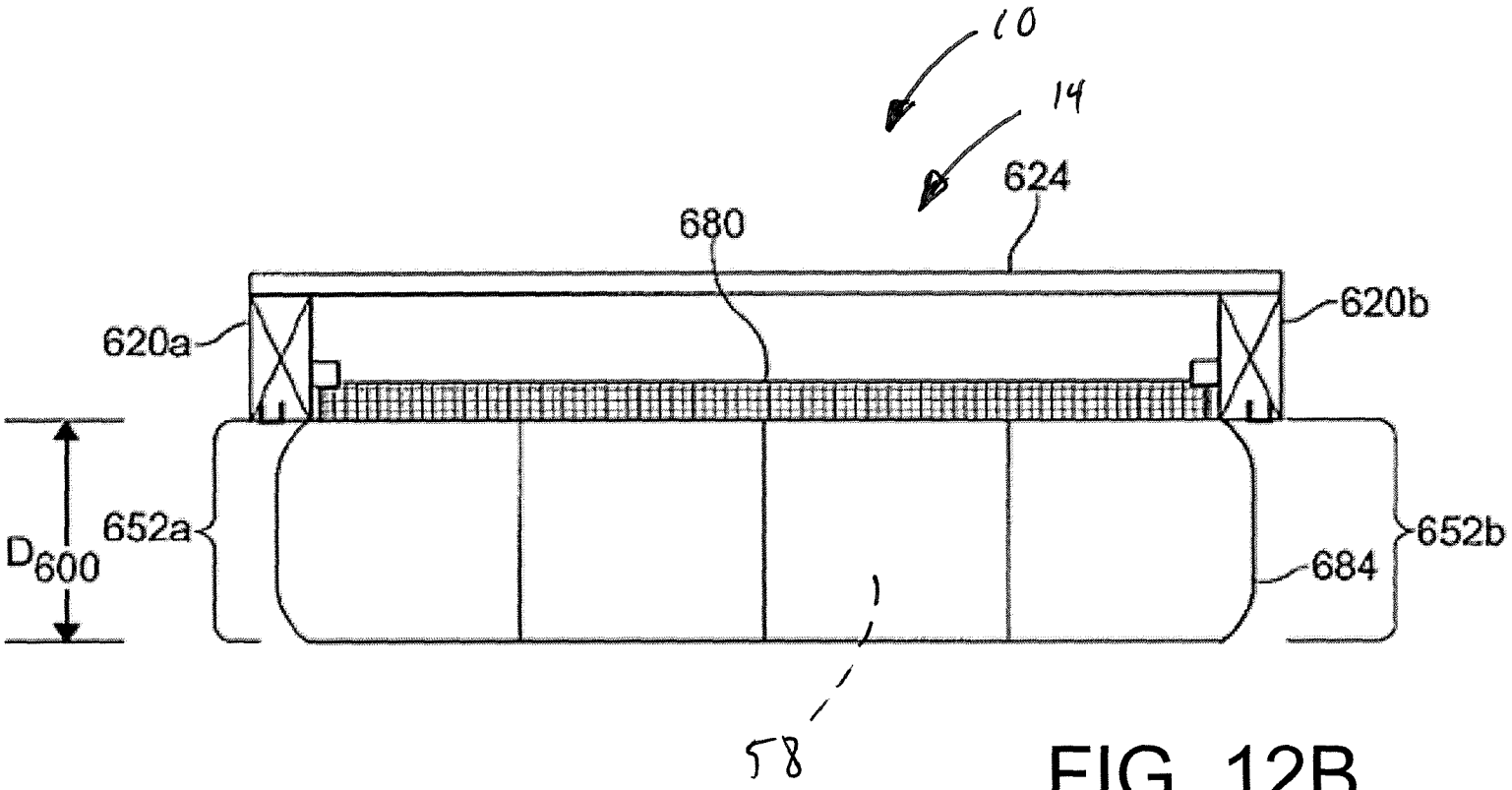
FIG. 12B is a partial front view, in elevation, of a building structure, illustrating completed installation of the components of FIG. 12A.

Referring to FIGS. 12A and 12B, another system is illustrated. Generally, this system entails use of shaped insulative containers to form box-shaped insulation cavities. In the example illustrated by FIGS. 12A and 12B, the system optionally provides a vent space 1082 1200. The vent space 1082 may extend from an eve 1202 of the roof (See FIG. 1) to a ridge 1204 of the roof to cool the sheathing 624 and/or shingles disposed above the sheathing. The vent space 1082 also provides a path for moisture beneath the sheathing to escape.

Referring first to FIG. 12A, support members 620*a* and 620*b* and sheathing panel 624 are illustrated. In the illustrated embodiment, support members 620*a*, 620*b* and sheathing panel 624 are the same as, or similar to, support members 20*c*, 20*d* and sheathing panel 24 shown in FIG. 6 and described above. However, in other embodiments, support members 620*a*, 620*b* and sheathing panel 624 can be different from support members 20*c*, 20*d*, 20*e* and sheathing panel 24. Support member 620*a* has a major face 642*b* and support member 620*b* has a major face 644*a*.

Referring again to FIG. 12A, in a first assembly step cleat 622*a* is fastened to the major face 642*b* of support member 620*a* by fasteners, an adhesive, and/or a sealant (not shown). The cleat 622*a* can be a continuous member that extends substantially the length of the support member 620*a* or the cleat 622*b* can constitute discontinuous segments. In a similar manner, cleat 622*b* is fastened to the major face 644*a* of support member 620*b* by fasteners (not shown). As will be explained below, the cleats 622*a*, 622*b* are configured as fastening supports for a panel 680. In the illustrated embodiment, the cleats 622*a*, 622*b* are wooden framing members having dimensions of 1.0 inch by 1.0 inch. However, in other embodiments the cleats 622*a*, 622*b* can be other structures and can be formed from other materials sufficient to provide fastening supports for the panel 680.

Referring again to FIG. 12A, the panel 680 is fastened to the cleats 622*a*, 622*b* by fasteners (not shown). In the illustrated embodiment, the panel 680 is formed from rigid foam insulation. The rigid foam insulation is configured to complement the insulative characteristics of the insulative containers. However, in other embodiments, the panel 680 can be any desired material, such as for example, plywood. The panel 680 has a depth DP such that in an installed position, a bottom face of the panel 680 is substantially flush with bottom faces of support members 620*a*, 620*b*. However, in other embodiments, the bottom face of the panel extends beyond the bottom faces of the support members 620*a*, 620*b* or is recessed from the bottom faces of the support members 620*a*, 620*b*. In one exemplary embodiment, the panel 680 substantially fills the cavity, such that there is no vent space 1082 or substantially no vent space 1082.

Referring again to FIG. 12A, an insulative container 682 (hereafter "container") is illustrated. The container 682 is configured for attachment to the support members 620*a*, 620*b* and further configured to form a substantially box-shaped insulation cavity. The box-shaped insulative container is subsequently filled with loosefill insulation material.

Referring again to FIG. 12A, the container 682 includes an outer skin 684, a plurality of reinforcing ties 686*a*-686*e* and a reinforced bottom 688. In the illustrated embodiment, the outer skin 684 is the same as, or similar to, the netting 30 illustrated in FIG. 5 and described above. However, in other embodiments, the outer skin 684 can be different from the netting 30.

The reinforcing ties 686*a*-686*e* are configured to restrain expansion of the outer skin 684 during filling of the container 682 with loosefill insulation material, such that a filled container retains a box-like shape having a substantially planar lower surface. In the illustrated embodiment, the reinforcing ties are formed from reinforced fiberglass materials. In other embodiments, the reinforcing ties can be formed from other desired materials, such as for example, polymeric materials, sufficient to restrain expansion of the outer skin 684 during filling of the container 682 with loosefill insulation material, such that a filled container forms a box-like shape having a substantially planar lower surface.

Referring again to FIG. 12A, the container 682 includes a flange 690. Portions of the flange 690 extend beyond the outer skin 684 of the container 682. During assembly of the container 682 to the truss cords 620*a*, 620*b*, fasteners (not shown) are inserted through the portions of the flange 690 extending beyond the outer skin 684 of the container and into the support members 620*a*, 620*b*.

Referring now to FIG. 12B, a container 682 filled with loosefill insulation material is shown fastened to the support members 620*a*, 620*b* and adjacent to the panel 680. The container 682 forms a box-like cross-sectional shape with a substantially planar bottom surface. After the container 682 has been filled with loosefill insulation material, the reinforcing ties 686*a*-686*e* form a tension in the outer skin 684. The tension imparted on the outer skin 684 by the reinforcing ties 686*a*-686*e* results in the container 682 retaining a box-like cross-sectional shape.

Referring again to FIG. 12B, the insulation cavity 650 has an adjustable depth D600, such as to provide different insulative values. As further shown in FIG. 12B, a first insulation space 652*a* is located under support member 620*a* and a second insulation space 652*b* is located under support member 620*b*. As shown in FIG. 12B, the containers 682 filled with loosefill insulation material, expand in a horizontal direction such as to fill insulation spaces 652*a*, 652*b*. When additional containers 682 are installed, the combination of expanded adjacent containers act to fill the insulation spaces 652*a*, 652*b* located under the support members.

Referring again to FIGS. 12A-12B, the boxed netting insulation system provides the same advantages as previously discussed, namely, a uniform thickness of the loosefill insulation material, the depth of the insulation cavities can be adjusted to provide different depths of the loosefill insulation material and insulation spaces located below the support members are filled with loosefill insulation material, thereby insulating the support members.

Figure 12C:
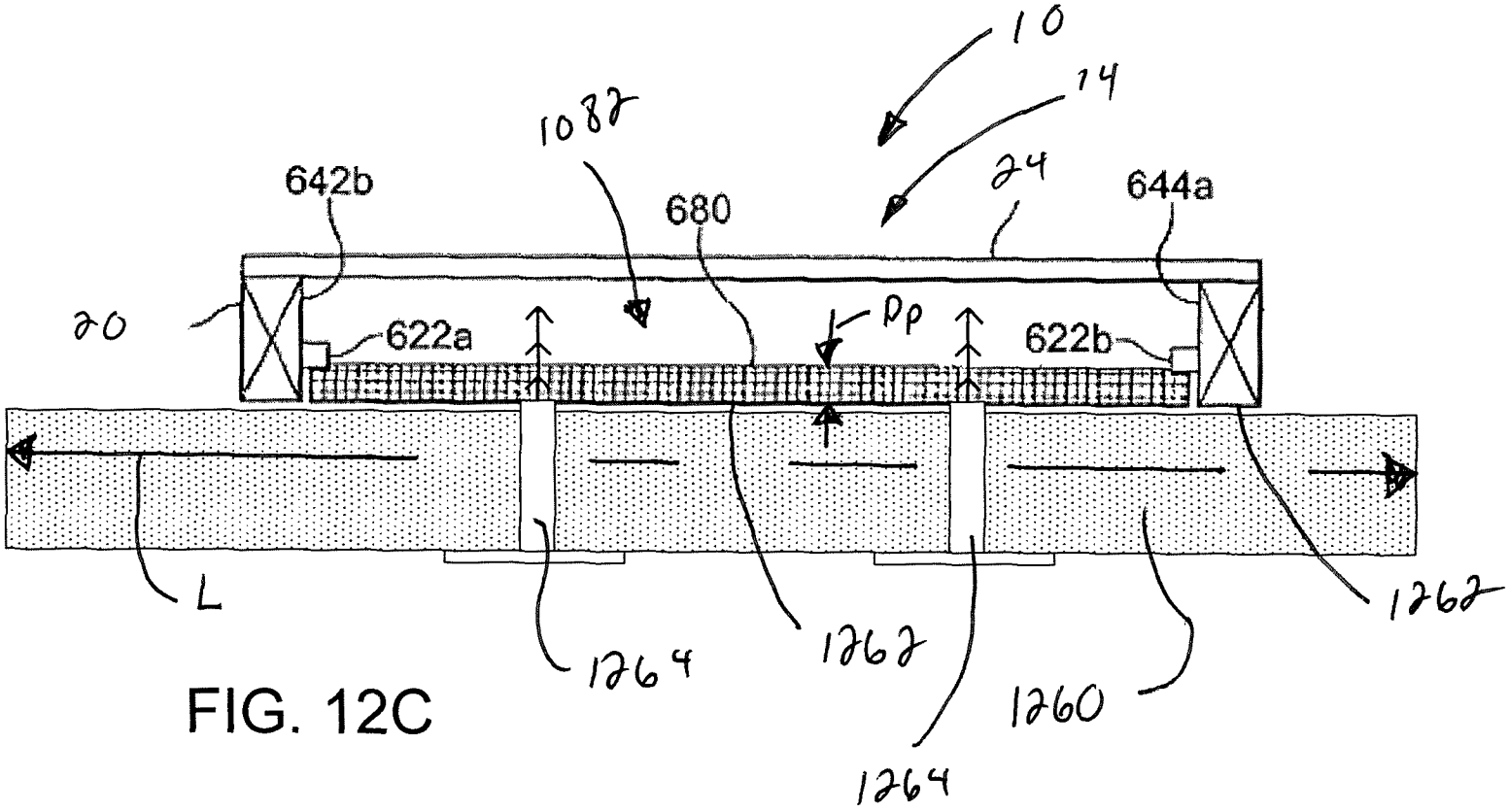
FIG. 12C is a view illustrating components of another embodiment of another insulation system.

FIG. 12C illustrates another insulation system. In the example illustrated by FIG. 12C, the system optionally provides a vent space 1082. The vent space 1082 may extend from an eve 1006 of the roof (See FIG. 1) to a ridge 1010 of the roof to cool the sheathing 624 and/or shingles disposed above the sheathing. The vent space 1082 also provides a path for moisture beneath the sheathing to escape.

Referring first to FIG. 12C, support members 20 and sheathing panel 24 are illustrated. In a first assembly step, cleats 622 are fastened to major faces 642 of support members 20 by fasteners, an adhesive, and/or a sealant (not shown). The cleat 622 can be a continuous member that extends substantially the length of the support member 20 or the cleat 622 can constitute discontinuous segments. The cleats 622 are configured as fastening supports for a panel 680. In the illustrated embodiment, the cleats 622 are wooden framing members having dimensions of 1.0 inch by 1.0 inch. However, in other embodiments the cleats 622 can be other structures and can be formed from other materials sufficient to provide fastening supports for the panel 680.

Referring again to FIG. 12C, the panel 680 is fastened to the cleats 622 by fasteners (not shown). In the illustrated embodiment, the panel 680 is formed from rigid foam insulation. The rigid foam insulation is configured to complement the insulative characteristics of the insulation 58. However, in other embodiments, the panel 680 can be any desired material, such as for example, plywood. The panel 680 has a depth DP such that in an installed position, a bottom face of the panel 680 is substantially flush with bottom faces of support members 620. In one exemplary embodiment, the panel 680 substantially fills the cavity, such that there is no vent space 1082 or substantially no vent space.

The flush alignment of the panel 680 with the support members 20 provides a flush surface 1262 for mounting of an insulation material. In the example illustrated by FIG. 12C, an insulation material 1260, such as a batt of fiberglass insulation, a foam insulation board, and the like, can be mounted with the length L extending across three or more support members. The insulation material 1260 can be mounted to the flush surface 1262 in a wide variety of different ways. In the example illustrated by FIG. 12C, fasteners 1264 extend through the insulation material 1260 and into the panel 680 and/or the support members 20. The fasteners 1264 can be selected based on whether the insulation material 1260 is secured to the support member 20 of the panel 680. For example, a nail may be used to secure the insulation material 1260 to the support members 20 while a barbed fastener may be used to secure the insulation material to a panel 680 made from foam.

Figure 12D:
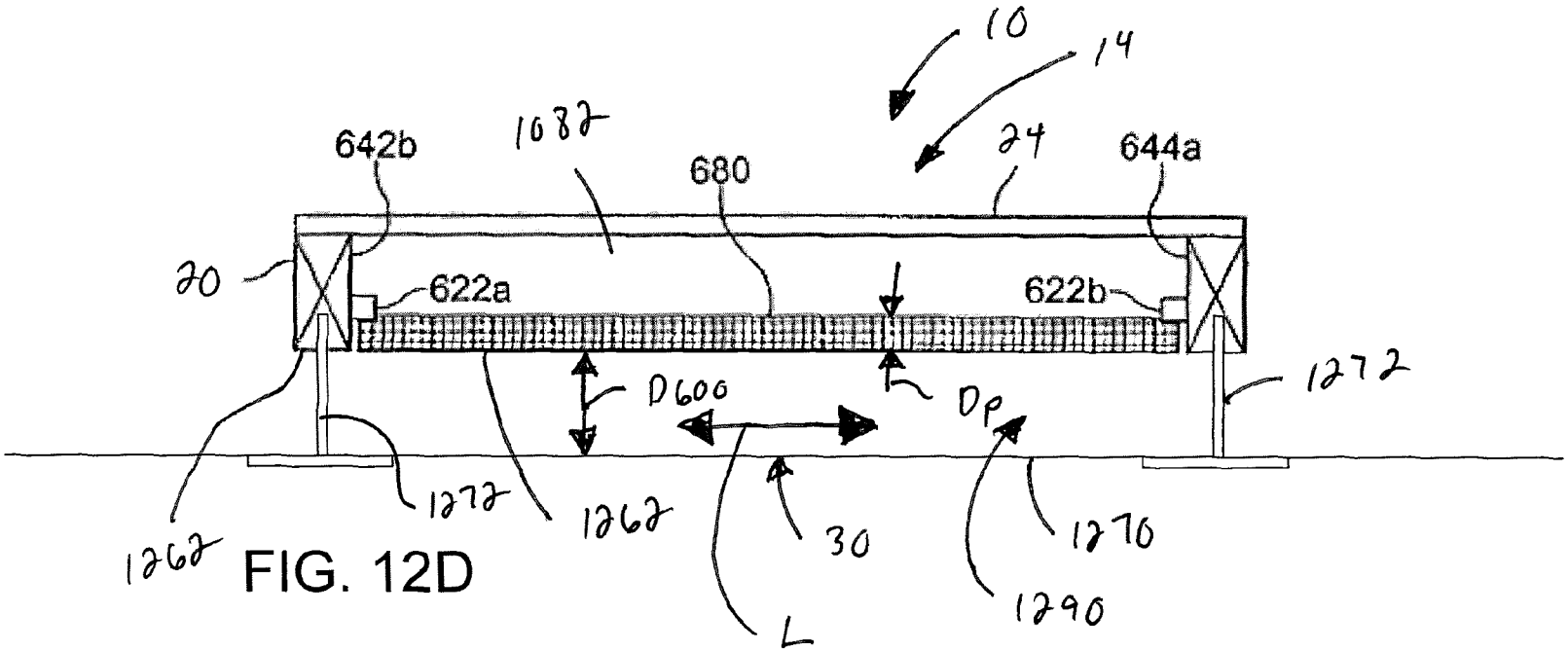
FIG. 12D is a view illustrating components of an embodiment of another insulation system.

FIG. 12D illustrates another insulation system. In the example illustrated by FIG. 12D, the system optionally provides a vent space 1082. The vent space 1082 may extend from an eve 1202 of the roof (See FIG. 1) to a ridge 1204 of the roof to cool the sheathing 24 and/or shingles disposed above the sheathing. The vent space 1082 also provides a path for moisture beneath the sheathing to escape.

Referring first to FIG. 12D, support members 20 and sheathing panel 24 are illustrated. In a first assembly step, cleats 622 are fastened to major faces 642 of support members 20 by fasteners, and adhesive, or a sealant (not shown). The cleat 622 can be a continuous member that extends substantially the length of the support member 20 or the cleat 622 can constitute discontinuous segments. The cleats 622 are configured as fastening supports for a panel 680. In the illustrated embodiment, the cleats 622 are wooden framing members having dimensions of 1.0 inch by 1.0 inch. However, in other embodiments the cleats 622 can be other structures and can be formed from other materials sufficient to provide fastening supports for the panel 680.

Referring again to FIG. 12D, the panel 680 is fastened to the cleats 622 by fasteners, an adhesive, and/or a sealant (not shown). In the illustrated embodiment, the panel 680 is formed from rigid foam insulation. The rigid foam insulation is configured to complement the insulative characteristics of the insulative containers. However, in other embodiments, the panel 680 can be any desired material, such as for example, plywood. The panel 680 has a depth DP such that in an installed position, a bottom face of the panel 680 is substantially flush with bottom faces of support members 620. In one exemplary embodiment, the panel 680 substantially fills the cavity, such that there is no vent space 1082 or substantially no vent space.

The flush alignment of the panel 680 with the support members 20 provides a flush surface 1262 for mounting of an insulation support material sheet 1270 with support pins 1272 having the same length. The insulation support sheet can be made from any of the materials described in this patent application. The insulation support material sheet 1270 can be mounted with the length L extending across three or more support members 20. The insulation support sheet 1270 can be mounted to the flush surface 1262 in a wide variety of different ways. In the example illustrated by FIG. 12D, support pins 1272 extend through the insulation support sheet and into the panel 680 and/or the support members 20. The pins 1272 can be configured based on whether the insulation support sheet 1270 is secured to the support member 20 or the panel 680. For example, a sharply pointed support pin 1272 may be used to secure the sheet 1270 to the support members 20 while a barbed fastener may be used to secure the sheet 1270 to a panel 680 made from foam.

Space 1290 defined by the insulation support sheet 1270, the sheathing 24, and the support members 20 is filled with loosefill insulation material 58. The insulation cavity 650 has an adjustable depth D600, by adjusting the length of the pins 1272, such as to provide different insulative values.

Any of the insulation systems by the present application can be used in a building structure 10 having a roof deck with a vent space 1082 between sheathing 24 and insulation 58. Referring to FIGS. 1D, and 13A-13C, the vent space 1082 can be formed in a wide variety of different ways. In the exemplary embodiment illustrated by FIGS. 13A and 13B, the vent space 1082 is provided by attaching a vent member or material 1300 from below the roof sheathing 24. In the exemplary embodiment illustrated by FIG. 13C, the vent space 1082 is provided by attaching a vent member or material 1300 from above the roof sheathing 24.

Figure 13A:
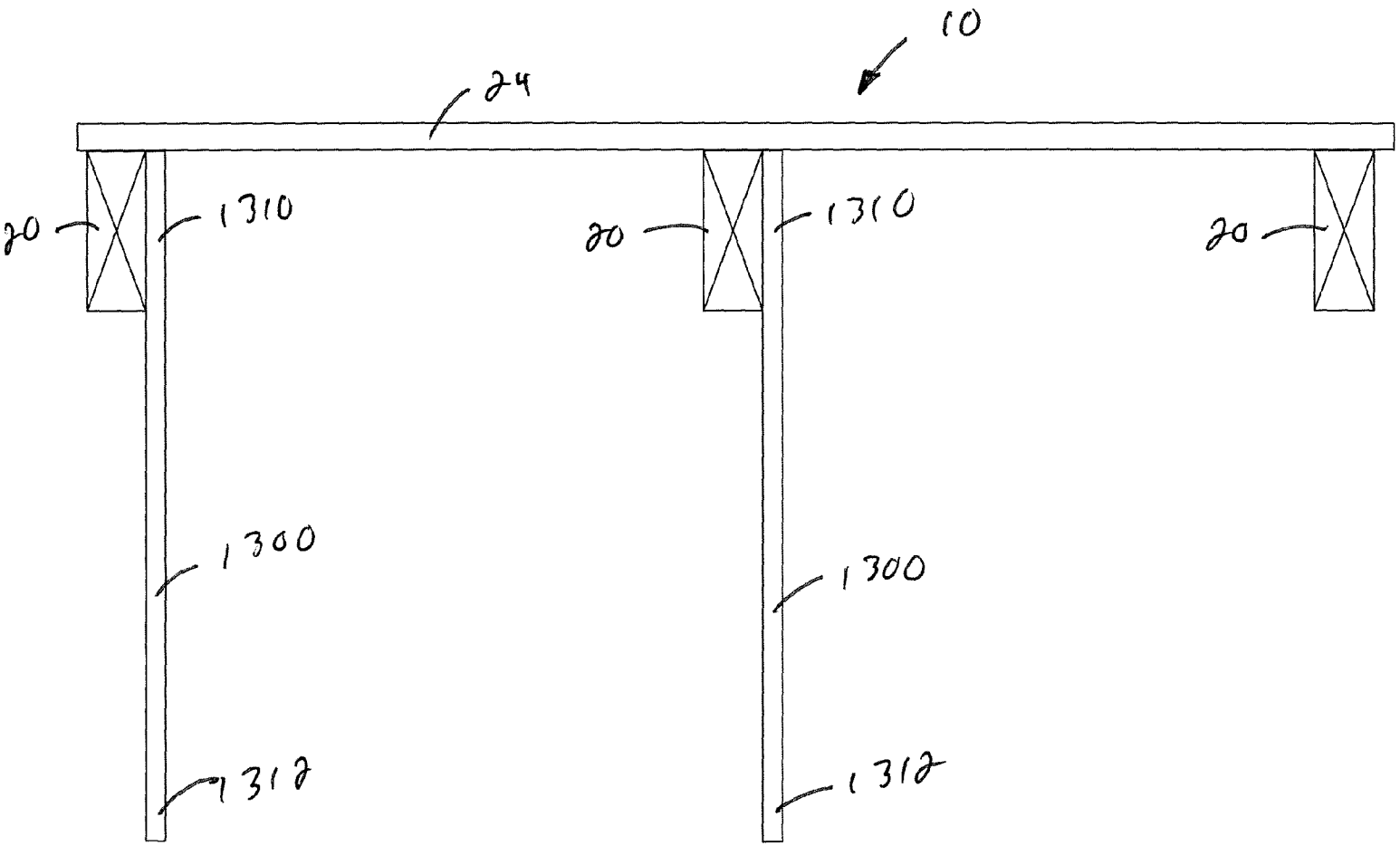
FIG. 13A is an illustration of a building structure and a passage forming member.
Figure 13B:
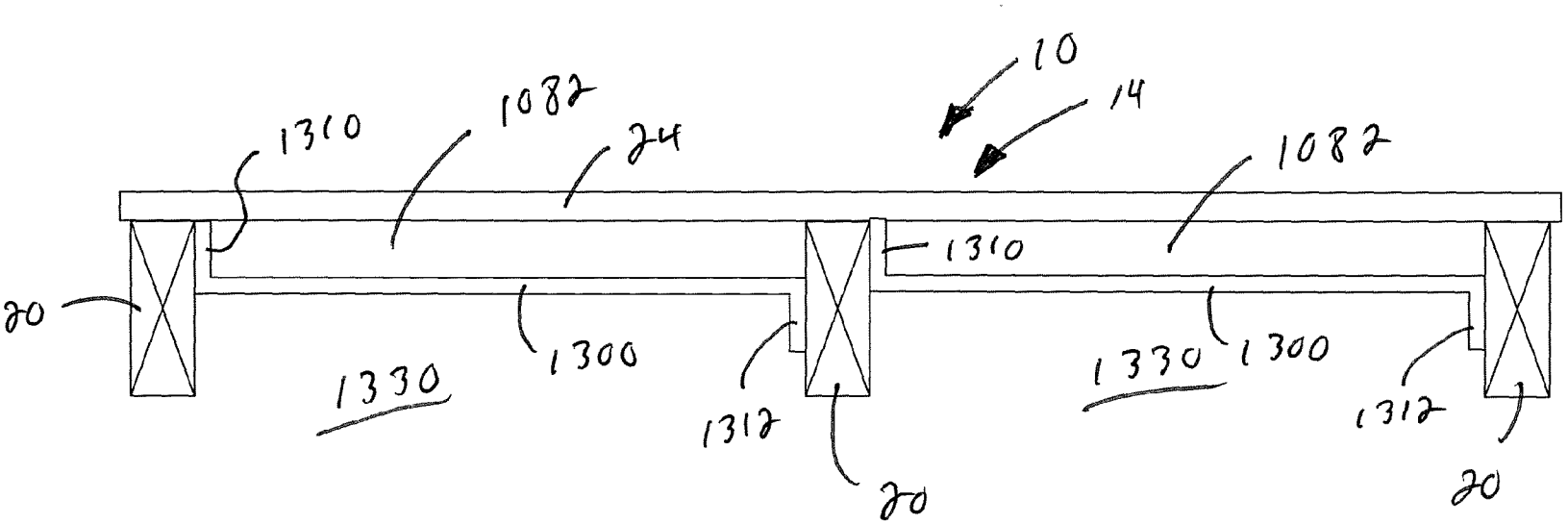
FIG. 13B is an illustration of a building structure with the passage forming member of FIG. 13A forming a roof deck vent passage.

The vent member or material 1300 can take a wide variety of different forms. The vent member or material 1300 can be made from any of the materials disclosed by the present application. In the example illustrated by FIGS. 13A and 13B, the vent member 1300 or material is rigid or substantially rigid. In the exemplary embodiment illustrated by FIGS. 13A and 13B, the vent member 1300 is formed in place between a pair of support members 20. Referring to FIG. 13A, a first end 1310 is attached to a support member 20. Referring to FIG. 13B, the vent member or material 1300 is bent or folded to fit between two support members 20 and a second end 1312 is attached to a support member 20 to form the vent space 1082. In another exemplary embodiment, the vent member 1300 is preformed and sized to fit between pairs of support members. In an exemplary embodiment, the vent member or material is configured to provide an air barrier between the vent space 1082 and an interior 1330 of the building structure 10. In another exemplary embodiment, a vent member or structure 1300 that is made from a flexible material is installed from below the roof sheathing.

Figure 13C:
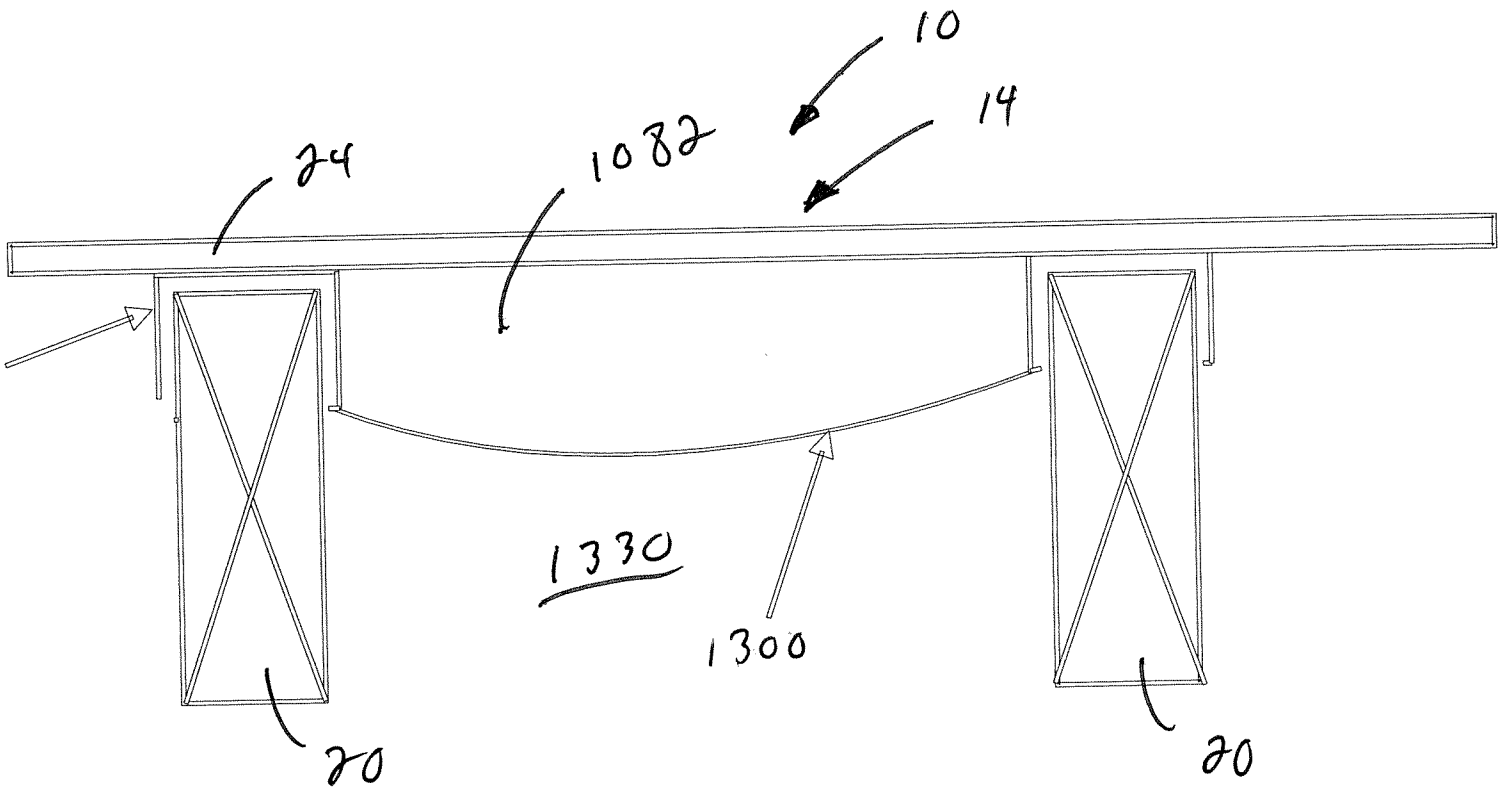
FIG. 13C is an illustration of a building structure with a flexible roof deck vent passage.

In the example illustrated by FIG. 13C, the vent material 1300 is flexible. In the exemplary embodiment illustrated by FIG. 13C, the vent material 1300 is placed over a pair of support members 20 prior to the sheathing 24. The attachment of the sheathing 24 attaches the vent material 1300 to the support members 20. In an exemplary embodiment, the vent material 1300 is configured to provide an air barrier between the vent space 1082 and an interior 1330 of the building structure 10. In another exemplary embodiment, a vent member or structure 1300 that is made from a rigid material is installed from above the roof sheathing.

FIGS. 14A-14E illustrate exemplary embodiments of building structures 10 having a roof deck with a vent space 1082 between sheathing 24 and insulation 58. In the example illustrated by FIG. 14A, the vent material 1300 and/or the insulation support material 30 is installed from above the support members 20. In the example illustrated by FIG. 14A, the vent material 1300 and the insulation support material are flexible, but may be rigid or have rigid portions. In the exemplary embodiment illustrated by FIG. 14A, the vent material 1300 and the insulation support material 30 are placed over a pair of support members 20 prior to the sheathing 24. The attachment of the sheathing 24 attaches the vent material 1300 and insulation support material 30 to the support members 20.

Figure 14A:
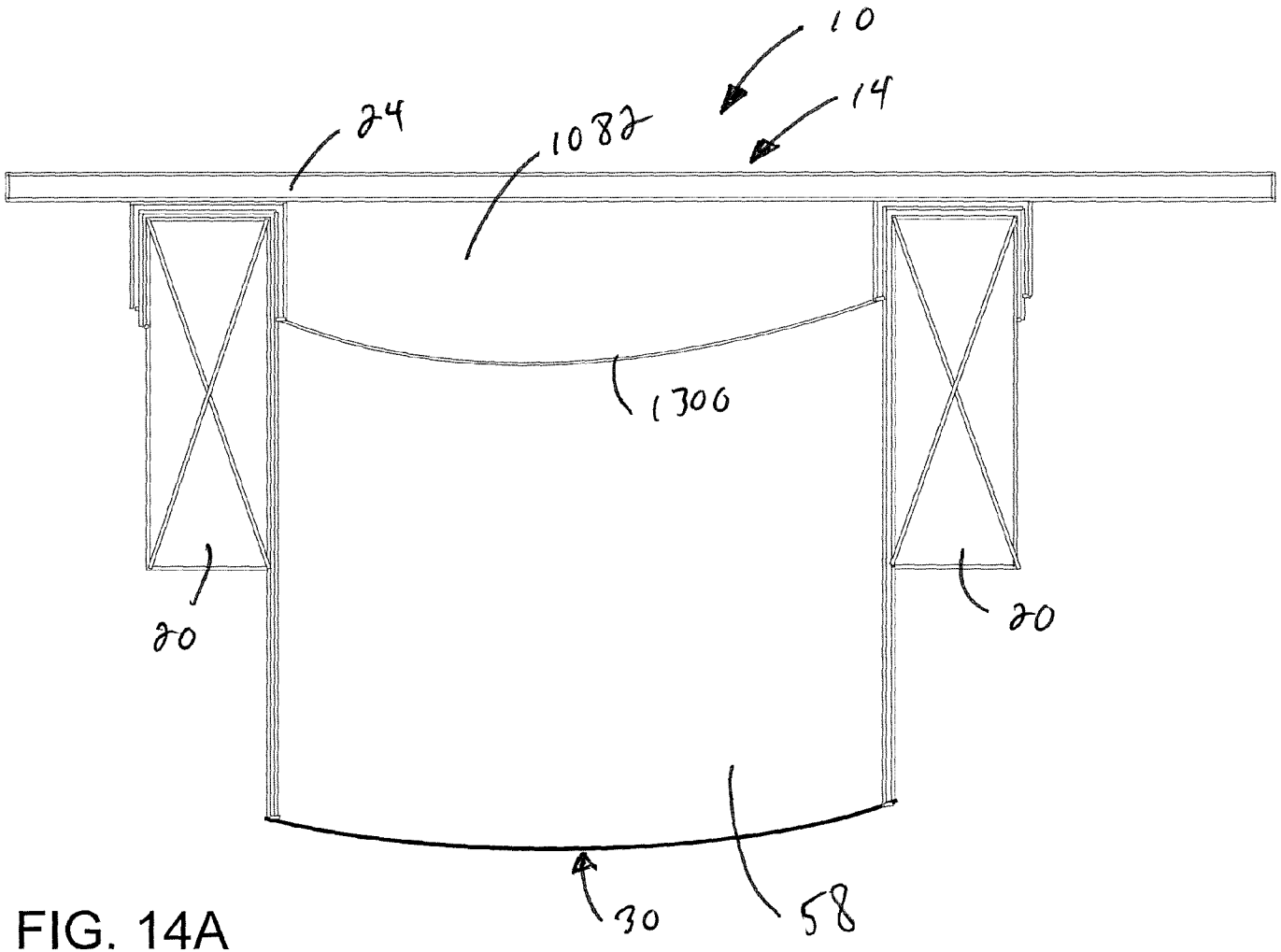
FIG. 14A is an illustration of an exemplary embodiment of an insulation support system with a roof deck vent passage.
Figure 14B:
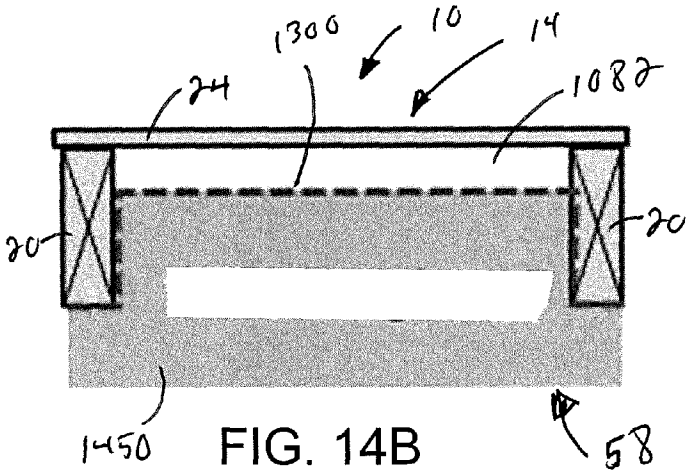
FIG. 14B is an illustration of an exemplary embodiment of an insulation support system with a roof deck vent passage.

In the example illustrated by FIG. 14B, a flexible insulation material 1450, such as a fiberglass insulation batt or blown-in insulation, is provided beneath the vent material 1300. Blown-in insulation can be supported by any of the insulation support materials and configurations disclosed by the present application. The illustrated flexible insulation material is provided between pairs of support members 20 and below the support members.

Figure 14C:
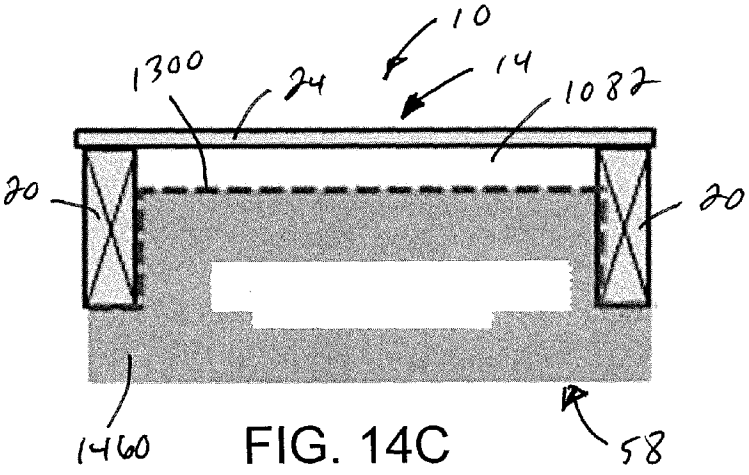
FIG. 14C is an illustration of an exemplary embodiment of an insulation support system with a roof deck vent passage.

In the example illustrated by FIG. 14C, a rigid insulation material 1460, such as a foam board, is provided beneath the vent material 1300. The illustrated rigid insulation material is provided between pairs of support members 20 and below the support members.

Figure 14D:
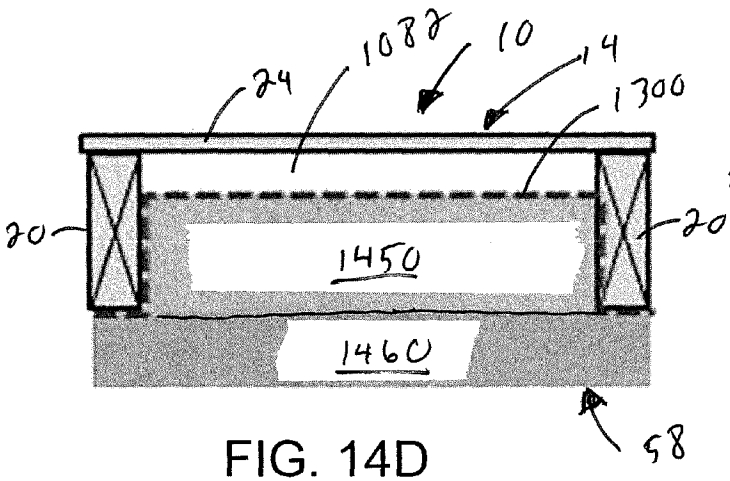
FIG. 14D is an illustration of an exemplary embodiment of an insulation support system with a roof deck vent passage.

In the example illustrated by FIG. 14D, a flexible insulation material 1450, such as a fiberglass insulation batt or blown-in insulation, and a rigid insulation material 1460, such as a foam board are provided beneath the vent material 1300. The flexible insulation material 1450 is supported by the rigid insulation material 1460. The illustrated flexible insulation material is provided between pairs of support members 20 and the rigid insulation material is provided below the support members.

Figure 14E:
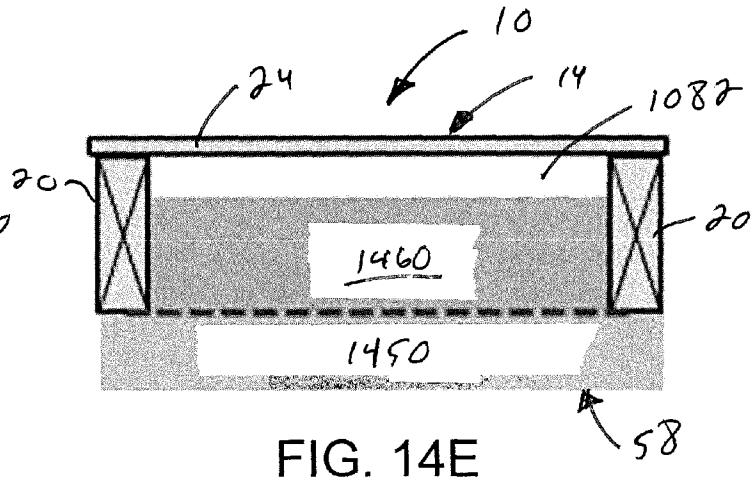
FIG. 14E is an illustration of an exemplary embodiment of an insulation support system with a roof deck vent passage.

In the example illustrated by FIG. 14E, a rigid insulation material 1460 and a flexible insulation material 1450, such as a fiberglass insulation batt or blown-in insulation, are provided beneath the vent material 1300. The illustrated rigid insulation material is provided between pairs of support members 20. The flexible insulation material 1450 is provided below the rigid insulation material 1460 and support members 20. Blown-in insulation can be supported by any of the insulation support materials and configurations disclosed by the present application.

Figure 14F:
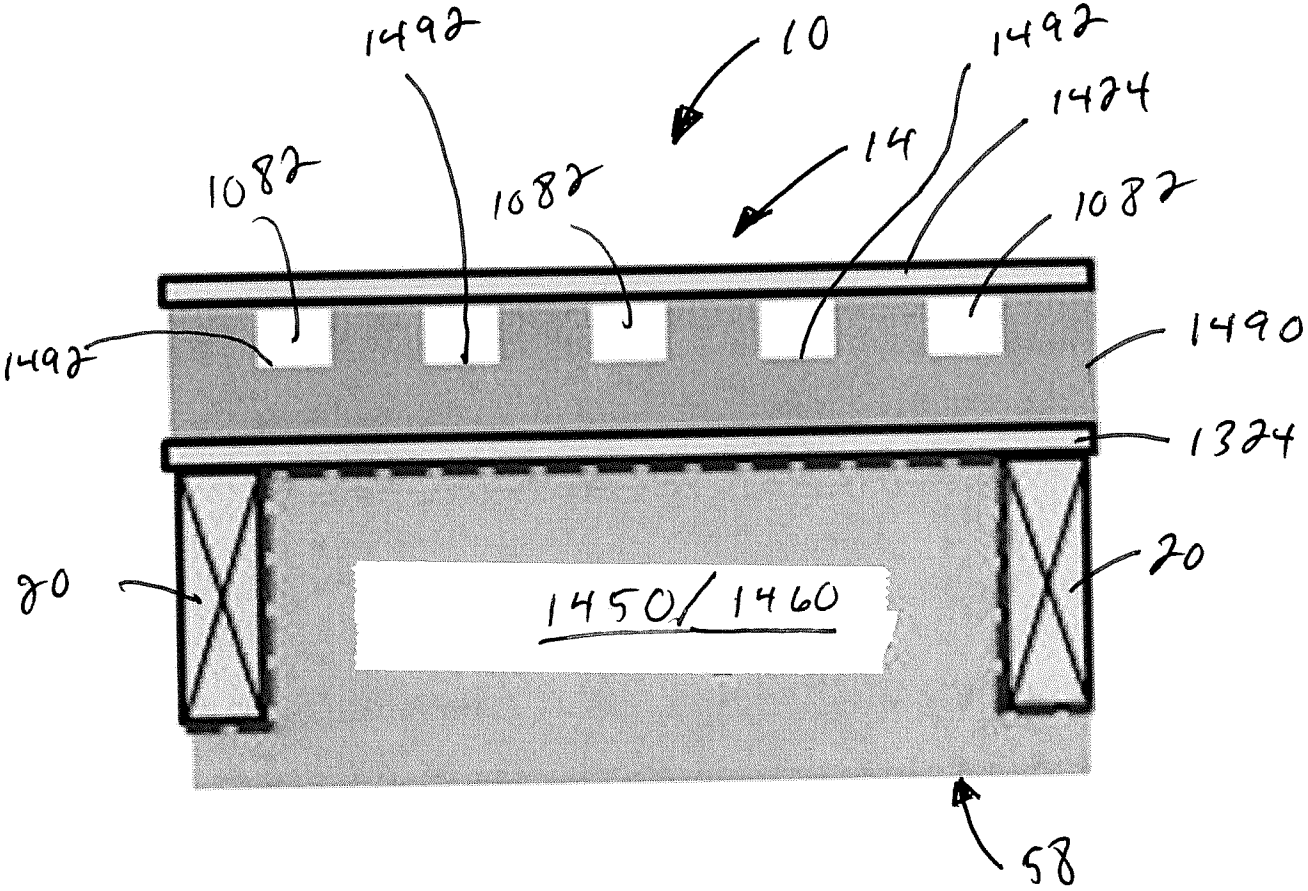
FIG. 14F is an illustration of an exemplary embodiment of an insulation support system with a roof deck vent passage.

FIG. 14F illustrates an exemplary embodiment of a building structures 10 having a roof deck with vent spaces 1082 between an inner sheathing layer 1324 and an outer sheathing layer 1424 and insulation 58. The vent spaces 1082 can be provided in a wide variety of different ways. For example, the vent space 1482 can be formed by a panel 1490 having grooves 1492. The panel 1490 may be a foam insulation panel. The vent spaces 1082 may also be formed using spacers or framing members. In the example illustrated by FIG. 14F, a flexible insulation material 1450, such as a fiberglass insulation batt or blown-in insulation, and/or a rigid insulation material 1460, such as a foam board, are provided beneath the inner sheathing layer 1324. Blown-in insulation can be supported by any of the insulation support materials and configurations disclosed by the present application. The flexible and/or rigid insulation material is provided between pairs of support members 20 and below the support members.

Figure 15A:
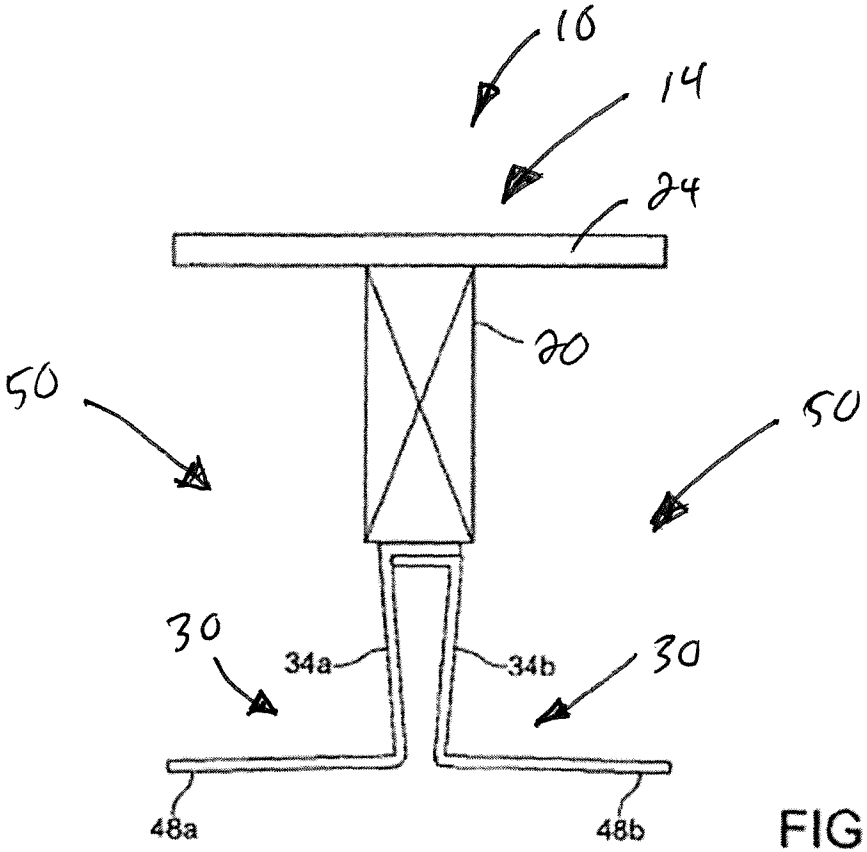
FIGS. 15A-15C illustrate another exemplary embodiment of an insulation support system.
Figure 15B:
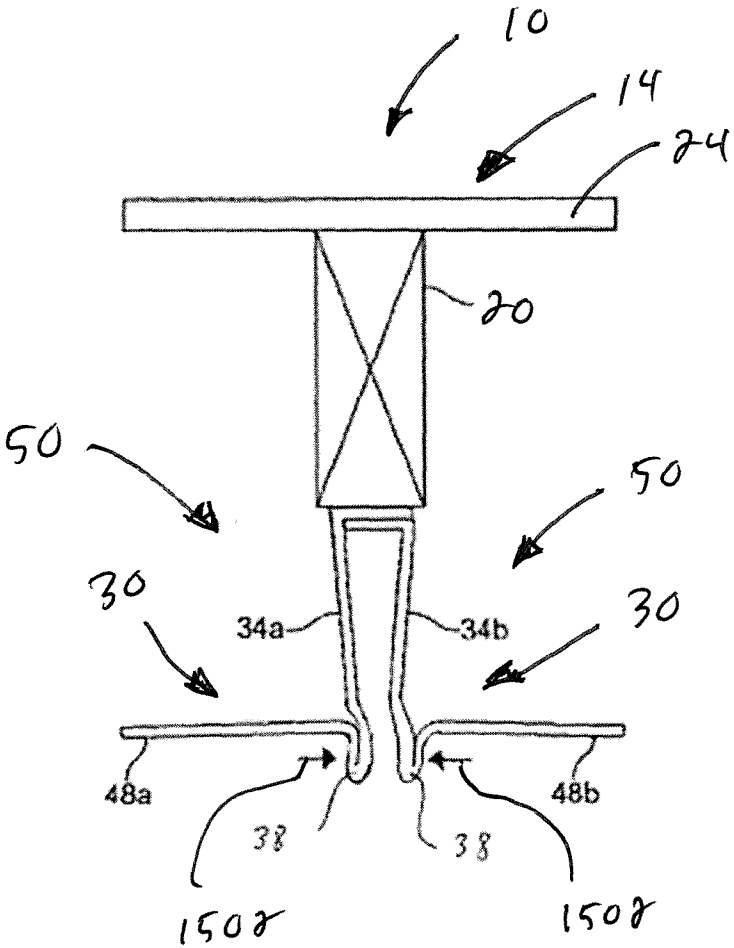
Figure 15C:
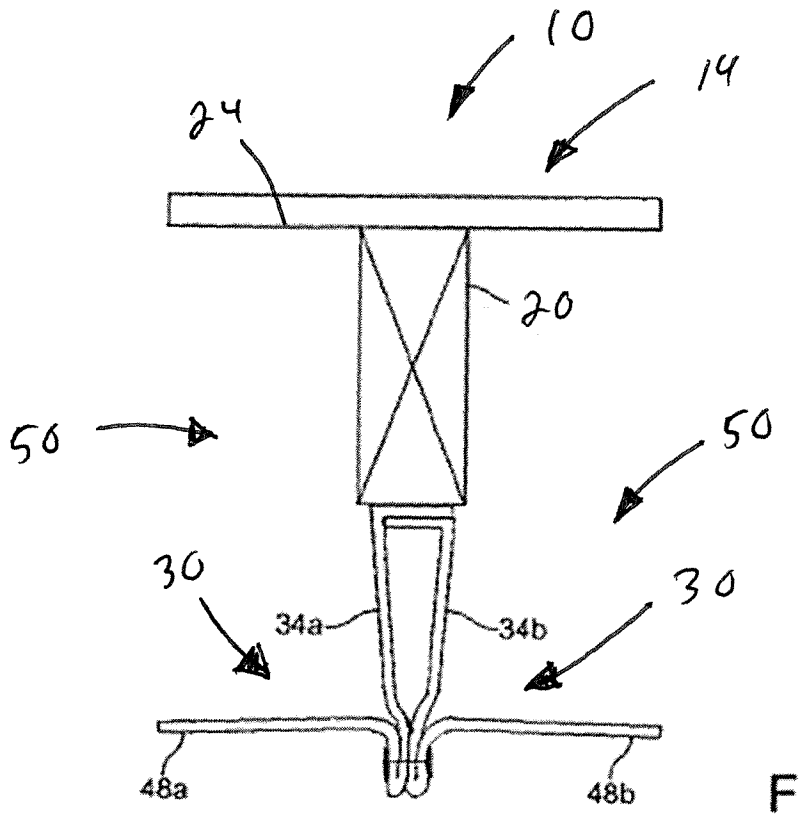

FIGS. 15A-15C illustrate another exemplary embodiment similar to the insulation support system embodiments disclosed by FIGS. 3, 3A, 4, 4A, 5-5E, 6, 6A, 10A and 10B. In the embodiment illustrated by FIGS. 15A-15C, one or more of the tabs 38 (See FIG. 15B) are formed during installation of the insulation support material 30. The netting can otherwise have any of the insulation support material 30 configurations illustrated by FIGS. 3, 3A, 4, 4A, 5-5E, 6, 6A, 10A and/or 10B.

The insulation support material 30 is configured for attachment to the support members 20, sheathing 24, or other structure and further configured to contain the loosefill insulation material Referring to FIG. 15A, the insulation support material 30 does not initially have any tabs. Referring to FIG. 15B, the insulation support material 30 may bunched or gathered as indicated by arrows 1502 to form one or more tabs 38. Referring to FIG. 15C a tab 38 is connected to another tab 38 or another portion of the insulation support material to form an insulation cavity 50. The insulation cavities can have any of the configurations disclosed by the present application or other configurations.

FIGS. 16A-16D, illustrate another exemplary embodiment of a building structure 10 with an insulation system having a the vent space 1082. In the exemplary embodiment illustrated by FIGS. 16A-16D, the vent space 1082 is provided by attaching a vent member or material 1300 from below the roof sheathing 24.

Figure 16A:
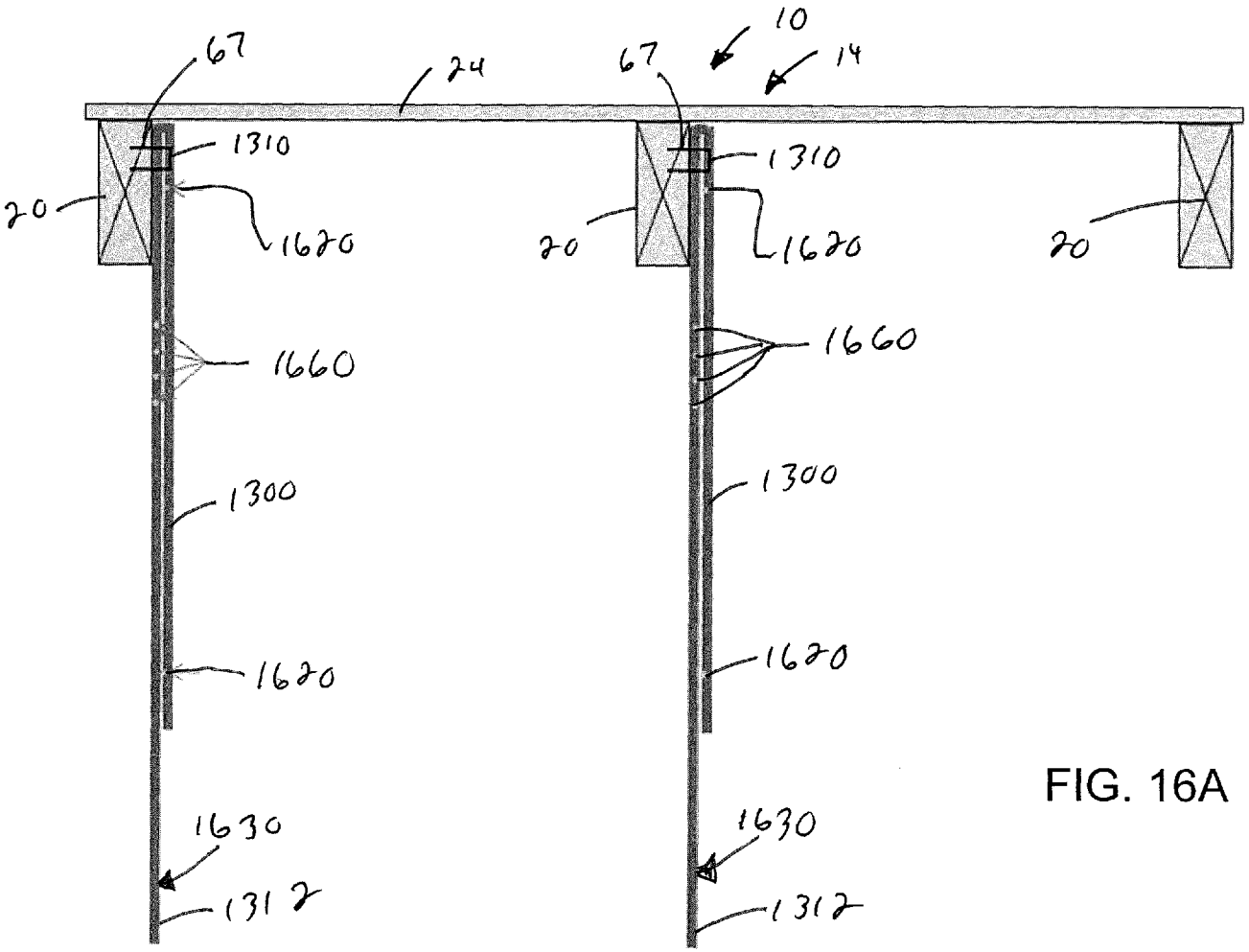
FIGS. 16A-16D illustrate another exemplary embodiment of an insulation system.
Figure 16B:
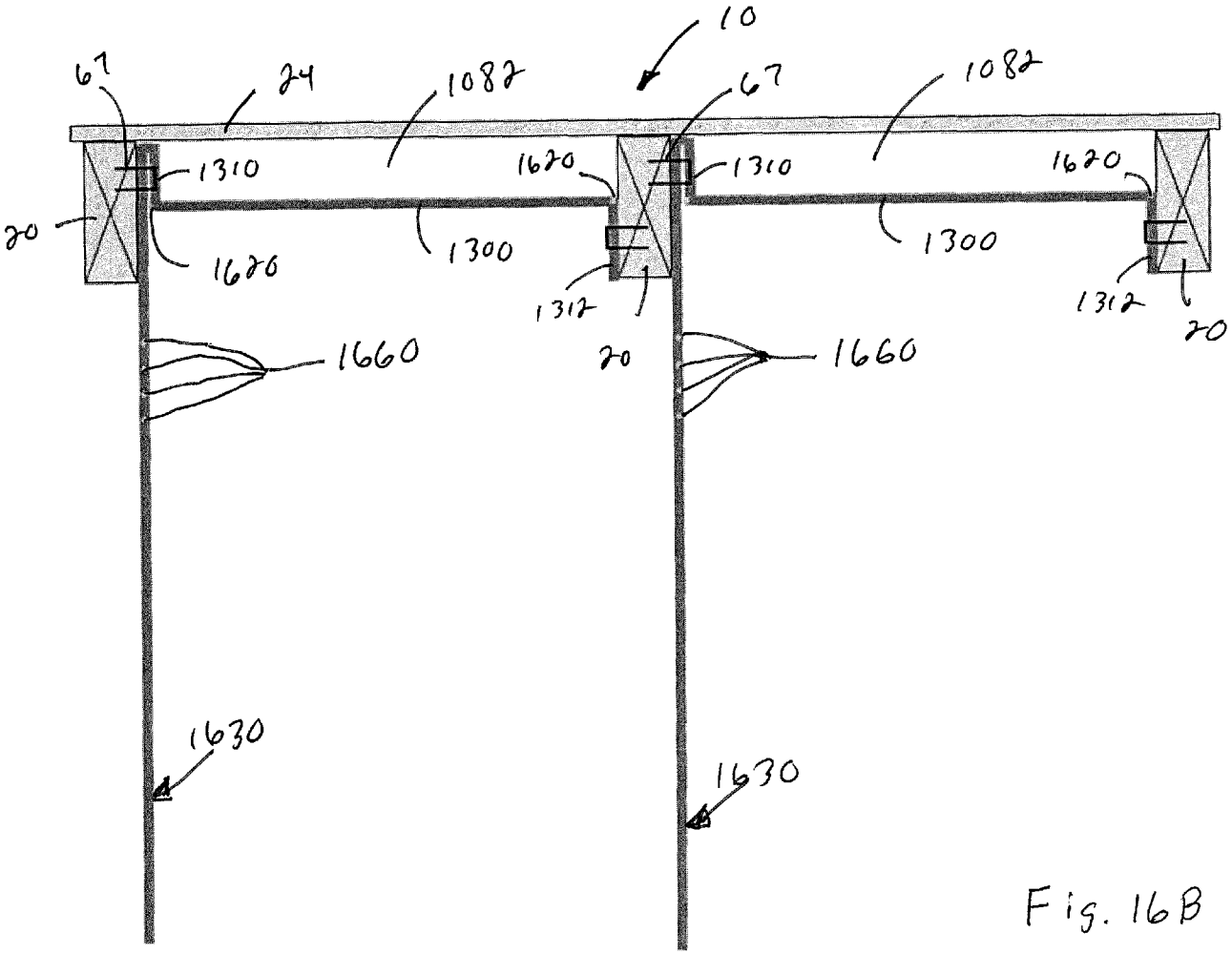
Figure 16D:
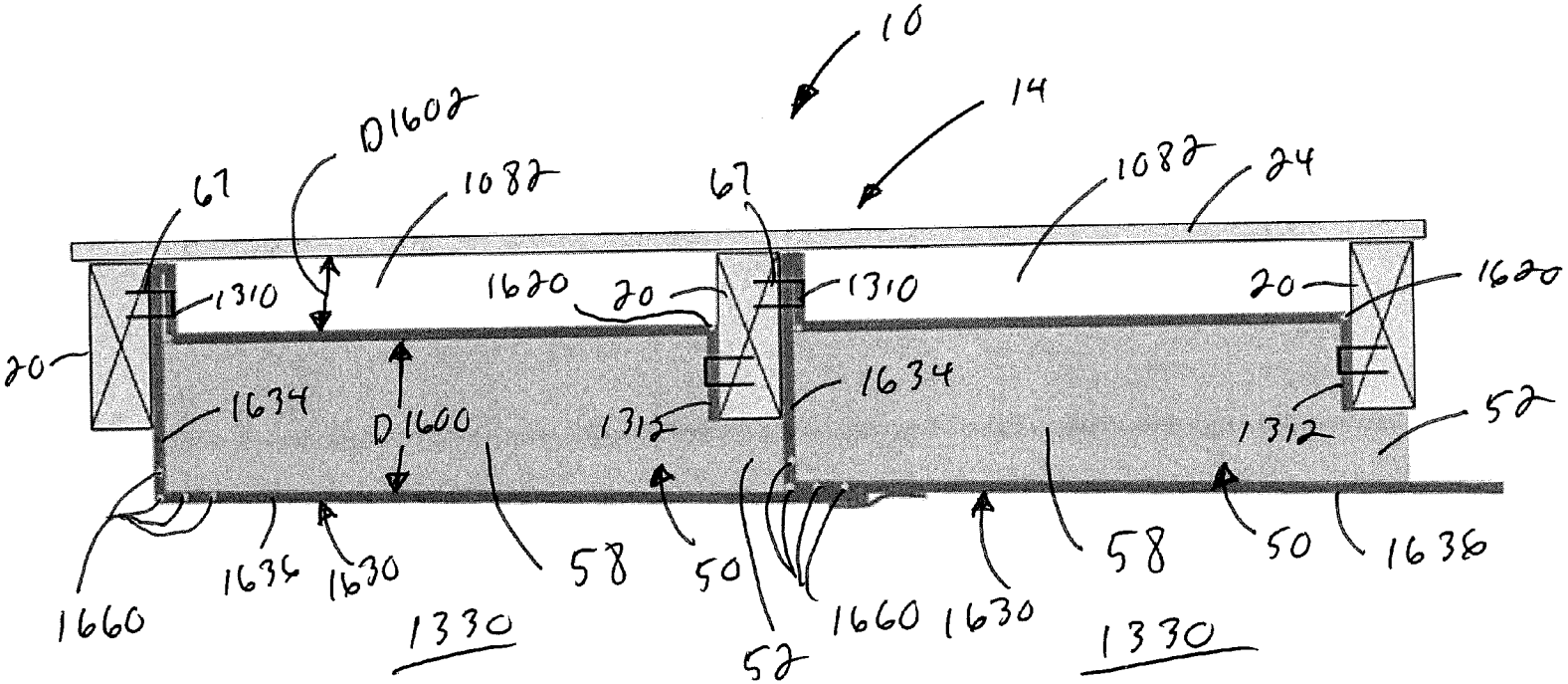

The vent member or material 1300 can take a wide variety of different forms. The vent member or material 1300 can be made from any of the materials disclosed by the present application. In the example illustrated by FIGS. 16A-16D, the vent member 1300 or material is rigid or substantially rigid. In the exemplary embodiment illustrated by FIGS. 16A-16D, the vent member 1300 is formed in place between a pair of support members 20. Referring to FIG. 16A, a first end 1310 of the vent member and a first end of insulation support material 30 is attached to a support member 20. Referring to FIG. 16B, the vent member or material 1300 is bent or folded along optional pre-formed creases 1620 to fit between two support member 20 and a second end 1312 is attached to a support member 20 to form the vent space 1082. In an exemplary embodiment, the vent member or material is configured to provide an air barrier between the vent space 1082 and an interior 1330 of the building structure 10. In another exemplary embodiment, a vent member or structure 1300 that is made from a flexible material is installed from below the roof sheathing.

In the example illustrated by FIGS. 16A-16D, the insulation system uses interconnecting, substantially rigid members and/or flexible material such as netting. The interconnecting material may take a wide variety of different forms and may take a wide variety of different configurations. For example, rigid interconnecting material may comprise cardboard, plastic, and the like. The flexible insulation support material 30 may comprise a plastic film, a mesh, combinations of plastic film and mesh, and the like. In one exemplary embodiment, the netting material may be a breathable material, a vapor barrier, a vapor retarder, and/or an air barrier material.

Figure 16C:
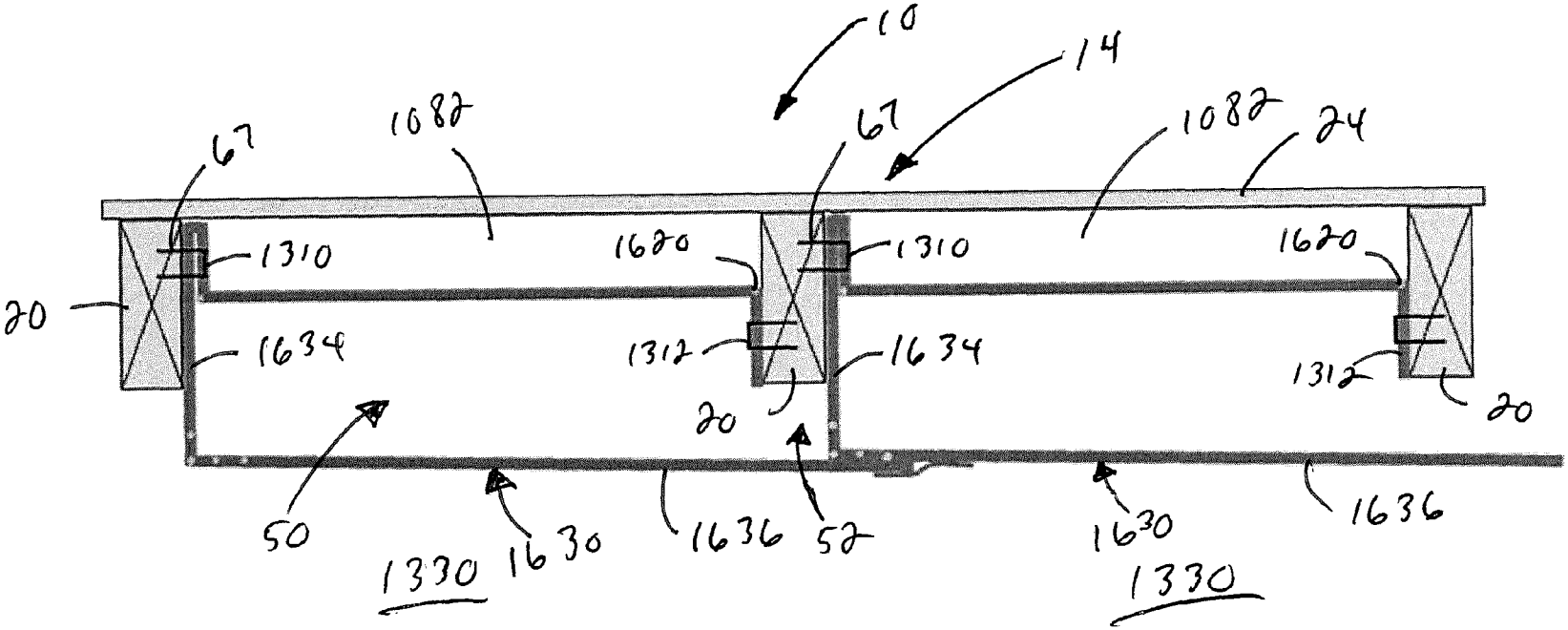

Referring to FIG. 16C, interconnecting portions 1630 are illustrated. Part of an interconnection portion 1630 is positioned adjacent to the major face of a support member 20 and fastened to the support member 20 with one or more fasteners 67 along with the vent member 1300. However, as noted above, the netting, such as the interconnecting portion 30 can be connected to any portion of the support member 20 and/or to the roof sheathing 24.

Referring to FIG. 16C, interconnecting portion 1630 can be folded on top of and connected to and adjacent interconnecting portion 1630, thereby forming a box-shaped insulation cavities 50. When made from a rigid material, interconnecting portion 1630 is bent such that a side panel segment 1634 and the span segment 1636 form an approximate right angle with each other. The approximate right angles formed between the side panels segments 1634 with the span segment 1636 defines a box-shaped insulation cavity 50.

In one exemplary embodiment the interconnecting portions are formed from a rigid material structural cardboard material. The rigid material, such as structural cardboard material is configured to retain the box-like cross-sectional shape of the insulation cavity after the loosefill insulation material is distributed into the formed insulation cavities. In other embodiments, the interconnecting portions can be formed from other materials, such as the non-limiting example of reinforced fiberglass or polymeric-based materials sufficient to form a box-shaped insulation cavity. In still other embodiments, the interconnecting portions 1630 can be formed from flexible materials, such as for example, the netting 30 illustrated in FIG. 2A and described above. In some exemplary embodiments, the interconnecting portions are made from more than one different material. For example, the span segments 1636 may be made from a flexible material and the side panel segments 1634 may be made from a rigid material. As another example, the span segments 1636 may be made from an air barrier material, a vapor barrier material, and/or a vapor retarder material, while the side panel segments 1634 are made from a breathable material, an open netting, or a mesh.

Referring again to FIG. 16D, insulation cavities 50 have a depth D1600. The depth D1600 is defined as the total of the depth of the support members 20 and the widths of the side panel segments that extends below the support members, minus the depth D1602 of the vent space 1082. In one exemplary embodiment, the interconnecting portions 1630 include creases 1660 that allow the depth D1600 to be adjusted using the same interconnecting portions 1630. Thereby, the R value can be adjusted using the same interconnecting portions 1630.

As further shown in FIG. 16C, an insulation pockets 52 are formed as a portion of insulation cavity 50 and located under a support member 20. Distributing loosefill insulation material (not shown) into the insulation cavities results in loosefill insulation material filling the insulation pockets 52. As the filled insulation pockets are located below the support members, the filled insulation pockets are configured to insulate the support members.

Figure 17A:
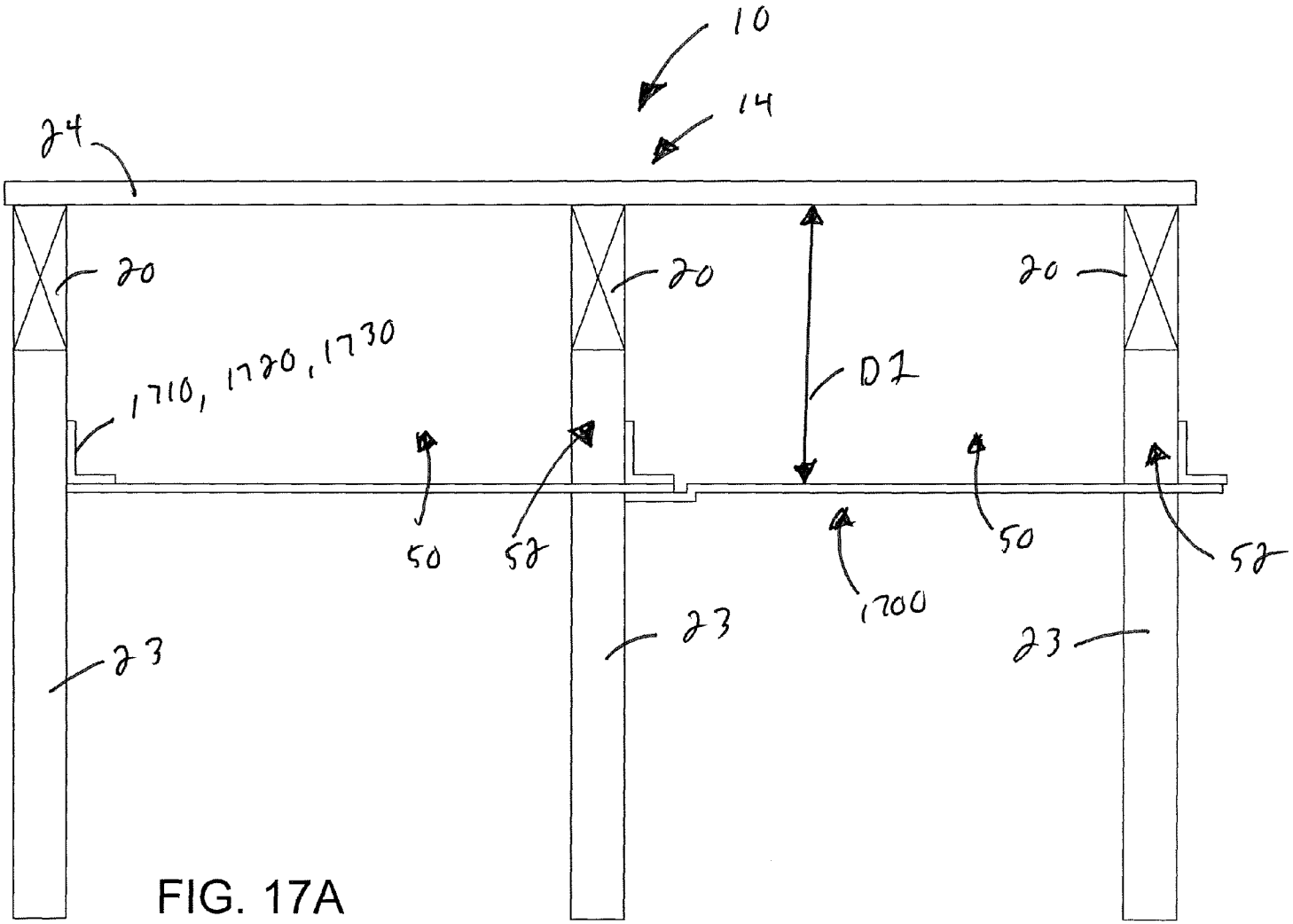
FIGS. 17A-17C illustrate another exemplary embodiment of an insulation system.
Figure 17B:
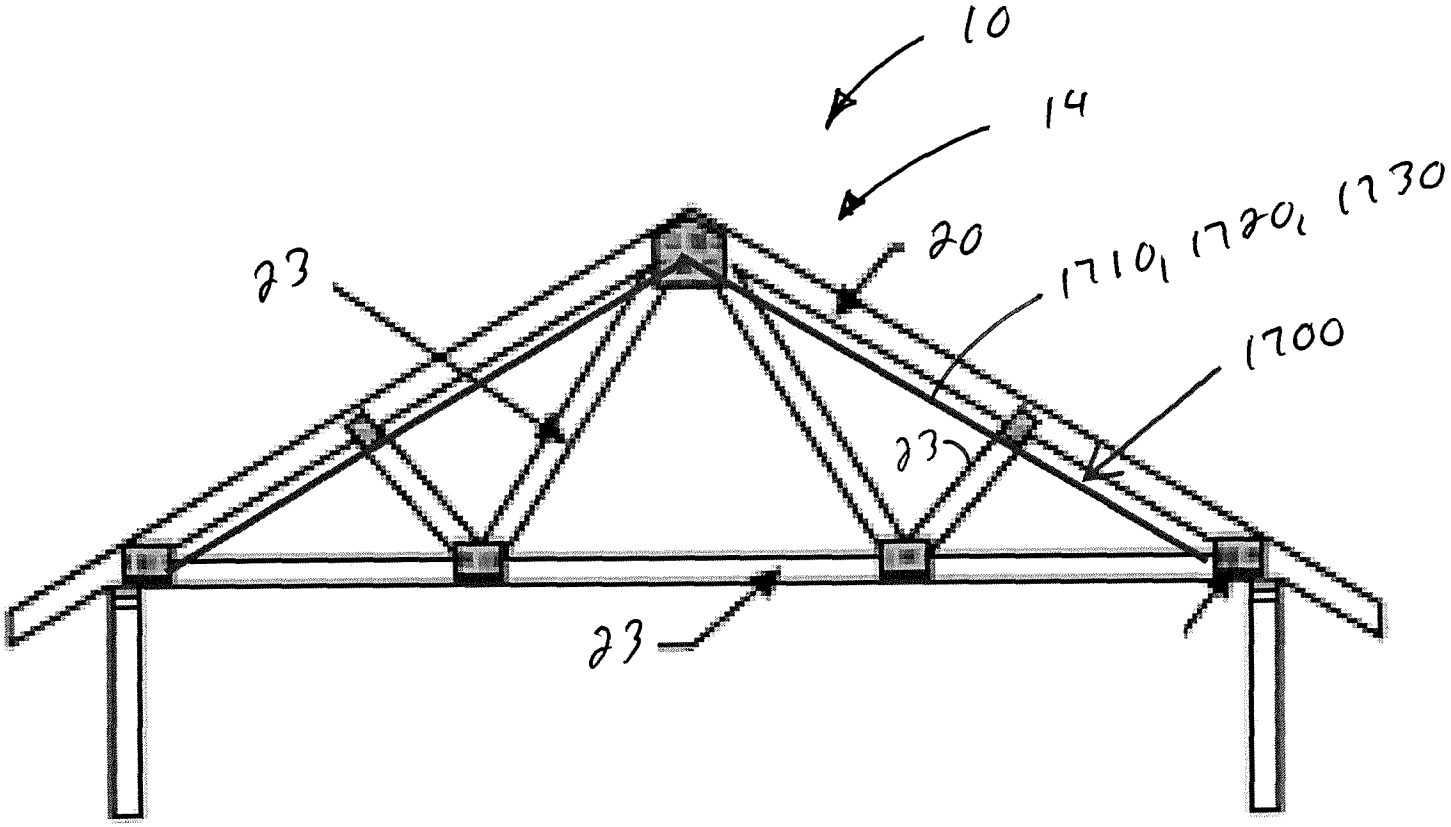
Figure 17C:
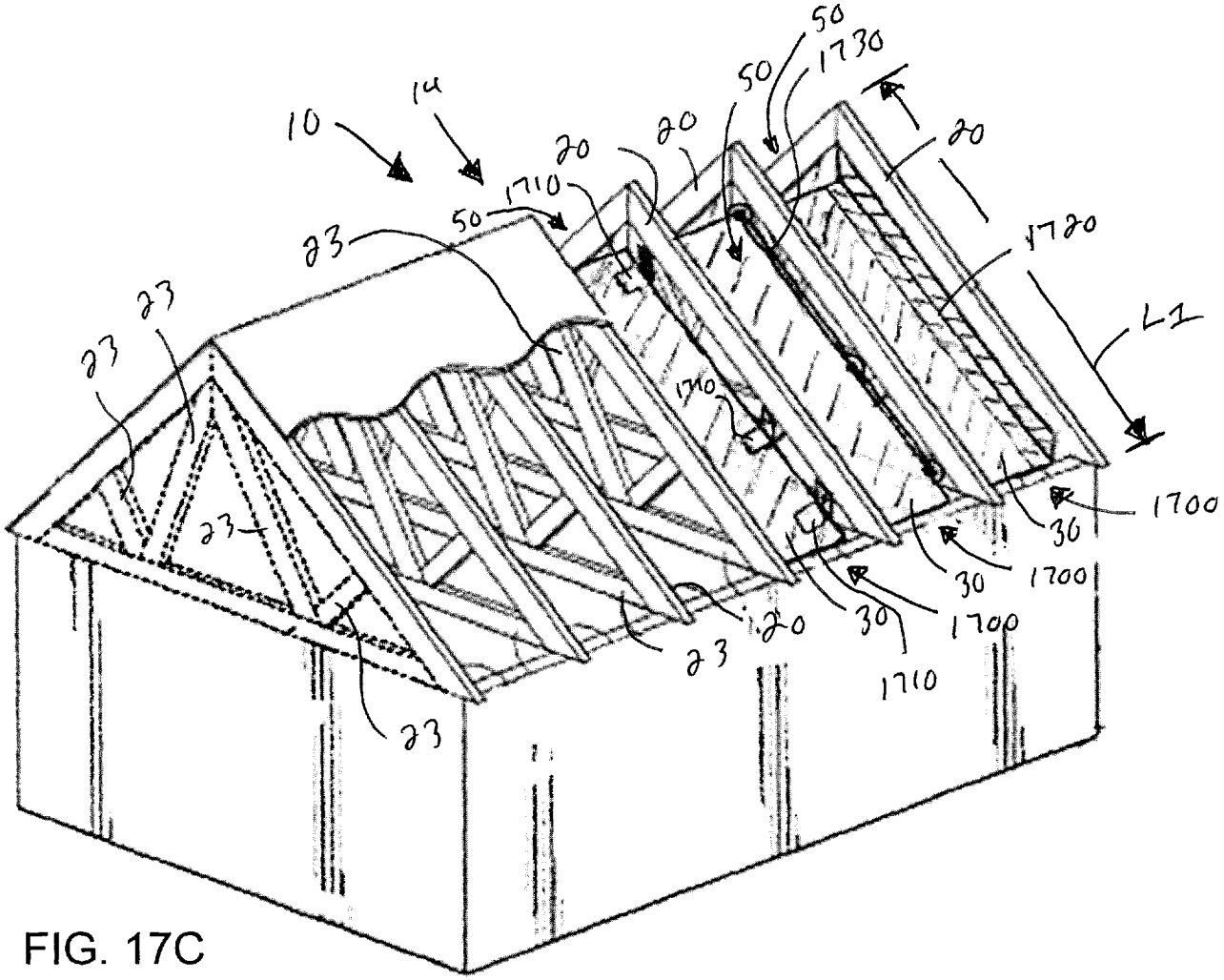

FIGS. 17A-17C illustrate another exemplary embodiment of a building structure 10 having an insulation support system 1700. In the exemplary embodiment illustrated by FIGS. 17A-17C, the insulation support material 30 may be a sheet of material. In the illustrated embodiment, roof sheathing support members 20 are supported by support members 23. For example, when the support members 20 are truss chords, the support members 23 are webs that support the truss chords. In the exemplary embodiment illustrated by FIGS. 17A-17C, the insulation support material 30 is attached to and supported by the support members 23 below the support members 20.

Referring to FIG. 17C, the insulation support material 30 can be attached to and supported by the support members 23 in a wide variety of different ways. For example, discrete brackets 1710 can be attached to the support members 23 and the insulation support material 30 can be attached to the discrete brackets. A continuous bracket 1720 that extends the length L1 of the insulation cavity can be attached to the support members 23 and the insulation support material 30 can be attached to the continuous bracket 1720. A chord, ribbon, rope, or tape 1730 that extends the length L1 of the insulation cavity can be attached to the support members 23 and the insulation support material 30 can be attached to the chord, ribbon, rope, or tape 1730. The insulation support material 30 can be attached to the chord, ribbon, rope, or tape 1730 in a wide variety of different ways. In one exemplary embodiment, the chord, ribbon, rope, or tape 1730 could include hooks that connect with loops on the insulation support material 30. The insulation support material 30 can be connected to the brackets 1710, bracket 1720, or chord, ribbon, rope, or tape 1730 with staples or other desired fasteners, such as the non-limiting examples of double sided tape, adhesives, clips or clamps.

Referring to FIG. 17C, a length of insulation support material is positioned along the length L1 of the adjacent support members 20 and attached to brackets 1710, a bracket 1720, or chord, ribbon, rope, or tape 1730. An insulation cavity 50 extends the length L1 (See FIG. 17C) of the support members 20 and has a depth D1 (See FIG. 17A). Referring to FIG. 17A, insulation pockets 52 are formed as a portion of insulation cavity under support members 20. The insulation support system 1700 illustrated by FIGS. 17A-17C can be filled with loosefill insulation in the same manner as described with respect to the embodiment of FIG. 6 above.

The insulation system illustrated by FIGS. 17A-17C advantageously provides many benefits, although not all benefits may be realized in all circumstances. First, as shown in FIG. 17A, the insulation cavity 50 provides a uniform thickness of the loosefill insulation material. The term "uniform thickness", as used herein, is defined to mean having a substantially consistent depth. Second, the depth D1 of the insulation cavities can be adjusted to provide different depths of the loosefill insulation material. As the thermal resistance (R-Value) of the loosefill insulation material within the insulation cavities is, in part, a function of the depth of the loosefill insulation material, the thermal resistance (R-Value) of the loosefill insulation material can be adjusted by differing depth D1 by adjusting the placement of the brackets 1710, bracket 1720, or chord, ribbon, rope, or tape 1730 on the support members 23. A third advantage is that distributing the loosefill insulation material 58 into the insulation cavity 50 results in loosefill insulation material filling the insulation pockets 52. As the filled insulation pockets 52 are positioned below the support members 20, the filled insulation pockets 52 are configured to insulate the support members 20.

Figure 17D:
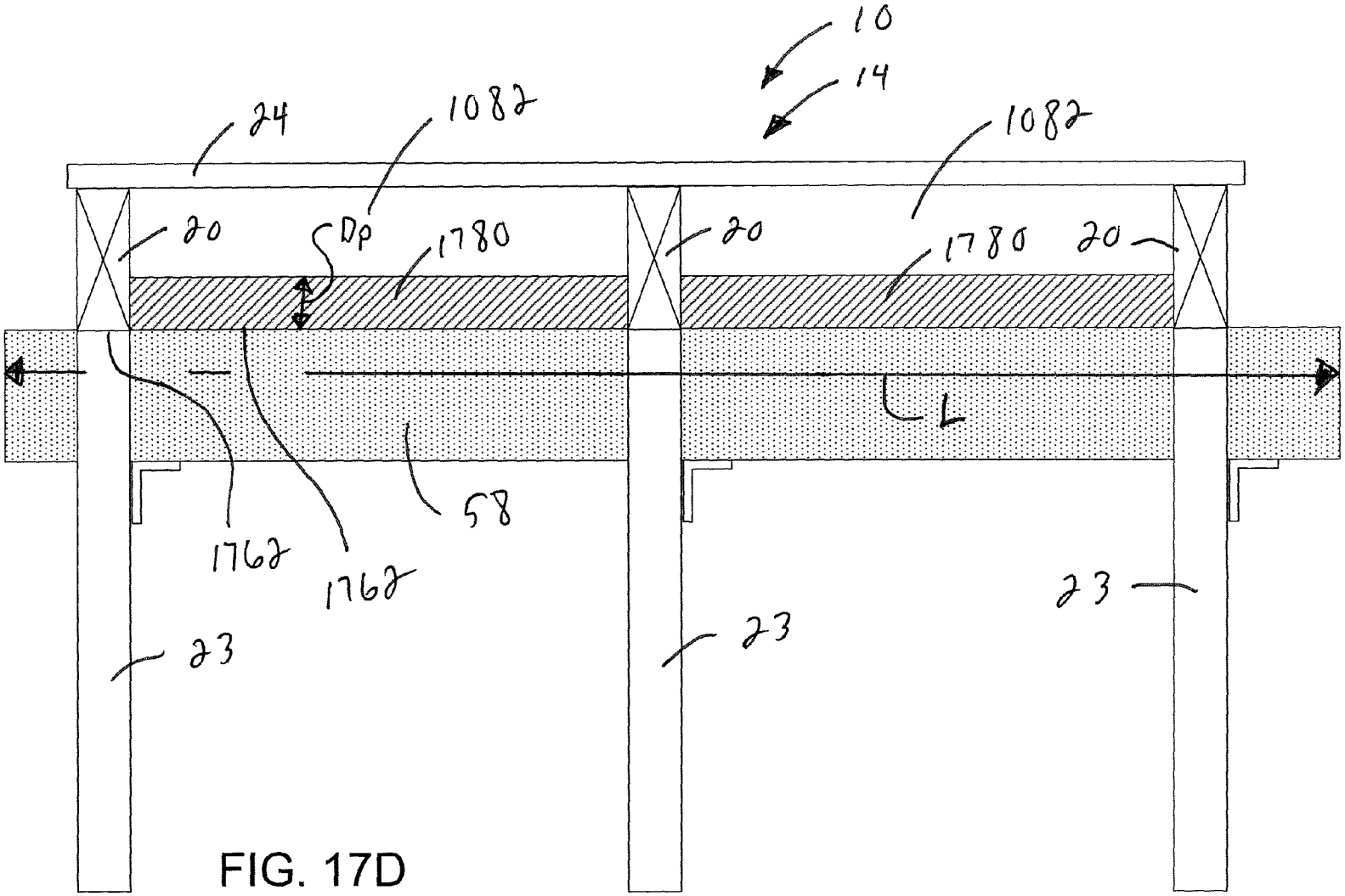
FIG. 17D illustrates another exemplary embodiment of an insulation system.

FIG. 17D illustrates another insulation system. In the example illustrated by FIG. 17D, the system optionally provides a vent space 1082. The vent space 1082 may extend from an eve 1202 of the roof (See FIG. 1) to a ridge 1204 of the roof to cool the sheathing 24 and/or shingles disposed above the sheathing. The vent space 1082 also provides a path for moisture beneath the sheathing to escape.

Support members 20, support members 23 that support members 20, and sheathing panel 24 are illustrated. In a first assembly step, panels 1780 are fastened between pairs of support members 20 to form the vent space 1082. In the illustrated embodiment, the panel 1780 is formed from rigid foam insulation. The rigid foam insulation is configured to complement the insulative characteristics of the insulation system. However, in other embodiments, the panel 1780 can be any desired material, such as for example, plywood. The panel 1780 has a depth DP such that in an installed position, a bottom face of the panel 1780 is substantially flush with bottom faces of support members 20. In one exemplary embodiment, the panel 1780 substantially fills the cavity, such that there is no vent space 1082 or substantially no vent space.

The flush alignment of the panel 1780 with the support members 20 provides a flush surface 1762 for mounting of an insulation material. In one exemplary embodiment, the insulation material 1760 is mounted with the length of the insulation material extending along the length L1 of the support members 20. In the example illustrated by FIG. 17D, an insulation material 1760, such as a batt of fiberglass insulation, a foam insulation board, and the like, can be mounted with the length L extending across three or more support members. The insulation material 1760 can be mounted to the flush surface 1762 in a wide variety of different ways. In the example illustrated by FIG. 17D, brackets 1710, bracket 1720, or chord, ribbon, rope, or tape 1730 on the support members 23 support the insulation material 1760 (See FIG. 17C). The brackets 1710, bracket 1720, or chord, ribbon, rope, or tape 1730 on the support members 23 optionally hold or sandwich the insulation material 1760 against the panel 1780. The brackets 1710, bracket 1720, or chord, ribbon, rope, or tape 1730 on the support members 23 can support the insulation material 1760 without penetrating the insulation material 1760 of a facing of the insulation material, like a nail or staple would. This support system is useful when the insulation material 1760 or a facing on the insulation material provides an air barrier.

Figure 18A:
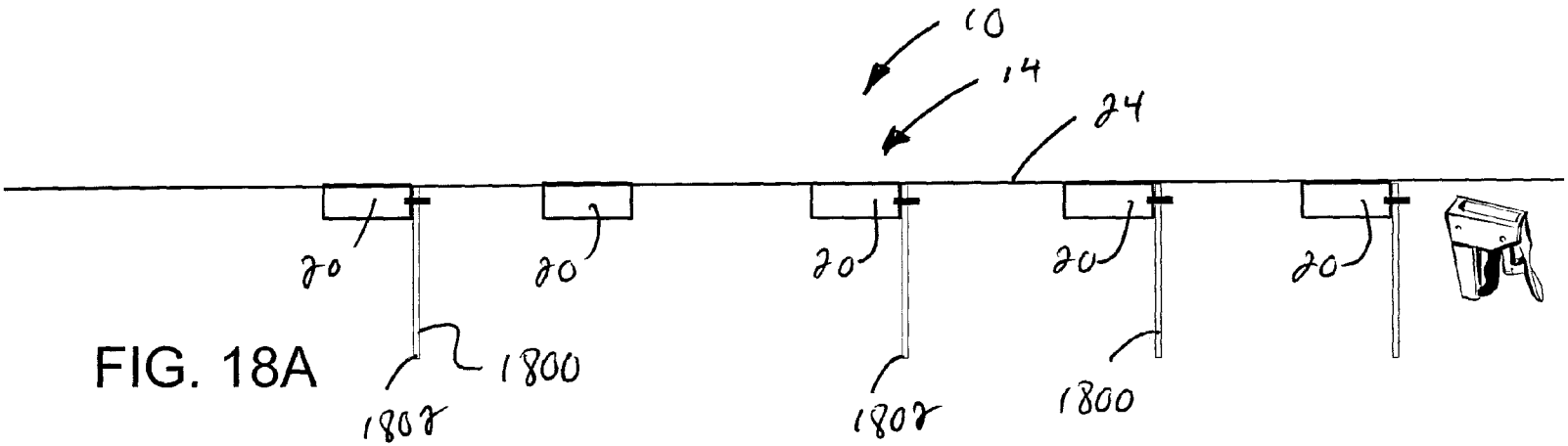
FIGS. 18A-18C illustrate another exemplary embodiment of an insulation system.
Figure 18B:
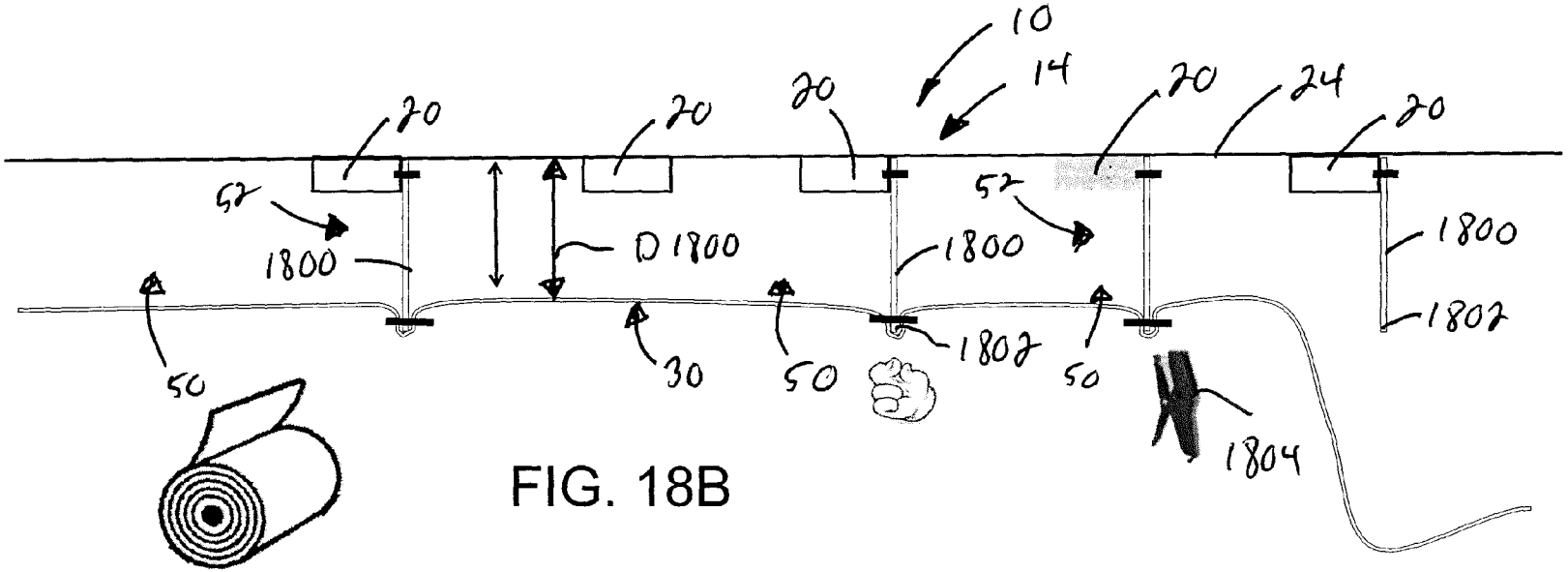
Figure 18C:
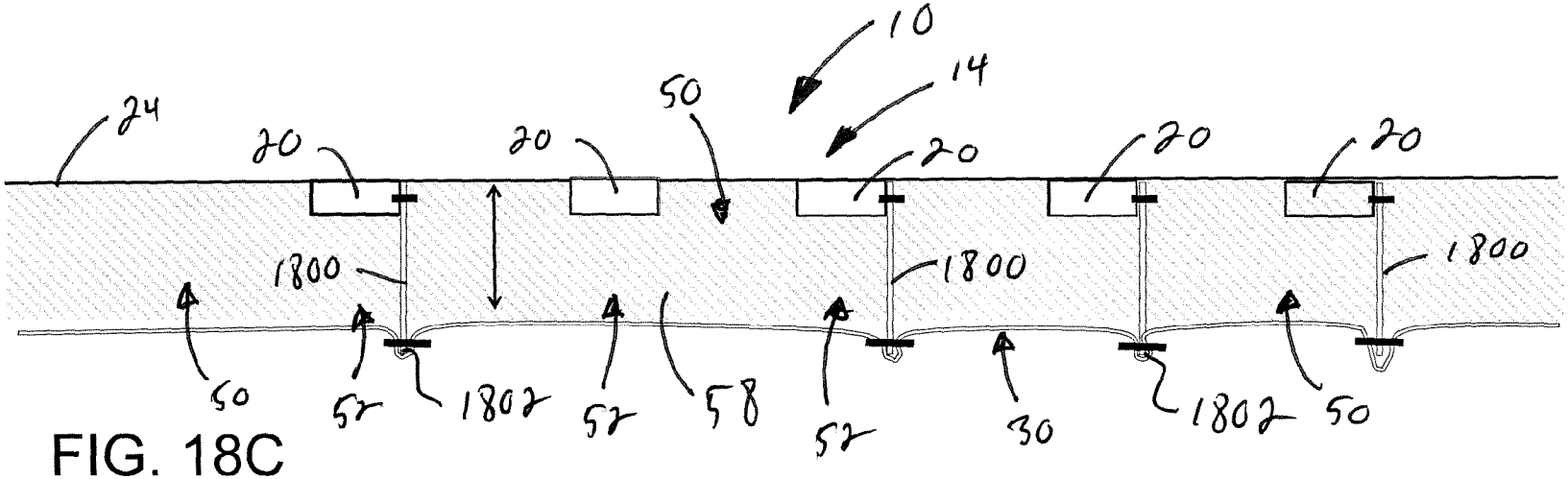

Referring now to FIGS. 18A-18C, another method of forming insulation cavities is illustrated. Generally, this method entails use of a supports 1800 secured to support members 20. Insulation support material 30 is secured to ends 1802, for example by pinching the insulation support material 30 over the ends 1802 and securing the insulation support material 30 to the ends 1802 with a fastener 1804.

The supports 1800 are connected to support members 20. The support members 1800 can be attached to the support members 20 in a wide variety of different ways. For example, fasteners, such as nails, staples, clips, and clamps, and/or adhesives can be used to connect the supports 1800 to the support members 20. Sheathing panels 24 are attached to the support members 20.

The supports 1800 can be made from a wide variety of different materials and can have a variety of different configurations. In an exemplary embodiment, supports 1800 are rigid or substantially rigid and abut the sheathing panel 24 before being secured to the support members. This abutment accurately and repeatably sets the depth D1800 of the insulation cavity 50. Using different supports 1800 allows the depth of the insulation cavities 50 to be varied in the same building structure 10 or between different building structures. The supports 1800 can be formed from structural cardboard material, fabric or fiberglass scrim, wood, foam, etc. In one exemplary embodiment, the supports 1800 may have a length that corresponds to the length L1 of the support members 20, such that the supports 1800 extend substantially from the eave 1006 of the roof to the ridge 1010 of the roof. In another exemplary embodiment, the supports 1800 may have a length that is much shorter than the length L1 of the support members 20. In this embodiment, discrete, spaced apart supports 1800, such that the supports 1800 are attached to the support members from the eave 1006 of the roof to the ridge 1010 of the roof, with gaps in-between.

The length (longer dimension) of the insulation support material 30 extends across the supports 1800 as illustrated by FIG. 18B. In another exemplary embodiment, the length of the insulation support material 30 extends in the direction of the length of the support members 20. The support material 30, pairs of spaced apart supports 1800, and sheathing 24 define insulation cavities 50. In the illustrated embodiment, the insulation cavities 50 have boxlike cross-sectional shapes that are substantially retained after loosefill insulation is blown into the insulation cavities. As illustrated by FIGS. 18A and 18B, insulation supports 1800 may not be attached to every support member 20, such that some insulation cavities 50 span multiple support members. As such, the width of the insulation cavities 50 is adjustable.

Referring now to FIG. 18C, loosefill insulation 150 is distributed within the insulation cavities 50. Insulation pockets 52 are formed as a, portion of insulation cavity located under the support members 20. In the embodiment where gaps are formed between discrete, spaced apart supports 1800, distribution of loosefill material 58 into one cavity 50 causes the loosefill material 58 to pass into another cavity through the gaps. This allows multiple cavities 50 to be filled at once by inserting the loosefill supply hose into a single cavity. Distributing loosefill insulation material 58 into the insulation cavities 50 results in loosefill insulation material filling the insulation pockets 52. As the filled insulation pockets 52 are positioned below the support members 20, the filled insulation pockets 52 are configured to insulate the support members 20.

Figure 19:
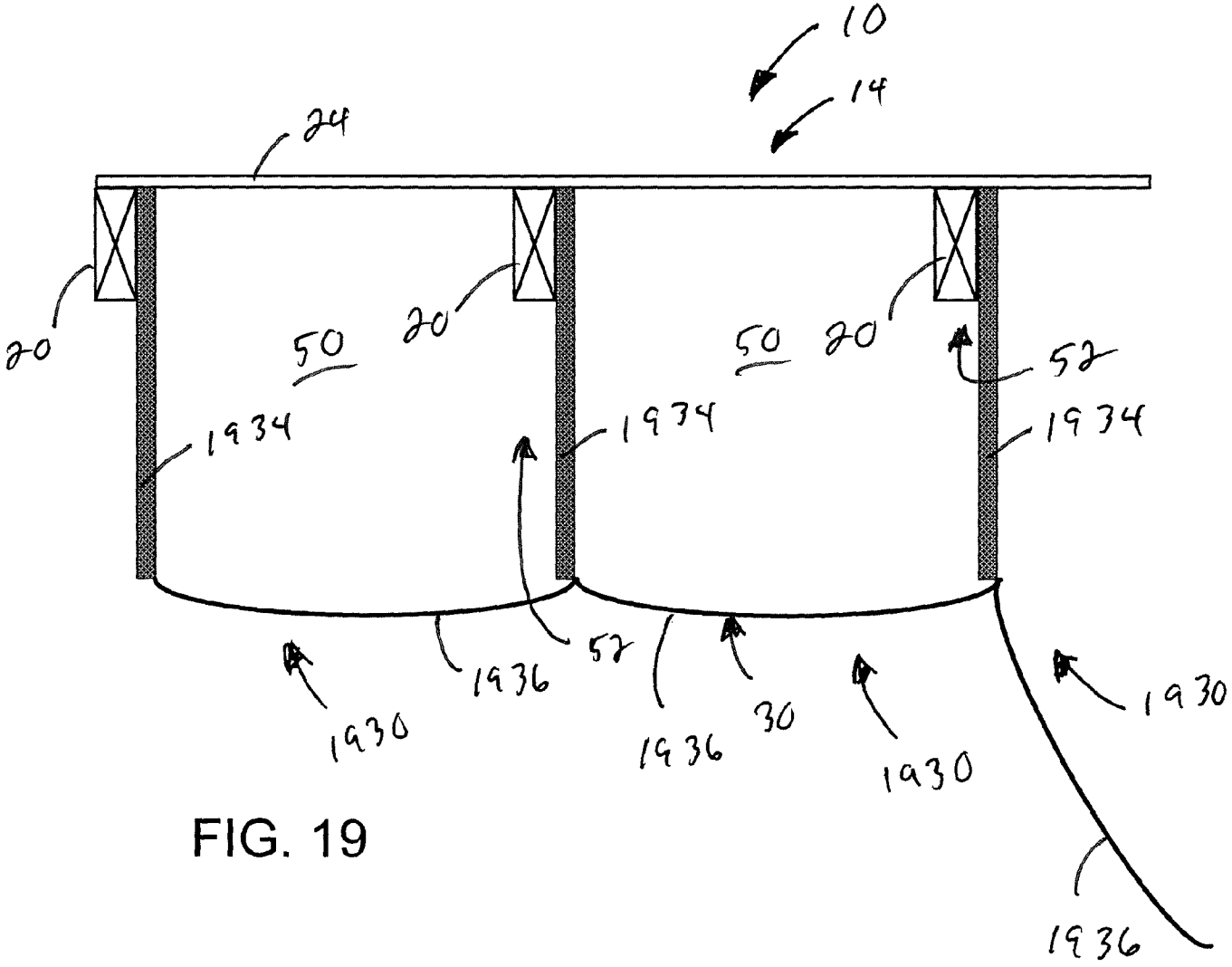
FIG. 19 illustrates another exemplary embodiment of an insulation system.

FIG. 19 illustrates another exemplary embodiment of an insulation system. Generally, this method entails use of interconnecting insulation support components 1930. In the example illustrated by FIG. 19, the support components 1930 each include a rigid or at least partially rigid side panel 1934 and a flexible insulation support or span portion 1936, such as netting, for example, the netting 30 described in the embodiments illustrated by FIGS. 2A, 2B and 3-6. The interconnecting support components 1930 may take a wide variety of different forms and may take a wide variety of different configurations. For example, the side panel 1934 may comprise cardboard, plastic, foam board and the like. Span portion 1936 may comprise a plastic film, a mesh, combinations of plastic film and mesh, and the like. In one exemplary embodiment, the span portion 1936 material may be a breathable material, a vapor barrier, a vapor retarder, and/or an air barrier material.

Support members 20 and sheathing panel 24 and interconnecting support components 1930 are illustrated by FIG. 19. Side panel segment 1934 of an interconnecting support component 1930 is positioned adjacent to a support member 20, in abutment with sheathing panel 24, and fastened to the support member 20. The abutment of the side panel segment 1934 with the sheathing panel 24 sets the depth the insulation cavity.

The span segments 1936 are configured for attachment to the side panel segments 1934, thereby forming insulation cavities. The span segment 1936 of one interconnecting support component 1930 is connected to side panel segment 1934 of another interconnecting support component 1930 with any desired fastener, tape, adhesive, and the like.

Figure 20:
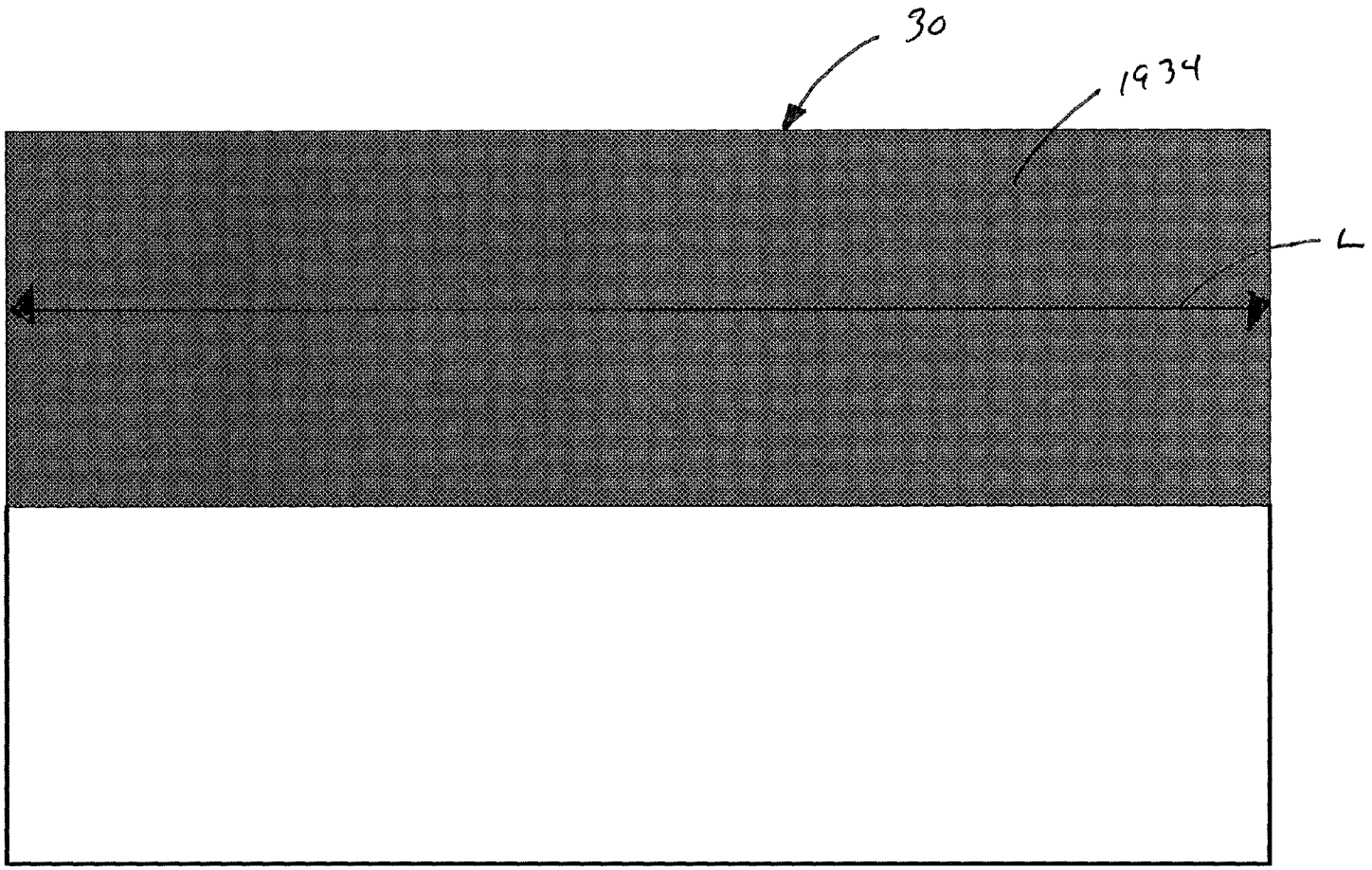
FIG. 20 illustrates an example of a netting material for the insulation system illustrated by FIG. 19.
Figure 21:
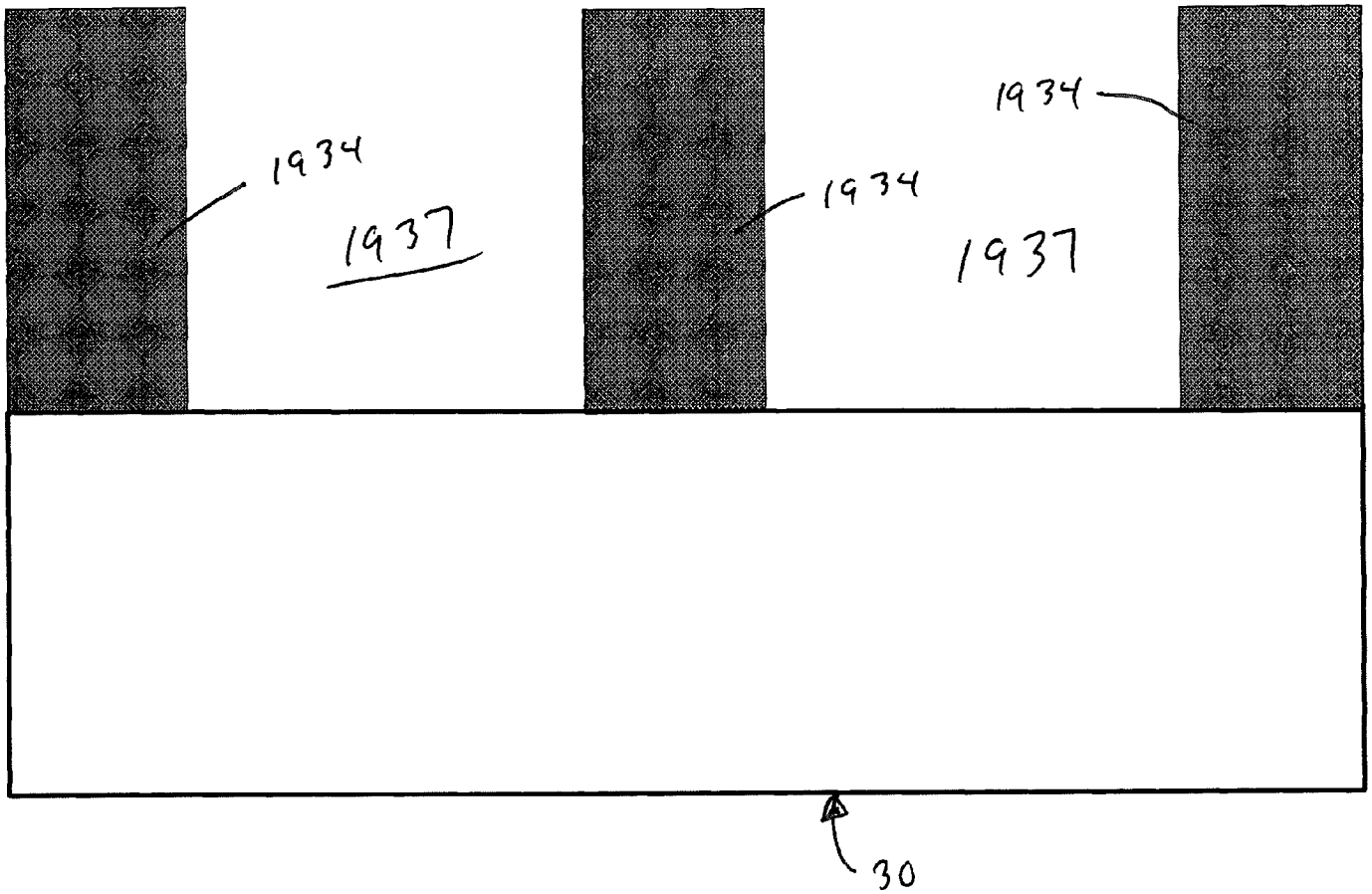
FIG. 21 illustrates an example of a netting material for the insulation system illustrated by FIG. 19.
Figure 22:
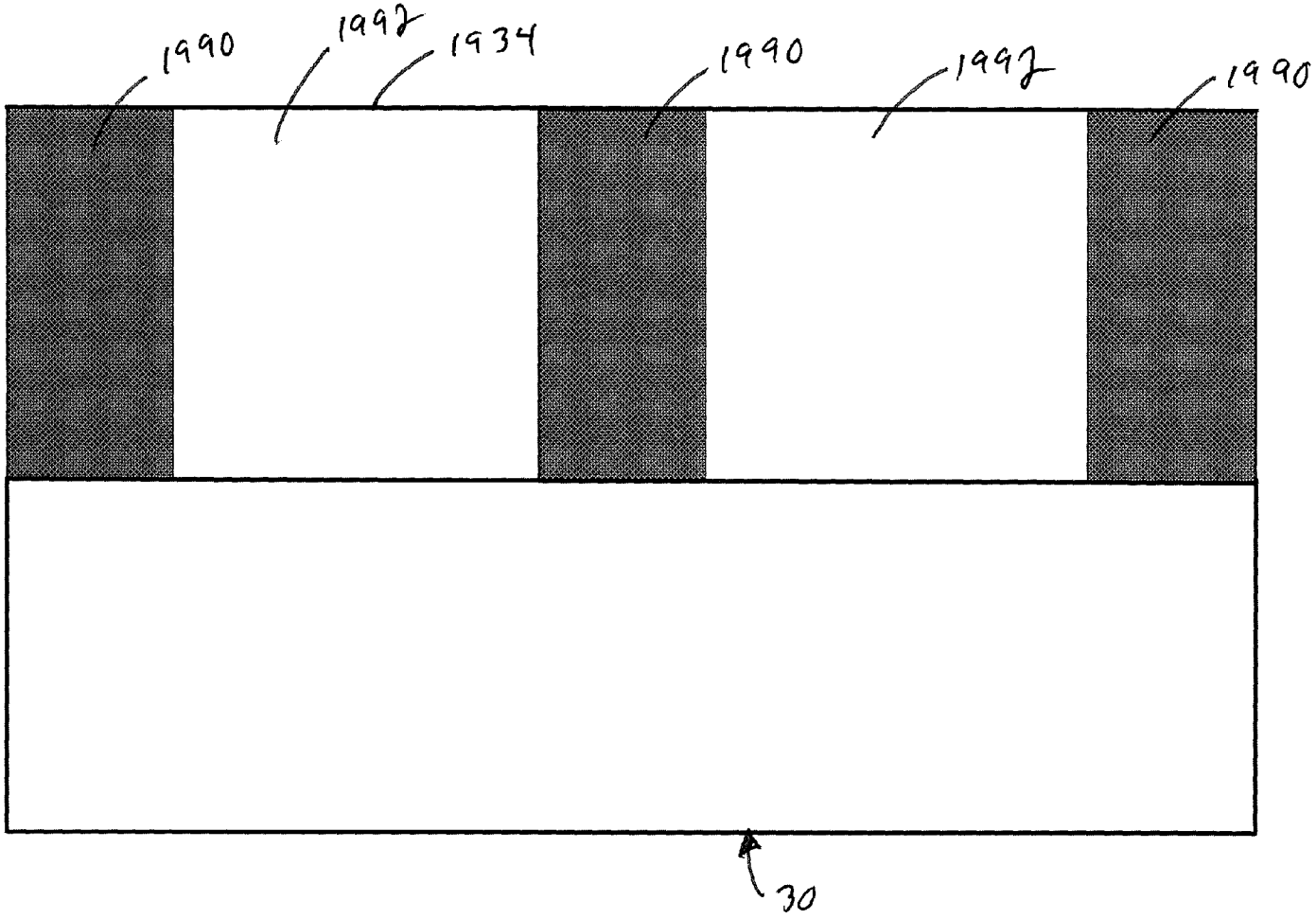
FIG. 22 illustrates an example of a netting material for the insulation system illustrated by FIG. 19.

Referring to FIG. 20, in one exemplary embodiment, side panel segments 1934 are continuous and have a length that corresponds to the length L1 of the support members 20, such that the supports side panel segments 1934 extend substantially from the eave 1006 of the roof to the ridge 1010 of the roof. Referring to FIG. 21, in another exemplary embodiment, the side panel segments 1934 have a length that is much shorter than the length L1 of the support members 20. In this embodiment, discrete, spaced apart side panel segments 1934 are attached to the span segment 1936 with gaps 1937 in-between. Referring to FIG. 22, in another exemplary embodiment, the side panel segments 1934 have rigid portions 1990 with lengths that are much shorter than the length L1 of the support members 20 and flexible portions 1992 in between the rigid portions 1990. In one exemplary embodiment, the flexible portions do not substantially restrict airflow, so that air that blows the loosefill insulation 58 into the cavity 50 can escape the cavity.

Referring to FIG. 19, insulation pockets 52 are formed as a portion of insulation cavities 50 and located under support members 20. In the embodiment of FIG. 21, where gaps are formed between discrete, spaced apart side panel segments 1934, distribution of loosefill material 58 into one cavity 50 causes the loosefill material 150 to pass into another cavity through the gaps. This allows multiple cavities 50 to be filled at once by inserting the loosefill supply hose into a single cavity. Distributing loosefill insulation material (not shown) into the insulation cavities results in loosefill insulation material filling the insulation pockets. As the filled insulation pockets are located below the support members, the filled insulation pockets are configured to insulate the support members.

FIGS. 23A-23D, 24A-24C, and 25-27 illustrate another exemplary embodiment of an insulation system. This method entails use of insulation support components 2330. In the example illustrated by FIGS. 23A-23D, 24A-24C, and 25-27, the support components 2330 each include a pair of rigid or at least partially rigid side members 2334 and a flexible center portion 2336, such as netting, for example, the netting 30 described in the embodiments illustrated by FIGS. 2A, 2B and 3-6. The support components 2330 may take a wide variety of different forms. For example, the side members 2334 may comprise cardboard, plastic, foam board and the like. In the illustrated embodiment, the side members 2334 are "L" shaped in cross-section, but may have any shape. For example, the side members 2334 may be straight. The flexible center portion 2336 may comprise a plastic film, a mesh, combinations of plastic film and mesh, and the like. In one exemplary embodiment, the all or portions of the side members 2334 and/or all or portions of the flexible center portion 2336 may be made from a breathable material, a vapor barrier, a vapor retarder, and/or an air barrier material.

Figure 23B:
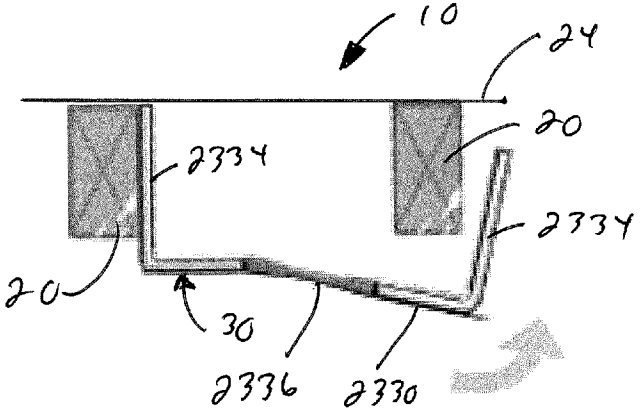
FIGS. 23A-23D illustrate another exemplary embodiment of an insulation system.
Figure 23A:
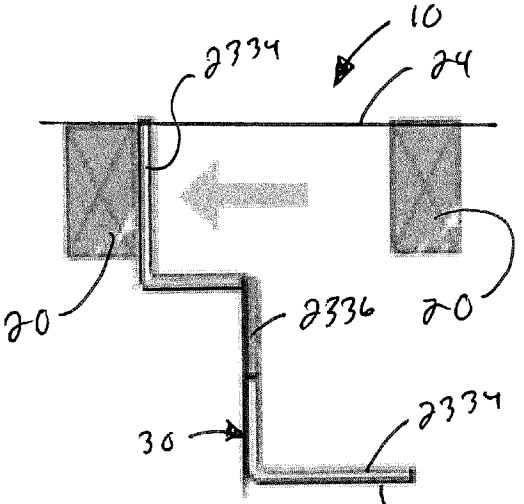
Figure 23C:
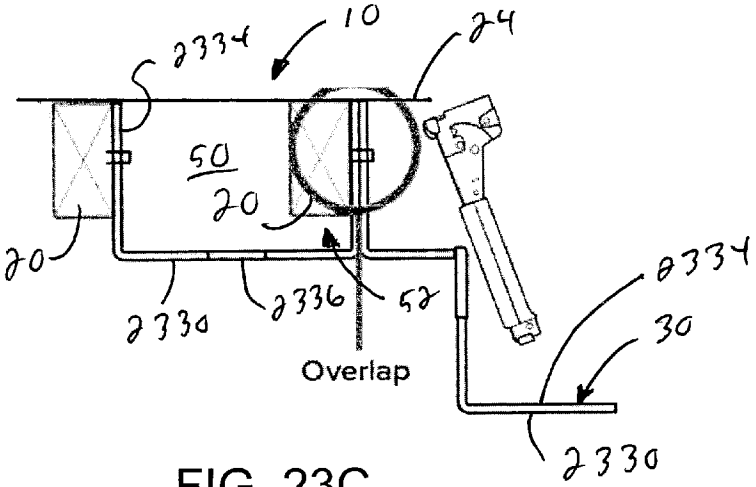
Figure 23D:
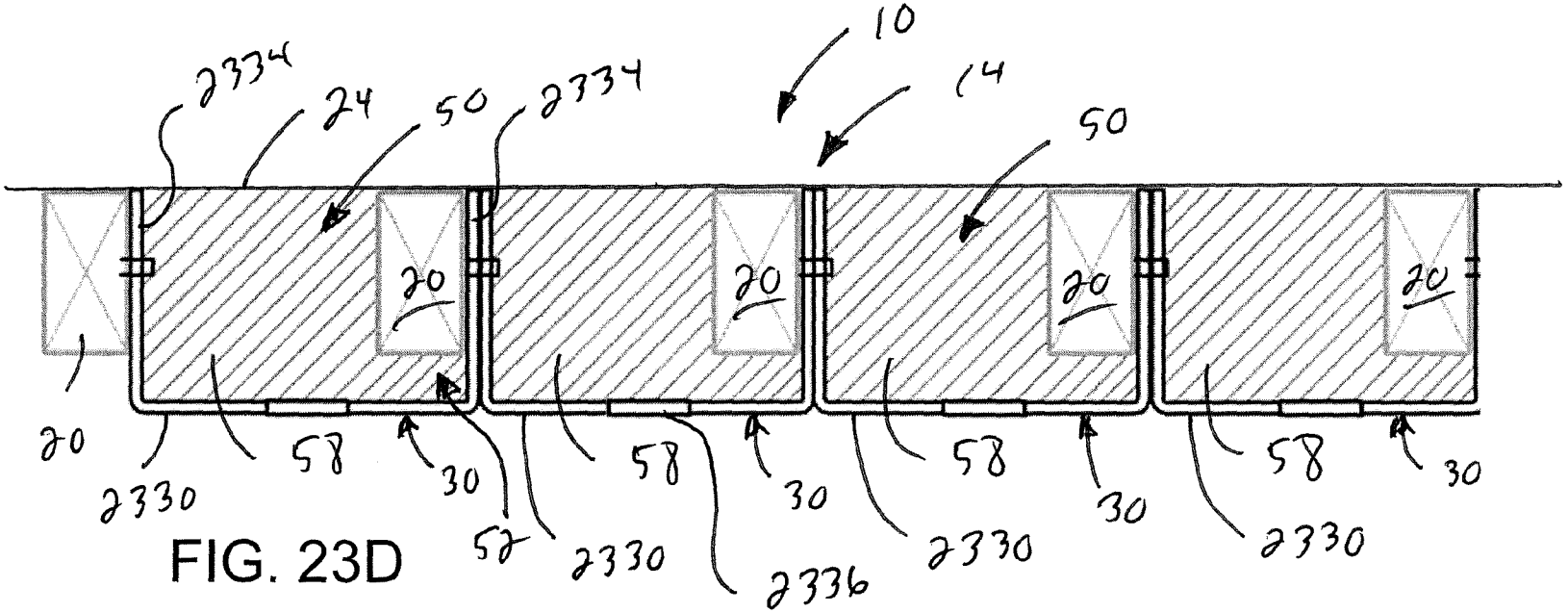
Figure 24A:
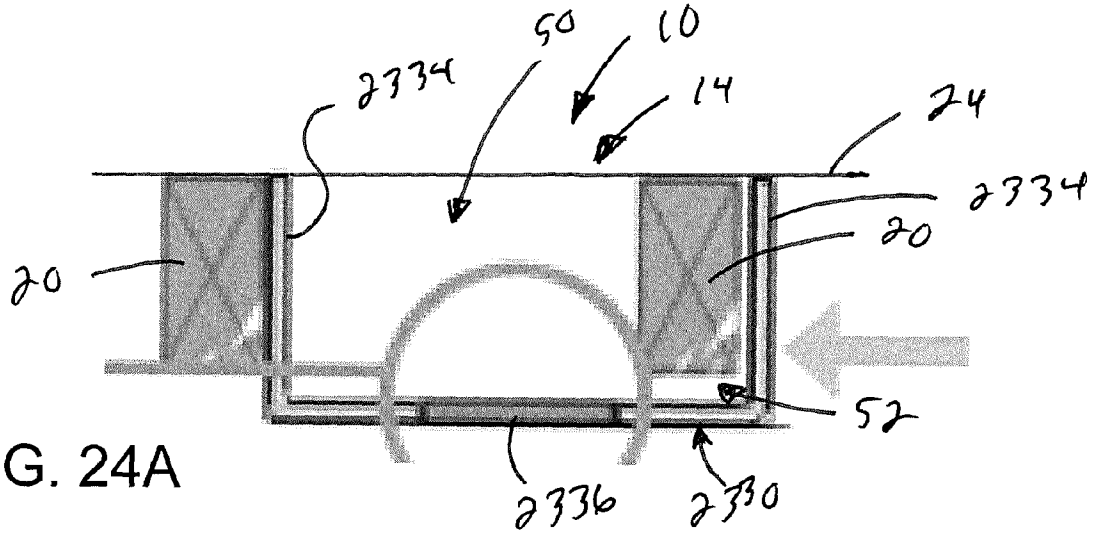
FIGS. 24A and 24B illustrate widening of the insulation system of FIGS. 23A-23D to accommodate wider spaces between structural members.
Figure 24B:
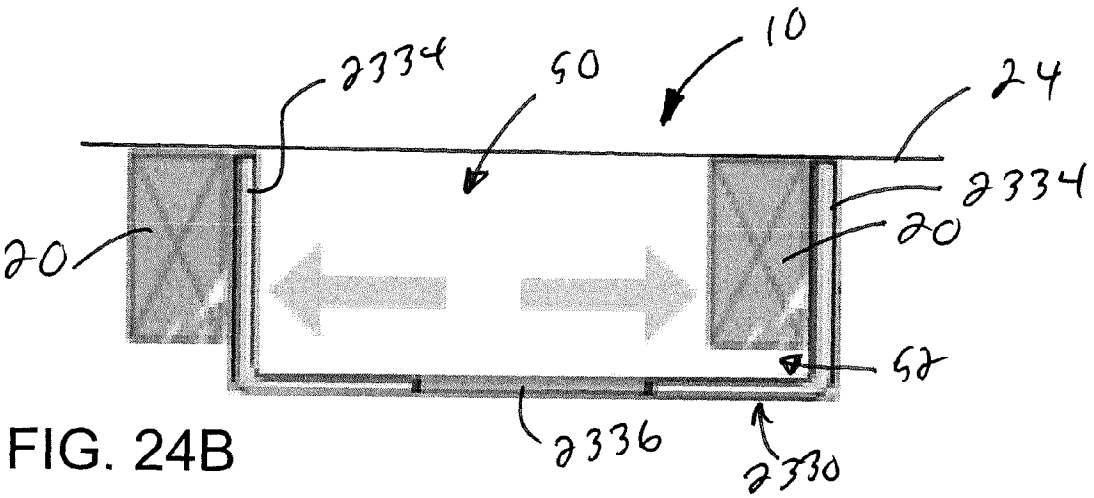
Figure 24C:
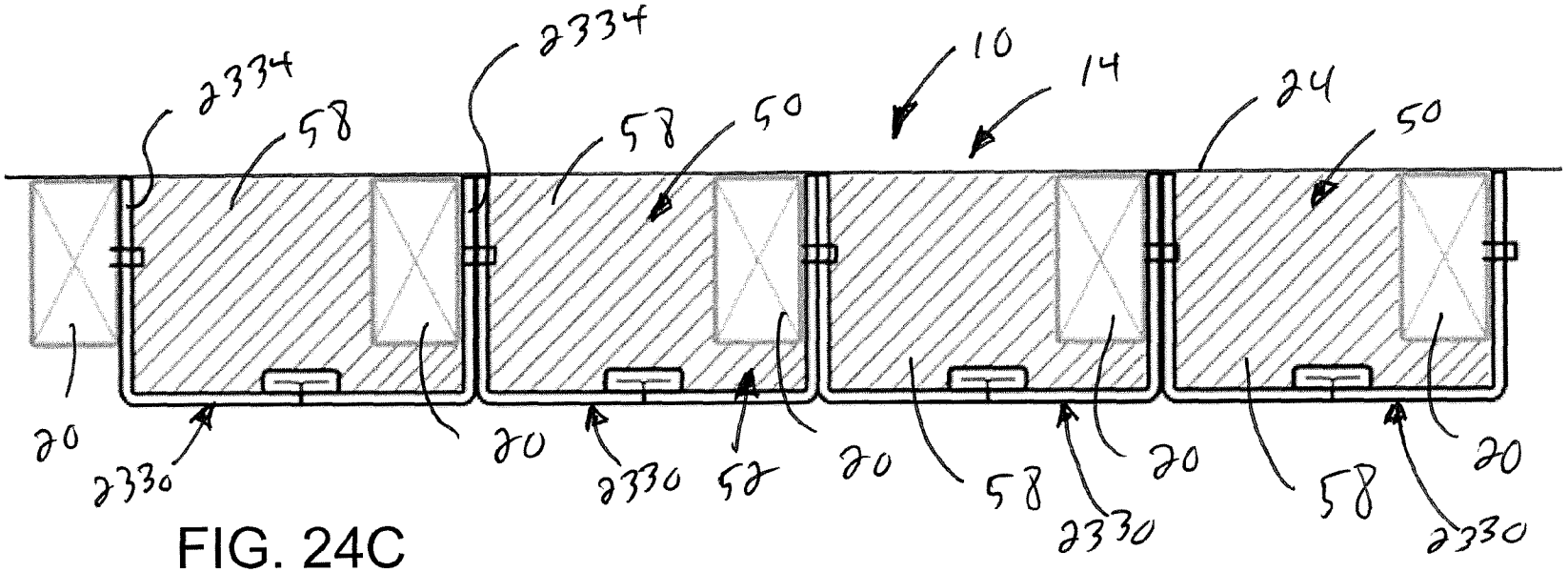
FIG. 24C illustrates narrowing of the insulation system of FIGS. 23A-23D to accommodate narrower spaces between structural members.
Figure 25:
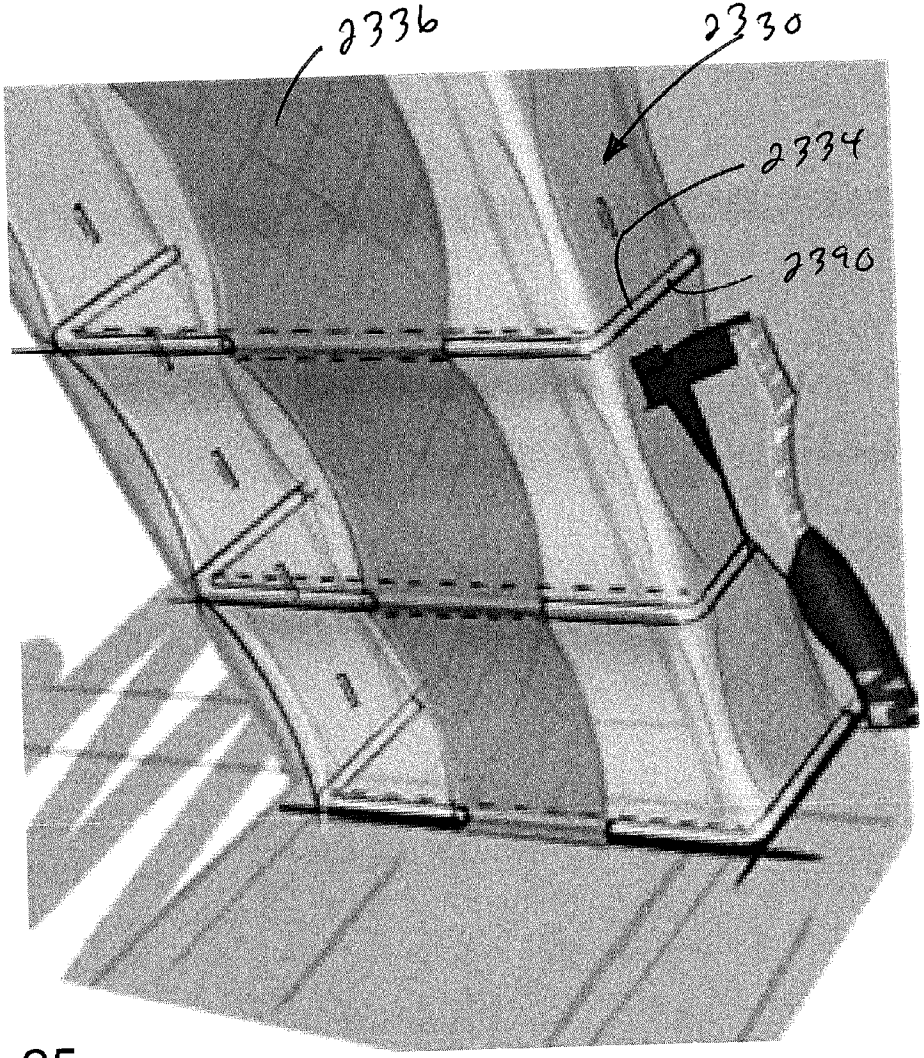
FIG. 25 is a perspective view of an insulation support system being installed on a building structure.

Support members 20, a sheathing panel 24, and support components 2330 are illustrated by FIGS. 23A-23D, 24A-24C, and 25-27. Referring to FIG. 23A, a side member 2334 of support component 2330 is positioned adjacent to a support member 20, in abutment with sheathing panel 24, and fastened to the support member 20. Referring to FIGS. 23B and 25, the side member 2334 of support component 2330 is positioned adjacent to a support member 20, in abutment with sheathing panel 24, and fastened to the support member 20. The abutment of the side members 2334 with the sheathing panel 24 sets the depth of the insulation cavity. Referring to FIGS. 23C and 23D, the side members 2334 of other support components 2330 are fastened to additional support members 20 to form multiple insulation cavities 50.

Referring to FIGS. 24A and 24B, in one exemplary embodiment, the flexible center portion 2336 is stretchable or extendable to accommodate different spacings between support members 20. In an exemplary embodiment, the flexible center portion 2336 is resilient to allow the support component 2330 to retract after being stretched. FIG. 24A illustrates the flexible center portion 2336 retracting to accommodate a narrower spacing between the support members 20. FIG. 24B illustrates the flexible center portion 2336 being stretched to accommodate a wider spacing between the support members 20. FIG. 24C illustrates that the flexible center portion 2336 can be inwardly folded to accommodate spaces between support members 20 that are narrower than the retracted width of the support component 2330.

Figure 26:
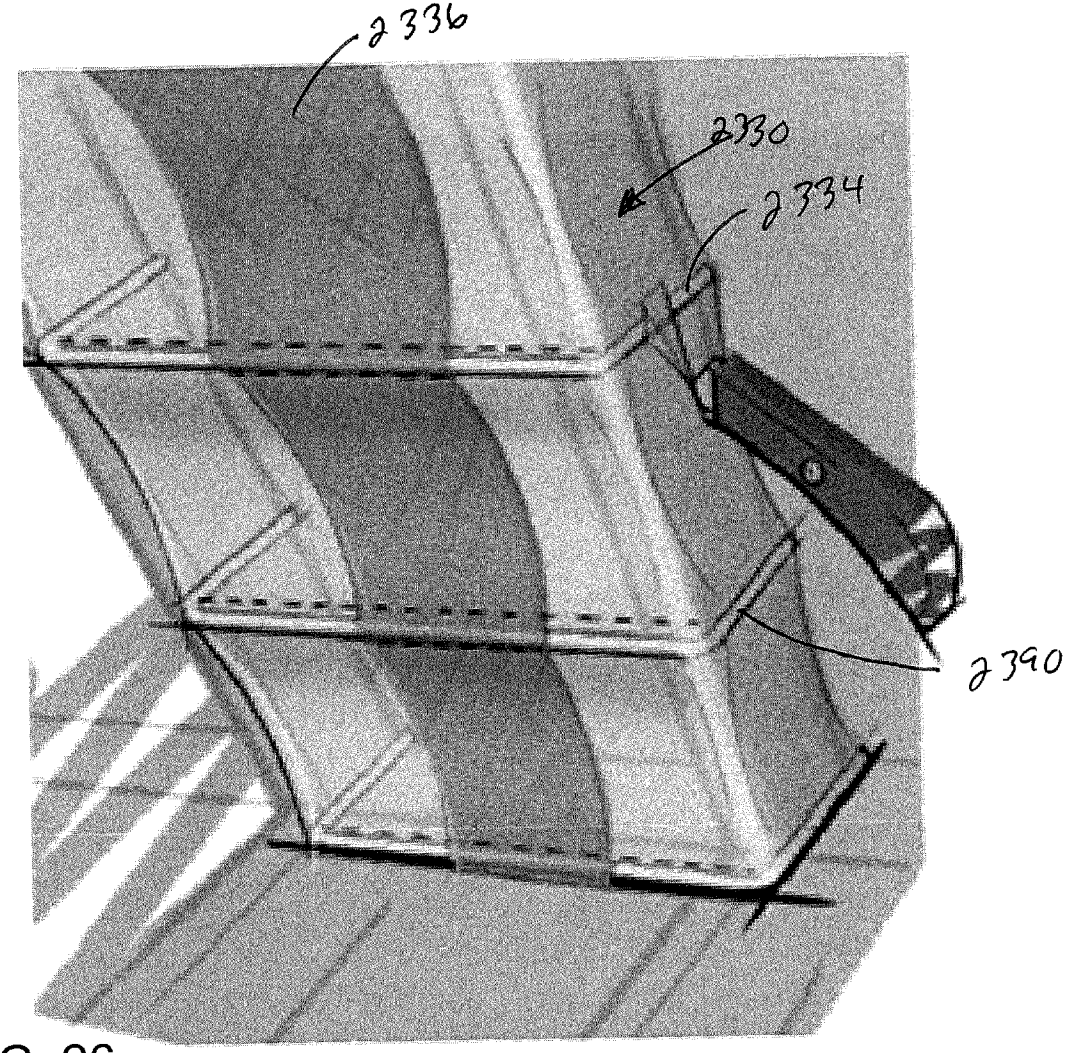
FIG. 26 illustrates cutting of the insulation support system of FIG. 25 being cut to accommodate a truss web.
Figure 27:
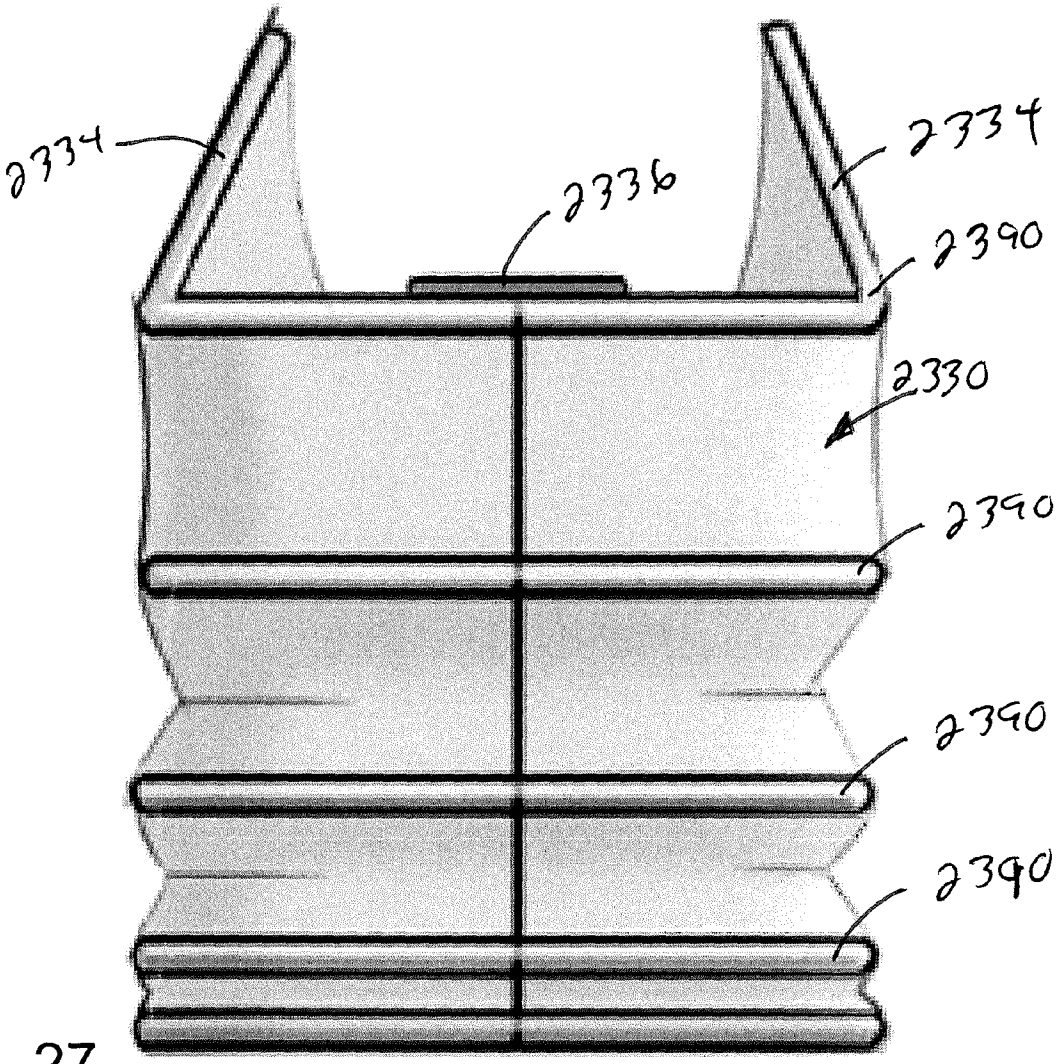
FIG. 27 illustrates that the insulation support system of FIG. 25 may have an accordion configuration that allows the insulation support system to be compressed for shipping and handling.

In one exemplary embodiment, side members 2334 are continuous and have a length that corresponds to the length L1 of the support members 20, such that the supports side members 2334 extend substantially from the eave 1006 of the roof to the ridge 1010 of the roof. Referring to FIGS. 25-27. in one exemplary embodiment, the side members 2334 have narrow rigid portions 2390 that are much narrower than the length L1 of the support members 20 and a flexible portion 2392 that is supported by the narrow rigid portions 2390. Referring to FIG. 27, in one exemplary embodiment the configuration of the narrow rigid portions and the flexible portion provides the support component 2330 with an accordion configuration that allows the insulation support system to be compressed in length for shipping and handling and expanded in length for installation. In one exemplary embodiment, the flexible portions do not substantially restrict airflow, so that air that blows the loosefill insulation 58 into the cavity 50 can escape the cavity.

Referring to FIG. 23D, insulation pockets 52 are formed as a portion of insulation cavities 50 and located under support members 20. Distributing loosefill insulation material (not shown) into the insulation cavities results in loosefill insulation material filling the insulation pockets. As the filled insulation pockets are located below the support members, the filled insulation pockets are configured to insulate the support members.

Referring to FIG. 26, in one exemplary embodiment, the side members 2334 or portions of the side members 2334 are formed from a material that is easily cutable, for example cutable by a utility knife. This cutability allows slots or openings to be cut in the side members 2334 to allow side members 2334 to be installed over cross-members 23 of trusses. For example, the side members may be made from an air barrier material, a vapor barrier material, and/or a cardboard material that is easily cutable with a utility knife razor blade. In another exemplary embodiment, the side members 2334 have pre-cut slots or openings that allow the side members 2334 to be installed over cross-members of trusses.

Figure 28:
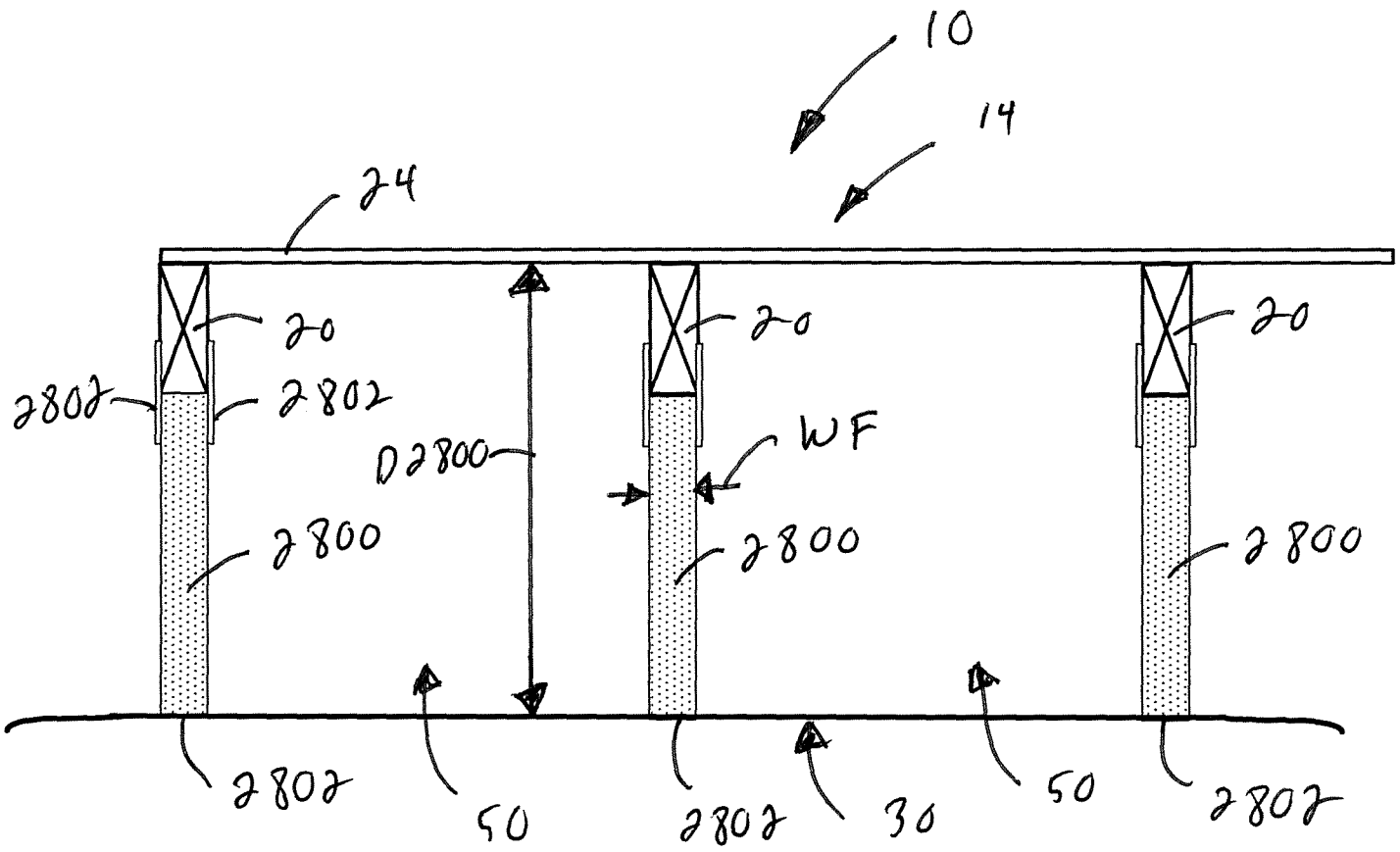
FIG. 28 is an illustration of an exemplary embodiment of an insulation support system.

Referring now to FIG. 28, another method of forming insulation cavities is illustrated. Generally, this method entails use of a supports 2800 secured to faces of support members 20. Insulation support material 30 is secured to ends 2802, for example by stapling, gluing, or otherwise fastening the insulation support material 30 to the ends 2802. In one exemplary embodiment, the supports 2800 are pre-installed on the support members 20 by the manufacturer of the support members. For example, the support members 20 may be truss chords of pre-assembled trusses. The truss manufacturer uses computer software to size and cut all of the components of the truss, including the supports. The truss manufacturer the pre-assembles the truss, including the supports 2800 to reduce thermal bridging. The supports allow an insulation batt or blown-in insulation support 30 to be easily assembled to the truss. The insulation batt may be a FRK-25 or FSK-25 faced insulation batt.

The support members 2800 are connected to support members 20. The support members 2800 can be attached to the support members 20 in a wide variety of different ways. For example, fasteners, such as nails, staples, clips, and clamps, and/or adhesives can be used to connect the supports 2800 to the support members 20. In the example illustrated by FIG. 28, fastening substrates 2802 are attached to opposite sides of the support members 2800 and the support members 20 to fasten the two together. The substrates 2802 can take a wide variety of different forms. For example, the substrates 2802 can be tape, metal, plastic or wood panels, etc. Sheathing panels 24 are attached to the support members 20.

The supports 2800 can be made from a wide variety of different materials and can have a variety of different configurations. In an exemplary embodiment, supports 2800 are rigid or substantially rigid and abut the support members 20 before being secured to the support members. This abutment accurately and repeatably sets the depth D2800 of the insulation cavity 50. Using different supports 2800 allows the depth of the insulation cavities 50 to be varied in the same building structure 10 or between different building structures. The supports 2800 can be formed from structural cardboard material, fabric or fiberglass scrim, wood, insulating foam, etc. In one exemplary embodiment, the width WF of a foam support 2800 matches or substantially matches the width WS of the support 20. As such, the foam support 2800 insulates the support members 20.

In one exemplary embodiment, the support members 2800 may have a length that corresponds to the length L1 of the support members 20 or lengths that correspond to lengths of spans of the support members between web supports 23, such that the supports 1800 extend substantially from the eave 1006 of the roof to the ridge 1010 of the roof. As such, the support members 2800 may insulate or substantially insulate the entire length and/or width of the support members 20.

In another exemplary embodiment, the supports 2800 may have a length that is much shorter than the length L1 of the support members 20. In this embodiment, discrete, spaced apart supports 00, such that the supports 1800 are attached to the support members 20 from the eave 1006 of the roof to the ridge 1010 of the roof, with gaps in-between.

The length (longer dimension) of the insulation support material 30 extends across the supports 2800 as illustrated by FIG. 28. In another exemplary embodiment, the length of the insulation support material 30 extends in the direction of the length of the support members 20. The support material 30, pairs of spaced apart supports 2800, and sheathing 24 define insulation cavities 50. In the illustrated embodiment, the insulation cavities 50 have boxlike cross-sectional shapes that are substantially retained after loosefill insulation 58 is blown into the insulation cavities. Insulation supports 2800 may not be attached to every support member 20, such that some insulation cavities 50 span multiple support members. As such, the width of the insulation cavities 50 is adjustable.

Figure 28A:
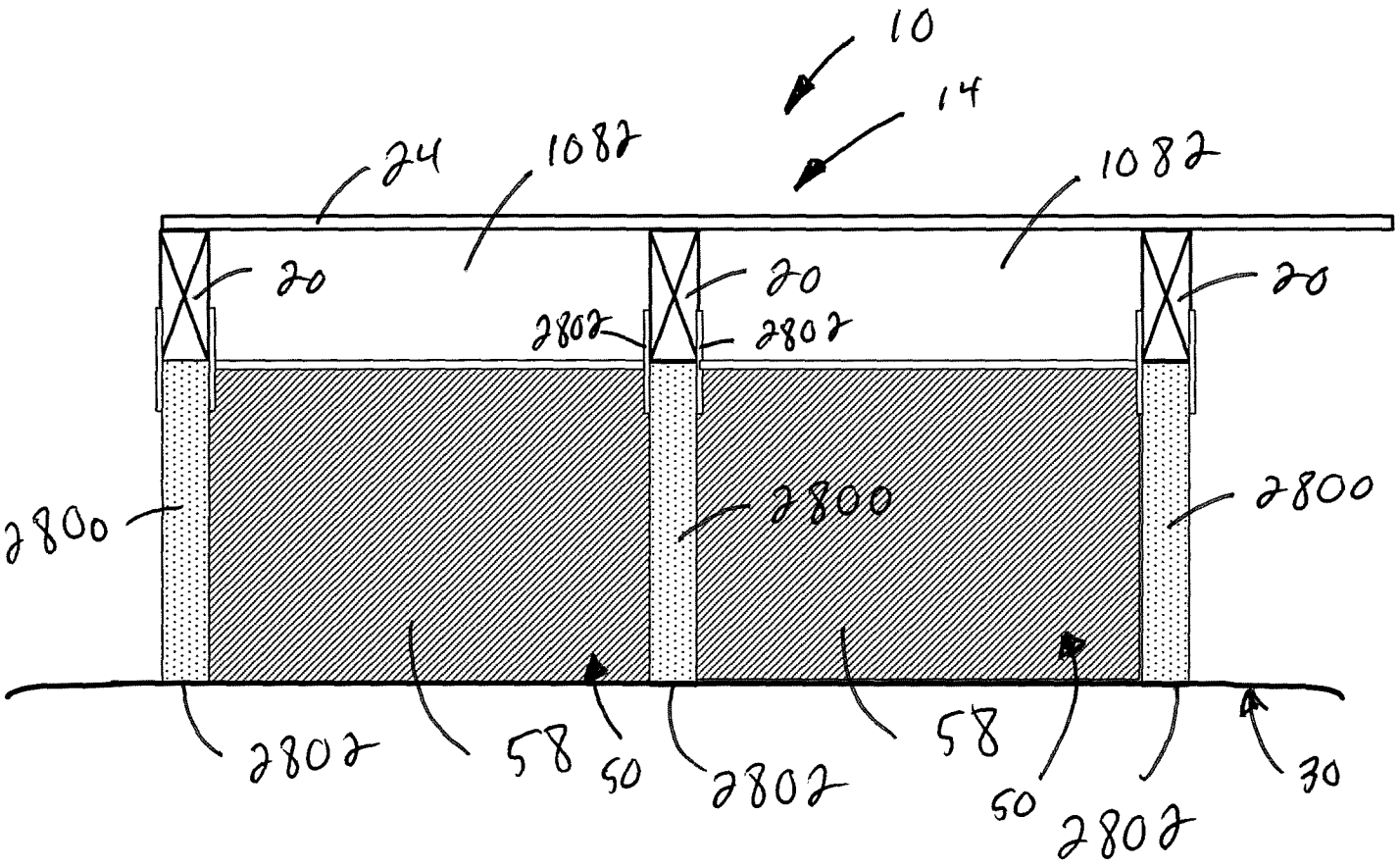
FIG. 28A is an illustration of an exemplary embodiment of an insulation system that uses the insulation support system of FIG. 28.
Figure 28B:
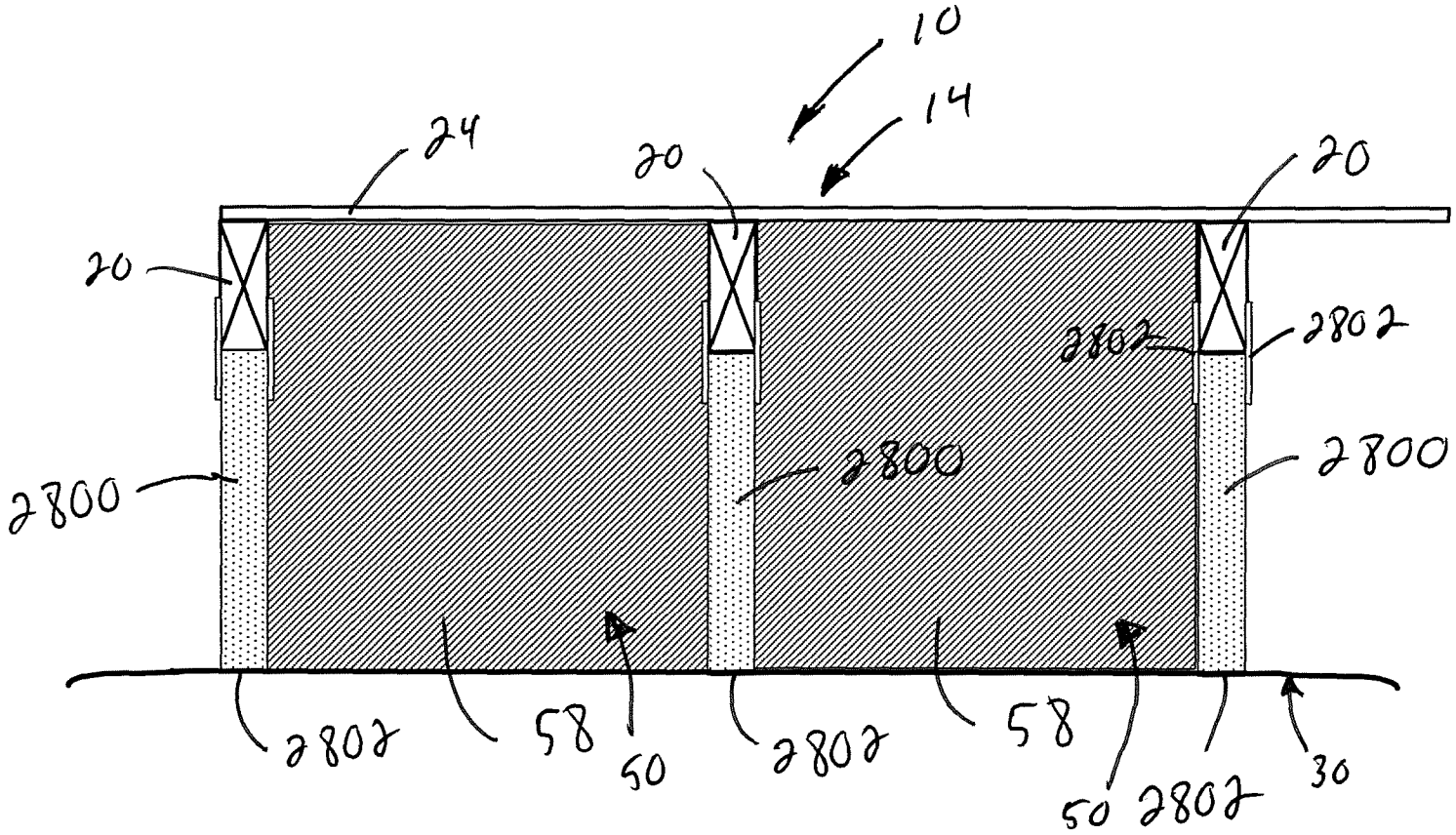
FIG. 28B is an illustration of an exemplary embodiment of an insulation system that uses the insulation support system of FIG. 28.

Referring to FIGS. 28A, and 28B, the insulation system may be provided with vent passage 1082 (FIG. 28A) or be completely filled with insulation 58 (FIG. 28B). In either case, loosefill insulation 58 is distributed within the insulation cavities 50. Insulation pockets are formed as a portion of insulation cavity located under the support members 20 in the embodiment where gaps are formed between discrete, spaced apart supports 2800. In the embodiment where gaps are formed between discrete, spaced apart supports 2800, distribution of loosefill material 58 into one cavity 50 causes the loosefill material 58 to pass into another cavity through the gaps. This allows multiple cavities 50 to be filled at once by inserting the loosefill supply hose into a single cavity. Distributing loosefill insulation material 58 into the insulation cavities 50 results in loosefill insulation material filling the insulation pockets.

Referring now to FIGS. 29-37, another method of forming insulation cavities is illustrated. Generally, this method entails use of a supports 2900 secured to faces of support members 20 by extensions 2905 that fit against or clamp against side surfaces of the support member.

The extensions 2905 can take a wide variety of different forms. In the example illustrated by FIG. 30A, the extensions 2905 are integrally formed with a body 2907 of the supports 2900. Optional frictional devices 2909, such as teeth, can be provided on inside surfaces 2911 of the flanges. The frictional devices 2909 hold the support on the support member 20 after installation.

Figure 30B:
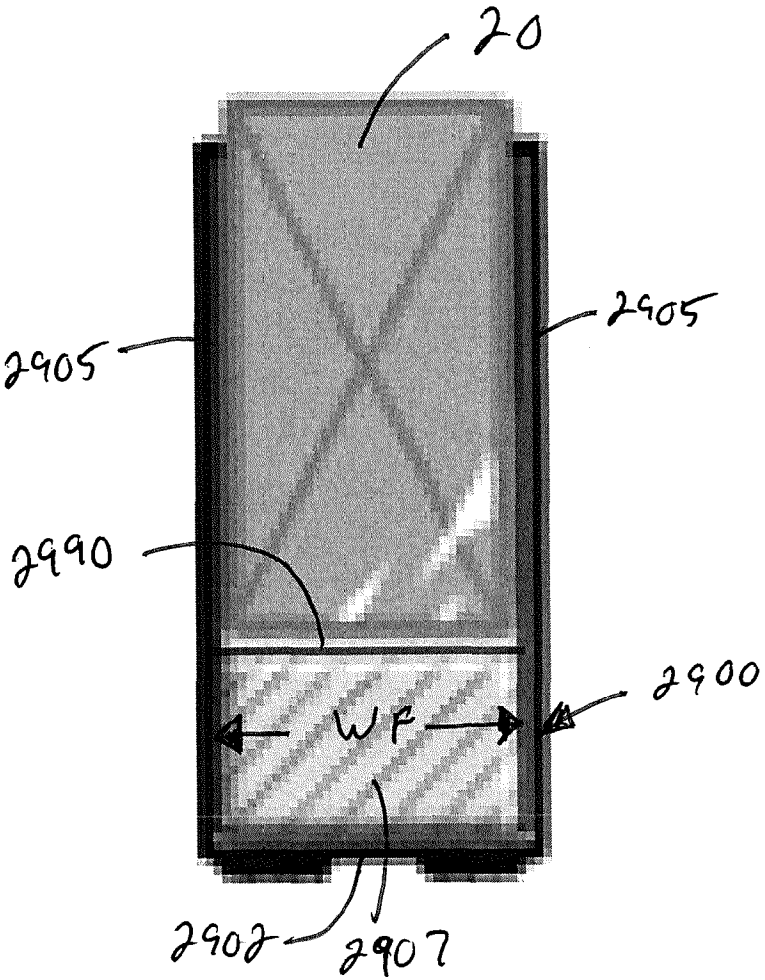
FIGS. 30A and 30B are end views that illustrate securing of support members to the building structure in the system of FIG. 29.
Figure 30A:
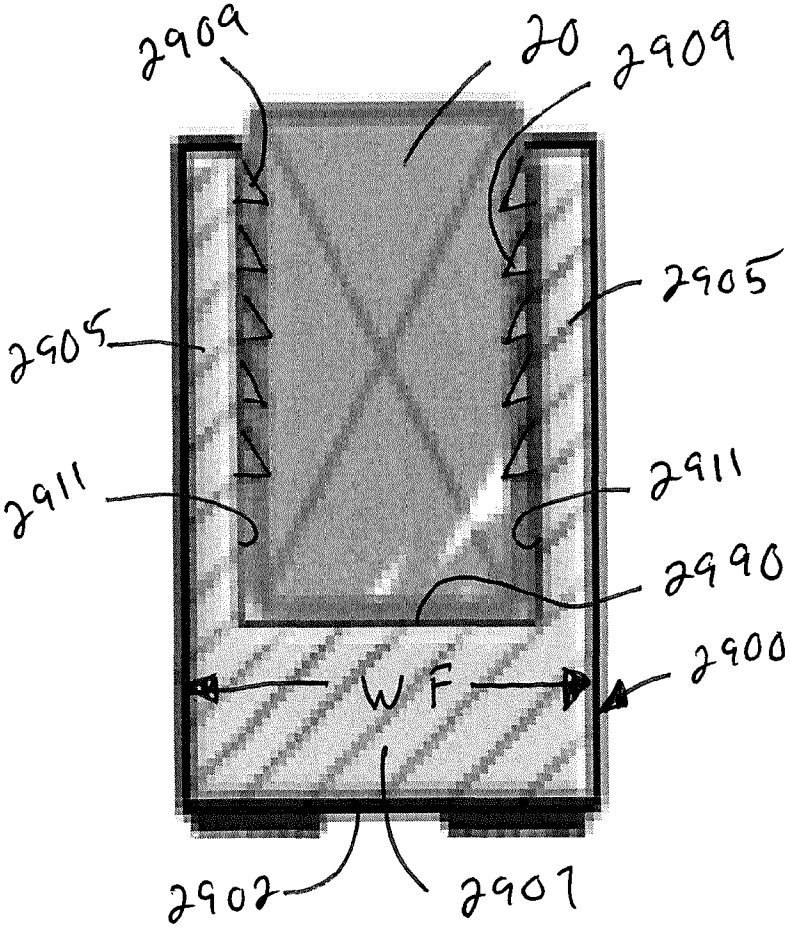
Figure 32:
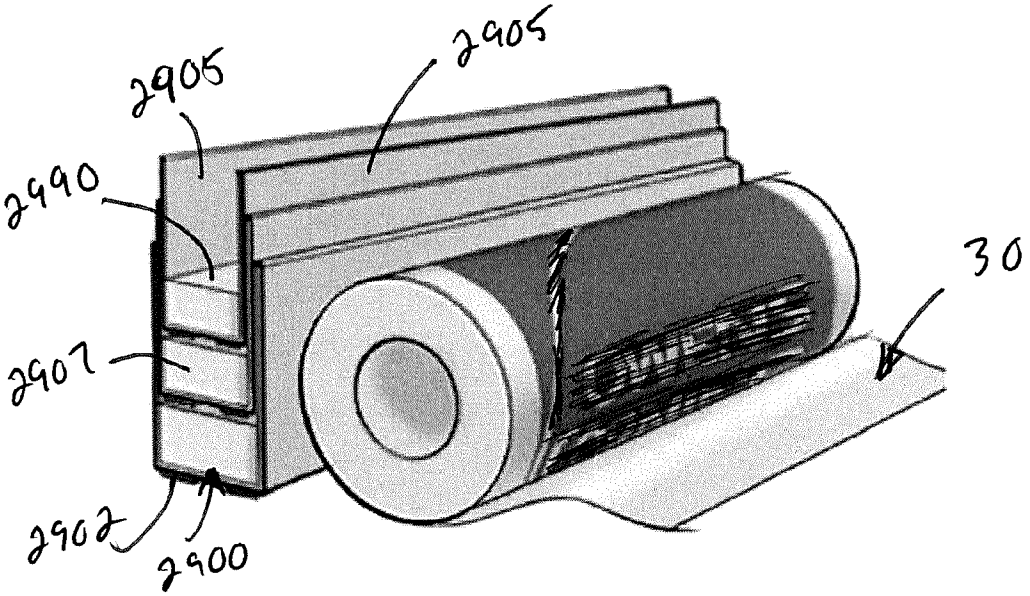
Figure 34:
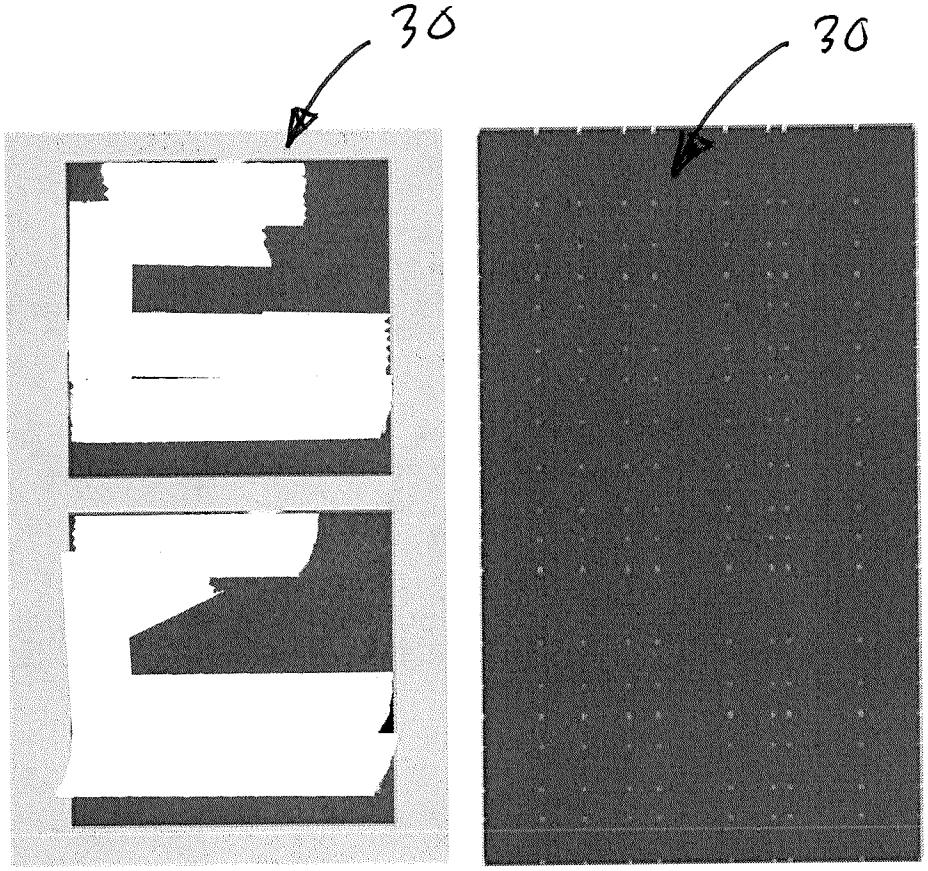
Figure 35:
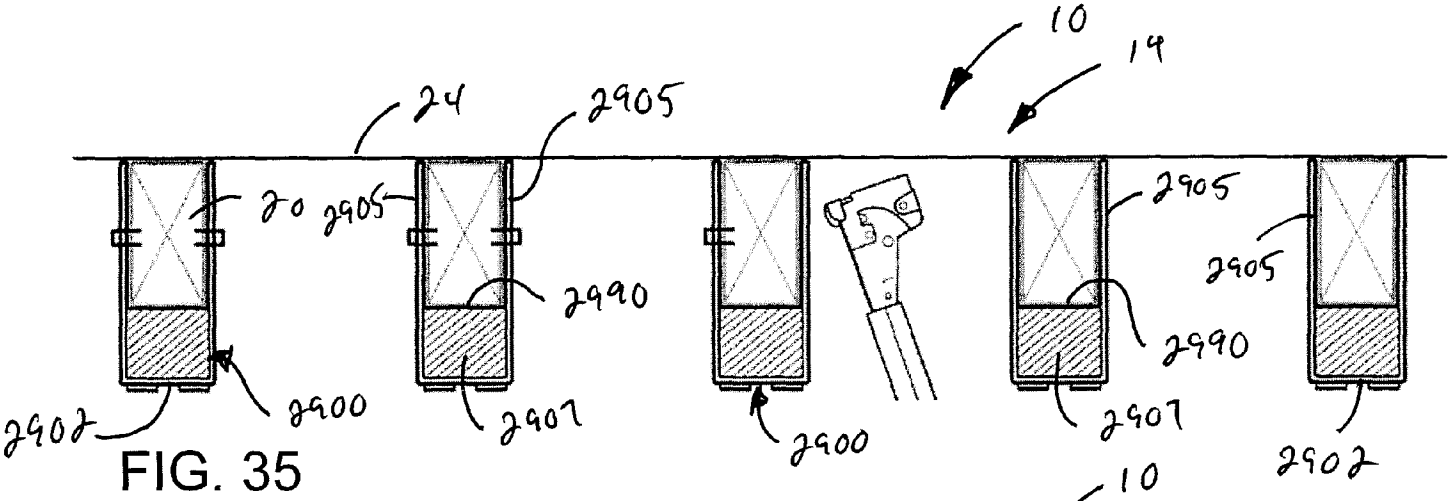
FIGS. 35-37 illustrate installation of the insulation system of FIG. 29.
Figure 36:
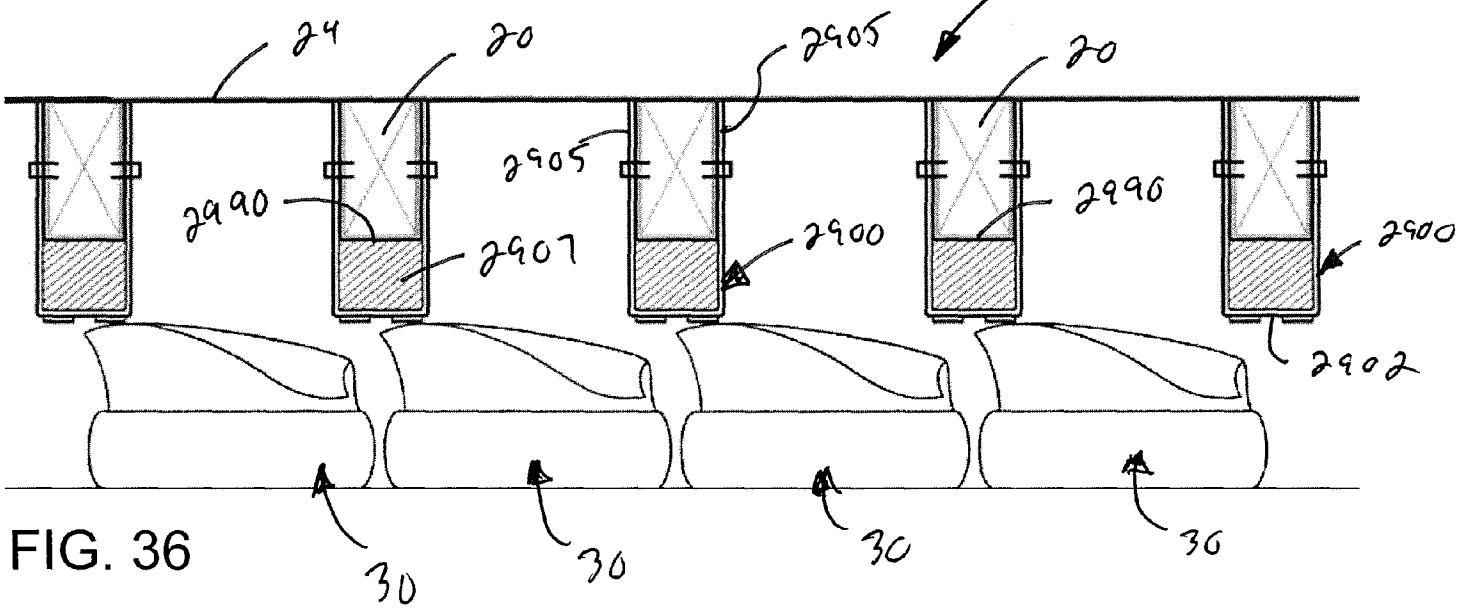

In the example illustrated by FIG. 30B, the extensions 2905 are attached to the body 2907 of the supports 2900. The separate extensions 2905 can be made from a wide variety of different materials. Referring to FIG. 32, the body 2907 and extension 2905 configuration of the supports 2900 allows the supports to be nested and stacked in one exemplary embodiment.

Figure 33:
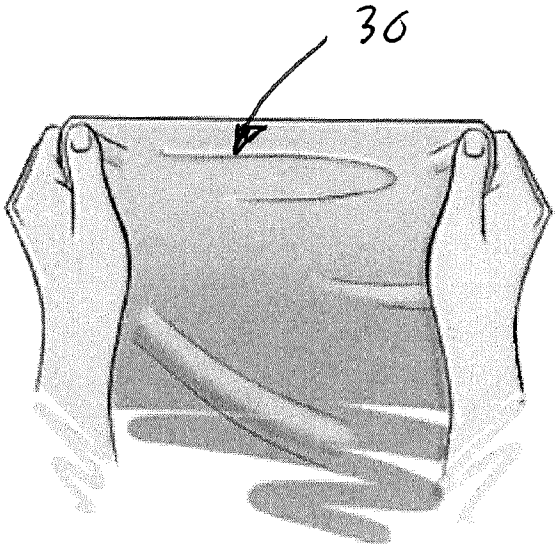
FIG. 32-34 illustrate components of the system of FIG. 29.

Referring to FIGS. 32 and 33, the insulation support material 30 may be provided on a roll and may be a stretchy material. The insulation support material may be any of the materials described in the present application. Insulation support material 30 is secured to ends 2902, for example by stapling, gluing, or otherwise fastening the insulation support material 30 to the ends 2902. In the example illustrated by FIGS. 29-37, the insulation support material 30 is secured to the ends 2902 by a hook and loop material, such as velcro. In one exemplary embodiment, loops are provided on the insulation support material (see FIG. 34) and hooks are provided on the ends 2902 of the supports 2900. In another exemplary embodiment, hooks are provided on the insulation support material and loops are provided on the ends 2902 of the supports 2900.

The support members 2900 are connected to support members 20 by placing the extensions 2902 over the support members 20, such that an inside surface 2990 abuts the support surface. Then, the extensions 2902 and/or the inside surface 2990 can optionally be attached to the support member. The extensions 2902 and/or the inside surface 2990 can optionally be attached to the support member 20 in a wide variety of different ways. For example, fasteners, such as nails, staples, clips, clamps, and/or the teeth described above, and/or adhesives can be used to connect the extensions 2902 and/or the inside surface 2990 to the support members 20.

The supports 2900 can be made from a wide variety of different materials and can have a variety of different configurations. In an exemplary embodiment, supports 2900 are rigid or substantially rigid and abut the support members 20 to accurately and repeatably sets the depth D2900 of the insulation cavity 50. Using different supports 2900 allows the depth of the insulation cavities 50 to be varied in the same building structure 10 or between different building structures. The supports 2900 can be formed from structural cardboard material, fabric or fiberglass scrim, wood, insulating foam, etc. In one exemplary embodiment, the width WF of a foam support 2900 matches (FIG. 30B) or is wider (FIG. 30A) than the width of the support 20. As such, the foam support 2900 insulates the support members 20.

Figure 30C:
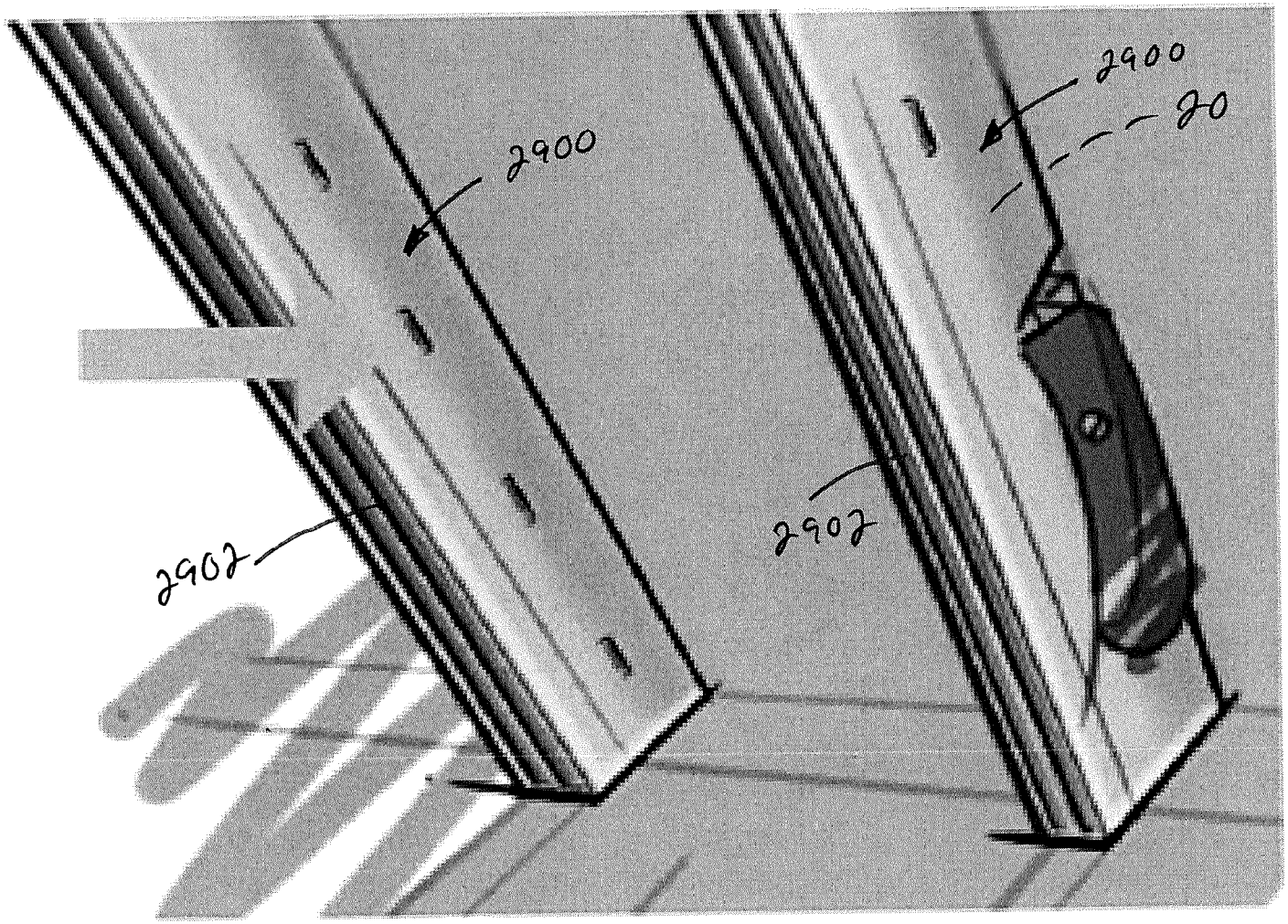
FIG. 30C is a perspective view illustrating that the support members of the FIG. 29 embodiment can be cut to fit around webs of truss support members.
Figure 31:
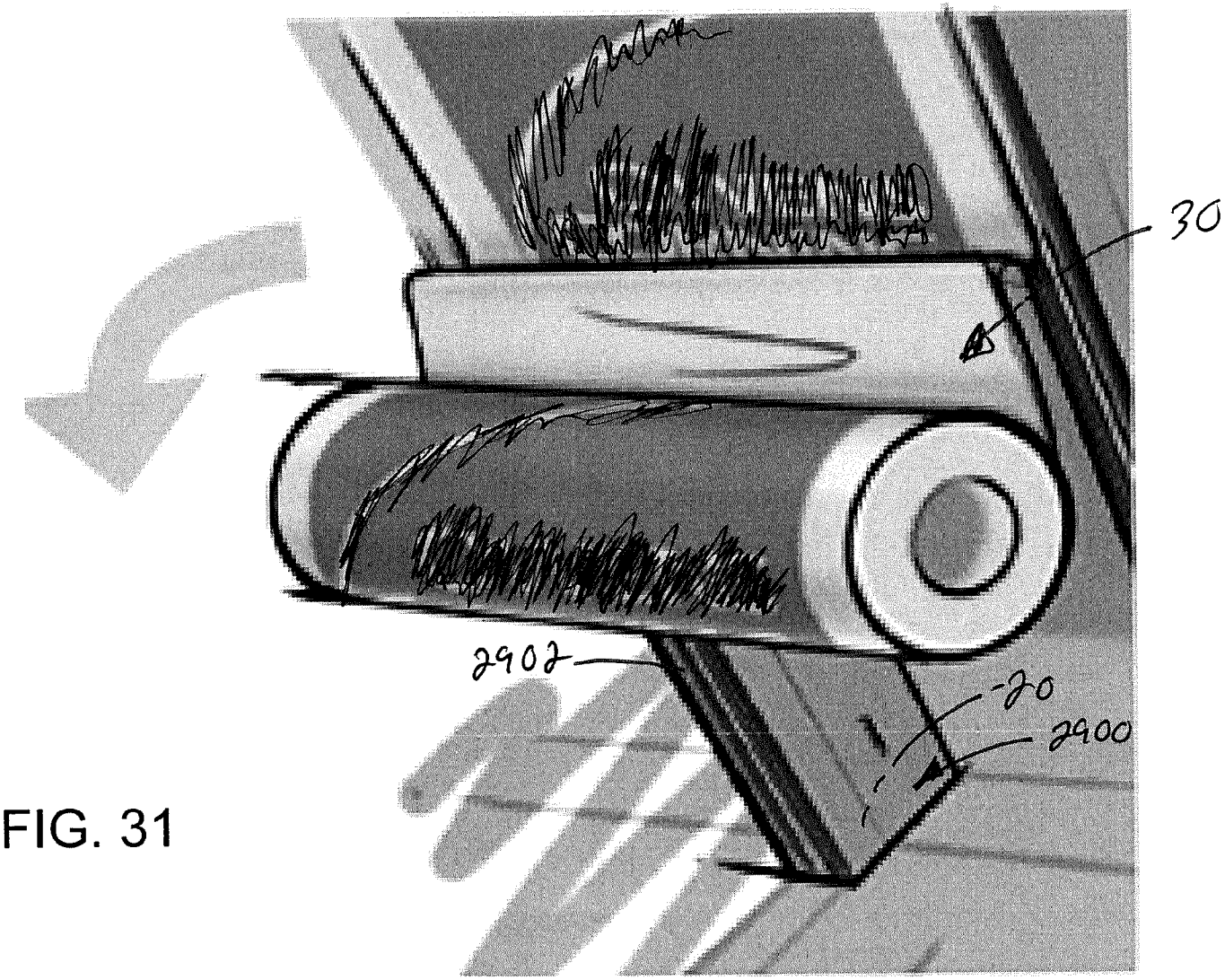
FIG. 31 is a perspective view that illustrates securing of insulation support material to the support members in the system of FIG. 29.

In one exemplary embodiment, the support members 2900 may have a length that corresponds to the length L1 of the support members 20 or lengths that correspond to lengths of spans of the support members between web supports 23, such that the supports 2900 extend substantially from the eave 1006 of the roof to the ridge 1010 of the roof. Referring to FIG. 30C, in one exemplary embodiment, the support members 2900 are formed from a material that is easily cutable, for example cutable by a utility knife. This cutability allows slots or openings to be cut in the support members 2900 to allow the support members 2900 to be installed over cross-members 23 of trusses. For example, the support members 2900 may be made from a foam material that is easily cutable with a utility knife razor blade. In another exemplary embodiment, the support members 2900 have pre-cut slots or openings that allow the support members 2900 to be installed over cross-members 23 of trusses. As such, the support members 2900 may insulate or substantially insulate the entire length of the support members 2900.

In another exemplary embodiment, the supports 2800 may have a length that is much shorter than the length L1 of the support members 20. In this embodiment, discrete, spaced apart supports 2900 are attached to the support members 20 from the eave 1006 of the roof to the ridge 1010 of the roof, with gaps in-between.

Figure 29:
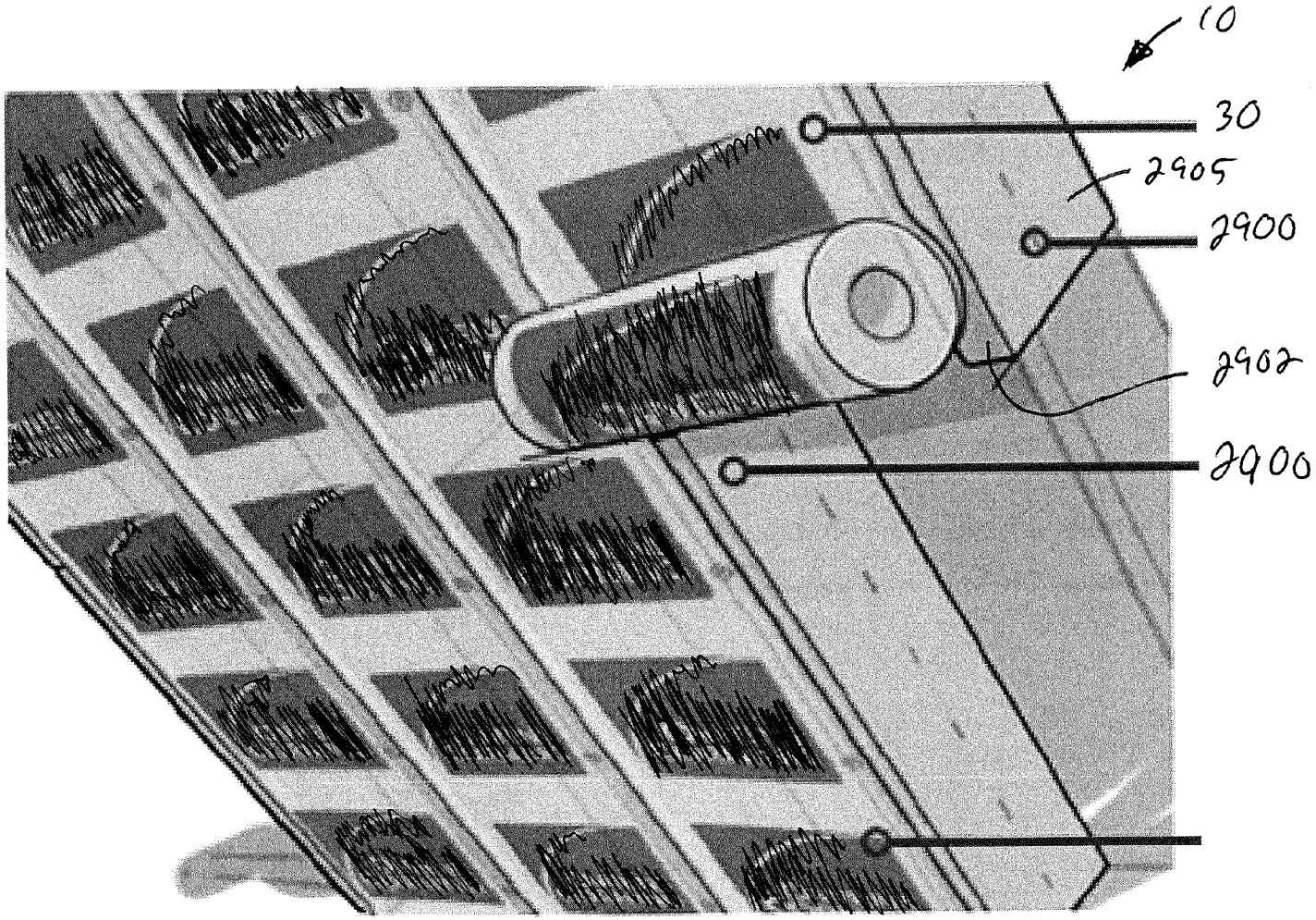
FIG. 29 is a perspective view of an insulation system on a building structure.
Figure 37:
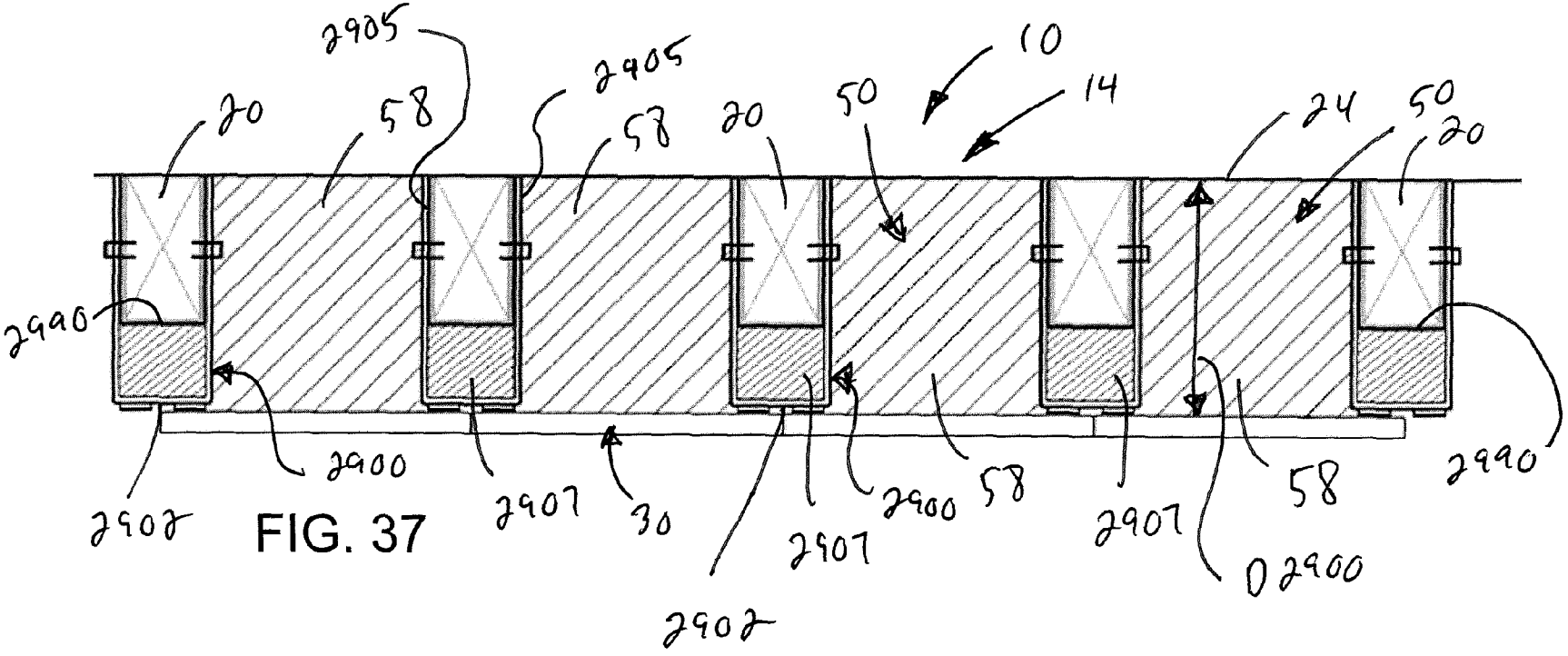

The length of the insulation support material 30 extends in the direction of the length of the support members 20 in the example illustrated by FIG. 29. In another exemplary embodiment, the length of the insulation support material 30 extends across the supports 2900. Referring to FIG. 37, support material 30, pairs of spaced apart supports 2900, and sheathing 24 define insulation cavities 50. In the illustrated embodiment, the insulation cavities 50 have boxlike cross-sectional shapes that are substantially retained after loosefill insulation is blown into the insulation cavities. Insulation supports 2900 may not be attached to every support member 20, such that some insulation cavities 50 span multiple support members. As such, the width of the insulation cavities 50 is adjustable.

Loosefill insulation 58 is distributed within the insulation cavities 50. Insulation pockets are formed as a portion of insulation cavity located under the support members 20 in the embodiment where gaps are formed between discrete, spaced apart supports 2800. In the embodiment where gaps are formed between discrete, spaced apart supports 2800, distribution of loosefill material 58 into one cavity 50 causes the loosefill material 58 to pass into another cavity 50 through the gaps. This allows multiple cavities 50 to be filled at once by inserting the loosefill supply hose into a single cavity. Distributing loosefill insulation material 58 into the insulation cavities 50 results in loosefill insulation material filling the insulation pockets under the support members 20.

Figure 38:
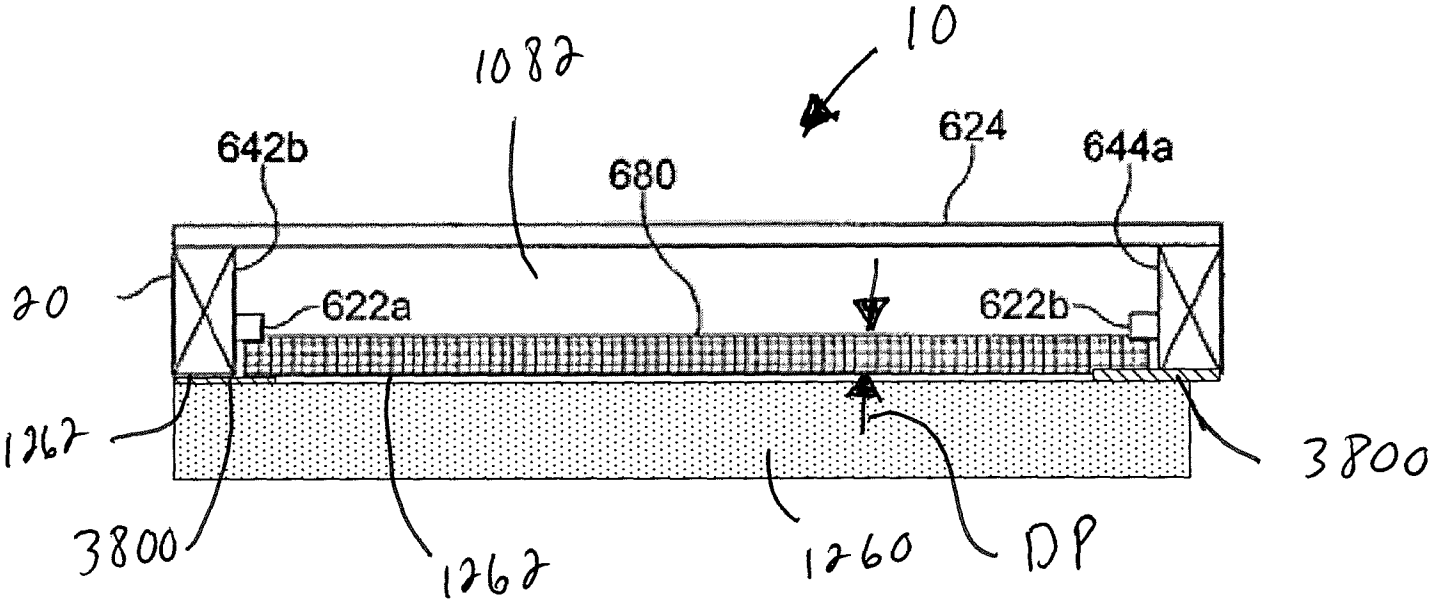
FIG. 38 illustrates another exemplary embodiment of an insulation system.

FIG. 38 illustrates another insulation system that provides a vent space 1082 and insulation 58 attached to support members 20 by velcro 3800. The vent space 1082 may extend from an eve 1202 of the roof (See FIG. 1) to a ridge 1204 of the roof to cool the sheathing 24 and/or shingles disposed above the sheathing. The vent space 1082 also provides a path for moisture beneath the sheathing to escape.

The vent space 1082 can be formed in any manner. In the example illustrated by FIG. 38, a panel 680 is attached between a spaced apart pair of supports 20. Sheathing 24 is disposed on the supports 20. In the illustrated embodiment, the panel 680 is formed from rigid foam insulation. The rigid foam insulation is configured to complement the insulative characteristics of the insulative containers. However, in other embodiments, the panel 680 can be any desired material, such as for example, plywood. The panel 680 has a depth DP such that in an installed position, a bottom face of the panel 680 is substantially flush with bottom faces of support members 20. In one exemplary embodiment, the panel 680 substantially fills the cavity, such that there is no vent space 1082 or substantially no vent space.

Referring to FIG. 38, the flush alignment of the panel 680 with the support members 20 provides a flush surface 1262 for mounting of an insulation material. An insulation material 1260, such as a batt of fiberglass insulation, a foam insulation board, and the like, can be mounted to the flush surface 1262 with hook and loop fasteners 3800.

Figure 39A:
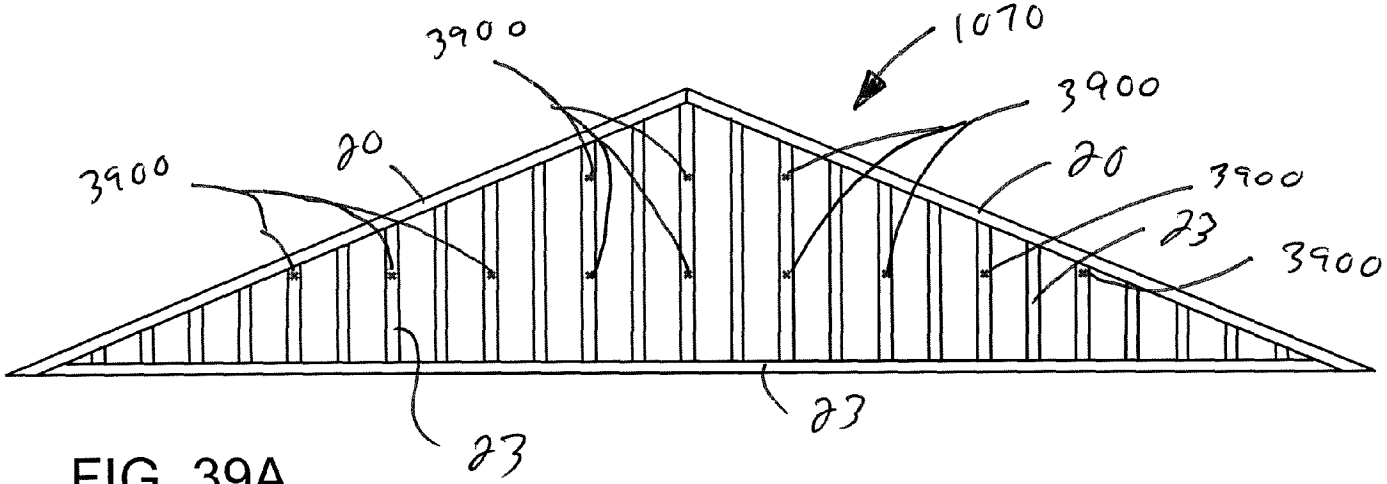
FIG. 39A illustrates an exemplary embodiment of a gable end with insulation support material pins.
Figure 39B:
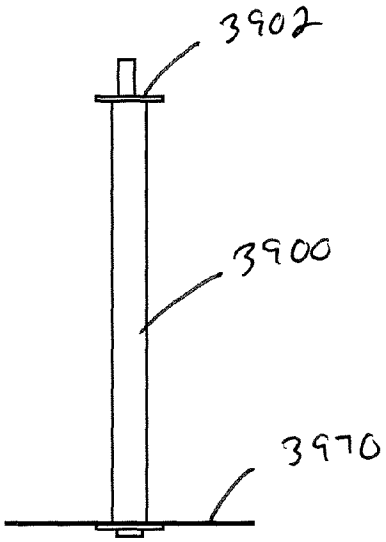
FIG. 39B illustrates an exemplary embodiment of an insulation support material pin.

Any of the insulation support systems and/or insulation systems disclosed by the present application can be used or adapted to a gable end 1070 of a building structure 10. Gable ends 1070 have a top support member 20. In the example illustrated by FIG. 39, the webs 23 of gable end trusses 1070 are vertical and do not form triangles. However, the gable end can take any form.

Referring now to FIGS. 39A, 39B, 41A, 41B, and 42A-42F, further embodiments of methods of forming insulation cavities are illustrated. Generally, this method entails use of supports pins 3900 secured to support members 20 of gable ends 1070. While FIGS. 39A, 39B, 41A, 41B, and 42A-42F illustrate the use of pins 3900 on gable ends 1070, the pins 3900 can be used in or be adapted to be used in any of the embodiments of the present application.

The pins 3900 can be made from a wide variety of different materials and can have a variety of different configurations. Insulation support material 30 is secured to ends 3902 of the pins 3900. The insulation support material 30 may be secured to ends 3902 of the pins 3900 in a wide variety of different ways. For example, the pins 3900 may include a fastener 3960 (See FIG. 41A), the pins 3900 may include a large diameter backing washer 3962 (See FIG. 41B) and a fastener (not shown), and/or the pins 3900 may include barbs 3964 (See FIG. 42E).

Figure 42A:
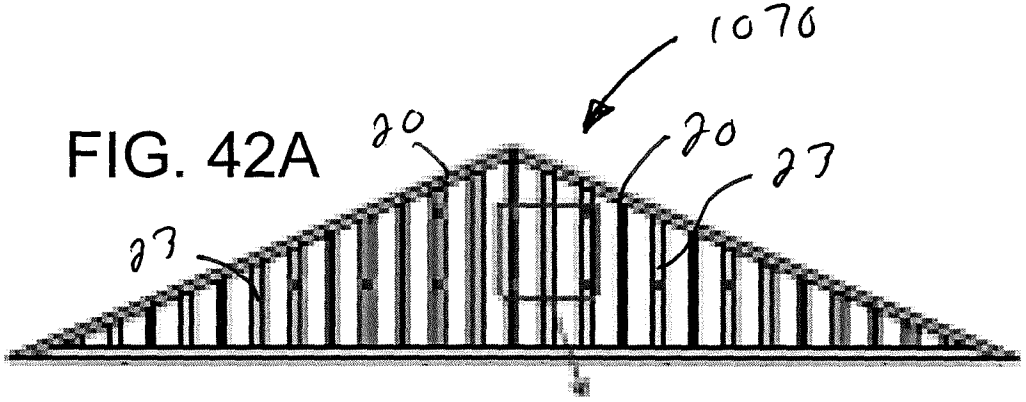
FIGS. 42A-42C illustrate an exemplary embodiment of a gable end with insulation support material pins.
Figure 42B:
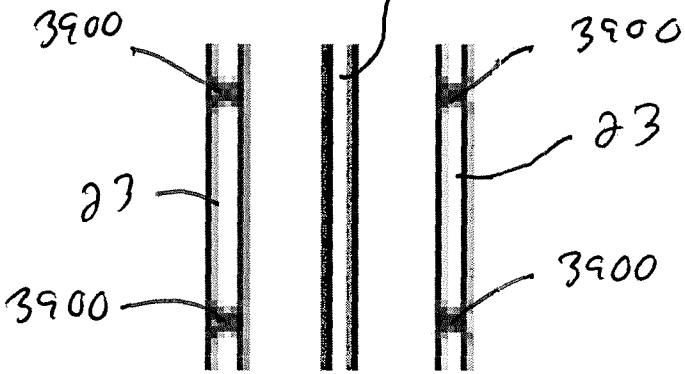
Figure 42C:
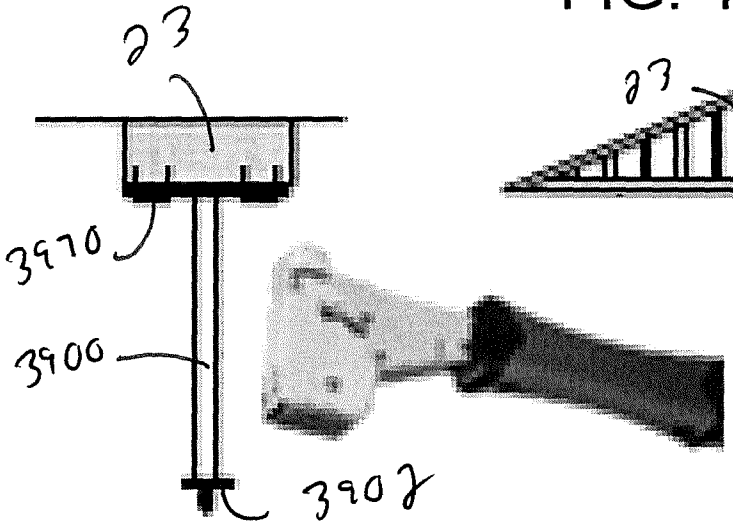
Figure 42D:
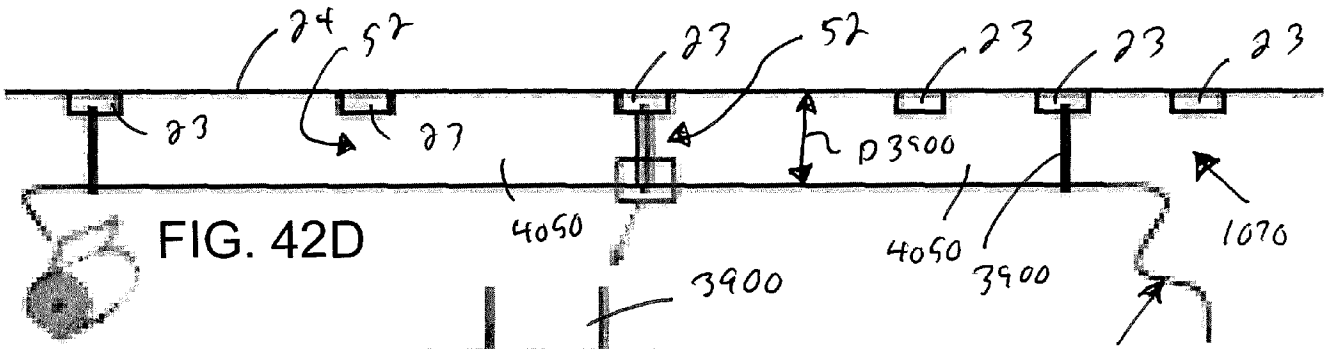
FIGS. 42D and 42E illustrate an exemplary embodiment of a gable end with an insulation support system.
Figure 42E:
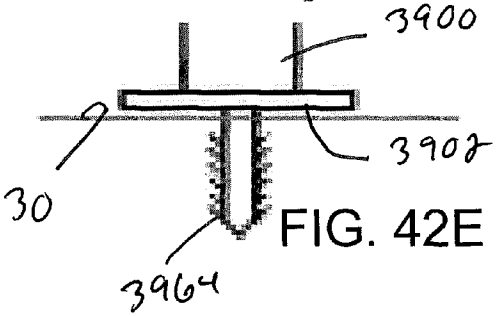

The pins 3900 are connected to support members 20 and/or the support members 23. The support members 3900 can be attached to the support members 20 and/or the support members 23 in a wide variety of different ways. Referring to FIG. 42C for example, fasteners, such as nails, staples, clips, and clamps, and/or adhesives can be used to connect an enlarged base portion 3970 of the pins 3900 to the support members 20 and/or the support members 23.

In an exemplary embodiment, pins 3900 are rigid and abut the support members 20 and/or the support members 23 or have a stop that abuts the support members 20 and/or the support members 23. This abutment accurately and repeatably sets the depth D3900 of the insulation cavity 50. Using different length pins 3900 allows the depth of the insulation cavities 50 to be varied in the same building structure 10 or between different building structures.

Figure 40:
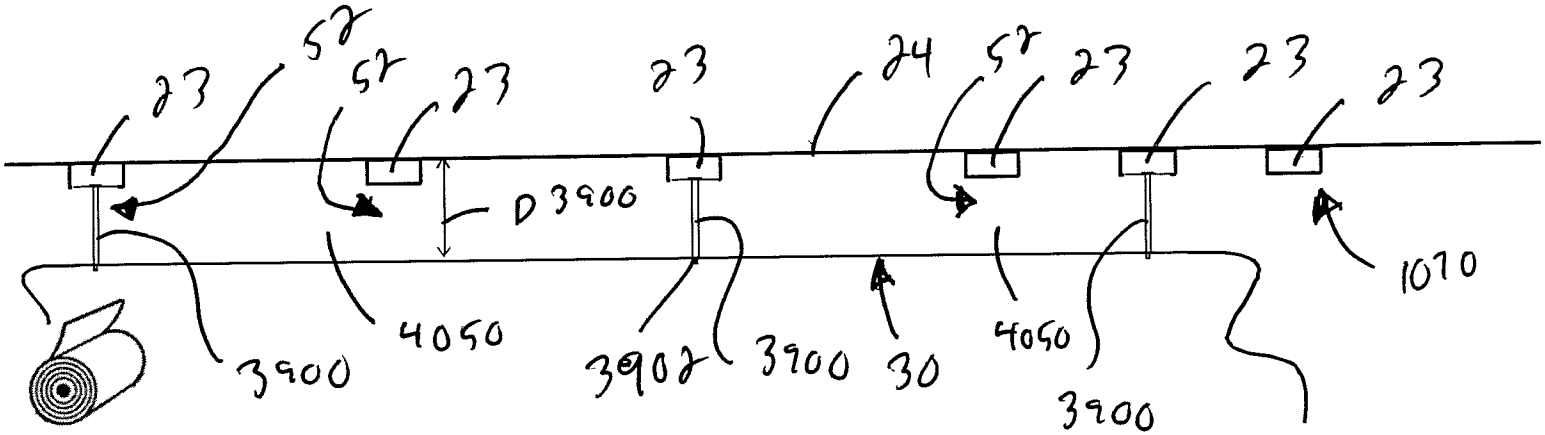
FIG. 40 illustrates an exemplary embodiment of an insulation support system on a building structure.
Figure 41B:
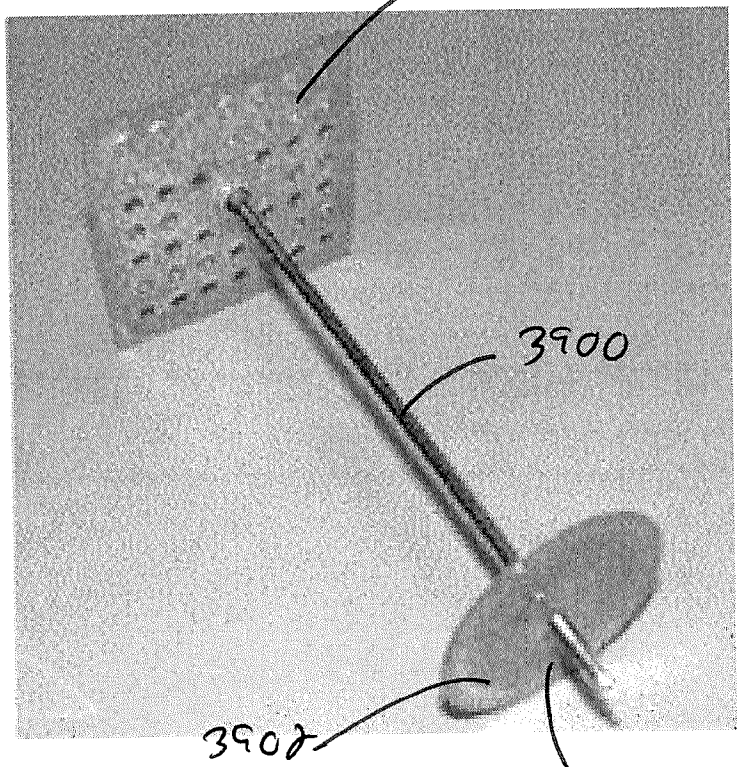
FIGS. 41A and 41B illustrate exemplary embodiments of insulation support material pins.
Figure 41A:
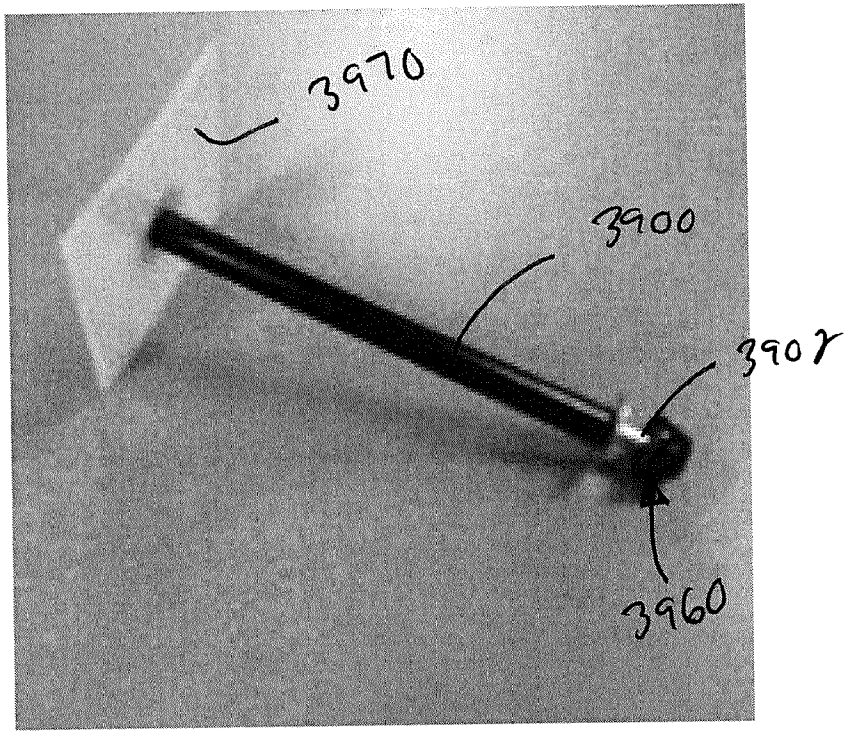

The length (longer dimension) of the insulation support material 30 extends across the gable 1070 as illustrated by FIG. 40. In another exemplary embodiment, the length of the insulation support material 30 extends in the direction of the height of the support members 23. The support material 30 and gable end sheathing 24 define a gable end insulation cavity 4050.

Figure 42F:
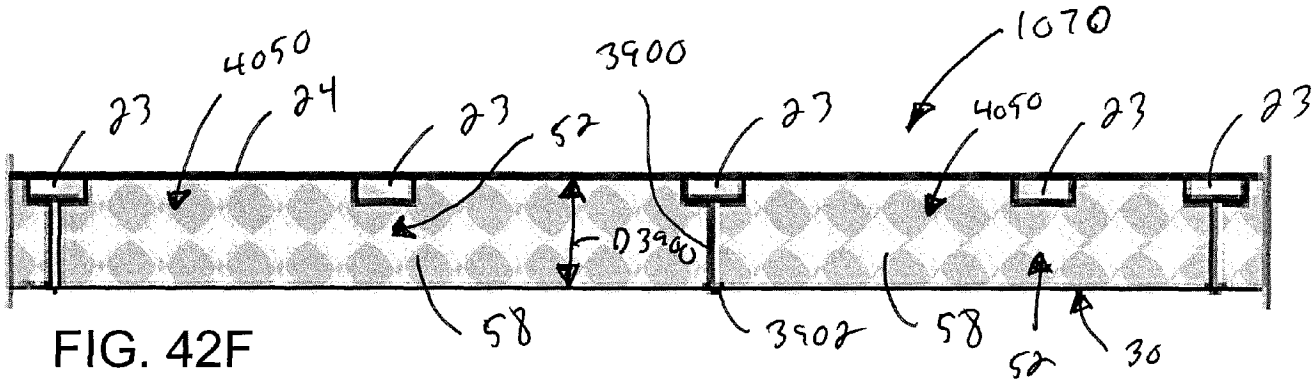
FIG. 42F illustrates an insulation system that includes the insulation support system of FIGS. 42D and 42E.

Referring now to FIG. 42F, loosefill insulation 58 is distributed within the gable end insulation cavity 4050. Insulation pockets 52 are formed as a portion of insulation cavity 4050 located under the support members 20. Distribution of loosefill material 58 causes the loosefill material 58 to pass the support members 23 through the pockets 52. This allows the gable end 1070 to be filled at once by inserting the loosefill supply hose into the insulation support material 30. Distributing loosefill insulation material 58 into the insulation cavity 4050 results in loosefill insulation material filling the insulation pockets 52. As the filled insulation pockets 52 are positioned next to the support members 23, the filled insulation pockets 52 are configured to insulate the support members 23.

Figure 43A:
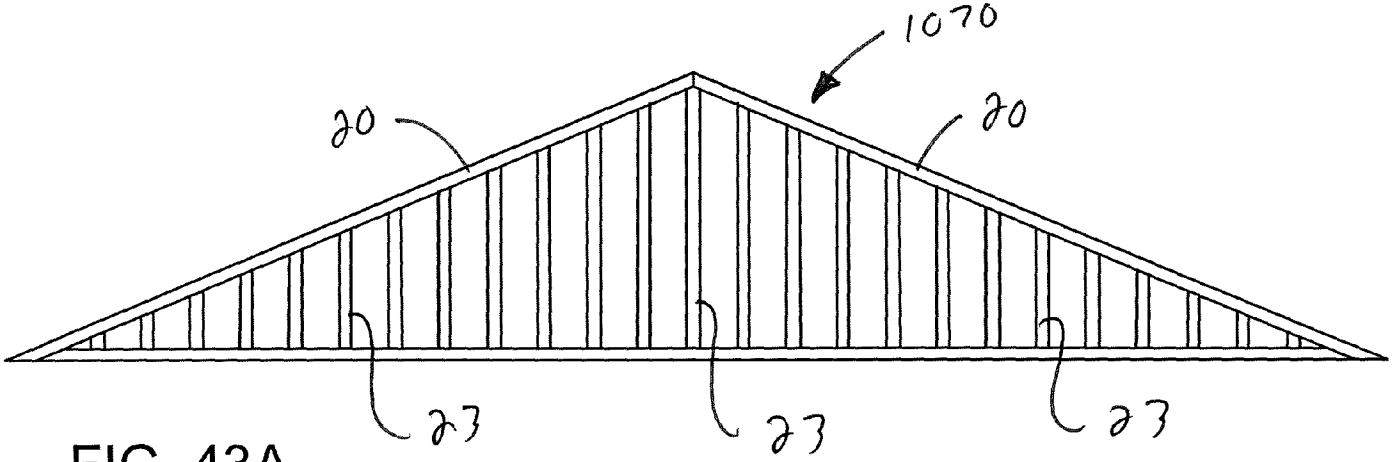
FIGS. 43A and 43B illustrate an exemplary embodiment of a gable end insulation support system.
Figure 43B:
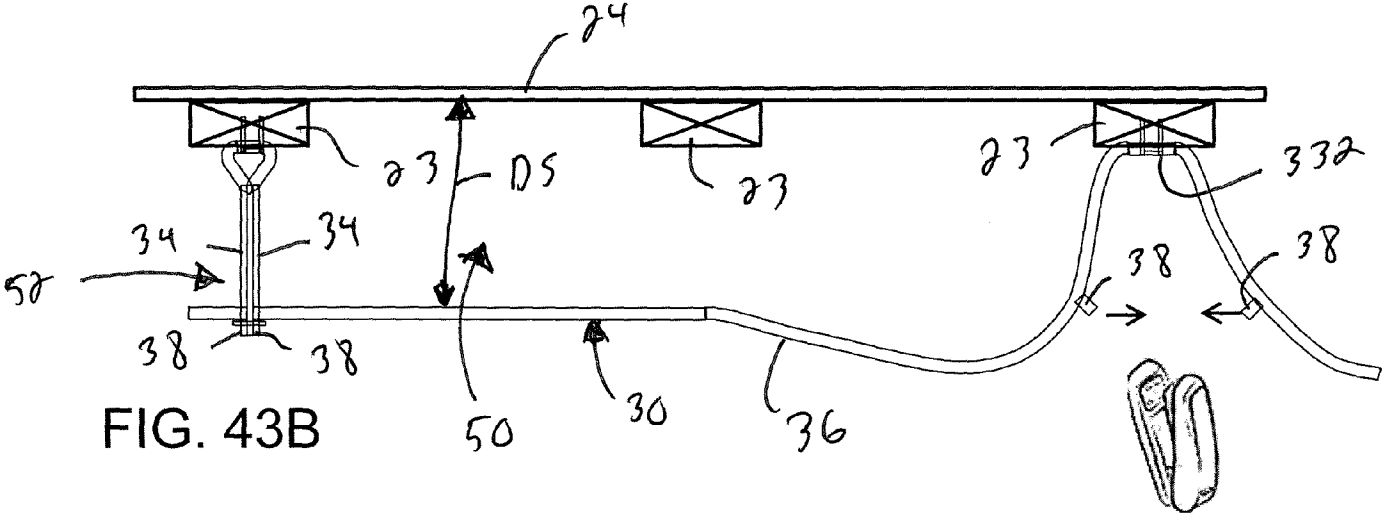

FIGS. 43A and 43B illustrate an exemplary embodiment similar to the embodiment illustrated by FIGS. 3A, 4A, and 6A, except the insulation system is applied to a gable end 1070. The insulation support material 30 may be unrolled or otherwise dispensed to expose a length of insulation support material that generally corresponds to the width of gable end truss 1070. The insulation support material 30 is cut to the shape of the gable end truss 1070.

In a next step, the formed insulation support material is positioned along the width of adjacent support members 23 such that the tabs 38 extend in a direction away from the sheathing panel 24. Next, the fastening segments 332 are fastened to the minor faces of support members 23 along the height of the support member 23, thereby allowing the formed length of insulation support material 30 to extend from the support members 23 to define insulation cavities 50.

Referring to FIG. 43B, in a next step, the tabs 38 are fastened together as shown to form substantially taught insulation cavities 50, each having a substantially rectangular configuration. In an exemplary embodiment, a distance DS from the sheathing panel 24 to the span segments 36 is substantially uniform. F Fastening of the tabs 38 brings the span segments substantially together under tension. The tension imparted on the span segments 36 results in the side panels 34 and the span segments 36 of the insulation cavities 50 forming boxlike cross-sectional shapes that are substantially retained after loosefill insulation is blown into the insulation cavities 50. Referring now to FIG. 43B, insulation pockets 52 are formed as a portion of insulation cavity 50 and are located behind support members 23. The insulation support system illustrated by FIGS. 43A and 43B can be filled with loosefill insulation in the same manner as described with respect to FIG. 6 above.

Figure 44A:
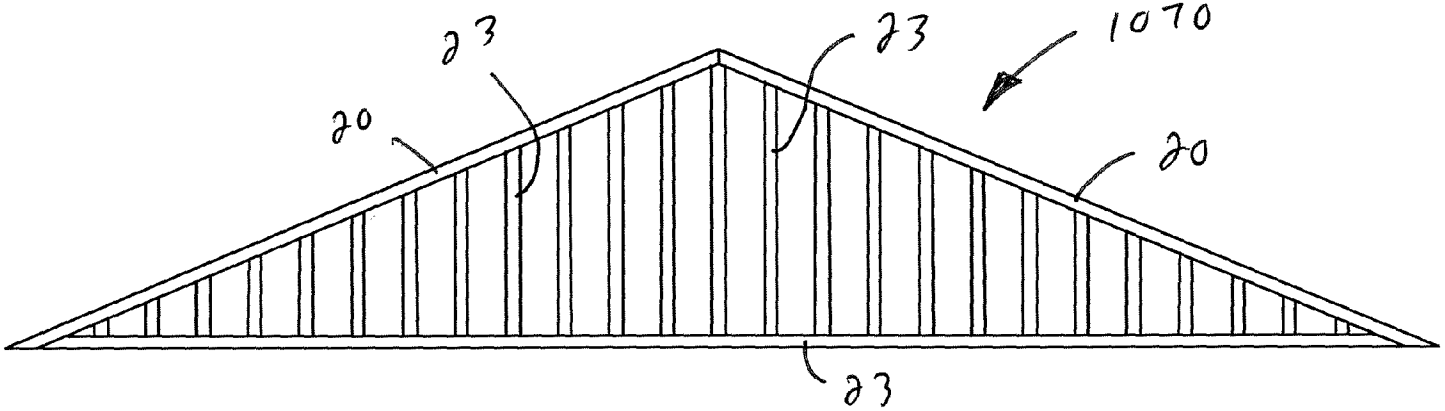
FIGS. 44A and 44B illustrate an exemplary embodiment of a gable end insulation support system.
Figure 44B:
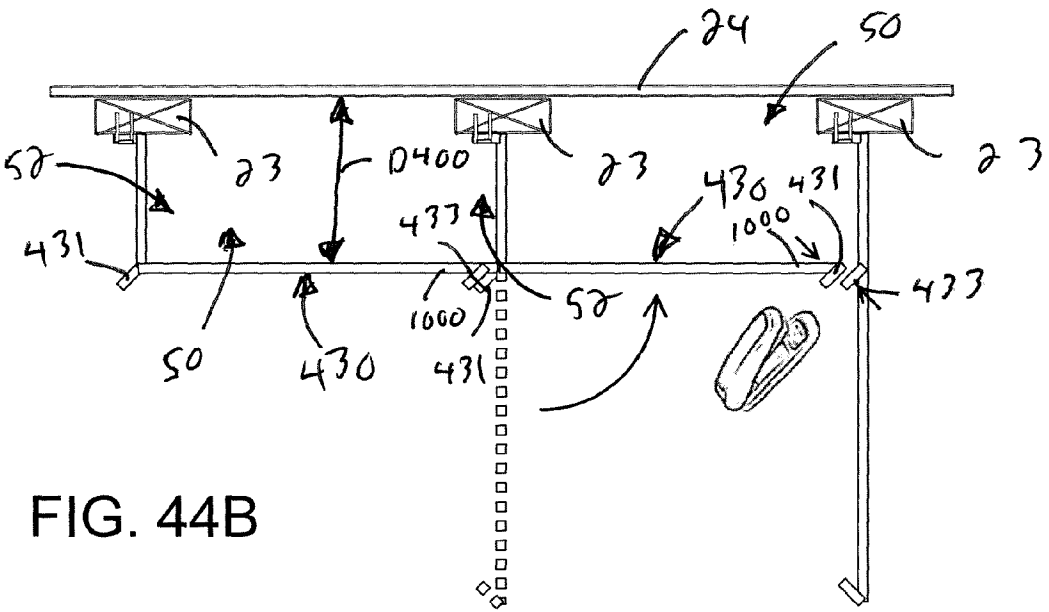

FIGS. 44A and 44B illustrate an exemplary embodiment similar to the embodiment illustrated by FIGS. 10A and 10B, except the insulation system is applied to a gable end 1070. This method entails use of interconnecting, substantially rigid members and/or flexible insulation support material 30 to form box-shaped insulation cavities. The interconnecting material may take a wide variety of different forms and may take a wide variety of different configurations. For example, rigid interconnecting material may comprise cardboard, plastic, and the like. Flexible netting material 30 may comprise a plastic film, a mesh, combinations of plastic film and mesh, and the like. In one exemplary embodiment, flexible netting material may be a breathable material, a vapor barrier, a vapor retarder, and/or an air barrier material.

Support members 23 and sheathing panel 24 are illustrated by FIG. 44B. Interconnecting portions 430 are optionally cut to the shapes defined by the support members 20 and the support members 23 of the gable end truss 1070. Part of interconnecting portions 430 are positioned adjacent to a major face of a support member 23 and fastened to the support member 23 with one or more fasteners. However, as noted above, the interconnecting portion 430 can be connected to a portion of the support member 20, a portion of the support member 23 and/or to the roof sheathing 24.

Each interconnecting portion 430 has an optional first tab 431 spaced apart from an optional second tab 433. The optional first tabs 431 are configured for attachment to the optional second tabs 433, thereby forming box-shaped insulation cavities. In one exemplary embodiment, the second tabs 433 are omitted and the first tabs 431 are connected to ends 1000 of the interconnecting portions 430.

After each first interconnecting portion 430 has been fastened to the support member 23, the interconnecting portion 430 is bent or folded at a point below the first tab 431 and a span segment 436 is rotated in a counterclockwise direction such that second tab 433 aligns with the first tab 431 of another interconnecting portion 430. The second tab 433 and the first tab 431 are attached together with any desired fastener (not shown).

When made from a rigid material, interconnecting portion 430 is bent such that a side panel segment 434 and the span segment 436 form an approximate right angle with each other. Also, the span segment 436 forms an approximate right angle with the side panel segment 434 of the next interconnecting member 430. The approximate right angles formed between the side panels segments 434 with the span segment 436 define a box-shaped insulation cavity 50. In a repetitive manner, the interconnecting portions 430 are bent or folded such that first tabs 431 are connected to corresponding second tabs 433 or ends 1000.

In one exemplary embodiment the interconnecting portions 430, are formed from a rigid material structural cardboard material. The rigid material, such as structural cardboard material is configured to retain the box-like cross-sectional shape of the insulation cavity after the loosefill insulation material is distributed into the formed insulation cavities. In other embodiments, the interconnecting portions can be formed from other materials, such as the non-limiting example of reinforced fiberglass or polymeric-based materials sufficient to form a box-shaped insulation cavity.

In still other embodiments, the interconnecting portions 430 can be formed from flexible materials, such as netting or insulation support material 30 described above. In this embodiment, the tabs of the flexible interconnecting portions 430 can be fastened together in the same, or similar, manner as illustrated in FIG. 5 and described above. In some exemplary embodiments, the interconnecting portions 430 are made from more than one different material. For example, the span segments 436 may be made from a flexible material and the side panel segments 434 may be made from a rigid material. As another example, the span segments 436 may be made from an air barrier material, a vapor barrier material, and/or a vapor retarder material, while the side panel segments 434 are made from a breathable material, an open netting, or a mesh.

Referring again to FIG. 44B, insulation cavities 50 have a depth D400. The depth D400 is defined as the total of the depth of the support members 23 and the amount of material of the side panel 434 that extends past the support members 23.

Insulation pockets 52 are formed as a portion of insulation cavity 50 and located behind the support member 23. Distributing loosefill insulation material (not shown) into the insulation cavities results in loosefill insulation material filling the insulation pockets 52. As the filled insulation pockets 52 are located behind the support members 23, the filled insulation pockets are configured to insulate the support members 23.

Figure 45A:
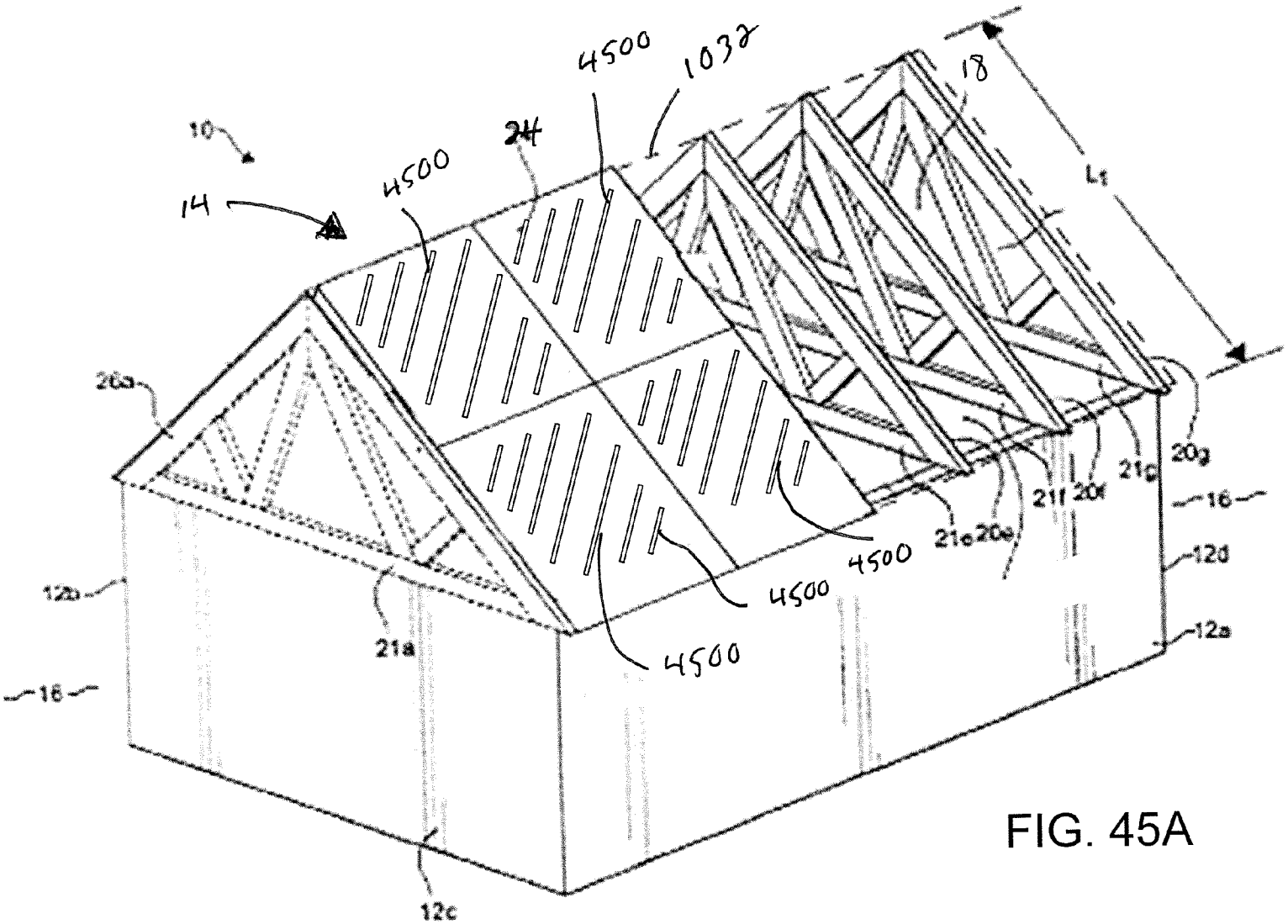
FIG. 45A illustrates an exemplary embodiment of a roof having an air barrier and that is water vapor breathable.
Figure 45B:
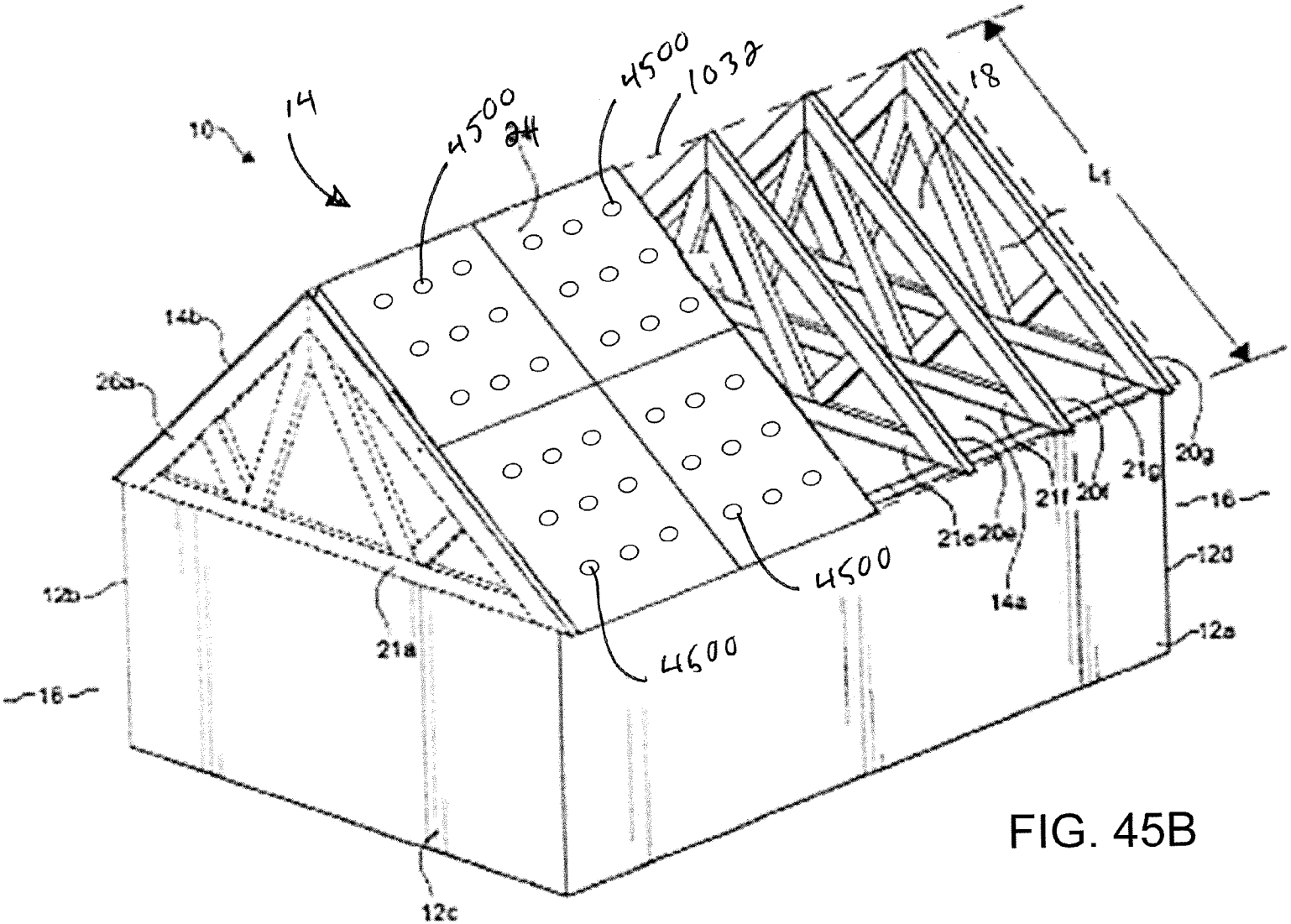
FIG. 45B illustrates an exemplary embodiment of a roof having an air barrier and that is water vapor breathable.
Figure 46:
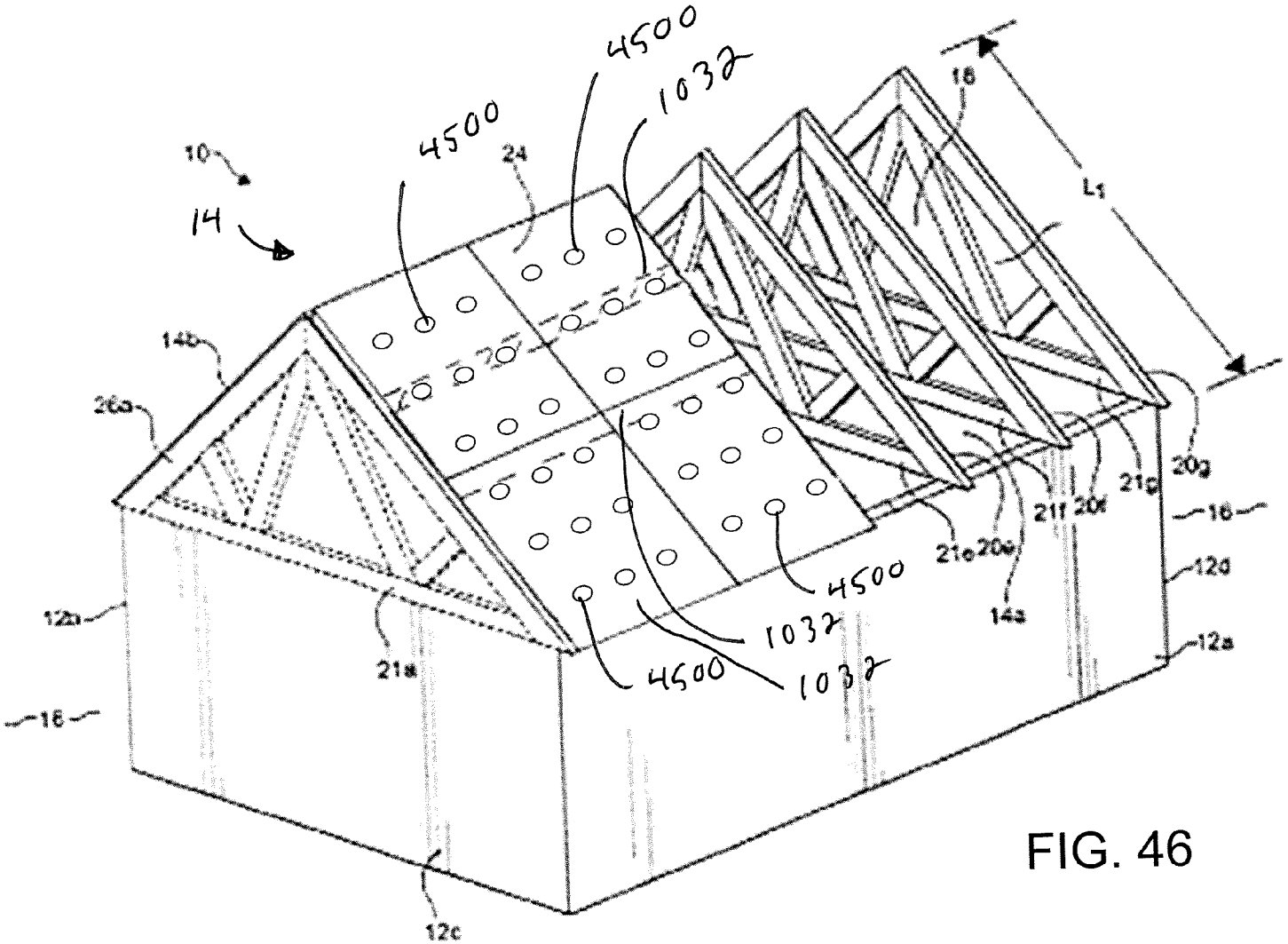
FIG. 46 illustrates an exemplary embodiment of a roof having an air barrier and that is water vapor breathable.

FIGS. 45A, 45B, and 46 illustrate exemplary embodiments of roof decks 14. Water vapor is less dense than air so it will stay high in the attic space, meaning it is always close to the underside of the roof deck. Moisture laden water vapor enters the attic space from normal activities in the home (breathing, cooking, bathing, laundry, etc) through ceiling penetrations for lights, ceiling fans, HVAC diffuser penetrations or any other path the water vapor can follow into the attic 18 and to the roof deck 14. Depending on the area of the country/world, the roof sees alternating hot and cold temperatures. Areas with generally high ambient temperatures do not allow the water vapor to condense on the underside of the roof deck because the dew point is never reached. There may be occasional periods where the dew point is reached but this is infrequent. There is only a small amount of moisture that is absorbed by the underside of the roof deck under these conditions. The little water that is absorbed is displaced when the roof sees higher temperatures again and exits the attic 18 through standard vents. In other areas, cold temperatures outside the roof exceed the dewpoint of the water vapor in the attic. Roofs in these cold temperature areas of the country may see many hot and cold cycles/seasons.

The roof decks 14 illustrated by FIGS. 45A, 45B, and 46 can be used with any of the embodiments of insulation support systems and/or insulation systems disclosed herein and/or with other insulation systems. The roof decks 14 of these embodiments are designed to create a way for water vapor to exit the attic 18 through the roof deck 14, while keeping atmospheric air from entering the building 10 through the roof deck. This can be accomplished in a variety of different ways. In the exemplary embodiments illustrated by FIGS. 45A, 45B, and 46, sheathing panels 24 provide a way for water vapor to exit the attic 18 at various locations along the slope of the roof, while an air barrier layer 1032 prevents atmospheric air from entering the attic 18.

The sheathing panels 24 can be configured to allow water vapor to exit the attic in a wide variety of different ways. In the examples illustrated by FIGS. 45A, 45B, and 46, the sheathing panels 24 include opening 4500, such as slots or holes that are designed to allow water vapor to exit the attic 18. In another exemplary embodiment, gaps are provided between adjacent sheathing panels in addition to or instead of the openings 4500. Any way of providing a path for water vapor below the sheathing panels 24 to move above the panels 24 can be employed.

In one exemplary embodiment, the combination of the sheathing panels 24 and the air barrier layer 1032 provides a path for vapor to exit an unvented attic at all times. The path the vapor follows allow the vapor to exit the attic 18 at all times, while disallowing atmospheric air to enter at all times. In the exemplary embodiments illustrated by FIGS. 45A, 45B, and 46, paths for water vapor to exit are created along the inclined slope of the roof deck 14, not just at the ridge. In the example illustrate by FIG. 45A, the openings 4500 are slots that are perpendicular or at some angle to the roof support members 20. These slots are sized and spaced up the slope of the roof deck 14 and may run the entire width or some portion of the width of the sheathing panels 24 or roof deck. In the examples illustrated by FIGS. 45B and 46, the openings 4500 or exit points may be holes or some other optimal shape, pattern or configuration. The openings create paths 4500 or exit points from low to high points in the roof deck 14 for water vapor in the attic to escape the attic 18.

In one exemplary embodiment, the sheathing panels 24 have the configuration of a lath used in older buildings for plaster and lath walls. The laths on the roof deck 14 may be much wider than the gaps between them in some exemplary embodiments. For example, the laths may be five times as wide, ten times as wide, twenty times as wide or more than the gaps between laths. The gaps between the laths provide the path for water vapor to exit the attic.

The air barrier layer 1032 can take a wide variety of different forms. The air barrier layer can be any of the air barrier layers described in this application or other air barrier layers. In an exemplary embodiment, the air barrier layer 1032 is a membrane that allows water vapor to escape through the engineered openings and at the same time does not allow atmospheric air to enter the attic 18. In this way, the water vapors are never able to reach their dewpoint, because the water vapor exits the attic 18 before the water vapor can change phase into liquid water. The attic 18 is still considered to be unvented because the barrier layer 1032 does not allow atmoshperic air to enter where the water vapor escapes. Shingles or other roof coverings are configured and installed such that the water vapors from the attic are released to the atmosphere, but prevent water from rain, melting ice or other moisture sources to reach, enter or penetrate the barrier layer 1032, and thereby enter into the attic space.

Referring to FIGS. 45A, 45B, and 46, in an exemplary embodiment, the air barrier layer 1032 is installed over any number of gaps or openings 4500 between or in the roof sheathing 24 for the entire width of the roof deck 14 or less than the entire width of the roof deck. The air barrier layer 1032 is not air permeable so external air cannot enter the attic. Water vapor from the attic 18 escapes from under the shingles at various points up the pitch of the roof until the slope ends at the peak or ridge or at a ridge vent.

The air barrier layer 1032 can be applied to the roof deck 14 in a wide variety of different ways. In the examples illustrated by FIGS. 45A and 45B, an air barrier layer 1032 is applied beneath the sheathing panels 24 to air seal the roof deck. The air barrier layer 1032 may be applied between the sheathing panels 24 and the structural members 20. For example, the air barrier layer 1032 can be applied to the structural members 20, before the sheathing panels 24 are installed. In the example illustrated by FIG. 46, an air barrier layer 1032 is applied above the sheathing panels 24 to air seal the roof deck. The air barrier layer 1032 may take a wide variety of different forms. The air barrier layer 1034 may be an underlayment disposed between the sheathing panels 24 and shingles (not shown).

FIGS. 47A, 47B, and 48-50 illustrate exemplary embodiments of roof decks 14 and devices 4700 for providing a vent space 1082 below sheathing panels 24 of a roof deck. For example, the devices 4700 may be used to provide a vent space 1082 in an unvented attic (See FIG. 1D) or a cathedral ceiling. The roof decks 14 illustrated by FIGS. 47A, 47B, and 48-50 can be used with any of the embodiments of insulation support systems and/or insulation systems disclosed herein and/or with other insulation systems.

Figure 47B:
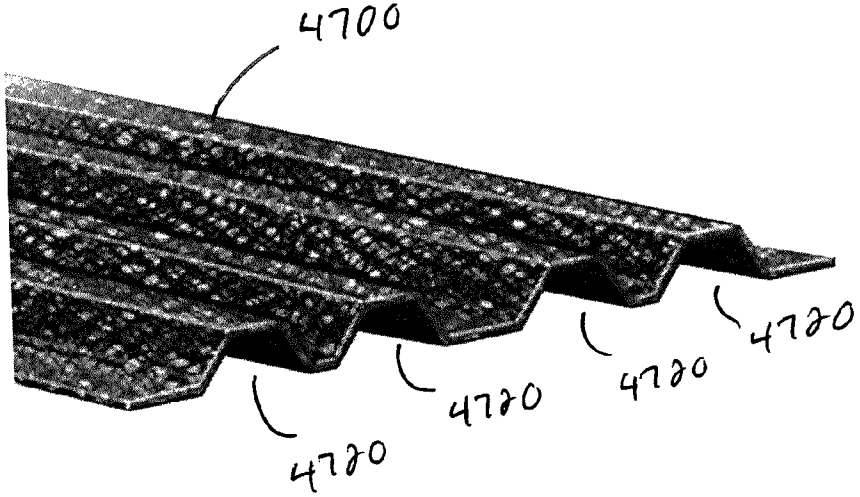
FIGS. 47A and 47B illustrate an exemplary embodiment of a vent passage material.
Figure 47A:
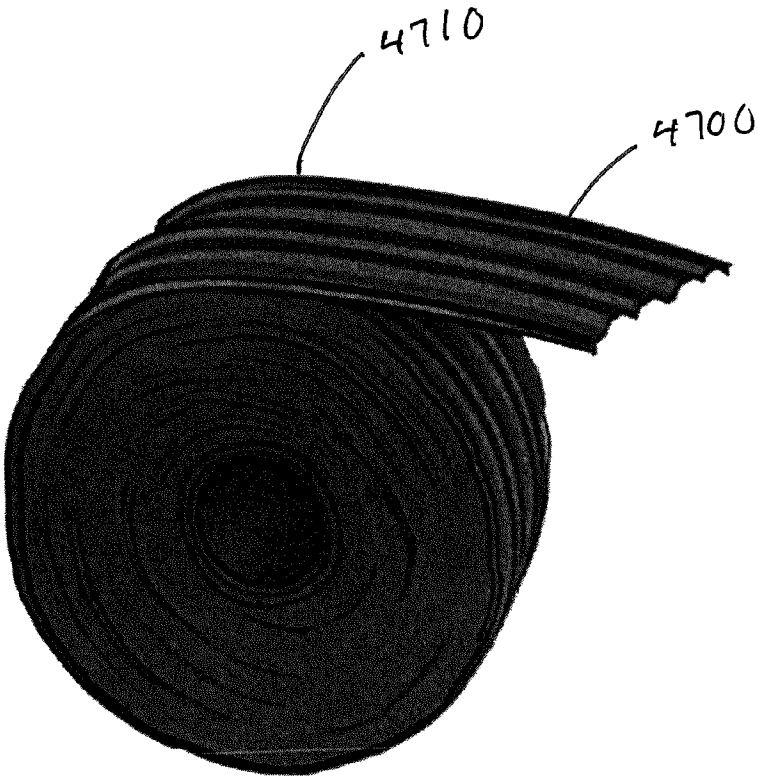

The devices 4700 can take a wide variety of different forms. Referring to FIGS. 47A and 47B, in one exemplary embodiment, the vent space forming device 4700 is a continuous vent chute that is supplied on a roll 4710 and is used to provide the vent space 1082 (See FIG. 1D) in building structures 10 with cathedral ceilings or unvented attics. Because the vent chute 4700 can be cut to the precise length needed, and attached at just the ends of the chute, the vent chute 4700 minimizes the amount of ladder work needed to provide cathedral ceiling vent space 1082. This minimized ladder work is as compared to the conventional method of tiling individual 4 ft chutes from soffit to ridge, which requires multiple trips up and down a ladder for installation of each 4 ft chute. By reducing ladder work, the installer will complete the installation much more quickly.

Insulation contractors working in the new construction market have a need for products that reduce the labor associated with installation of insulation products. One of the most labor intensive jobs is the installation of vent chutes in cathedral ceilings. Installing vent chutes on a cathedral ceiling (prior to the installation of batts or loose fill) can take as much time, if not more, than the installation of all of the other vents/baffles combined (i.e. those that are installed at eaves in what will be the attic). There are two main reasons that the installation of vent chutes is so labor intensive:

(1) the roof deck along a cathedral ceiling is provided with a vent chute continuously from eave to ridge, requiring many more baffles than what is required at the eaves in a vented attic.

(2) existing vent chutes only come in 4-6 ft lengths, requiring the installer to go up and down ladder many times to install each individual piece, which takes time.

Referring to FIG. 47A, in one exemplary embodiment, the vent chutes 4700 are in a compact roll 4710 form (for example, about 3 ft in diameter, but any size can be used depending on the application). The roll can easily be stored stored in a warehouse, loaded on and off a truck, and carried to and from the jobsite. The vent chutes 4700 can have any shape that provides one or more vent spaces 1082. In the exemplary embodiment illustrated by FIG. 47B, the vent chute 4700 provides multiple vent spaces 1082 in the form of a plurality of parallel channels 4720. However, in other embodiments, the vent chute 4700 provides a single, wide vent space that extends the width or substantially the width of the chute 4710. The vent chute 4700 can be sized and shaped for any given roof deck application.

Figure 48:
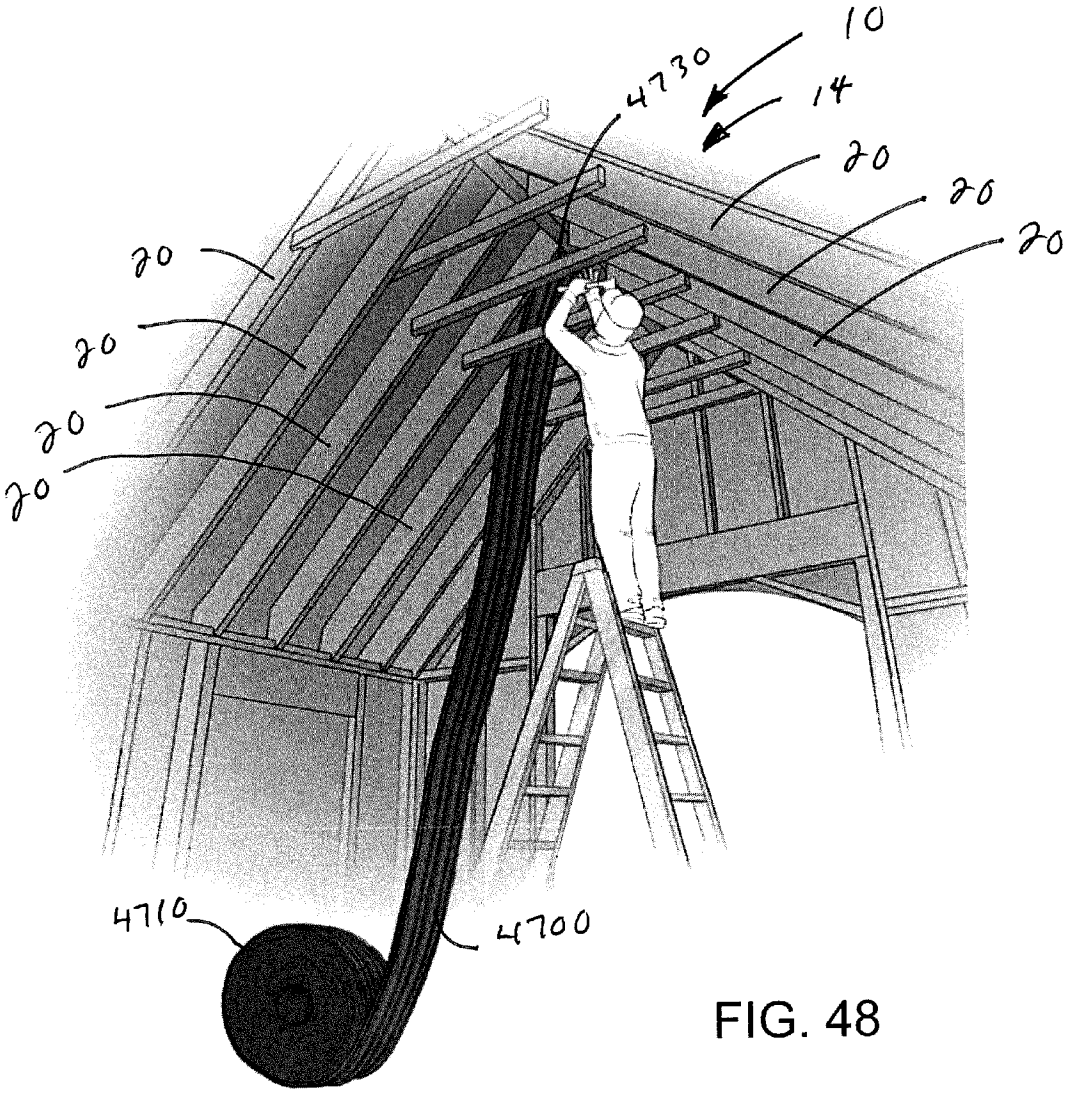
FIGS. 48-50 illustrate installation of the vent passage material illustrated by FIGS. 47A and 47B in a building structure.
Figure 49:
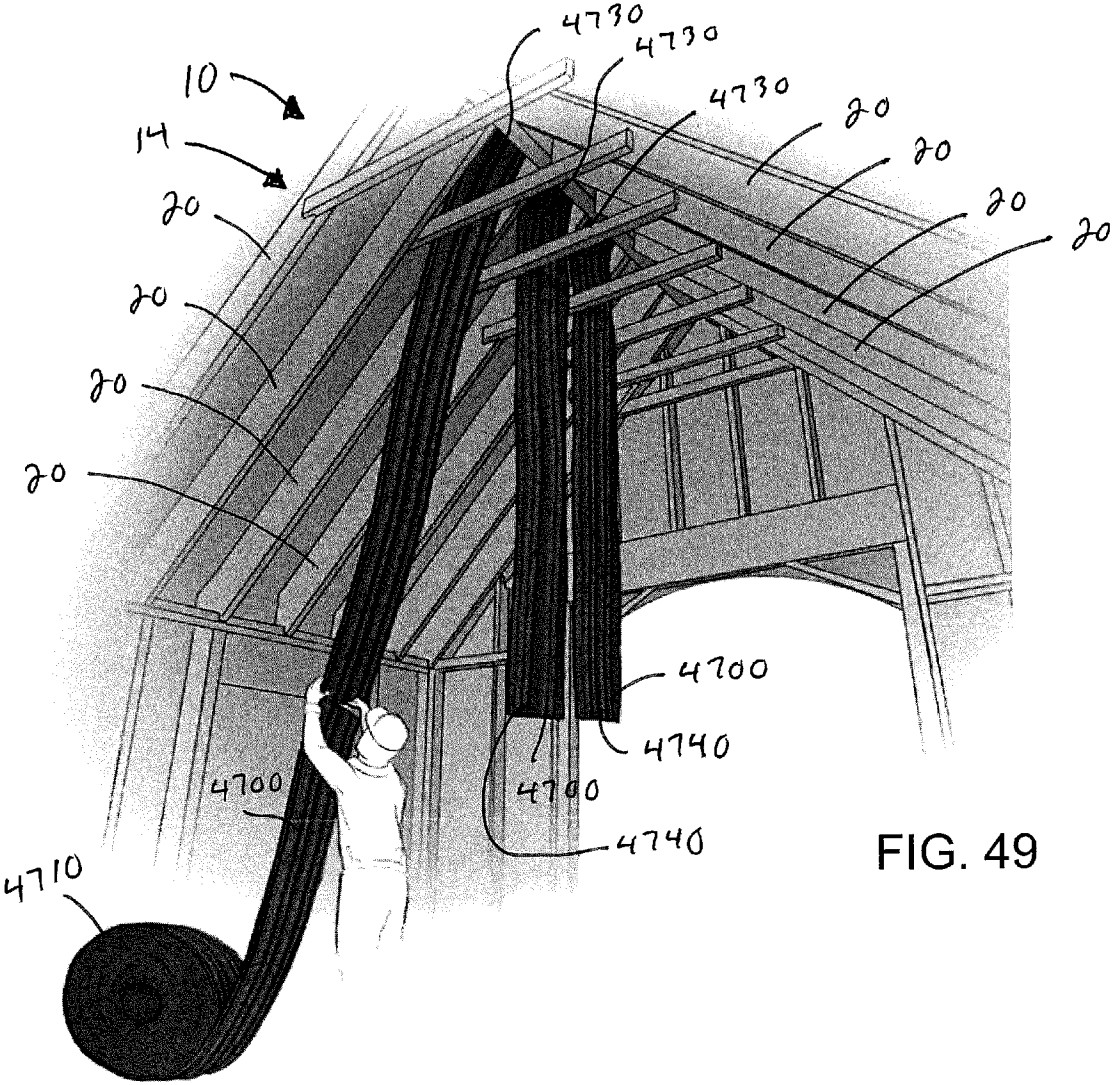
Figure 50:
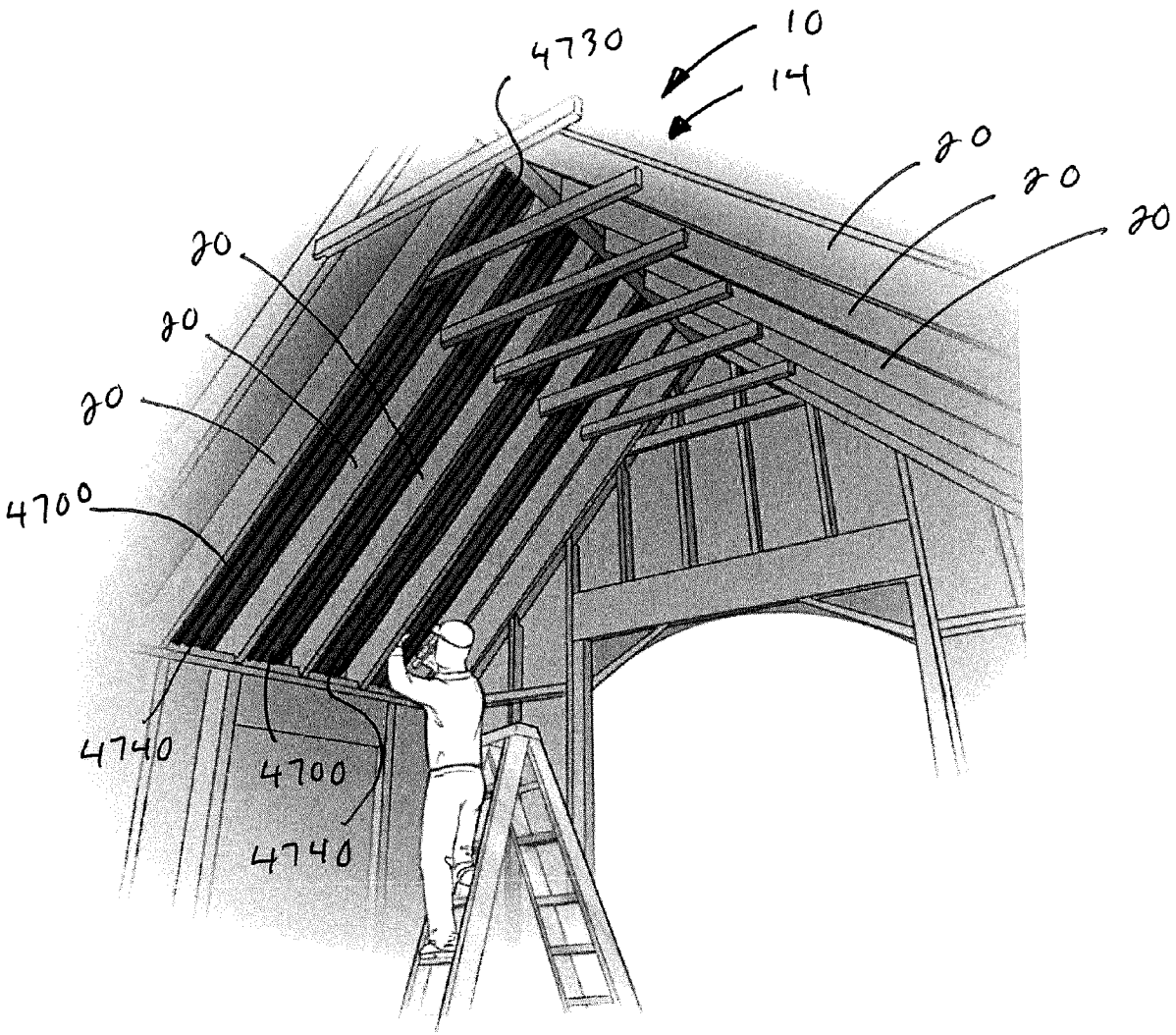

FIGS. 48-50 illustrate installation of the vent chutes 4700. Referring to FIG. 48 in a first step an installer unrolls an excess of the vent chute 4700 while climbing up a ladder positioned underneath a cathedral ceiling. The vent chute 4700 can similarly be installed, optionally without a ladder, in an unvented attic. The installer attaches a top 4730 of the vent chute 4700 to the top of one of the cathedral ceiling's cavities or to the top of one of the unvented attic's cavities by stapling or otherwise fastening the vent chute 4700 to the sheathing and/or the support members 20 of the roof deck. Referring to FIG. 49, in a second step, the installer cuts the vent chute 4700 to the desired length for all of the cavities in the cathedral ceiling or unvented attic. Measuring and cutting the vent chutes 4700 to the appropriate length can be facilitated with markings (notches, different color, etc.) every foot along the sides of the vent chute 4700. In a third step, the installer staples or otherwise fastens lower ends 4740 of the vent chutes 4700 to the sheathing 24 and/or the support member 20 at the eaves of the cavities using either stilts or a ladder if the vent chutes are being applied in a cathedral ceiling or optionally without stilts or a ladder if the vent chutes are applied in an unvented attic. This process is repeated for each vent chute 4700 and corresponding pair of support members 20.

One benefit of the method illustrated by FIGS. 48-50 is that the installer would only need the ladder once or twice per cavity or bay, compared 3 to 6+ times per bay (depending on the cathedral ceiling size) using the conventional approach of nesting individual baffles along the cavity's length. An alternative to the method illustrated by FIGS. 48-50 is to measure and cut one vent chute 4700 to the appropriate length, and then use the cut vent chute as a template to cut the rest of the vent chutes in succession on the floor. Then the installer may go up the ladder with 2 or 3 vents at one time to make multiple attachments near the roofs ridge. Using this approach, the installer would further minimize ladder usage, possibly to one trip up and down per every 3 cavities.

In one embodiment, the vent chutes 4700 may sheets would sag somewhat in the middle. However, this sagging is removed when the cavities are filled with insulation, such as loose fill or batts. The insulation 58 (batts or LF), presses the vent chutes 4700 into place against the roof deck sheathing 24. If however the sagging were not taken up by the insulation 58, the installer may apply another line of staples at the mid-section of the vent chutes 4700, or the installer may be able to pull the vent chute 4700 taught at the bottom. An air barrier layer 1032 may be provided below the vent chute 4700 in one exemplary embodiment. The air barrier layer may be provided between the insulation 58 and the vent chute 4700. In another exemplary embodiment, the vent chutes are configured to act as air barriers for the roof deck 14. A variety of different material options can be used to achieve vent chutes that allow moisture (gas/vapor) to easily pass through, but restrict air-flow. One advantage of the polymer mesh materials is that they would not provide a significant surface for condensation to form on. However, the mesh of polymer fibers do little to impede air-flow. In one exemplary embodiment, an air barrier layer 1032 (which may be any of the air barrier layers described herein), such as a non-woven veil that allows moisture transport, but block air-flow, can be laminated to the vent chutes 4700. One example of an air barrier layer that may be bonded to the vent chute 4700 material is non-woven polypropylene used in weather resistant barriers like Tyvek™. Other possibilities for air barrier layers 1032 include woven and non woven fabrics made from glass fibers, natural fibers, or plastic fibers.

The vent chutes 4700 can be made from a wide variety of different materials and have a variety of different geometric configurations to achieve the desired functionalities for the application. For example, the vent chutes can be configured to:

(1) Provide the ventilation gap or space 1082 between the roof deck sheathing 24 and the insulation.

(2) Be easily attached to the roof deck (for example with a hammer stapler).

(3) Be able to be rolled onto and off of a spool.

(4) Not collapse under pressure from attached insulation.

(5) Be easily cut to the desired length. and/or (6) Not lead to issues with condensation or excessive air-leakage into the building's conditioned space.

The vent chutes 4700 can be made from a wide variety of different materials and can have a wide variety of different configurations. For example, the vent chutes 4700 can be made from a continuous sheet of mesh material, with a width of the cavities, that is made out of extruded polymer fibers and has corrugations that run along the length of the chute. The polymer mesh material is stiff enough to maintain its profile after the insulation is installed to keep the vent gap open, and is also flexible enough to be easily packaged in a roll. The polymer mesh has the advantage of not being a surface for condensation.

One configuration of the vent chute 4700 material is an "egg carton" surface profile made from entangled, but open, polymer fibers. In combination with a wire mesh material, this open air "egg carton" surface profile keeps the insulation separated from the roof deck sheathing 24, while also allowing more air to flow from soffit to ridge than would be possible with air-impermeable membrane of the same "egg carton" shape (as air must flow around the egg cartons, instead of through them). The metal wire mesh provides good rigidity to the vent chute. Another configuration of the vent chute 4700 material has a one-dimension surface variation, such as those illustrated by FIG. 47B can result in a more compact roll.

In one exemplary embodiment, the vent chutes 4700 include perforations that run along the length of the vent chutes. These perforations enable the installer to reduce the width (22.5" wide for example or other width) to fit a narrower cavity width (e.g. 16" on center, or narrow cavities along rakes).

Figure 51:
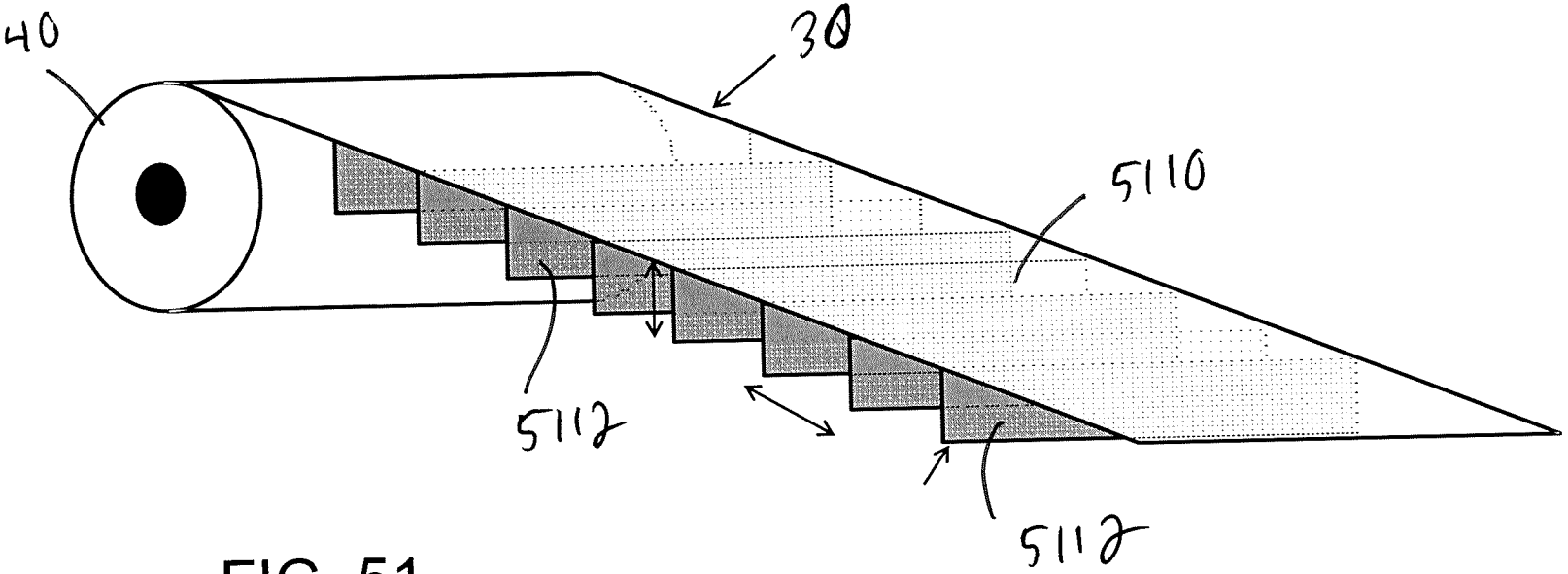
FIG. 51 illustrates an exemplary embodiment of an insulation support material.
Figure 52A:
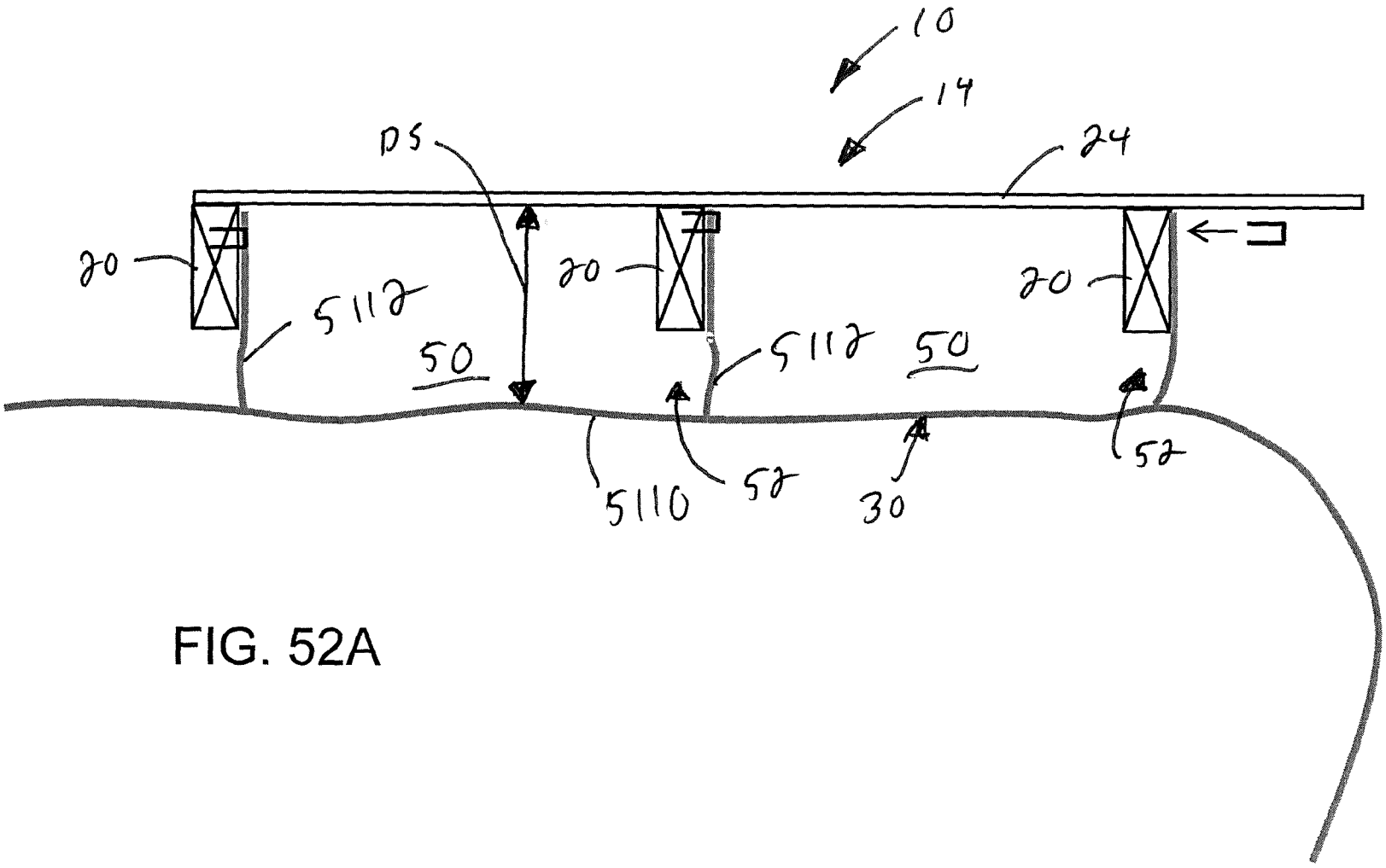
FIG. 52A illustrates installation of the insulation support material of FIG. 51 on a building structure.
Figure 52B:
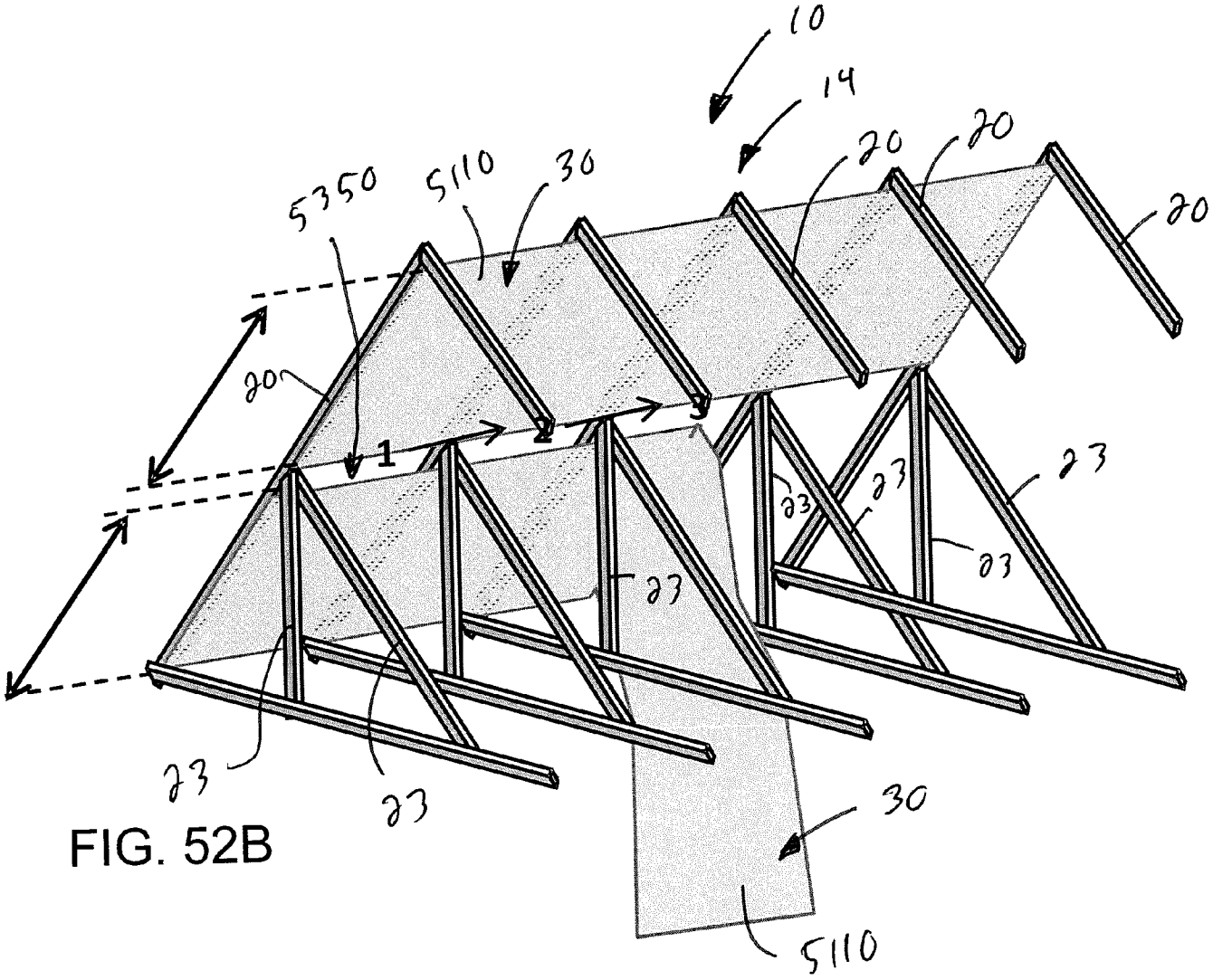
FIG. 52B illustrates installation of the insulation support material of FIG. 51 in an attic formed by trusses.

FIGS. 51, 52A, and 52B illustrate an exemplary embodiment where the insulation support material 30 can be rolled out to span at multiple support members 20 (i.e. to form two or more insulation cavities 50 with one piece of insulation support material. In the embodiment illustrated by FIGS. 51, 52A, and 52B, the insulation support material 30 creates an enclosure for loose fill fiberglass to be installed along the underside of roof deck sheathing 24 in unvented attic assemblies. The system illustrated by 51, 52A, and 52B has insulation support material that comprises a continuous membrane 5110 that optionally is provided on a roll 5100, and has side panels 5112 that branch out to one side and run perpendicular to the membrane's length. In an exemplary embodiment, the side panels 5112 are regularly spaced. In one embodiment, the spacing between the side panels 5112 matches a given support member spacing, such as truss or rafter spacing, for example 24 inches. The width of the side panels 5112 is such that the appropriate enclosure depth can be accurately and easily achieved.

FIG. 52A illustrates representative adjacent support members 20, such as a truss chords and a sheathing panel 24 Referring to FIG. 52B, the insulation support material 30 is unrolled onto the support members 20 from a roll 40 between webs 23, between webs 23 and upper ends of support members 20, and/or between webs 23 and lower ends of support members 20. The support material 30 is cut thereby forming a length of insulation support material that corresponds to the span of the roof deck 14.

Referring to FIG. 52A, the side panels 5112 are attached to the support member 20. In the illustrated embodiment, the side panels 5112 are attached to the inside-face of support member of a truss, using a fastened, such as a stapler. However, it should be apparent that the side panels can be attached to any structure of the roof deck 14 in any manner. The side panels 5112 can be attached to any portion of the support members 20, to any portion of the support members 23, and/or to any portion of the sheathing.

Figure 53A:
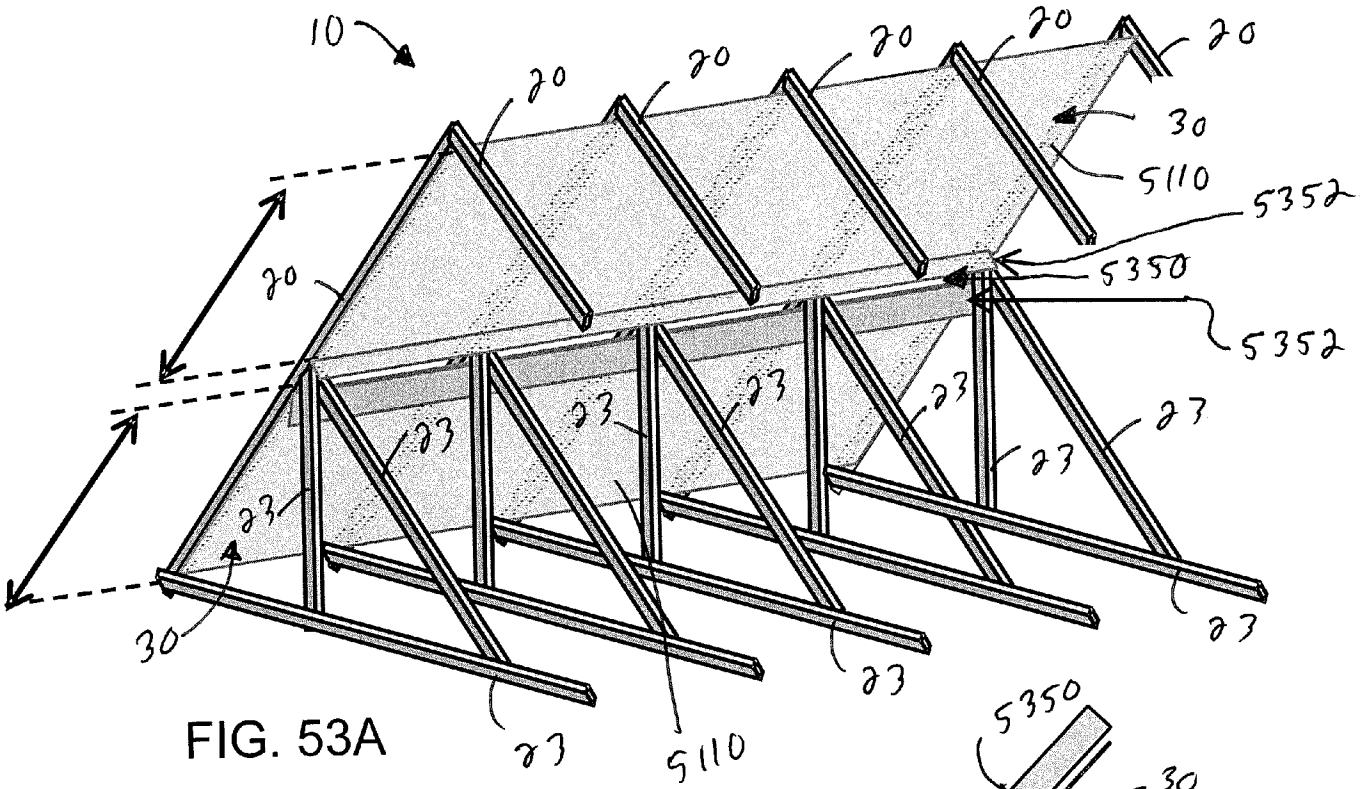
FIGS. 53A-53C illustrate an exemplary embodiment of installation of insulation support material of FIG. 51 in an attic formed by trusses.
Figure 53B:
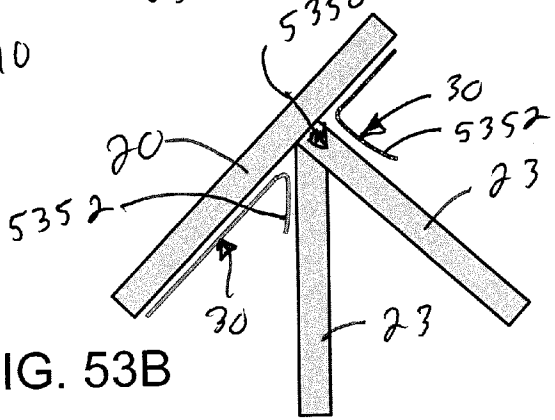
Figure 53C:
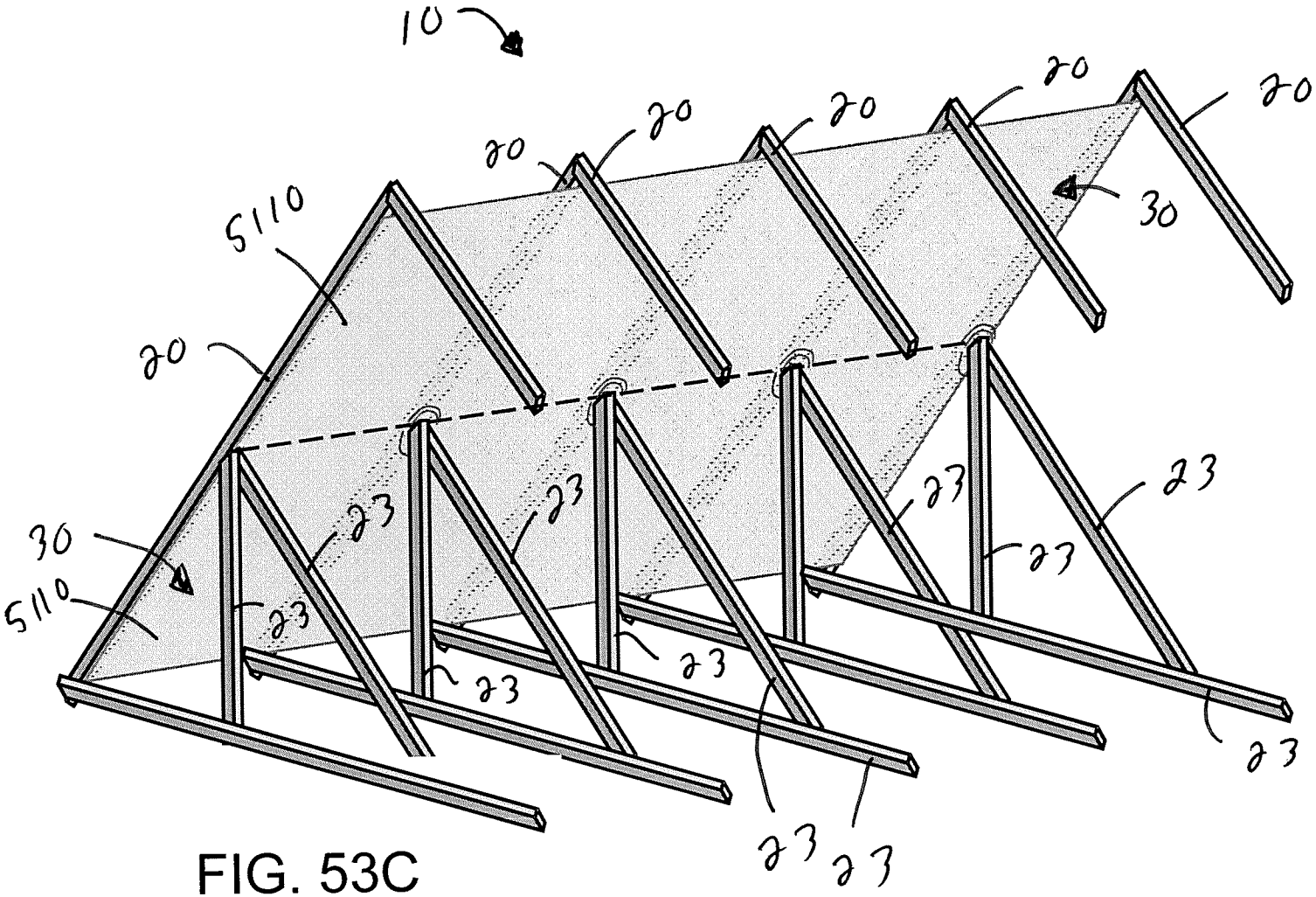
Figure 54:
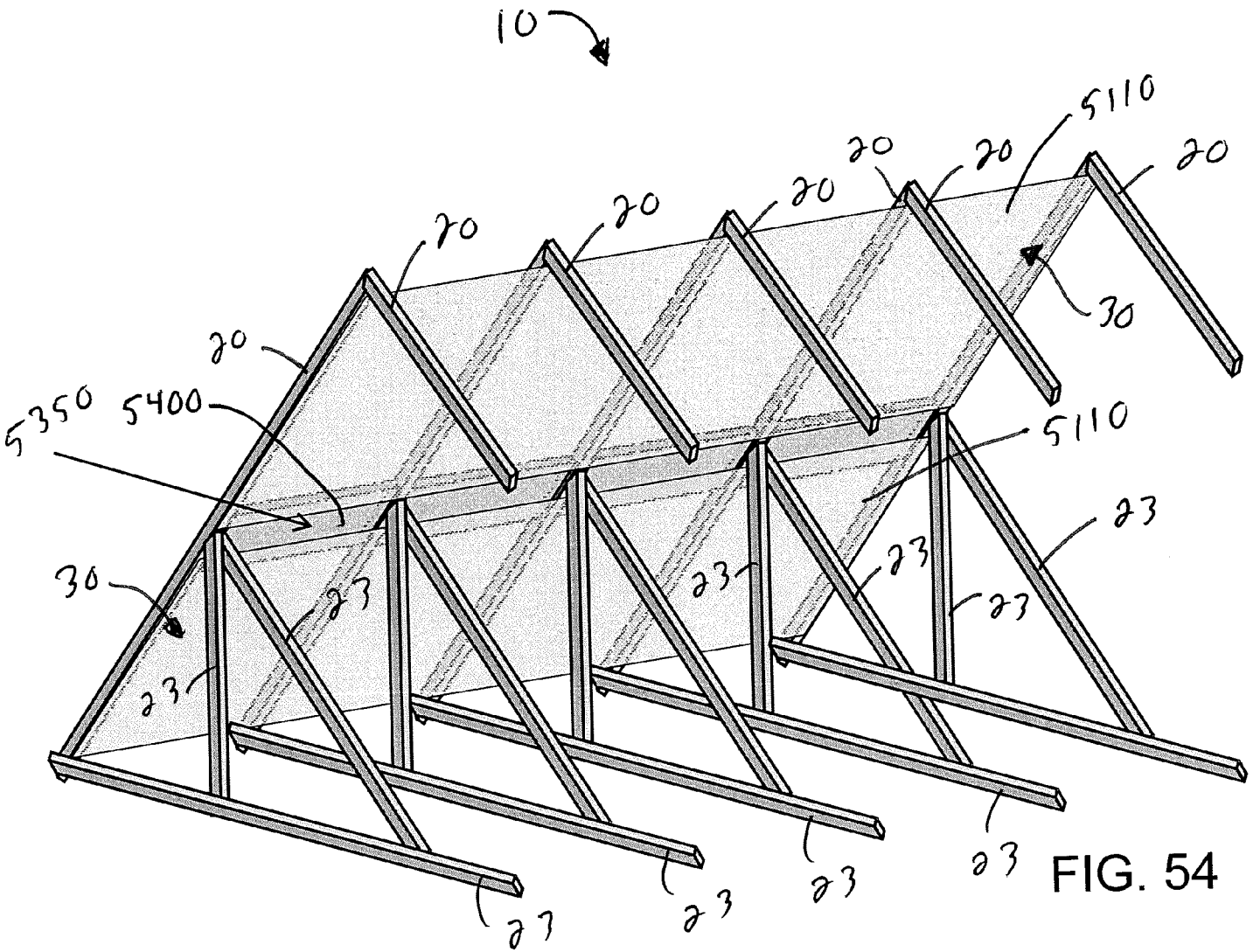
FIG. 54 illustrates an exemplary embodiment of installation of insulation support material of FIG. 51 in an attic formed by trusses.

Referring to FIGS. 53A and 54B, upon terminating the support material 30 on opposing ends, usually at the eave 1006 and ridge 1010, the enclosures that are created are filled with loose fill insulation 58. However, the truss webs 23 prevent a continuous membrane 5110 from being applied over an entire section of the roof deck 14. In the example illustrated by FIG. 52B, the insulation support material 30 is applied in long sections than run horizontally, i.e. parallel to the eaves. This leaves a gap 5350 between the each section. If the gap 5350 is not bridged, the blown loose fill insulation 58 is not contained. In one exemplary embodiment, adjacent horizontally running sections of the membrane 5110 are spliced together. This splicing can be accomplished in a wide variety of different ways. In one exemplary embodiment, the membranes 5110 are provided with flaps 5352 (FIG. 53B). Referring to FIG. 53C, the flaps 5352 can be stretched around the webs 23 and fastened together, for example by stapling. FIG. 54 illustrates another way to splice the two sections together. In the example illustrated by FIG. 54, an insulation batt 5400 is placed into the gap between the two sections.

The insulation support material 30 illustrated by FIGS. 51, 52A, and 52B, form insulation cavities 50, each having a substantially rectangular configuration. In an exemplary embodiment, a distance DS from the sheathing panel 24 to the membrane 5110 is substantially uniform. Referring to FIG. 52A, the insulation cavities 50 have insulation pockets 52 located under support members 20. Loosefill insulation material 58 is distributed into the insulation cavities 50 until the insulation cavities 50 are filled.

FIGS. 55-58 illustrate an exemplary embodiment that is similar to the embodiment illustrated by FIGS. 51, 52A, and 52B, except the side panels 5112 are attached to the support members 20 by passing fasteners through the membrane 5110 and into the side panels 5112. This allows the insulation support material 30 to be attached by simply rolling out a sheet of the support material 30 to be attached in the same manner as a wall fabric or in the same manner as housewrap is installed.

Figure 55:
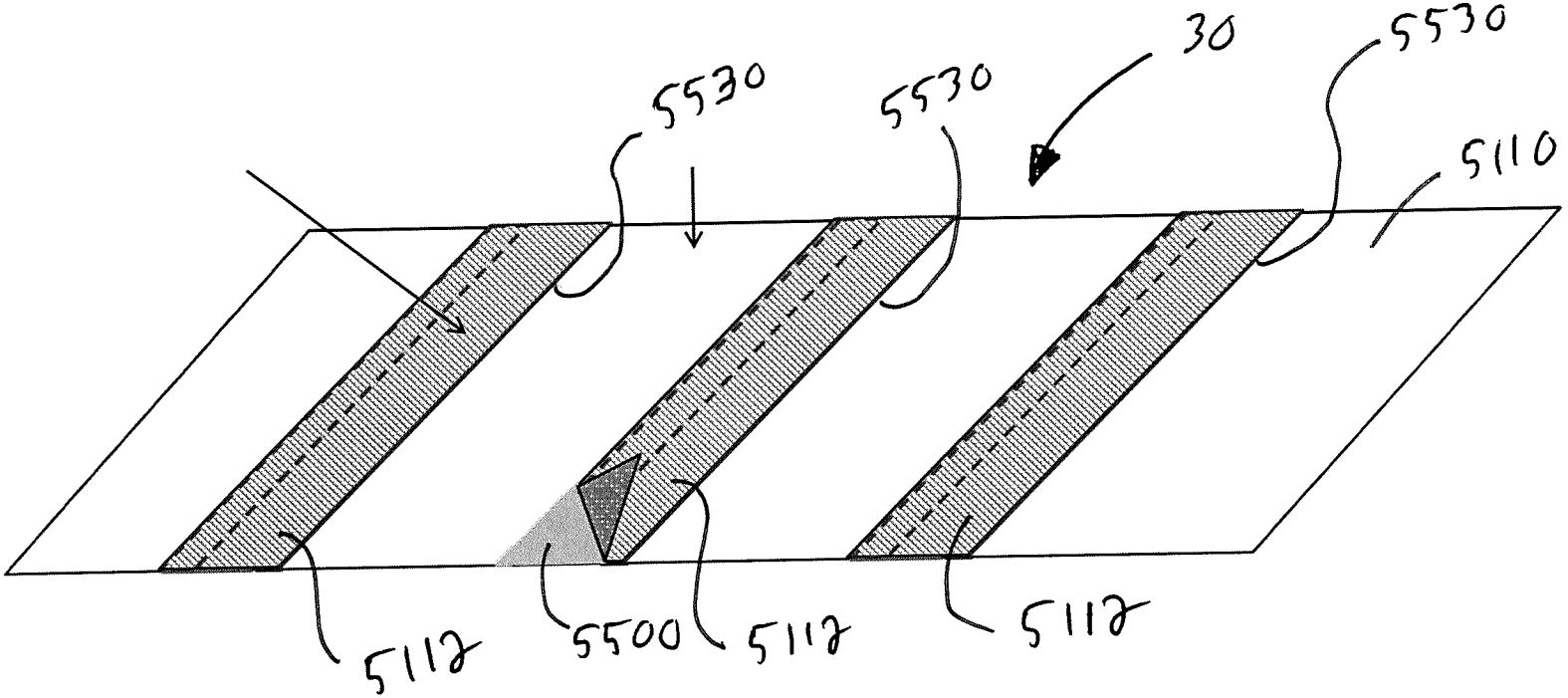
FIG. 55 illustrates an exemplary embodiment of an insulation support material.

Referring to FIG. 55, one edge 5530 of each side panel 5112 is permanently attached to the membrane 5110. The edge 5530 can be permanently attached to the membrane 5110 in a wide variety of different ways. For example, the edge 5530 of the side panel 5112 can be attached to the membrane 5110 by sewing seams, thermal bonding, strong adhesive, etc. In one exemplary embodiment, the side panels 5112 lay flat against the membrane 5110 and are releasably attached to the side panels 5112, so that the side panels 5112 can be peeled away from the membrane 5110, except for the attachment at the edge 5530. This releasable attachment can be achieved in a wide variety of different ways. In one exemplary embodiment, the side panels 5112 are attached to the membrane 5110 by a mild, releasable adhesive 5500 to hold the side panels 5112 in the flat layed configuration. The releasable adhesive 5500 allows the membrane 5110 to be released from the continuous membrane with a mild to moderate force as indicated by hand 5502. Possible adhesive options include pressure sensitive adhesives, Velcro, etc.

Figure 58:
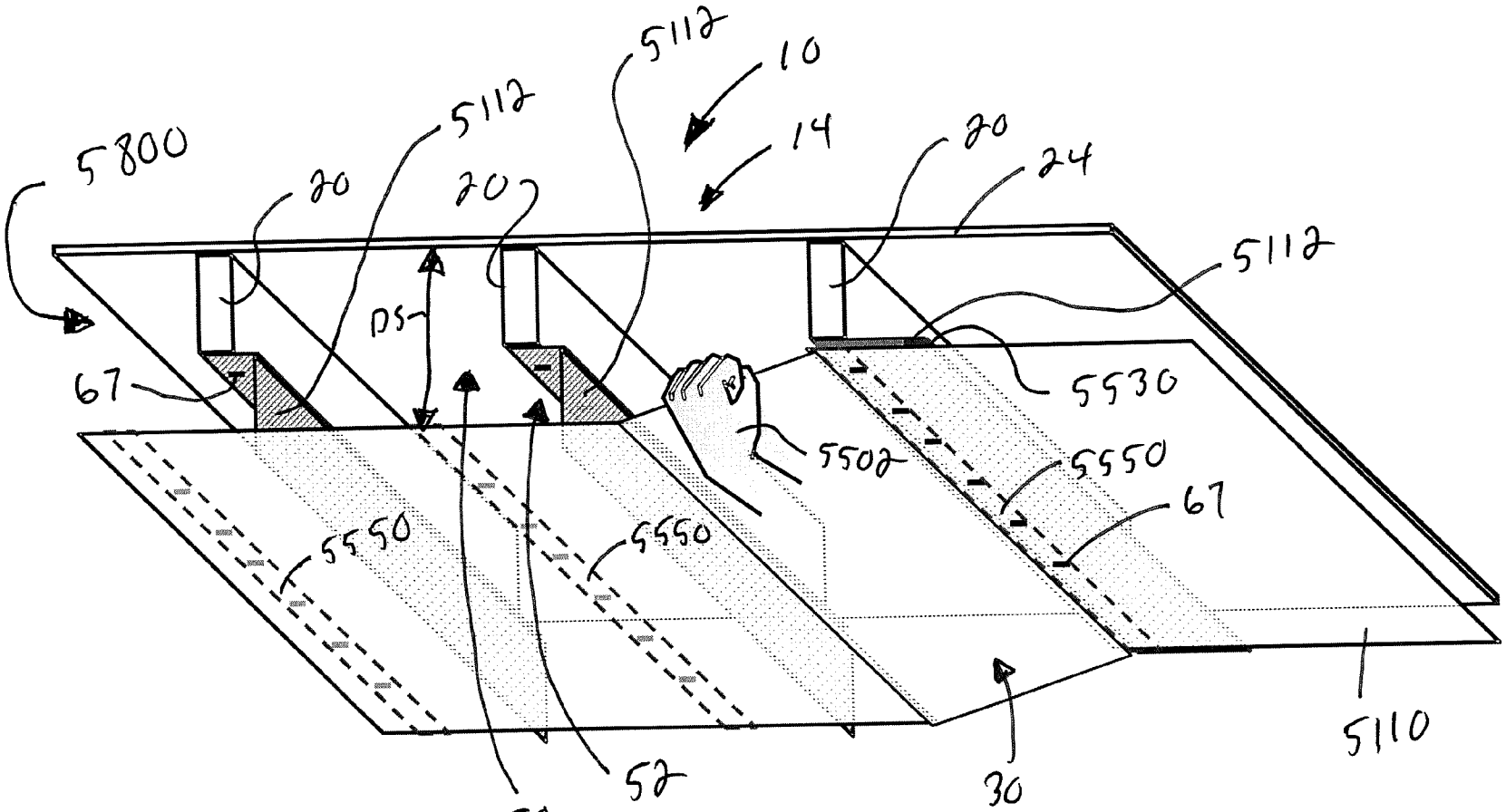

Referring to FIG. 58, in one exemplary embodiment, the side panels 5112 have significantly more pull through resistance or strength to staples or other fasteners than the continuous membrane 5110. For example, the side panels 5112 may have twice, three times, or more pull through resistance than the pull through resistance of the membrane 5110. Referring again to FIG. 55, in one exemplary embodiment, one or more optional fastening guide strips 5550 are provided to assist alignment of the panels 5112 with the support member 20 at the location corresponding to the desired enclosure depth/R-value. In another exemplary embodiment, the membrane 5110 is made from a transparent material to assist alignment of the panels 5112 with the support members 20. The panels 5112 may include guide strips 5550 to assist alignment of the panels 5112 with the support member 20 at the location corresponding to the desired enclosure depth/R-value.

Figure 56:
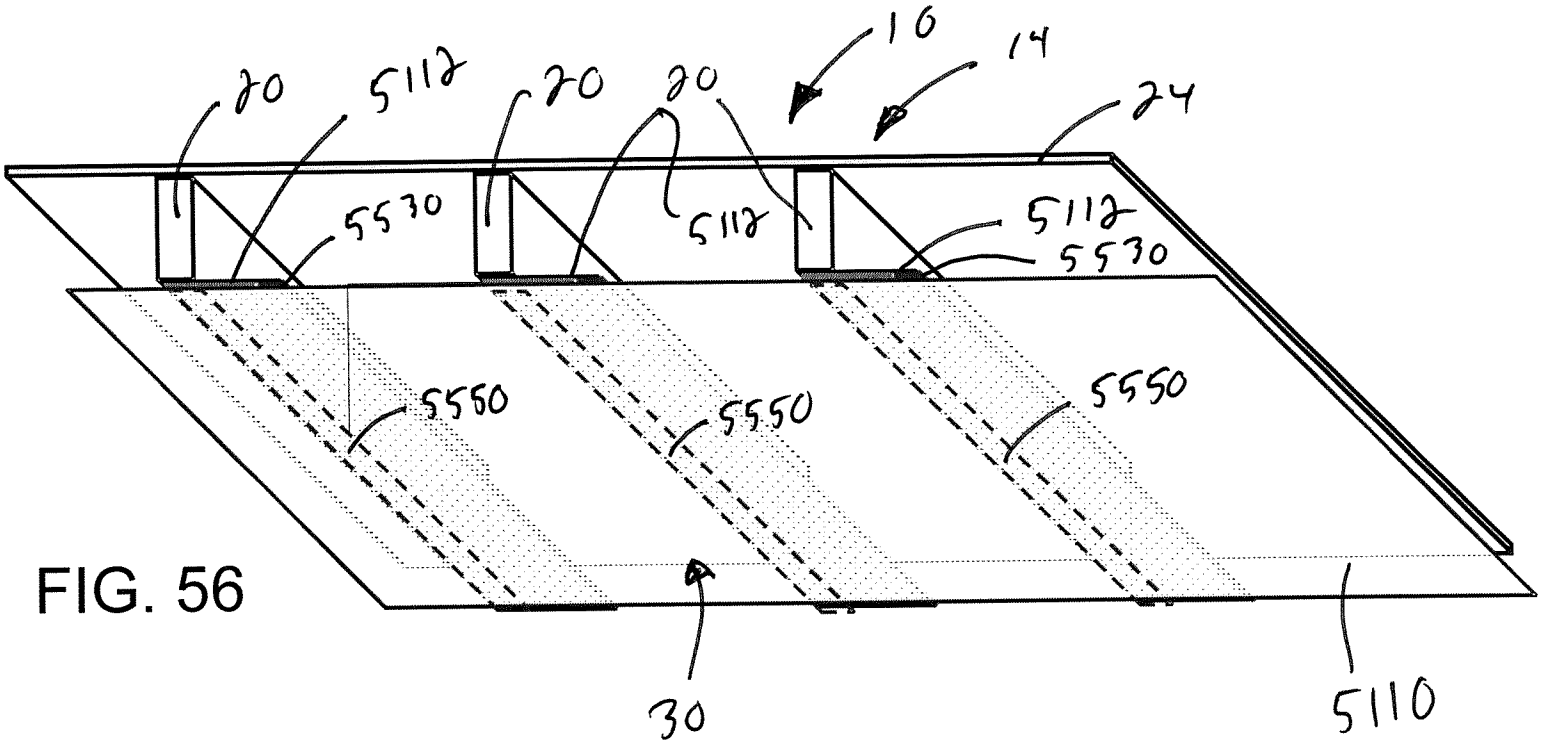
FIGS. 56-58 illustrate installation of the insulation support material of FIG. 55 on a building structure.
Figure 57:
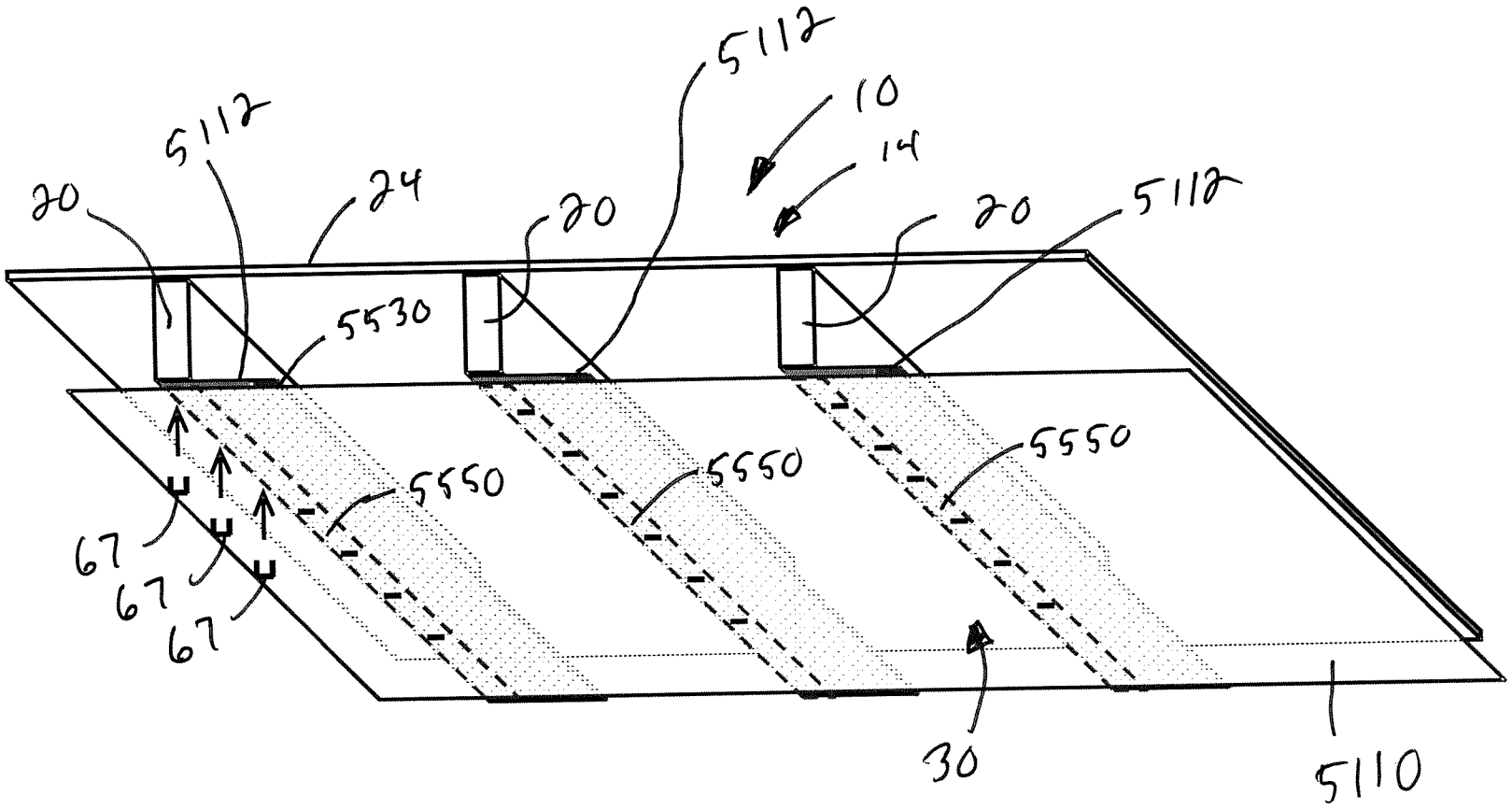

FIGS. 56-58 illustrate installation of the membrane 30 of FIG. 55. Referring to FIG. 56, the membrane 30 is unrolled and cut to the dimensions of the roof deck 14. The membrane 30 is positioned with respect to the support members 20, so that the panels 5112 are aligned with the support members 20. For example, the optional fastening guide strips 5550 are aligned with truss chords. Referring to FIG. 57, the membrane 30 is fastened in place with fasteners that pass through the membrane 5110 and panels 5112. For example, an installer fires staples or other fasteners 67 through the fastening guide strip 5550, and into the front face of the support member 20, such as a truss chord.

Referring to FIG. 58, the membrane 30 is converted to a panelized insulation enclosure 5800. In the example illustrated by FIG. 58, the membrane 5110 is pulled or otherwise applying force as indicated by the hand 5502 in FIG. 58. In an exemplary embodiment, a light to moderate force pulls/rips the membrane over the staples while, also releasing the side panels 5112 from the continuous membrane 5110. This step can be accomplished either by manually pulling as indicated by the hand 5810 in FIG. 58 or by simply filling the enclosure with insulation 58, such as loose fill insulation. In another exemplary embodiment, the membrane 5110 can be provided with perforated circles, or complete holes, into which the fasteners or staples are applied. The perforated circles or holes ensure that the membrane 5110 pulls over the fastener, such as the illustrated staples. Splicing two sections of the membrane enclosure can be accomplished using the same methods shown by and described with respect to FIGS. 53A and 54.

The membrane 5110 and the side panels 5112 can be made from a wide variety of different materials. For example, the membrane 5110 and the side panels 5112 can be made from any of the materials described in this application. The membrane 5110 and/or the side panels 5112 can be made from woven & non-woven fabric, plastic sheets, and vapor control membranes.

The insulation support material 30 illustrated by FIGS. 55-58, form insulation cavities 50, each having a substantially rectangular configuration. In an exemplary embodiment, a distance DS from the sheathing panel 24 to the membrane 5110 is substantially uniform. Referring to FIG. 58, the insulation cavities 50 have insulation pockets 52 located under support members 20. Loosefill insulation material 58 is distributed into the insulation cavities 50 until the insulation cavities 50 are filled.

Figure 59:
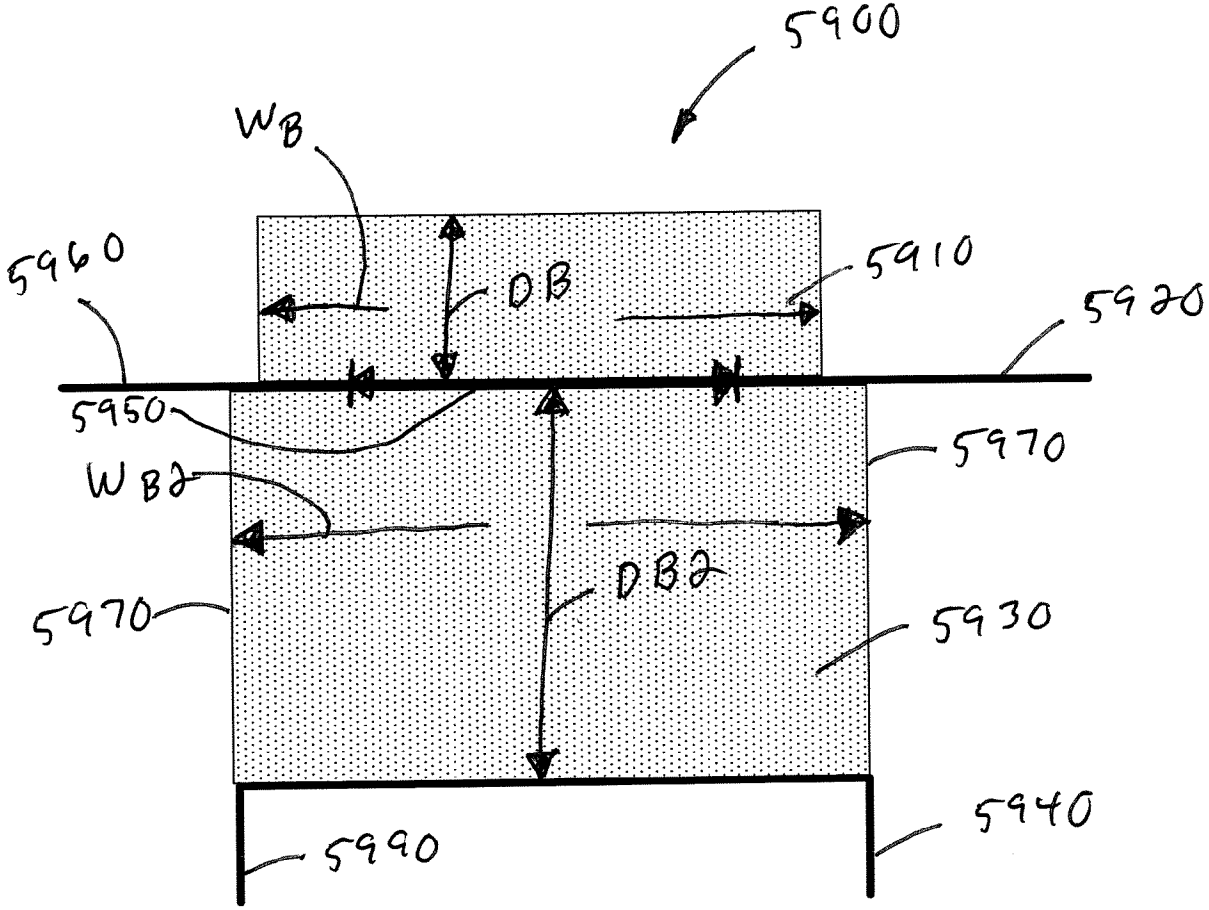
FIG. 59 illustrates an exemplary embodiment of an insulation material.
Figure 60:
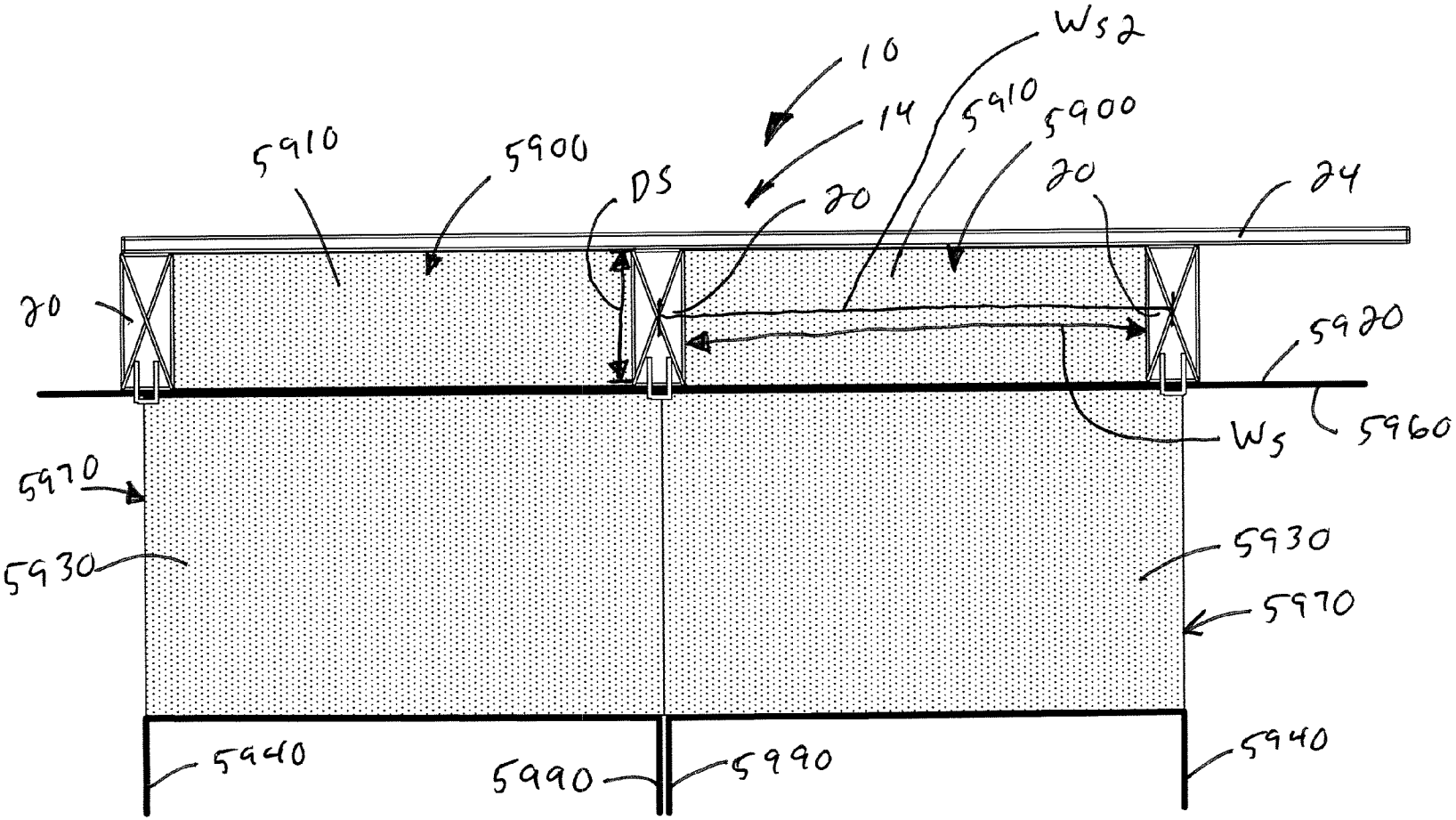
FIGS. 60 and 61 illustrate installation of the insulation material illustrated by FIG. 59 on a building structure.
Figure 61:
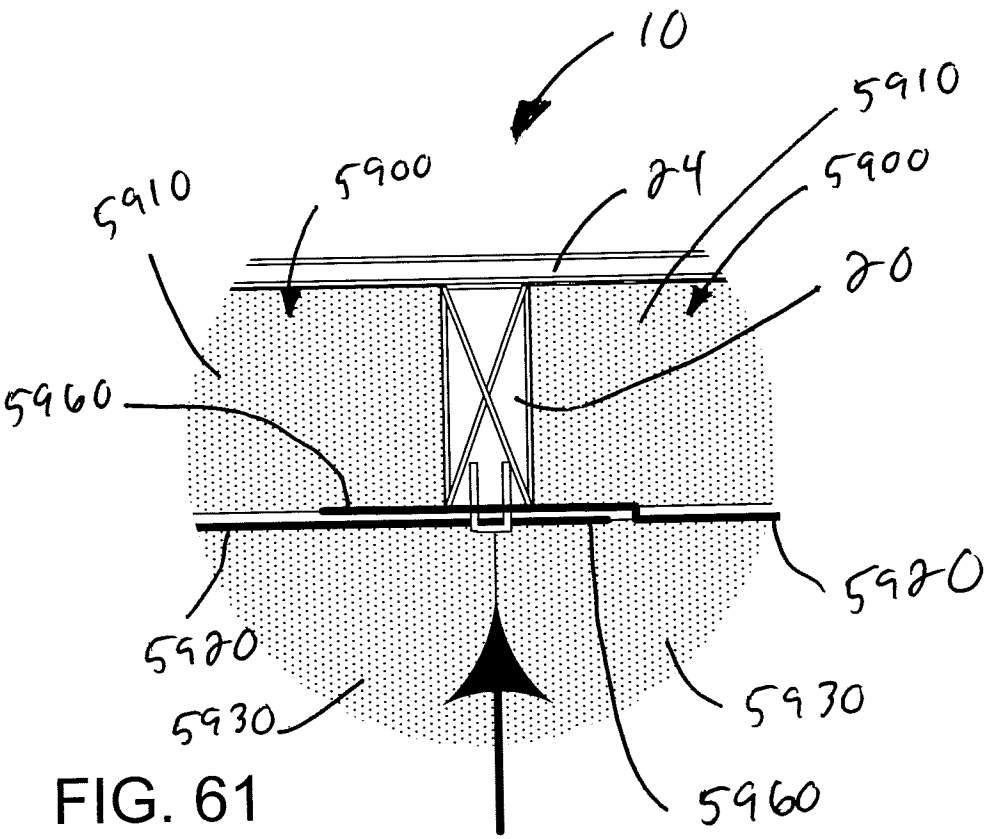

FIGS. 59-61 illustrate an exemplary embodiment of an insulation assembly 5900. Referring to FIG. 59, the insulation assembly 5900 includes a first insulation piece 5910, a joining sheet 5920, a second insulation piece 5930, and an optional connecting sheet 5940. The first insulation piece 5910 can take a wide variety of different forms. In one exemplary embodiment, the insulation piece 5910 is a fiberglass insulation batt or a foam board having a depth $D_B$ that substantially matches the depth $D_S$ of the supports 20. In one exemplary embodiment, the insulation piece 5910 is a fiberglass insulation batt or a foam board having a depth $D_B$ that is larger than the depth $D_S$ of the supports 20, but the depth $D_B$ can be compressed to the depth $D_S$ of the supports 20. In one exemplary embodiment, the insulation piece 5910 is a fiberglass insulation batt or a foam board having a width $W_B$ that substantially matches the width $W_s$ between the supports 20. In one exemplary embodiment, the insulation piece 5910 is a fiberglass insulation batt or a foam board having a width $W_B$ that is larger than the width $W_S$ between the supports 20, but the width $W_B$ can be compressed to the width $W_S$ between the supports 20.

The second insulation piece 5930 can take a wide variety of different forms. In one exemplary embodiment, the second insulation piece 5930 is a fiberglass insulation batt or a foam board having a depth $D_{B2}$ that is selected based on a desired R value for the insulation assembly. In one exemplary embodiment, the second insulation piece 5930 is a fiberglass insulation batt or a foam board having a width $W_{B2}$ that substantially matches the center to center distance or width $W_{S2}$ between the supports 20. In one exemplary embodiment, the second insulation piece 5930 is a fiberglass insulation batt or a foam board having a width $W_{B2}$ that is wider than the center to center width $W_{S2}$ of the supports 20, but the width $W_{B2}$ can be compressed to the center to center width $W_{S2}$ of the supports 20.

In an exemplary embodiment, the first insulation piece 5910 is connected to the second insulation piece 5930 by the joining sheet 5920. The first insulation piece 5910 can be connected to the second insulation piece 5930 in a wide variety of different ways. For example, the first and second insulation pieces 5910, 5930 can be connected to opposite sides of the joining sheet 5920 by an adhesive. In one exemplary embodiment, the insulation piece 5910 is adhered to the joining sheet 5920 across less than entire width of the first insulation piece. For example, the first insulation piece 5910 can be joined to the joining sheet 5920 in the area indicated by arrows 5950. In one exemplary embodiment, the second insulation piece 5930 is adhered to the joining sheet 5920 across less than entire width of the second insulation piece. For example, the second insulation piece 5930 can be joined to the joining sheet 5920 in the area indicated by arrows 5950.

The joining sheet 5920 can take a wide variety of different forms and can be made from a wide variety of different materials. In one exemplary embodiment, the joining sheet 5920 has a width that is wider than the width $W_{B2}$ of the second insulation piece 5930. The wider width results mounting tabs 5960 that extend from sides 5970 of the insulation assembly 5900. In one exemplary embodiment, the joining sheet 5920 is made from an air and moisture permeable material. For example, the joining sheet may be an air and moisture permeable scrim, kraft material, or non-woven material. The joining sheet may be any air and moisture permeable material, such as any of the air and moisture permeable materials disclosed in the present patent application.

In an exemplary embodiment, the optional connecting sheet 5940 is connected to the second insulation piece 5930. The connecting sheet 5940 can be connected to the second insulation piece 5930 in a wide variety of different ways. For example, the connecting sheet 5940 can be connected to the second insulation piece by an adhesive.

The optional connecting sheet 5940 can take a wide variety of different forms and can be made from a wide variety of different materials. In one exemplary embodiment, the joining sheet 5920 has a width that is wider than the width $W_{B2}$ of the second insulation piece 5930. The wider width results connecting tabs 5990 that extend from sides 5970 of the insulation assembly 5900. In one exemplary embodiment, the connecting sheet 5940 is made from an air permeable and moisture impermeable permeable material. For example, the connecting sheet 5940 may be a water vapor retarder material, such as any of the vapor retarder materials disclosed in the present application.

FIGS. 60 and 61 illustrate installation of the insulation assembly 5900. In one exemplary embodiment, the insulation piece 5910 is placed in the space between the supports 20. If necessary, the width $W_B$ of the insulation piece 5910 is compressed to fit the width $W_S$ between the supports 20. Referring to FIG. 61, the mounting tabs 5960 are overlapped, placed over the supports 20, and fastened to the supports 20. In exemplary embodiment, the second insulation piece 5930 is compressed to allow the mounting tabs 5960 to be fastened to the supports 20, for example by staples. In one exemplary embodiment, the second insulation piece 5930 can be compressed without pulling the mounting tabs 5960 away from the supports, because the joining sheet 5920 is adhered across less than entire width of the second insulation piece. For example, adhering the joining sheet 5920 to the second insulation piece in the area indicated by arrows 5950 allows the side ends of the insulation piece 5930 to be compressed to thereby allow the mounting tabs 5960 to be fastened to the faces of the supports 20, for example, by stapling. Once the mounting tabs 5960 are fastened to the supports 20, the connecting tabs 5970 are connected together and in one embodiment, sealed together to provide the insulation system 5900 with a continuous vapor retarder.

Referring to FIG. 60, the insulation piece 5930 has end portions that are located under or behind support members 20. In one exemplary embodiment, the insulation pieces 5930 abut one another to provide continuous or substantially continuous insulation behind or below the support member s 20.

FIGS. 62A-62D illustrate exemplary embodiments of insulation systems 6200 that include a moisture buffering material 6210 on an inside of an insulation cavity 50. The moisture buffering material adds a moisture capacitance to the insulation system. The insulation system 6200 can be any of the insulation systems disclosed by the present patent application. In the examples, illustrated by FIGS. 62A-62D, the systems 6200 include insulation 58, roof deck sheathing 24, support members, insulation support material 30, and the moisture buffering material 6210.

Figure 63:
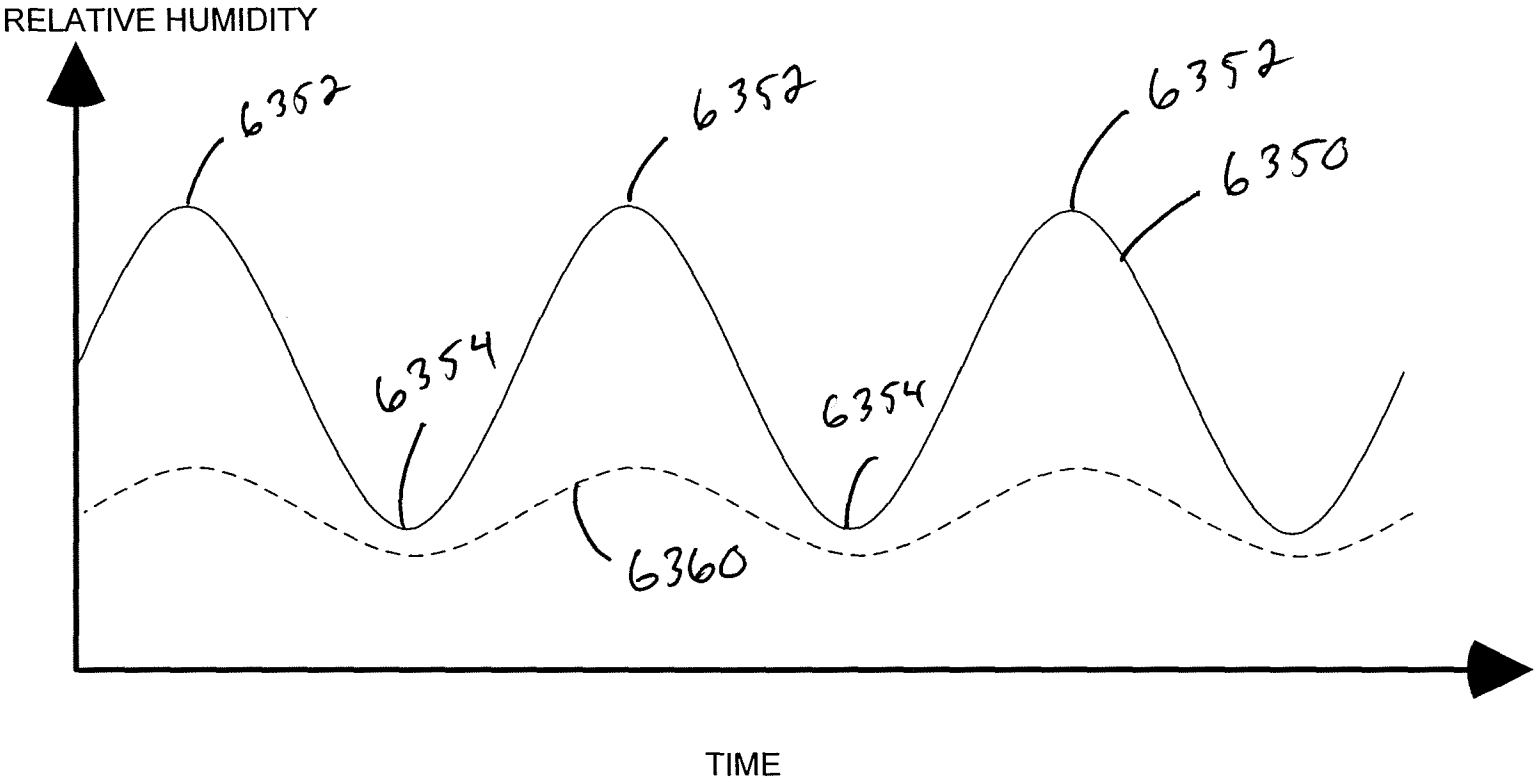
FIG. 63 illustrates is a graph illustrating variations of relative humidity in an insulation cavity with and without a buffer material.

Referring to FIG. 63, moisture in the insulation cavities 50 can swing or fluctuate depending on the time of day and/or the season as indicated by plot 6350. Typically, the mean humidity (over the course of any given day and/or over the course of seasons) in the cavity 50 is less than an unacceptable level, where the dew point is reached and water condenses inside the cavity 50. However, peak humidities 6352 at particular times of day and/or in particular seasons may result in times where the humidity inside the cavity 50 exceeds the dew point. The moisture buffering material 6210 adds a moisture capacitance to the insulation system 6200 to absorb water vapor before the water vapor condenses at the peaks 6352 where the humidity exceeds the dew point. This absorbtion of water vapor keeps the humidity in the insulation cavity at a level where the water can condense out of the air if temperature drops. The moisture buffering material 6210 releases the moisture back into the interior of the building, when the drying potential exists (see for example the valleys 6354). That is, when the local humidity (the humidity in and near the insulation cavity 50) drops, the moisture buffering material releases the moisture as water vapor back to the location of lowest moisture concentration as dictated by Frick's law. For example, when the relative humidity in the cavity 50 drops below a threshold value, such as 50%, the moisture buffering material 6210 will release the water. The released water vapor will always return to the area of lowest humidity, which will typically be outside the cavity 50. The plot 6360 illustrates how the moisture buffering material 6210 reduces the peak humidities in the insulation cavities 50.

In one exemplary embodiment, the moisture buffering material 6210 is tuned based on the lowest that will be seen in the insulation cavity. The moisture buffering material 6210 is tuned to keep the relative humidity in the insulation cavity 50 from reaching the dew point at the minimum temperature that will be seen in the insulation cavity 50. This prevents saturation and condensation from ever occurring in the cavity.

The moisture buffering material 6210 can take a wide variety of different forms. For example, the moisture buffering material can be a hygric buffer, a desiccant, a wicking material, or other moisture absorbing material. In one exemplary embodiment, the moisture buffering material can hold many times its weight in water. For example, the moisture buffering material can hold more than five times its weight in water, more than ten times its weight in water, more than twenty times its weight in water, more than fifty times its weight in water, more than 100 times its weight in water, or even 500 times its weight in water. In one exemplary embodiment, the moisture buffering material 6210 is a superabsorbancy polymer (SAP). One acceptable SAP is Gelok, which has previously been used in diapers. 1.5 g of Gelok can absorb 90 g of water. The insulation support material can take a wide variety of different forms and can be made from a wide variety of different materials. For example, the insulation support material 30 can be any of the materials disclosed by the present patent application.

In one exemplary embodiment, the insulation support material 30 is a conventional insulation support material that allows air to freely pass through the material 30. This allows the insulation 58 to be easily blown into the insulation cavity 50. Air that blows the insulation 58 into the cavity can easily exit the through the insulation support material. The moisture buffering material 6210 can be applied to the insulation support material 30 in a wide variety of different ways. In one exemplary embodiment, the moisture buffering material 6210 is applied to an inside surface or portion(s) of the inside surface of the air permeable insulation support material (i.e. the side inside the cavity 50). For example, the moisture buffering material 6210 can be applied in multiple discrete locations of the inside surface of the insulation support material 30, so that uncovered areas of the insulation support material still allow air to freely pass through the material 30. In one exemplary embodiment, the buffering material is applied to a back side of a facing of an insulation batt, between the facing and the batt of insulation material.

In another exemplary embodiment, the insulation support material 30 is a vapor retarder. For example, the vapor retarder may have a perm rating of greater than 1 or the vapor retarder may be an adaptive vapor retarder that will change perm rating based on relative humidity and/or temperature. The moisture buffering material 6210 can be applied to the water vapor insulation support material 30 in a wide variety of different ways. For example, the moisture buffering material 6210 may be attached to the water vapor retarder insulation support material 30, laminated to the water vapor retarder insulation support material 30, and/or infused into the fabric of the insulation support material. In one exemplary embodiment, the moisture buffering material 6210 is applied to an inside surface or portion(s) of the inside surface of the water vapor retarder insulation support material 30 (i.e. the side inside the cavity 50). In one exemplary embodiment, the moisture buffering material 6210 can be applied in multiple discrete locations of the inside surface of the water vapor retarder insulation support material 30, so that uncovered areas of the insulation support material still have the desired permeance or the desired adaptive permeance. In one exemplary embodiment, the buffering material is applied to a back side of a facing of an insulation batt, between the facing and the batt of insulation material.

In another exemplary embodiment, the insulation support material 30 is a vapor barrier. The moisture buffering material 6210 can be applied to the water vapor insulation support material 30 in a wide variety of different ways. For example, the moisture buffering material 6210 may be attached to the water vapor barrier insulation support material 30, laminated to the water vapor barrier insulation support material 30, and/or infused into the fabric of the water vapor barrier insulation support material. In one exemplary embodiment, the moisture buffering material 6210 is applied to an inside surface or portion(s) of the inside surface of the water vapor retarder insulation support material 30 (i.e. the side inside the cavity 50). In one exemplary embodiment, the moisture buffering material 6210 can be applied in multiple discrete locations of the inside surface of the water vapor retarder insulation support material 30, so that uncovered areas of the insulation support material still have the desired permeance or the desired adaptive permeance. In one exemplary embodiment, the buffering material is applied to a back side of a facing of an insulation batt, between the facing and the batt of insulation material.

Figure 62A:
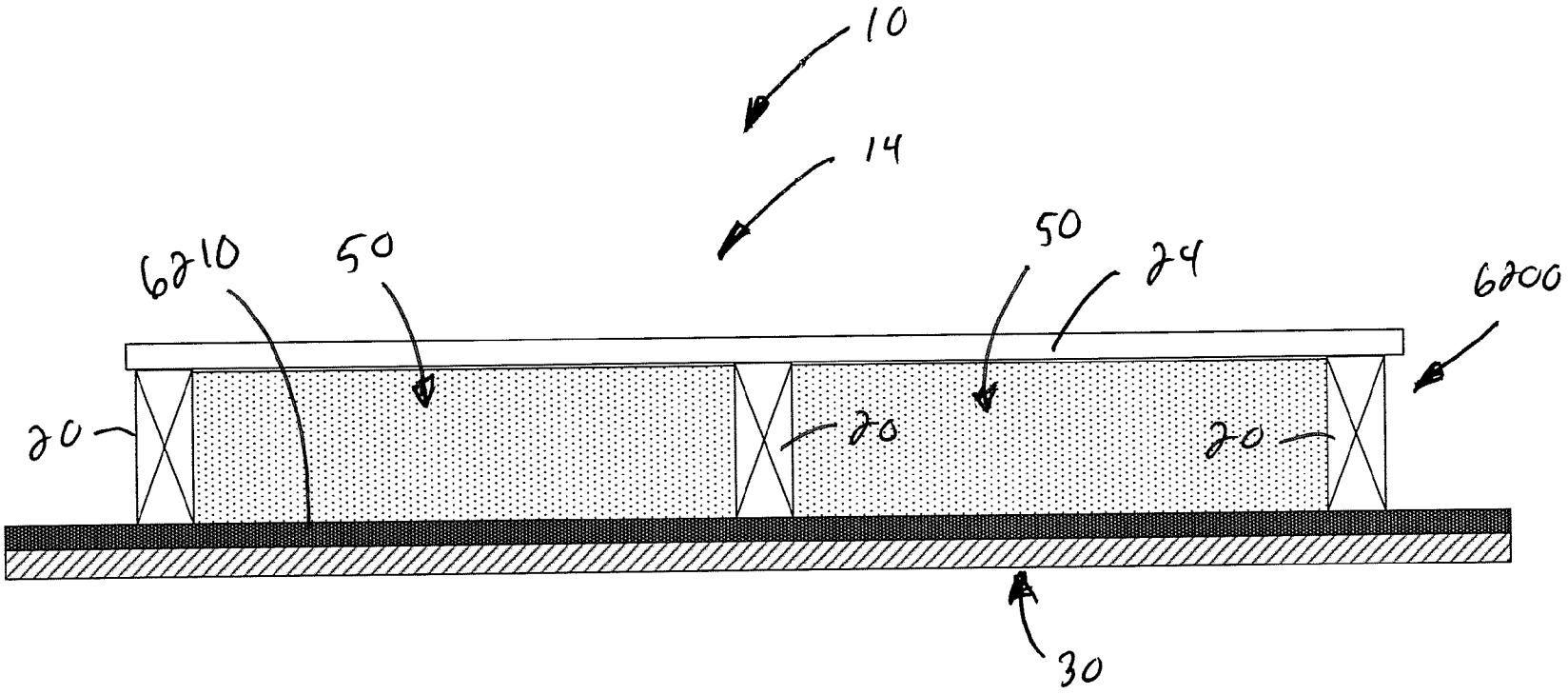
FIG. 62A illustrates an exemplary embodiment of an insulation system.
Figure 62B:
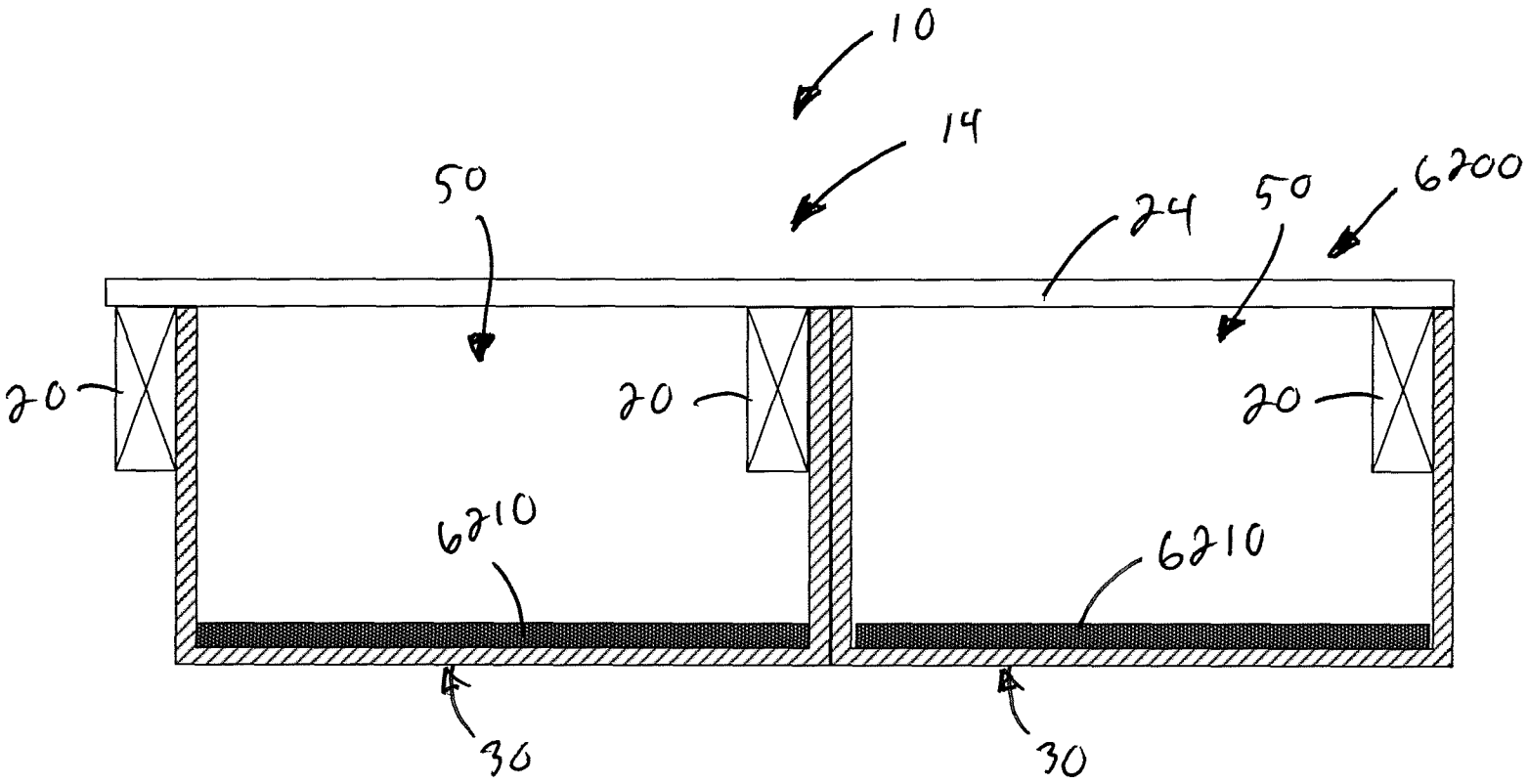
FIG. 62B illustrates an exemplary embodiment of and insulation support system.
Figure 62C:
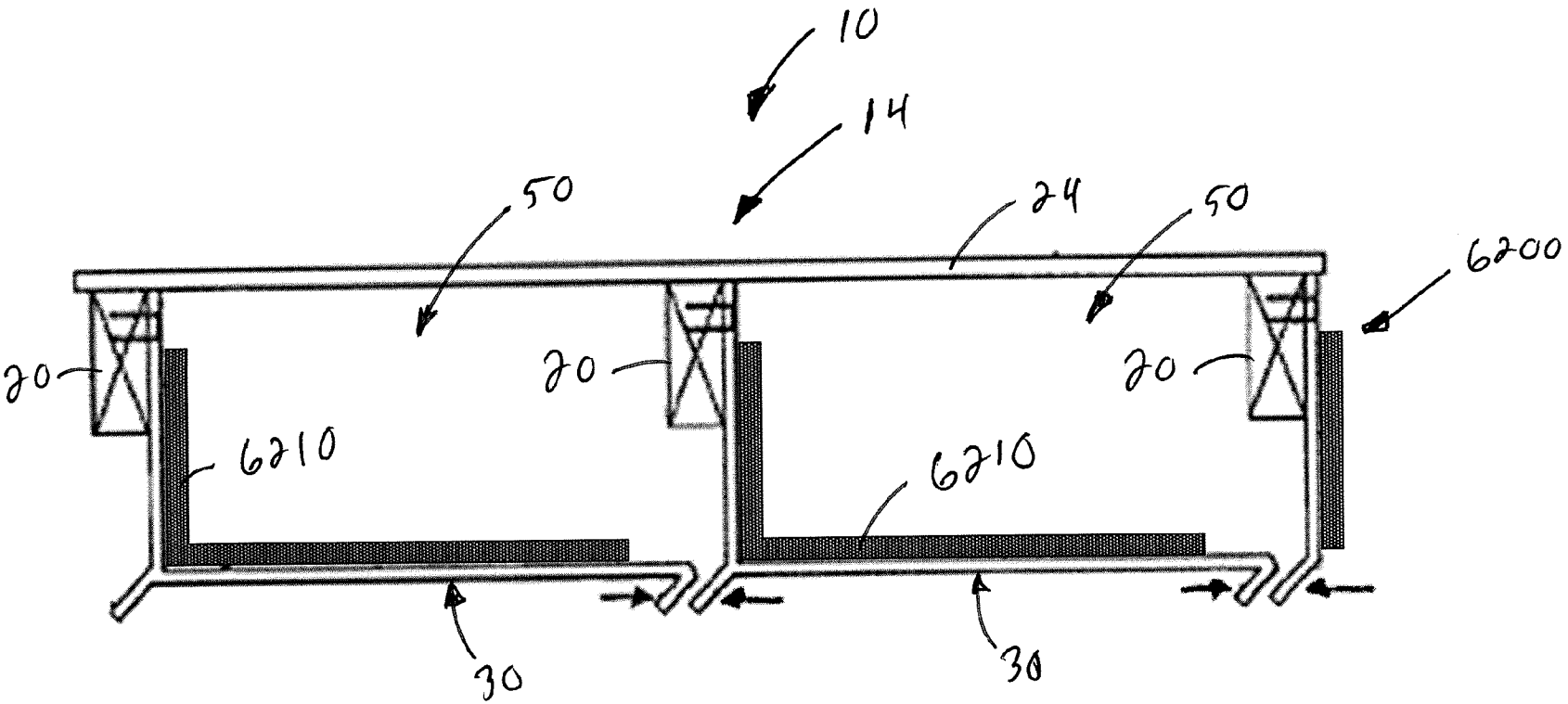
FIG. 62C illustrates an exemplary embodiment of an insulation support system.
Figure 62D:
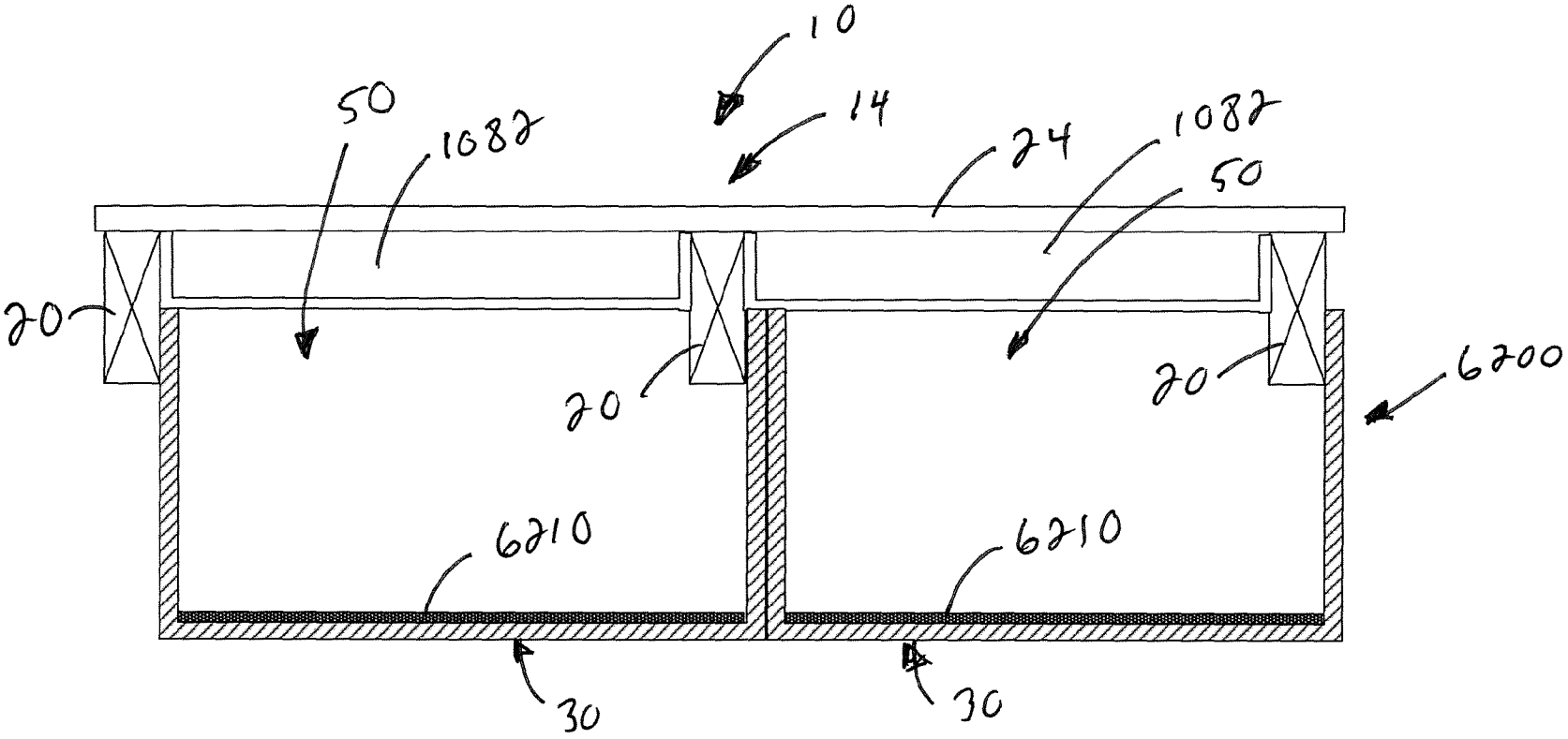
FIG. 62D illustrates an exemplary embodiment of an insulation support system.

In the example illustrated by FIG. 62A, the cavities 50 are defined between the sheathing 24, the support members 20, and the insulation support material 30. The moisture buffering material 6210 is provided inside the cavities 50, such as on the inside surface of the insulation support material 30. In the example illustrated by FIG. 62B, the insulation support system is generally the same or the same as the insulation support system illustrated by FIGS. 7A-7F with the moisture buffering material 6210 added. FIG. 62B illustrates that the clamps 164 (See FIG. 7A) can be omitted. In the example illustrated by FIG. 62C, the insulation support system is the same or generally the same as the insulation support system illustrated by FIGS. 10A and 10B with the moisture buffering material 6210 added. In the example illustrated by FIG. 62D, the insulation support system is the same or generally the same as the insulation support system illustrated by FIGS. 16A-16B with the moisture buffering material 6210 added in the insulation cavity 50.

Figure 64A:
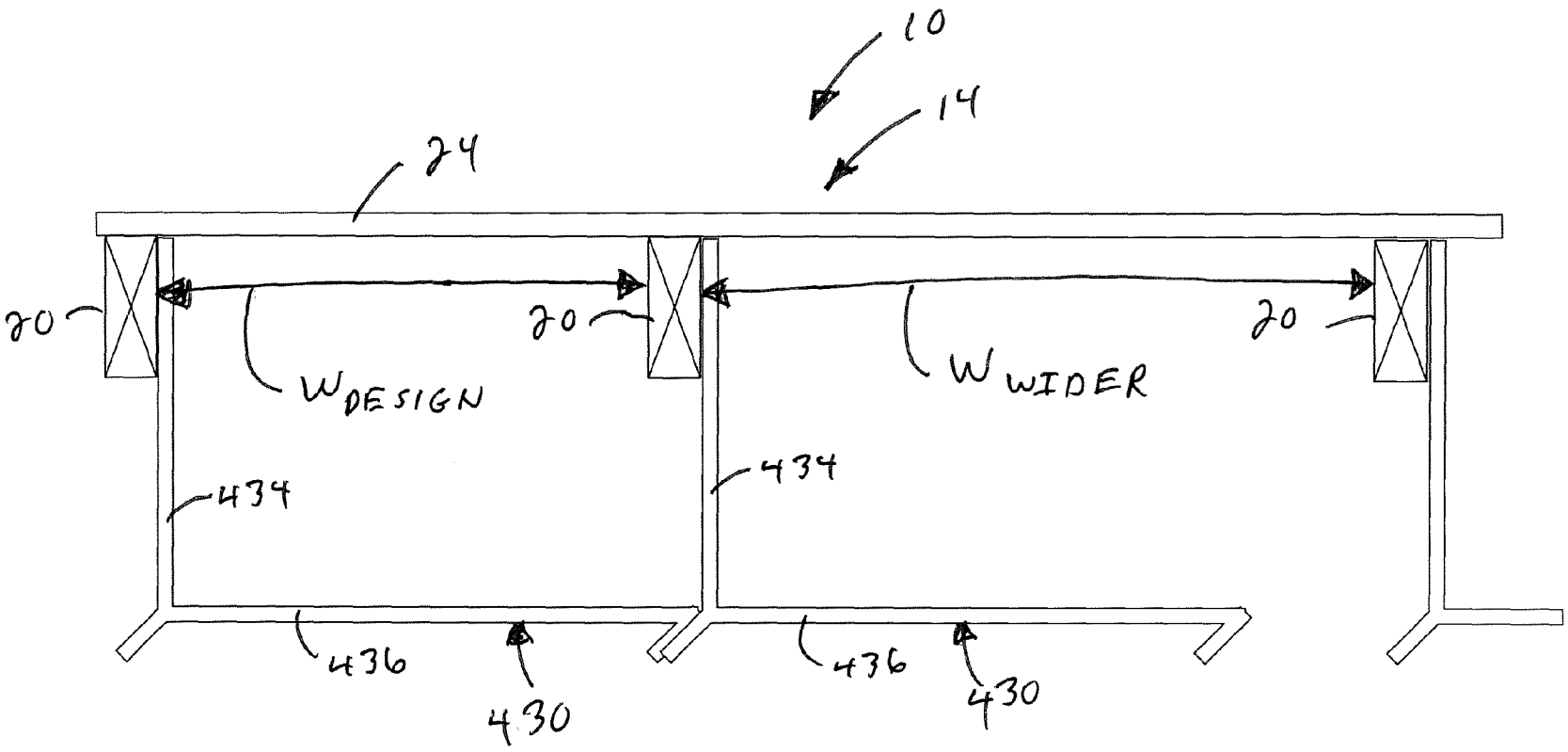
FIGS. 64A-64C illustrate an exemplary embodiment of an insulation support system.
Figure 64B:
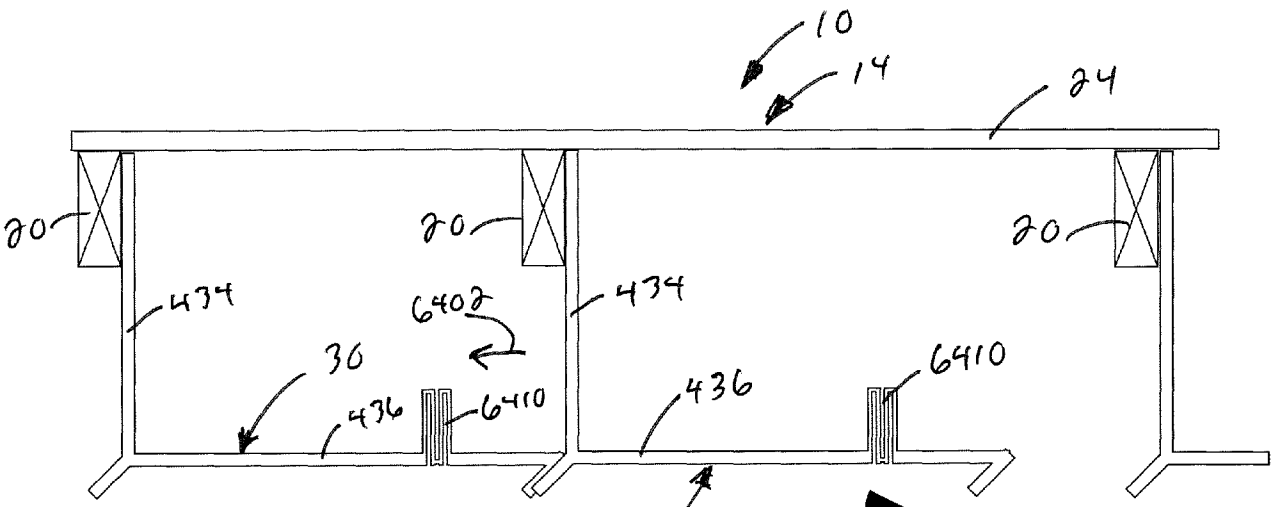
Figure 64C:
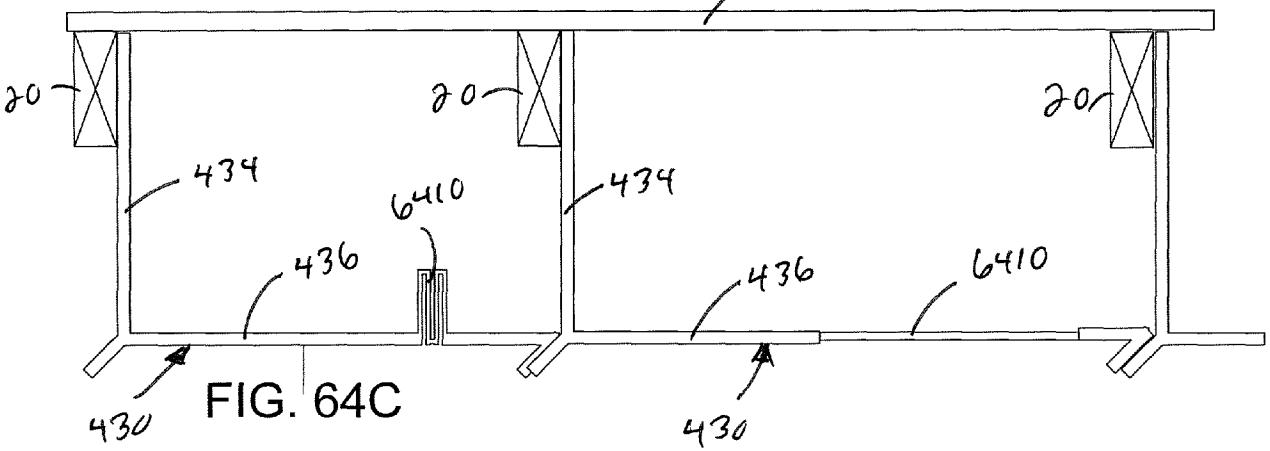

FIGS. 64A-64C illustrate a variation of the embodiment illustrated by FIGS. 10A and 10B. Referring to FIG. 64A, when the cavity 50 has the normal or designed width $W_{DESIGN}$, the span segments 436 of the embodiment illustrated by FIGS. 10A and 10B, form rectangular insulation cavities 50 as described above. However, width $W_{WIDER}$ between the support members 20 is wider than the designed width $W_{DESIGN}$, the span segment 436 may not reach the side panel segment 434 of the next interconnecting portion 430 or a rectangular insulation cavity may not be formed. Similarly when the distance between the support members 20 is narrower than the designed width $W_{DESIGN}$, the span segment may droop and a substantially rectangular insulation cavity is not formed.

In the exemplary embodiment illustrated by FIGS. 64B and 64C, the span segments 436 of the interconnecting portions 430 are expandable 6400 and/or retractable 6402 to accommodate different widths or spacing between the support members 20. The concept of expandable and retractable insulation support material 30 can be applied to any of the embodiments of the present application. The span segments 436 can be made to be expandable and/or retractable in a wide variety of different ways. For example, the span segment 436 can be made from an elastic material or have a portion 6410 that is made from an elastic material, the span segment can be accordion folded (see FIGS. 11C and 11E), the span segment can be provided with extension pieces or portions. Any way of making the span segments 436 expandable and/or retractable can be employed.

Figure 65A:
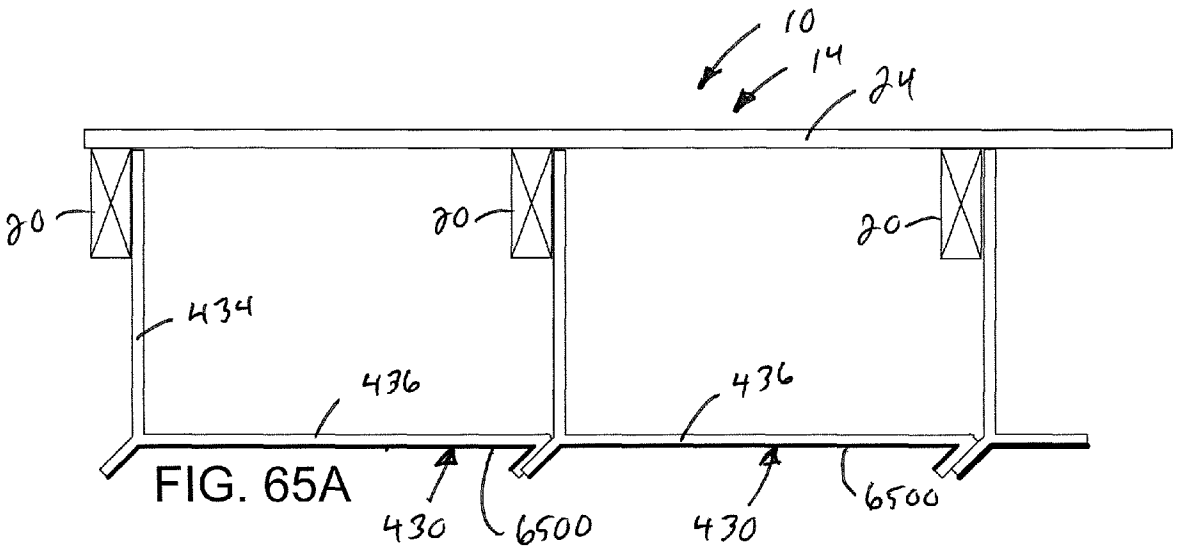
FIG. 65A illustrates an exemplary embodiment of an insulation support system.
Figure 65B:
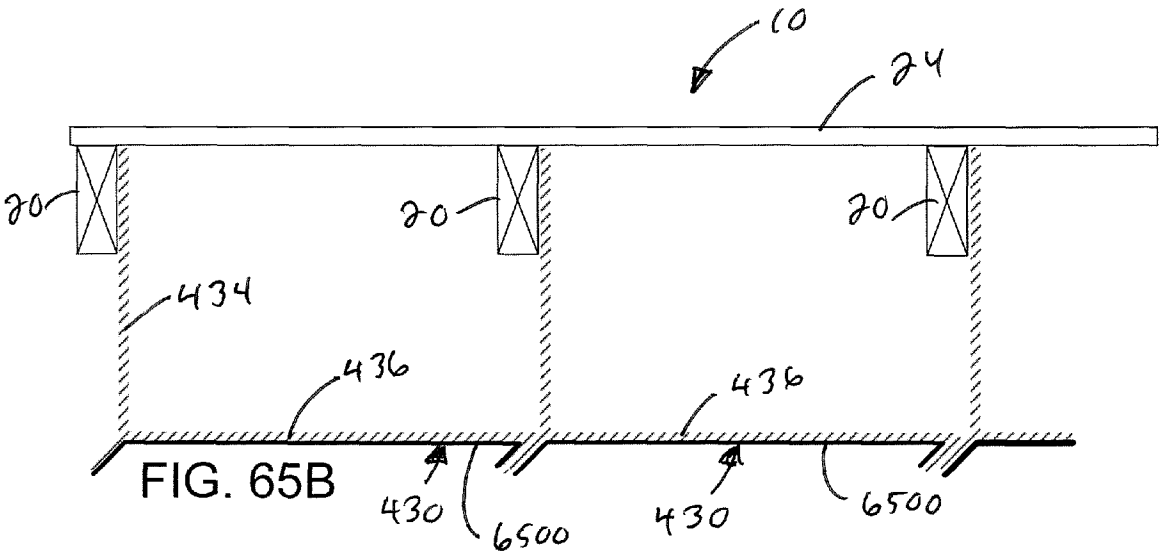
FIG. 65B illustrates an exemplary embodiment of an insulation support system.

FIGS. 65A and 65B illustrate a versions of the embodiment illustrated by FIGS. 10A and 10B where a vapor retarder material 6500 or a vapor barrier material is applied to the span segment 436 or is the span segment of the interconnecting portions 430. The concept of a vapor retarder material 6500 or a vapor barrier material is applied to the span segment 436 of the interconnecting portions 430 can be applied to any of the embodiments of the present application. The vapor retarder material 6500 or vapor barrier can be any of the vapor retarder or vapor barrier materials disclosed in the present application. For example, the vapor retarder may have a perm rating of greater than 1 or the vapor retarder may be an adaptive vapor retarder that will change perm rating based on relative humidity and/or temperature.

Referring to FIG. 65A, in one exemplary embodiment, the span segment 436 and the side panel segment 434 are made from a spun bond non-woven fabric, such as a spun bond polyester non-woven fabric. The non-woven fabric provides breathability for blowing the insulation 58 into the cavity 50. Covering the span segment 436 with the vapor retarder material 6500 or replacing the span segment 436 with the vapor retarder material reduces the breathability for blowing the insulation 58 into the cavity 50, since the air can no-longer escape through the span span segment 436. Air used to blow insulation into the cavity 50 escapes through the side panel segments 434, instead of through the side panel segments 434 and the span segments 436. The air used to blow insulation into the cavity 50 is blocked by the vapor retarder material of the span segments 436.

FIG. 65B illustrates an exemplary embodiment that is similar to the embodiment illustrated by FIG. 65A, except the side panel segment 434 and optionally the span segment 436 (with the vapor retarder material 6500 on it) are made from a material that provides more airflow as compared to the spun bond, non-woven material of FIG. 65A. Or, the span segment 436 can be made of only the vapor retarder material 6500. For example, the side panel segment 434 and the optionally the span segment 436 (when the span segment is not made only of the vapor retarder material 6500) are made from an open scrim material. For example, ratio of open area of the scrim material to blocked area of the scrim material (Open Area)/(Closed Area) may be greater than 10%, greater than 20%, greater than 30%, greater than 40%, or greater than 50%. More open area enhances the ability of the air that blows the insulation 58 into the cavity 50 to escape through the side panel segments 434, since the air is blocked by the vapor retarder material of the span segments 436.

Figure 66A:
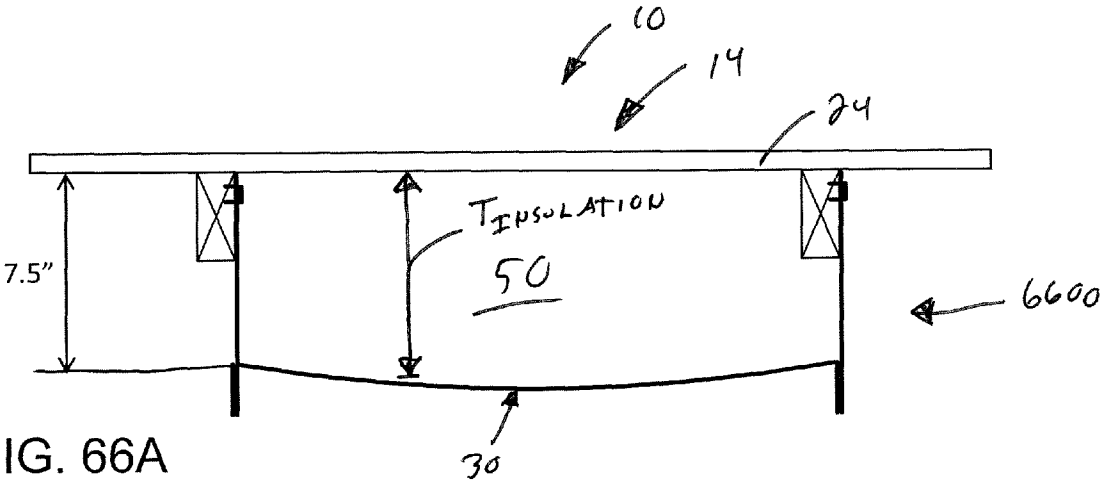
FIGS. 66A and 66B illustrate an exemplary embodiment of a blown insulation system.
Figure 66B:
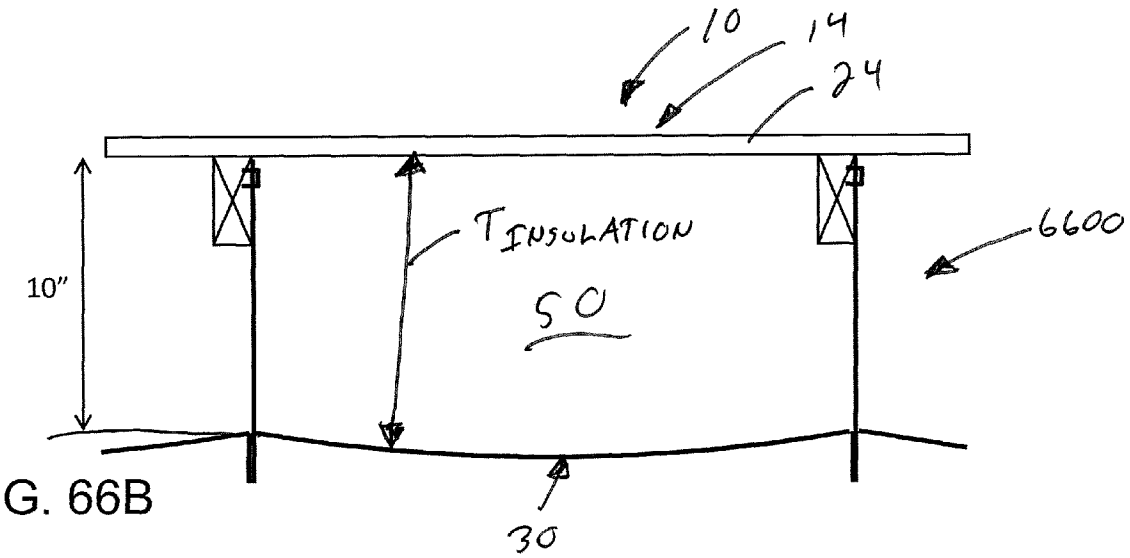

FIGS. 66A and 66B illustrate an exemplary embodiment of an insulation system 6600 where the R value of the system is increased using less insulation. In a building structure 10 with an unvented attic, more space may be available under the roof deck sheathing 24 than in a cathedral ceiling. As such, in some buildings 10, the thickness $T_{INSULATION}$ of the insulation 58 that can be provided below the roof deck sheathing can be increased without intruding on finished space in the building. By utilizing this increased thickness $T_{INSULATION}$ (compare the greater thickness in FIG. 66B to the thickness in FIG. 66A) and decreasing the density of the insulation 58, such as the density of loosefill insulation, a higher R value can be achieved with less insulation. An insulation with a decreased density may be lighter and have larger nodules than conventional loosefill insulation.

For example, the insulation system in FIG. 66A may have an insulation thickness $T_{INSULATION}$ of 7.5 inches, a density of 1.3 pounds per cubic foot (pcf), and a resulting R value of R4.0/in. As such, the overall R value of the insulation system is R30. The insulation system in FIG. 66B may have an insulation thickness $T_{INSULATION}$ of 10 inches, a density of only 0.7, and a resulting R value of R3.0/in. As such, the overall R value of the insulation system is also R30. However, since the density of the insulation 58 in the FIG. 66B embodiment is much less than the density of the insulation in the FIG. 66A embodiment, less insulation material is used in the FIG. 66B embodiment as compared to the FIG. 66A embodiment. In the example, 28% less insulation material 58 is used in the FIG. 66B embodiment as compared to the FIG. 66A embodiment, while achieving the same R value. The specific densities and thicknesses referred to in the example of FIGS. 66A and 66B is not meant to limit the application of the concept. The concept illustrated by FIGS. 66A and 66B can be adjusted based on the specific requirements of the building 10. The concept illustrated by FIGS. 66A and 66B can be applied to any of the insulation support and insulation system embodiments disclosed by the present application. In one exemplary embodiment, the insulation in the FIG. 66A insulation system is L77 insulation that is available from Owens Corning. In one exemplary embodiment, the insulation in the FIG. 66B insulation system is an insulation having a density that is less than the density of L77 insulation available from Owens Corning. For example, the insulation 58 of the example illustrated by FIG. 66B has a density that is at least 10% less, at least 20% less at least 30% less, at least 40% less, or at least 50% less than the density of L77 insulation available from Owens Corning.

Figure 67:
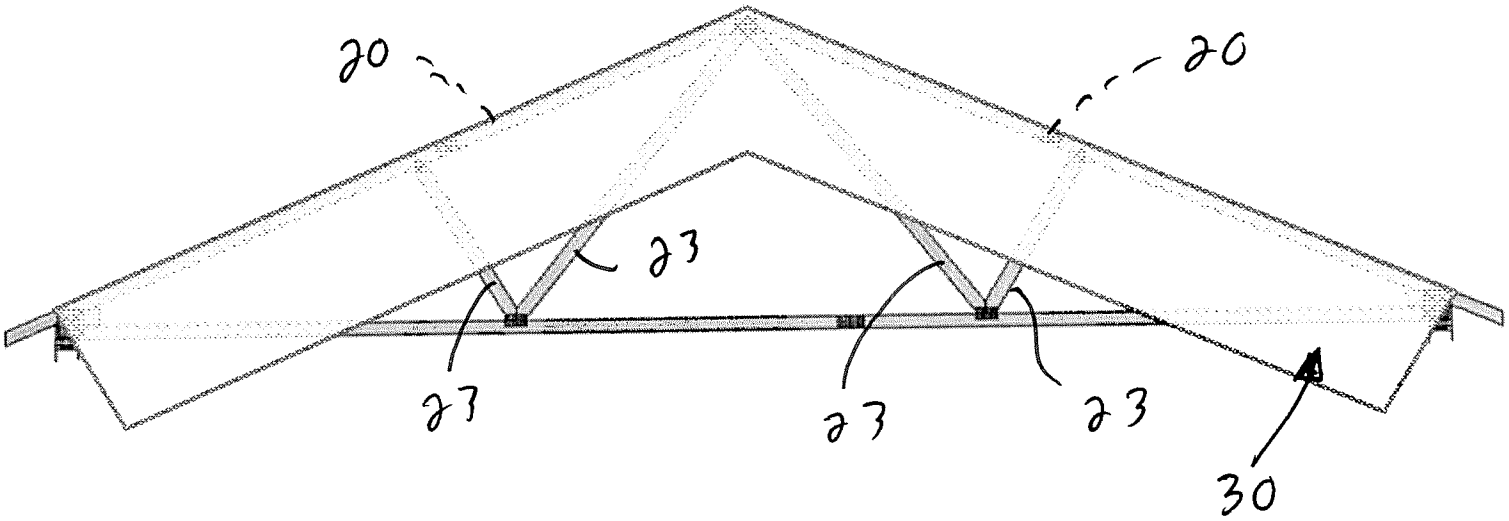
FIG. 67 illustrates an exemplary embodiment of a building structural assembly having a pre-installed insulation support material.

FIG. 67 illustrates an exemplary embodiment where insulation support material 30 is pre-installed on a support member or assembly, such as a pre-fabricated truss. The insulation support material can be any of the insulation support materials disclosed by the present application. When the support members or assemblies, such as the illustrated trusses, are erected to form the building structure 10, the insulation support material 30 is necessarily attached to the supports 20 in the correct, pre-installed position. After all of the support members or assemblies, such as the illustrated trusses, are erected, the insulation support materials are assembled together to form the insulation cavities. For example, the insulation support material 30 that is pre-installed on the illustrated trusses may have the form of the interconnecting portions illustrated by FIGS. 10A and 10B.

Figure 68:
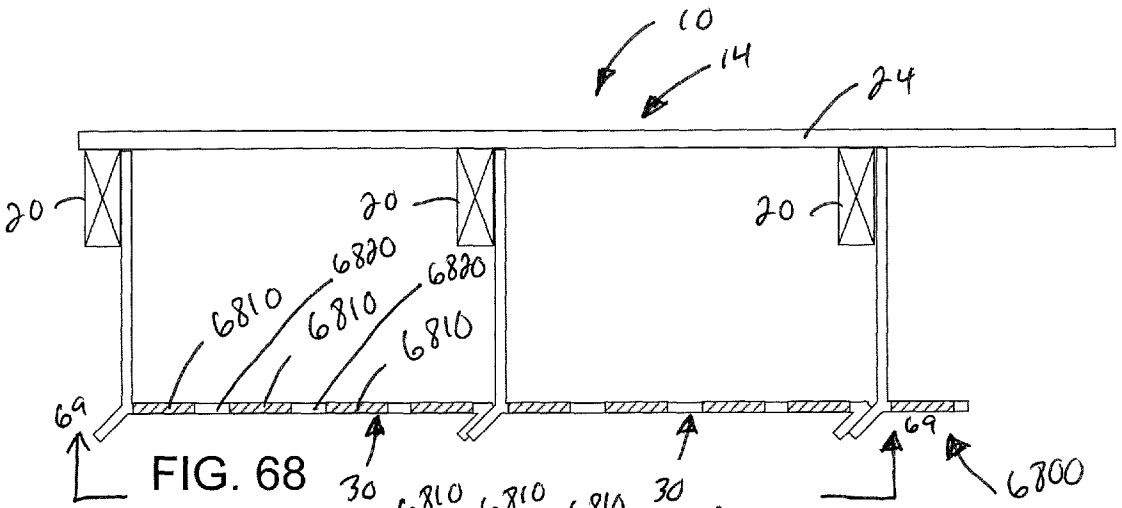
Figure 69:
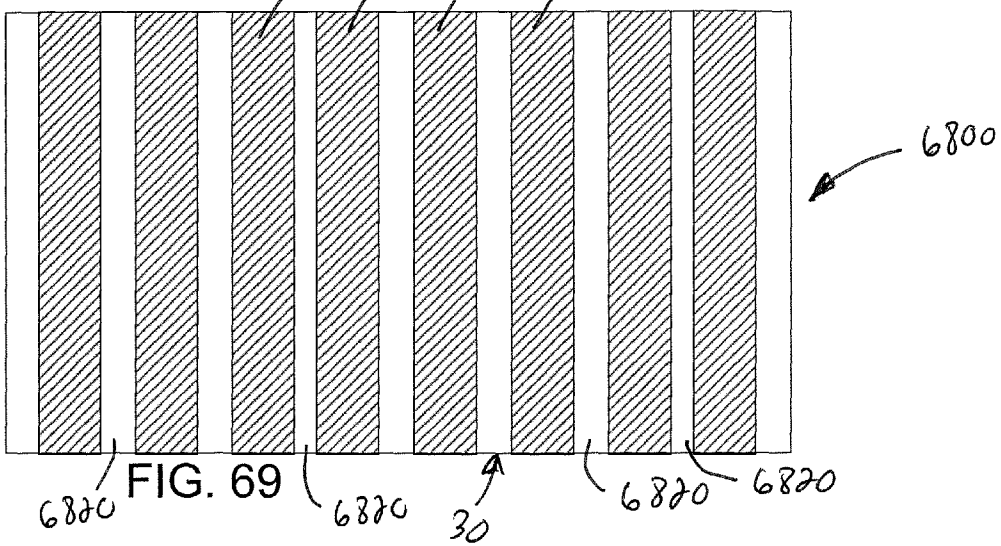

FIGS. 68 and 69 illustrate an exemplary embodiment of a composite vapor retarder material 6800. The composite vapor retarder material 6800 can take a wide variety of different forms. In the illustrated exemplary embodiment, the composite vapor retarder material includes a visually opaque material 6810 having a very low permeability and a visually transparent/translucent material 6820 having a much higher permeability. The resulting composite vapor retarder material has the desired permeability and is transparent/translucent enough to be easily installed onto the support members 20 and to allow blowing in of loose fill insulation to be viewed. The visually opaque material 6810 with low permeability and the visually transparent/translucent material 6820 with high permeability are illustrated as being in a striped configuration. However, the visually opaque material 6810 with low permeability and the visually transparent/translucent material 6820 can be arranged in any pattern of shapes and sizes. The permeability, the sizes, and/or the shapes of the visually opaque material 6810 with low permeability and the visually transparent/translucent material 6820 with high permeability are selected to provide a composite vapor retarder material 6800 with the desired permeability. For example, the permeability of the visually opaque material 6810 with low permeability is lower than the desired permeability and the visually transparent/translucent material 6820 with high permeability has a higher permeability that is higher than the desired permeability, such that the overall composite vapor retarder 6800 has the desired permeability. As a more specific example, the desired permeability may be 1 perm. In this example, the permeability of the visually opaque material 6810 with low permeability is less than 1 perm and the visually transparent/translucent material 6820 with high permeability has a permeability that is higher than 1 perm, such that the overall composite vapor retarder 6800 has a 1 perm permeability.

Figure 70:
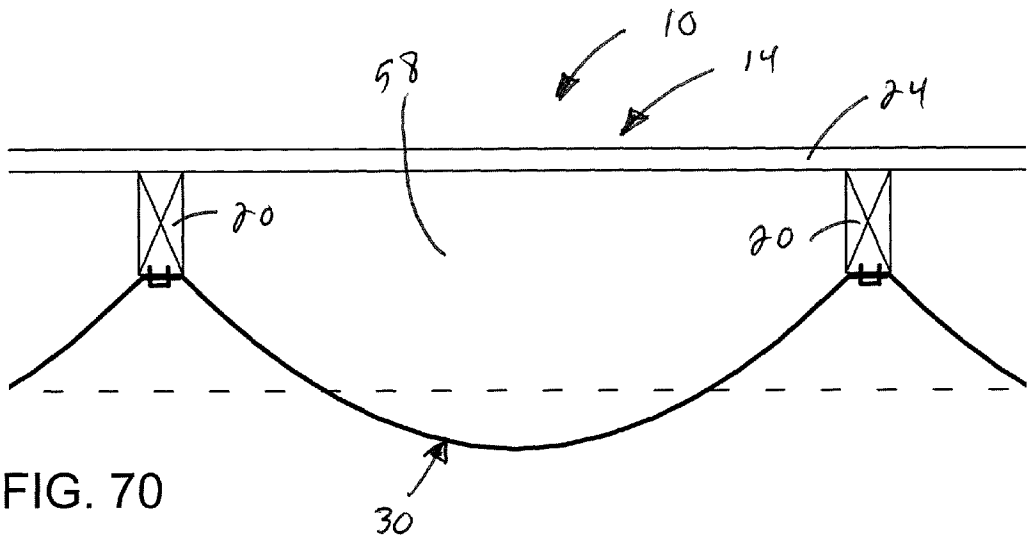
Figure 71:
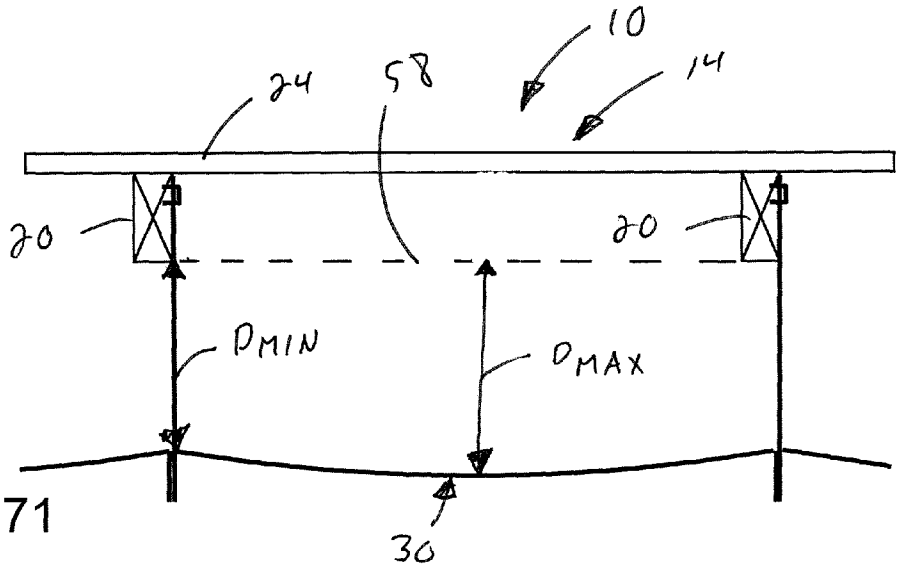

Referring to FIGS. 70 and 71, the present application describes insulation systems as having insulation with a substantially uniform thickness or depth and insulation support cavities that are substantially rectangular or that have substantially flat span segments. FIG. 70 illustrates an example of an insulation system that does not have insulation with a substantially uniform thickness or depth and insulation support cavities that not are substantially rectangular and that do not have substantially flat span segments. FIG. 71 illustrates an example of an insulation system having insulation with a substantially uniform thickness or depth and insulation support cavities that are substantially rectangular and that have substantially flat span segments. In one exemplary embodiment, insulation with a substantially uniform thickness or depth and insulation support cavities that are substantially rectangular and that have substantially flat span segments are quantified in terms of the minimum distance $D_{MIN}$ from the support member 20 to the bottom of the insulation 58 (typically directly below the support member) or the insulation support material 30 and the maximum distance $D_{MAX}$ (typically midway between the support members) from the support member 20 to the bottom of the insulation 58 or the insulation support material 30. In one exemplary embodiment, $(D_{MAX}-D_{MIN})/D_{MIN}\leq 0.5$ for insulation with a substantially uniform thickness or depth and insulation support cavities that are substantially rectangular and that have substantially flat span segments. In one exemplary embodiment, $(D_{MAX}-D_{MIN})/D_{MIN}\leq 0.4$ for insulation with a substantially uniform thickness or depth and insulation support cavities that are substantially rectangular and that have substantially flat span segments. In one exemplary embodiment, $(D_{MAX}-D_{MIN})/D_{MIN}\leq 0.3$ for insulation with a substantially uniform thickness or depth and insulation support cavities that are substantially rectangular and that have substantially flat span segments. In one exemplary embodiment, $(D_{MAX}-D_{MIN})/D_{MIN}\leq 0.2$ for insulation with a substantially uniform thickness or depth and insulation support cavities that are substantially rectangular and that have substantially flat span segments. In one exemplary embodiment, $(D_{MAX}-D_{MIN})/D_{MIN}\leq 0.1$ for insulation with a substantially uniform thickness or depth and insulation support cavities that are substantially rectangular and that have substantially flat span segments.

While some of the embodiments illustrated in the present application have been described above as utilizing loosefill insulation material to fill insulation cavities, it is within the contemplation of this invention that other insulative materials could be used within the formed insulation cavities. Non-limiting examples of other insulative materials that can be used include insulation in the form of batts, rigid board insulation and insulation nodules formed from batts and rigid board insulation.

It is also within the contemplation of this invention that the various embodiments of the insulation support materials discussed above include markings and/or indicia to aid an installer. Non-limiting examples of markings and/or indicia include positioning lines, stapling locations, and branding indications.

Any of the components of any of the insulation support systems disclosed in the present application are made from a transparent material to allow for easier installation and to allow viewing of loosefill insulation filling. In one exemplary embodiment, the insulation support material 30 includes a transparent vapor retarder, for example, a vapor retarder having a permeability 1 perm or greater than 1 perm.

While some of the embodiments described in the present patent application, have been described as using individual sections of netting to form insulation cavities between adjacent support members, it should be appreciated that sections of netting can be configured to span more than one insulation cavity. For example, the netting could span adjacent insulation cavities or the netting could any desired number of adjacent insulation cavities.

While some of the embodiments of the insulation cavities illustrated in this application have been illustrated and described as being filled with loosefill insulation material, it is within the contemplation of this invention that the insulation cavities can be configured with one or more channels configured as conduits configured to provide fresh air to the attic. In certain configurations, the channels are simply spaces, void of loosefill insulation, within the insulation cavities. In other embodiments, the conduits can include structures or mechanisms, such as for example vents or fans, to facilitate the provision of fresh air.

While the embodiments illustrated in this application illustrate the formation of box-shaped insulation cavities by fastening nettings, brackets and rigid members to support members, it should be appreciated that the boxed netting insulation system can be practiced by fastening nettings, brackets and rigid members to other structural members or framing members, such as for example roof decks, other faces of the support members or web members forming a truss system.

Several exemplary embodiments of insulation support systems and insulation systems are disclosed by this application. Insulation systems and insulation support systems in accordance with the present invention may include any combination or sub combination of the features disclosed by the present application.

In accordance with the provisions of the patent statutes, the principle and mode of operation of the boxed netting insulation systems have been explained and illustrated in its preferred embodiment. However, it must be understood that the boxed netting insulation systems may be practiced otherwise than as specifically explained and illustrated without departing from its spirit or scope.

We claim:

1. An insulation system for a roof, the insulation system comprising:

a plurality of roof sheathing panels that extend upward at an angle away from an eave of the roof toward a ridge of the roof;

a plurality of spaced apart structural members having lengths that extend upward at an angle away from the eave toward the ridge without insulation between the roof sheathing panels and the spaced apart structural members, wherein the spaced apart structural members support the roof sheathing panels, wherein the spaced apart structural members each include a top face that faces toward the roof sheathing panel and a bottom face that faces away from the roof sheathing panels;

a first insulation material disposed between an adjacent pair of the spaced apart structural members, wherein a length of the first insulation material extends along the lengths of each structural member of the adjacent pair of the spaced apart structural members, wherein the first insulation material has a bottom face that is substantially flush with the bottom faces of the spaced apart structural members, wherein the first insulation material comprises a fibrous material;

a second insulation material, wherein a single piece of the second insulation material has a length that extends across the bottom face of each structural member of the adjacent pair of the spaced apart structural members, such that the single piece of the second insulation material covers the bottom face of each structural member of the adjacent pair of the spaced apart structural members and the first insulation material, wherein the second insulation material comprises a fibrous material.

2. The insulation system of claim 1, wherein the spaced apart structural members are spaced apart truss chords.

3. The insulation system of claim 1, wherein the first insulation material substantially fills a space between the top and bottom faces of the spaced apart structural members.

4. The insulation system of claim 1, wherein there is a vent space between the first insulation material and the roof sheathing panels.

5. The insulation system of claim 1, wherein the second insulation material has a substantially planar lower surface.

6. The insulation system of claim 5, wherein the planar lower surface of the second insulation material is maintained by reinforcing ties.

7. The insulation system of claim 1, wherein the second insulation material is held against the first insulation material by fasteners that extend into the spaced apart structural members.

8. The insulation system of claim 1, wherein the second insulation material has a substantially uniform thickness.

9. The insulation system of claim 1, wherein the single piece of the second insulation material comprises loose fill insulation in a container.

10. The insulation system of claim 1, wherein the single piece of the second insulation material comprises an insulation batt.

11. The insulation system of claim 1, wherein the single piece of the second insulation material extends across the bottom faces of three or more of said spaced apart structural members.

12. The insulation system of claim 10, wherein the insulation batt extends across the bottom faces of three or more of said spaced apart structural members.

13. The insulation system of claim 1, wherein the second insulation material is held against the first insulation material by fasteners that extend through the second insulation material and into the spaced apart structural members.

14. The insulation system of claim 1, wherein the first insulation material comprises an insulation batt.

15. The insulation system of claim 1, wherein the first insulation material comprises an insulation batt and the second insulation material comprises an insulation batt.

16. The insulation system of claim 15, wherein the first insulation batt is connected to the second insulation batt.

17. An insulation system for a roof, the insulation system comprising:

a plurality of roof sheathing panels that extend upward at an angle away from an eave of the roof toward a ridge of the roof;

a plurality of spaced apart structural members having lengths that extend upward at an angle away from the eave toward the ridge, wherein the spaced apart structural members support the roof sheathing panels without insulation between the roof sheathing panels and the spaced apart structural members, wherein the spaced apart structural members each include a top face that faces toward the roof sheathing panel and a bottom face that faces away from the roof sheathing panels;

a first insulation batt disposed between an adjacent pair of the spaced apart structural members, wherein a length of the first insulation batt extends along the lengths of the adjacent pair of the spaced apart structural members, wherein the first insulation batt has a bottom face that is substantially flush with the bottom faces of the adjacent pair of the spaced apart structural members;

a second insulation batt, wherein a length of the second insulation batt extends across the adjacent pair of the spaced apart structural members and the first insulation batt, such that the bottom faces of the adjacent pair of the spaced apart structural members and the first insulation batt are covered by the second insulation batt.

18. The insulation system of claim 17, wherein the first insulation batt is compressed between the adjacent pair of the spaced apart structural members.

19. The insulation system of claim 17, wherein the spaced apart structural members are spaced apart truss chords.

20. The insulation system of claim 17, wherein the first insulation batt substantially fill a space between the top and bottom faces of the adjacent pair of the spaced apart structural members.

21. The insulation system of claim 17, wherein the second insulation batt has a substantially planar lower surface.

22. An insulation system for a roof, the insulation system comprising:

a plurality of roof sheathing panels that extend upward at an angle away from an eave of the roof toward a ridge of the roof;

a plurality of spaced apart wooden truss chords having lengths that extend upward at an angle away from the eave toward the ridge without insulation between the roof sheathing panels and the spaced apart truss chords, wherein the spaced apart truss chords support the roof sheathing panels, wherein the spaced apart truss chords each include a top face that faces toward the roof sheathing panel and a bottom face that faces away from the roof sheathing panels;

a first insulation material disposed between an adjacent pair of the spaced apart truss chords, wherein a length of the first insulation material extends along the lengths of the adjacent pair of the spaced apart truss chords, wherein the first insulation material has a bottom face that is substantially flush with the bottom faces of the spaced apart truss chords, wherein the first insulation material comprises a fibrous material;

a second insulation material, wherein a single piece of the second insulation material has a length that extends across the adjacent pair of the spaced apart truss chords and the first insulation material, such that the bottom faces of the adjacent pair of the spaced apart truss chords and the first insulation material are covered by the second insulation material, wherein the second insulation material comprises a fibrous material.

23. The insulation system of claim 22, wherein the first insulation material substantially fills a space between the top and bottom faces of the adjacent pair of the spaced apart truss chords.

24. The insulation system of claim 22, wherein there is a vent space between the first insulation material and the roof sheathing panels.

25. The insulation system of claim 22, wherein the second insulation material has a substantially planar lower surface.

26. The insulation system of claim 22, wherein the planar lower surface of the second insulation material is maintained by reinforcing ties.

27. The insulation system of claim 22, wherein the second insulation material is held against the first insulation material by fasteners that extend into the spaced apart truss chords.

28. The insulation system of claim 22, wherein the second insulation material has a substantially uniform thickness.

29. The insulation system of claim 22, wherein the second insulation material comprises loose fill insulation in a container.

30. The insulation system of claim 22, wherein the second insulation material comprises an insulation batt.

31. The insulation system of claim 22, wherein the second insulation material extends across three or more of said spaced apart truss chords.

32. The insulation system of claim 31, wherein the second insulation material extends across three or more of said spaced apart truss chords.

33. The insulation system of claim 22, wherein the second insulation material is held against the first insulation material by fasteners that extend through the second insulation material and into the spaced apart truss chords.

34. The insulation system of claim 22, wherein the first insulation material comprises an insulation batt.

35. The insulation system of claim 22, wherein the first insulation material comprises an insulation batt and the second insulation material comprises an insulation batt.

36. The insulation system of claim 35, wherein the first insulation batt is connected to the second insulation batt.

* * * * *